US011796243B2

(12) United States Patent
Park et al.

(10) Patent No.: US 11,796,243 B2
(45) Date of Patent: Oct. 24, 2023

(54) REFRIGERATOR

(71) Applicant: LG Electronics Inc., Seoul (KR)

(72) Inventors: Myeongseong Park, Seoul (KR); Daekil Kang, Seoul (KR); Ohchul Kwon, Seoul (KR); Sangho Jung, Seoul (KR); Hyuncheol Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 15 days.

(21) Appl. No.: 17/350,298

(22) Filed: Jun. 17, 2021

(65) Prior Publication Data

US 2021/0396456 A1 Dec. 23, 2021

(30) Foreign Application Priority Data

Jun. 17, 2020 (KR) ..... 10-2020-0073940
Sep. 2, 2020 (KR) ..... 10-2020-0111948

(51) Int. Cl.
*F25D 23/02* (2006.01)
*F25D 23/06* (2006.01)
*F25D 23/10* (2006.01)

(52) U.S. Cl.
CPC ..... *F25D 23/028* (2013.01); *F25D 23/066* (2013.01); *F25D 23/10* (2013.01); *F25D 2400/18* (2013.01)

(58) Field of Classification Search
CPC ..... F25D 23/028; F25D 23/066; F25D 23/10; F25D 2400/18; F25D 23/067
See application file for complete search history.

(56) References Cited

U.S. PATENT DOCUMENTS 5,358,326 A * 10/1994 Cherry ..... F25D 23/02 312/265.6
7,770,985 B2 * 8/2010 Davis ..... F25D 23/02 312/328

(Continued)

FOREIGN PATENT DOCUMENTS

EP 3809072 4/2021
EP 3809076 4/2021

(Continued)

OTHER PUBLICATIONS

Extended European Search Report in European Appln. No. 21179982.0, dated Nov. 18, 2021, 6 pages.

(Continued)

*Primary Examiner* — Hanh V Tran
(74) *Attorney, Agent, or Firm* — Fish & Richardson P.C.

(57) ABSTRACT

A refrigerator includes a cabinet and a door. The door includes a door body including a door liner, a front plate, a cap decor connected to the door liner and the front plate and having a recessed handle, and an insulator filled between the door liner, the front plate, and the cap decor. The door includes a panel assembly detachably mounted on a front surface of the door body and defining a front surface of the door. The panel assembly includes a panel defining an outer appearance of the front surface of the door and an insertion protrusion protruding backward from the panel and inserted into a front surface of the cap decor when the panel is mounted to restrict the panel assembly. The insertion protrusion extends from the outside of a recessed space of the handle in a direction crossing the recessed space.

17 Claims, 81 Drawing Sheets

(56) References Cited

U.S. PATENT DOCUMENTS

| | | | | |
|---|---|---|---|---|
| 7,954,345 | B2 * | 6/2011 | Park | D06F 39/14 68/139 |
| 8,336,975 | B2 * | 12/2012 | Allard | F25D 23/02 312/405.1 |
| 8,366,221 | B2 * | 2/2013 | Kim | F25D 23/02 312/405 |
| 8,408,665 | B2 * | 4/2013 | Lim | F25D 23/02 312/405 |
| 8,668,292 | B2 * | 3/2014 | Pae | F25D 23/028 312/405 |
| 8,789,900 | B2 * | 7/2014 | Laible | A47B 96/20 312/204 |
| 9,339,993 | B2 * | 5/2016 | Cites | B32B 3/04 |
| 9,476,633 | B2 * | 10/2016 | Allard | F25D 23/028 |
| 11,280,540 | B2 * | 3/2022 | Park | F25D 23/028 |
| 11,280,542 | B2 * | 3/2022 | Park | F25D 23/02 |
| 11,320,192 | B2 * | 5/2022 | Lee | F25D 23/028 |
| 11,402,147 | B2 * | 8/2022 | Lee | F25D 23/02 |
| 11,480,384 | B2 * | 10/2022 | Lee | F25D 23/126 |
| 2005/0006997 | A1 * | 1/2005 | Yoshioka | F25D 23/02 312/405 |
| 2006/0265960 | A1 * | 11/2006 | Leimkuehler | F25D 23/02 49/501 |
| 2007/0188059 | A1 * | 8/2007 | Davis | F25D 23/02 312/265.6 |
| 2008/0042537 | A1 * | 2/2008 | Kim | F25D 23/02 312/405 |
| 2008/0143227 | A1 * | 6/2008 | Kim | F25D 23/02 312/405 |
| 2011/0025173 | A1 * | 2/2011 | Ciyanoglu | F25D 23/10 312/204 |
| 2012/0073202 | A1 * | 3/2012 | Lee | F25D 29/005 49/70 |
| 2012/0169196 | A1 * | 7/2012 | Marchetti | E06B 5/006 312/265.6 |
| 2016/0178277 | A1 * | 6/2016 | Park | G06F 3/0416 345/173 |
| 2016/0209110 | A1 * | 7/2016 | Cho | F25D 23/062 |
| 2016/0341468 | A1 * | 11/2016 | Joo | F25D 11/02 |
| 2017/0082349 | A1 * | 3/2017 | Jung | F25D 23/028 |
| 2017/0343273 | A1 * | 11/2017 | Cheon | F25D 11/00 |
| 2017/0370631 | A1 * | 12/2017 | Kim | F25D 23/006 |
| 2018/0141718 | A1 * | 5/2018 | Ahlström | A45C 11/20 |
| 2018/0142941 | A1 * | 5/2018 | Arslan | F25D 23/028 |
| 2018/0172337 | A1 * | 6/2018 | Choi | A47F 3/043 |
| 2018/0187951 | A1 * | 7/2018 | Seo | F25D 23/02 |
| 2018/0187955 | A1 * | 7/2018 | Son | F25D 23/028 |
| 2018/0223582 | A1 * | 8/2018 | Shin | E05F 15/619 |
| 2018/0283768 | A1 * | 10/2018 | Raab | F25D 23/028 |
| 2019/0053685 | A1 * | 2/2019 | Chwalibog | A47L 15/4293 |

FOREIGN PATENT DOCUMENTS

| | | |
|---|---|---|
| JP | H02-44681 | 3/1990 |
| JP | 6460832 | 1/2019 |
| KR | 10-1013644 | 2/2011 |
| WO | WO2011162525 | 12/2011 |
| WO | WO2014024429 | 2/2014 |
| WO | WO2014038190 | 3/2014 |
| WO | WO2021112658 | 6/2021 |

OTHER PUBLICATIONS

Extended European Search Report in European Appln. No. 23164632.4, dated Jun. 28, 2023, 10 pages.

* cited by examiner

REFRIGERATOR

CROSS-REFERENCE TO RELATED APPLICATIONS

The present application claims priority under 35 U.S.C. 119 and 35 U.S.C. 365 to Korean Patent Application Nos. 10-2020-0073940, filed on Jun. 17, 2020, and 10-2020-0111948, filed on Sep. 2, 2020, the disclosures of which are hereby incorporated by reference in their entirety.

BACKGROUND

The present disclosure relates to a refrigerator.

In general, refrigerators are home appliances for storing foods at low temperature in an inner storage space covered by a refrigerator door. Here, the inside of the storage space is cooled using cool air that is generated by being heat-exchanged with a refrigerant circulated in a refrigeration cycle to store the foods in an optimal state.

Such refrigerators tend to increase more and more in size and provide multi-functions due to the trends of change of dietary life and high quality, and accordingly, refrigerators provided with various structures and convenience devices in consideration of user convenience are brought to the market.

In addition, structures that vary in outer appearance of a front surface of a door of the refrigerator are opened to harmonize with an environment, in which the refrigerator is disposed, or surrounding furniture or home appliances.

A structure in which a decor panel defining the outer appearance of the front surface of the door of the refrigerator is mounted is disclosed in U.S. Pat. No. 8,789,900. Also, a structure, in which a plurality of bridges for restriction are disposed at both sides of the decor panel, and brackets inserted into both ends of the door are coupled to the bridge so that the decor panel is mounted, is disclosed.

However, in the above-described technology according to the related art, since the plurality of brackets have to be mounted on the outside so as to mount the panel, productivity may be deteriorated, and an accurate mounting position may not be maintained according to workability of a worker. Particularly, there is a limitation of deteriorating the outer appearance of the structure in which the brackets for the coupling are exposed to both the sides of the door.

A structure in which a glass panel defining the outer appearance of the front surface of the door of the refrigerator is mounted is disclosed in Japanese Patent No. 6460832. In addition, a structure in which a plurality of recessed grooves are defined in a front surface portion of a door body, and an installation portion bent in multiple stages is disposed on a rear surface of the glass panel, and the installation portion is inserted into each of the recessed grooves to mount the glass panel, is disclosed.

However, in such a technique according to the related art, there is a limitation in that the coupling structure is exposed, and also, there is a limitation in that a portion of the upper end of the door, which is not partially coupled to the panel, exists according to a position of the coupling member.

Particularly, in the case in which a handle is provided on a top surface of the door, there is a limitation that it is impossible to couple a configuration for coupling such as a screw due to an arrangement of the handle, and thus, the coupling with the panel at the upper end of the door becomes weak.

In a structure in which the door is provided in a drawer type so as to hold the handle to be slidably withdrawn, the above-described limitations may be more serious, and a clearance may occur at the upper end of the panel or may be separated at the upper end of the panel.

Also, in such a technique according to the related art, a shape of the groove may be deformed, or the door itself may be bent or twisted due to dispersion of door components, a temperature difference inside the refrigerator during an operation of the refrigerator, and a foaming pressure during foaming of the insulator. Also, the glass panel may not be accurately mounted due to the deformation, and thus, there is a limitation in that a defect in outer appearance may occur.

Particularly, when the panel is made of a heavy material such as glass, since a plurality of structures of the groove and installation portion are required, and the installation portion has to be accurately coupled through the plurality of grooves to mount the glass panel, assembly and disassembly operations are not easy.

SUMMARY

Embodiments provide a refrigerator having a mounting structure of a panel assembly, which is improved in outer appearance by preventing a coupling portion from being exposed to the outside.

Embodiments also provide a refrigerator in which a rigidly mounted state of a panel assembly on a door, in which a recessed handle is defined, is maintained.

Embodiments also provide a refrigerator in which a gap between a panel assembly and a door body is prevented from occurring at upper and lower ends of a door.

Embodiments also provide a refrigerator in which a panel assembly is easily mounted and detached.

Embodiments also provide a refrigerator in which a quality of an outer appearance of a door is maintained even when the door itself is scattered or deformed.

Embodiments also provide a refrigerator in which safety is secured when a panel assembly is attached or detached.

In a refrigerator according to an embodiment, one end of upper and lower ends of a panel assembly defining an outer appearance of a front surface of a door may be supported by an upper cap decor or a lower cap decor, and a restriction member passing through the upper cap decor or the lower cap decor may restrict the other end of the panel assembly.

In a refrigerator according to an embodiment, an upper end of a panel assembly defining an outer appearance of a front surface of a door may be supported by an upper cap decor, in which a handle is defined to be recessed, a lower end of the panel assembly may be supported by a lower cap decor, and a restriction member passing through a handle so as to be restricted and coupled to the panel assembly may be provided inside the handle.

A refrigerator according to an embodiment may include a door body, into which an insulator is filled, and a panel assembly mounted on a front surface of a door body, wherein a restriction rib inserted along an upper or lower end of the panel assembly may be disposed on one end of the door body, and a restriction member passing through the door body may be restricted by the upper or lower end of the panel at the other end of the door body, which is disposed at a side opposite to the restriction rib.

In a refrigerator according to an embodiment, a panel assembly may have a structure in which one end thereof is supported through a vertical movement thereof, and the other end thereof is hooked to be restricted inside a door by a restriction member inserted from the outside.

In one embodiment, a refrigerator includes: a cabinet configured to define a storage space; and a door configured to open and close the storage space, wherein the door includes: a door body including a door liner configured to define a rear surface of the door, a front plate disposed to be spaced forward from the door liner, a cap decor which is connected to the door liner and the front plate to define a circumferential surface of the door and in which a recessed handle is defined, and a door body including an insulator filled between the door liner, the front plate, and the cap decor; and a panel assembly detachably mounted on a front surface of the door body and configured to define a front surface of the door, wherein the panel assembly includes: a panel configured to define an outer appearance of the front surface of the door; and an insertion protrusion configured to protrude backward from the panel and inserted into a front surface of the cap decor when the panel is mounted so as to restrict the panel assembly, wherein the insertion protrusion extends from the outside of a recessed space of the handle in a direction crossing the recessed space.

The cap decor may include: an upper cap decor configured to connect the door liner to an upper end of the front plate; and a lower cap decor configured to connect the door liner to a lower end of the front plate.

The upper cap decor may include: a top surface from which the handle is recessed and which is configured to define a top surface of the door; and a front surface extending downward from the top surface and coupled to the upper end of the front plate, wherein a protrusion insertion hole through which the insertion protrusion passes may be defined in the front surface.

The panel assembly may include a fixing bracket which extends along an upper end of a rear surface of the panel assembly and in which an insertion portion is defined in an upper end thereof, an upper support end configured to protrude forward along an upper end of the front surface and support an upper end of the panel assembly may be disposed on the upper cap decor, and an upper restriction rib configured to protrude downward and inserted into the insertion portion to restrict the upper end of the panel assembly may be disposed on the upper support end.

The panel assembly may include a fixing bracket which is provided on a rear surface of the panel assembly below the panel bracket on which a plurality of insertion protrusions are disposed, wherein the plurality of insertion protrusions may be disposed at the same height along the fixing bracket.

The insertion protrusion may be in contact with a bottom surface of a recessed space of the handle.

A top surface of the insertion protrusion may have an inclination that gradually decreases in a protruding direction, and a bottom surface of the insertion protrusion may be disposed at a position lower than that of the bottom surface of the recessed space of the handle.

The panel assembly may further include a lower bracket extending along a lower end of a rear surface of the panel and coupled to the lower cap decor.

A restriction member may be mounted inside the recessed space, and the restriction member may extend to sequentially pass through a bottom surface of the recessed space of the handle and the insertion protrusion.

A restriction member insertion hole may be defined in the recessed space of the handle, and a through-hole may be defined in the insertion protrusion, and when the panel assembly is mounted, the restriction member insertion hole and the through-hole may be aligned with each other so that the restriction member is inserted to sequentially pass through the restriction member insertion hole and the through-hole.

A protrusion insertion hole into which the insertion protrusion is inserted may be defined in a front surface of the upper cap decor, and a restriction portion to which the insertion protrusion and the restriction member are hooked to be restricted may be provided in the protrusion insertion hole.

The restriction portion may include: a first restriction portion which is hooked to be restricted by the restriction member when the restriction member is inserted; and second restriction portions disposed to be spaced apart from each other at both left and right sides of the first restriction portion and hooked to be restricted by both side surfaces of the insertion protrusion, wherein the restriction member may be inserted to pass between the second restriction portions disposed at both sides of the restriction member.

The restriction member may include: a cap configured to shield a restriction member insertion hole that is opened in an inner surface of the recessed space; and a body portion extending to pass through the inner surface of the recessed space from a bottom surface of the cap and hooked to be restricted by the insertion protrusion.

The body portion may further include a restriction member support portion that is hooked to be restricted by an opened circumference of the restriction member insertion hole when the restriction member is mounted to prevent the restriction member from being detached.

The cap decor may include: an upper cap decor which is configured to connect the door liner to an upper end of the front plate and on which the handle is disposed; and a lower cap decor configured to connect the door liner to a lower end of the front plate, wherein a restriction member passing through the lower cap decor so as to be coupled to a lower end of the panel assembly may be inserted into the lower cap decor.

The panel assembly may include: an upper bracket which is provided along an upper portion of a rear surface of the panel facing the upper cap decor and on which an insertion protrusion inserted into the upper cap decor is disposed; and a lower bracket which is provided along a lower portion of a rear surface of the panel facing the lower cap decor and is restricted by the lower cap decor.

The lower bracket may include: a lower adhesion portion adhering to the rear surface of the panel and extending along the rear surface of the panel; and a restriction protrusion configured to protrude backward from the lower adhesion portion and inserted into a front surface of the lower cap decor.

A front opening that is opened so that the restriction protrusion is inserted may be defined in the front surface of the lower cap decor, a bottom opening that is opened at a position corresponding to the front opening may be defined in a bottom surface of the lower cap decor, and a locking member, which is rotatably mounted in an accommodation space that communicates between the front opening and the bottom opening and is selectively coupled to the restriction protrusion, may be provided.

The locking member may include: a manipulation portion exposed to the bottom opening and manipulated by a user; a first restriction portion extending from a front end of the manipulation portion in a direction crossing an extension direction of the manipulation portion and hooked to be restricted by an end of the restriction protrusion; and a rotation shaft protruding in both lateral directions between the manipulation portion and the first restriction portion so as to be axially coupled to the cap decor.

A manipulation guide which is opened to the bottom opening and extends forward through an upper side of the manipulation portion to guide a user's finger so as to face the manipulation portion may be disposed inside the accommodation space.

The details of one or more embodiments are set forth in the accompanying drawings and the description below. Other features will be apparent from the description and drawings, and from the claims.

DETAILED DESCRIPTION OF THE EMBODIMENTS

Hereinafter, detailed embodiments will be described in detail with reference to the accompanying drawings. However, the scope of the present disclosure is not limited to proposed embodiments of the present invention, and other regressive inventions or other embodiments included in the scope of the spirits of the present disclosure may be easily proposed through addition, change, deletion, and the like of other elements.

A direction will be defined prior to the explanation. In an embodiment of the present disclosure, a direction facing a front surface of the door illustrated in FIG. 2 may be defined as a front direction, a direction facing a cabinet with respect to the front surface of the door will be defined as a rear direction, a direction facing a bottom surface on which the refrigerator is installed will be defined as a downward direction, and a direction that is away from the bottom surface will be defined as an upward direction. In the present technique, references to 'vertical', 'up', 'down', 'up and down', 'upper', 'lower', 'upward', 'downward', 'under' and like phrases, unless otherwise expressly stated, are to be understood with respect to an upright position of the refrigerator, i.e. a direction extending from a base or bottom of the refrigerator to a top of the refrigerator, for example when the refrigerator is installed for use. Similarly, references to 'front', 'back', 'rear', 'forward', 'rearward', 'to-and-fro', 'front and back', 'back and forth' direction and like phrases, unless otherwise expressly stated, are to be understood with respect to a direction when viewed from a front side of the refrigerator towards the storage space of the refrigerator, i.e. a direction extending from a door of the refrigerator inwards towards the storage space of the refrigerator. Similarly, references to 'horizontal', 'lateral', 'side', 'left', 'right', 'left side', 'right side', 'side to side' and like phrases, unless otherwise expressly stated, are to be understood with respect to a direction perpendicular to the vertical direction and to the front and back direction of the refrigerator, for example when viewed from a front side of the refrigerator in a direction towards the storage space of the refrigerator.

Figure 1:
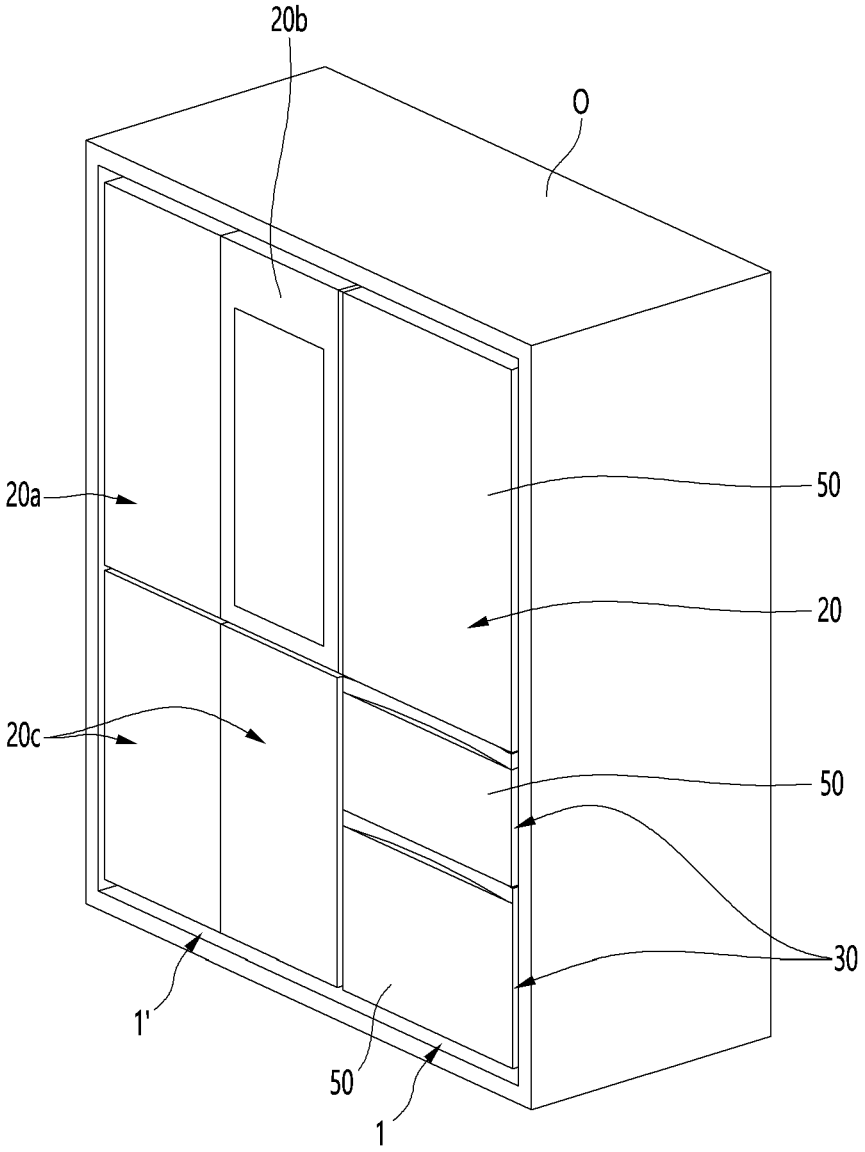
FIG. 1 is a perspective view illustrating a state in which a refrigerator is installed according to an embodiment.
Figure 2:
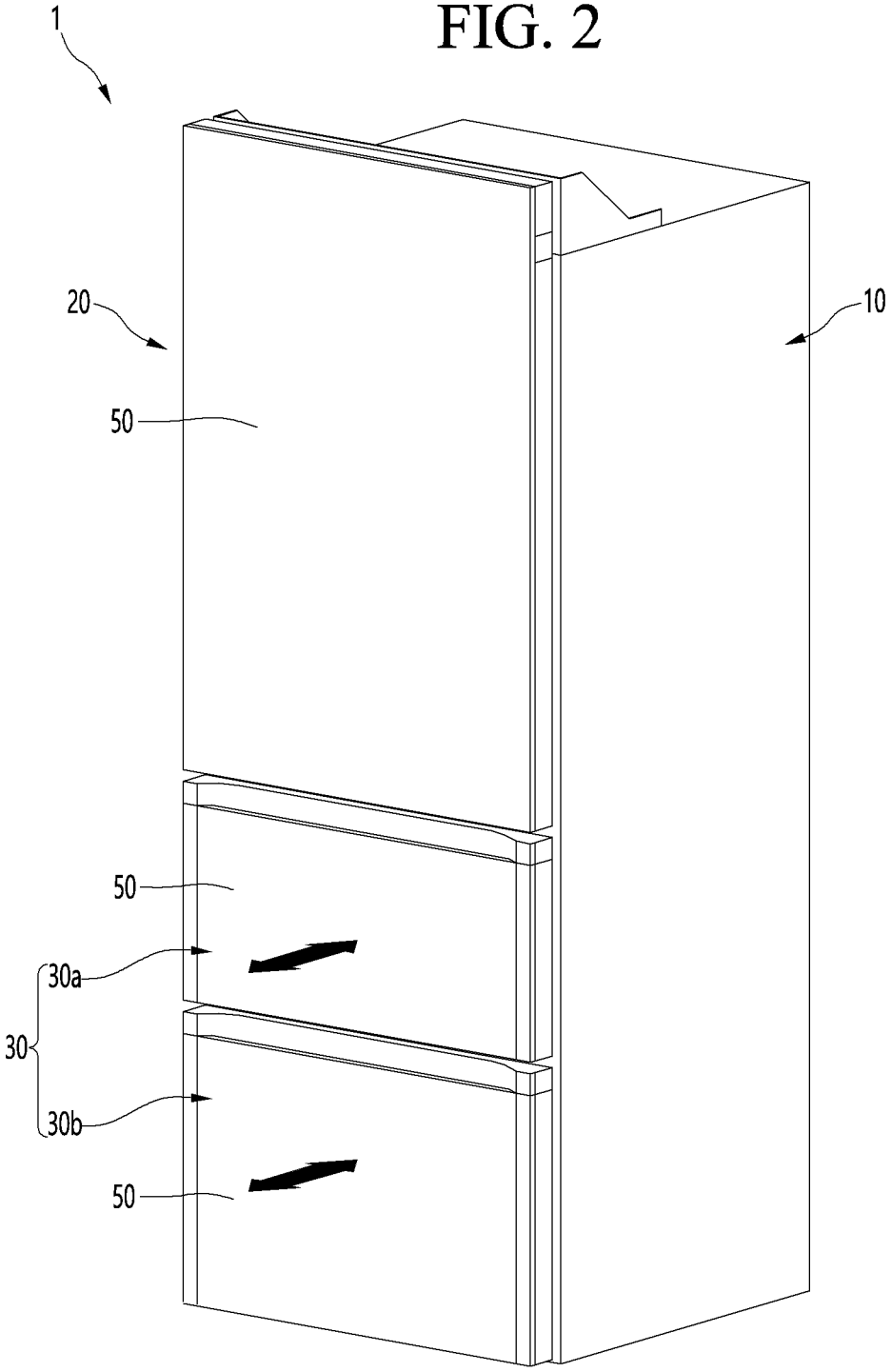
FIG. 2 is a perspective view of the refrigerator.

FIG. 1 is a perspective view illustrating a state in which a refrigerator is installed according to an embodiment. Also, FIG. 2 is a perspective view of the refrigerator.

Referring to the drawings, a refrigerator 1 according to an embodiment includes a cabinet 10 defining a storage space having an opened front surface and a door opening or closing the storage space. Here, an outer appearance of the refrigerator 1 may be defined by a cabinet 10 and doors 20 and 30.

Also, the refrigerator 1 may be mounted so as to harmonize with furniture or wall O of an indoor space. For example, as illustrated in FIG. 1, the refrigerator 1 may be installed in the indoor space such as a kitchen and may be disposed adjacent to the furniture or the wall O to harmonize with each other. That is, a space corresponding to a size of the refrigerator 1 may be provided in the furniture or the wall O, and the refrigerator 1 may be accommodated or disposed in a built-in type.

Also, the other refrigerator 1' may be continuously disposed in parallel at a side of the refrigerator 1. That is, a space in which a plurality of refrigerators 1 and 1' may be disposed may be provided by the furniture or the wall O.

The plurality of refrigerators 1 and 1' may have the same structure, and as necessary, the refrigerators 1 and 1' having various structures may be disposed in combination. For example, as illustrated in FIG. 1, in the refrigerator 1 disposed on a right side, doors 20 and 30 may be disposed vertically. That is, the right refrigerator 1 may be configured so that the door 20 that is opened and closed in a rotating manner is provided at an upper side, and the door 30 that is opened and closed in a sliding manner is provided at a lower side. Also, the refrigerator 1 disposed side by side at a left side may be configured so that an upper storage space is opened and closed by a pair of doors 20*a* and 20*b*, and a lower storage space is opened and closed by a pair of doors 20*c*. Also, the doors 20*a*, 20*b*, and 20*c* may be configured to be opened and closed in the rotating manner, and the doors 20*a*, 20*b*, and 20*c* may be referred to as French-type doors.

Panel assemblies 50 having the same outer appearance may be mounted on the doors 20, 30, 20*a*, and 20*c* of the left refrigerator 1' and the right refrigerator 1. The panel assembly 50 may define a front surface of each of the doors 20, 30, 20*a*, and 20*c*, and thus, the refrigerators 1 and 1' may have the same outer appearance to provide a unity look when viewed from a front side. Of course, one door 20*b* among the doors of the left refrigerator 1' may have a different outer appearance and be configured to have an internal see-through function. All of the remaining doors 20, 30, 20*a*, and 20*c* except for the door 20*b* having a specific function may have the same appearance.

That is, the doors 20, 30, 20*a*, and 20*c* of the refrigerators 1 and 1' have different sizes, but the panel assembly 50 having the same structure may be mounted. Thus, even if the plurality of refrigerators 1 are disposed, the same outer appearance, an outer appearance such as a color and texture may be provided. Of course, the panel assemblies 50 may be mounted by combining materials having different colors or different textures, as necessary.

Also, since each of the panel assemblies 50 has a detachable structure, the panel assembly 50 having an appropriate outer appearance may be selected according to an environment in which the refrigerators 1 and 1' and thus mounted to be replaced.

When the refrigerator 1 is mounted on the furniture or wall O, the outer appearance of the refrigerator 1 may be provided to have the same material or materials having the same texture as the furniture or wall O, and thus, the outer appearance of the refrigerator and the adjacent furniture or wall O may have a sense of unity. Of course, even if the outer appearance of the refrigerator 1 and the furniture or wall O do not have a sense of unity, the refrigerator 1 may be made of a material that is capable of harmonized with the furniture or wall O.

Also, the refrigerator 1 may be disposed adjacent to the adjacent refrigerator 1' and the furniture or wall O and also may be disposed close to the adjacent refrigerator 1 and the furniture or wall O in a range that does not interfere when the doors 20 and 30 are opened and closed.

A structure and mounting structure of the panel assembly 50 according to an embodiment may be the same in both the left refrigerator 1' and the right refrigerator 1. Therefore, hereinafter, a structure of the right refrigerator 1 of the refrigerators 1 and 1' of FIG. 1 will be described in more detail.

The refrigerator 1 may have an outer appearance defined by the cabinet 10 and the doors 20 and 30. Also, the cabinet 10 may define a storage space that is divided vertically. Also, the doors 20 and 30 that open and close the storage space may be continuously disposed in the vertical direction.

An upper door 20 may be provided in an upper storage space, and a lower door 30 may be provided in a lower storage space. The upper door 20 may open and close the upper storage space by rotation thereof. Thus, the upper door 20 may be referred to as a rotation type door. Also, the lower door 30 may be withdrawn in a drawer type to open and close the lower storage space, and the lower door 30 may be referred to as a drawer type door 30 or a drawer door 30.

The lower door 30 may be provided with two upper and lower doors, and the lower storage space opened and closed by the lower door 30 may be provided as one space, or a space in which each of the lower doors 30 is accommodated.

Outer appearances of front surfaces of the upper door 20 and the lower door 30 may be defined by the panel assemblies 50, respectively. The panel assemblies 50 provided in the upper door 20 and the lower door 30, respectively, may be different in size and have the same appearance.

Hereinafter, for convenience of explanation and understanding, the panel assembly 50 and a mounting structure of the panel assembly 50 will be described with reference to the lower door 30. Also, hereinafter, the lower door 30 may be referred to as a door 30.

Figure 3:
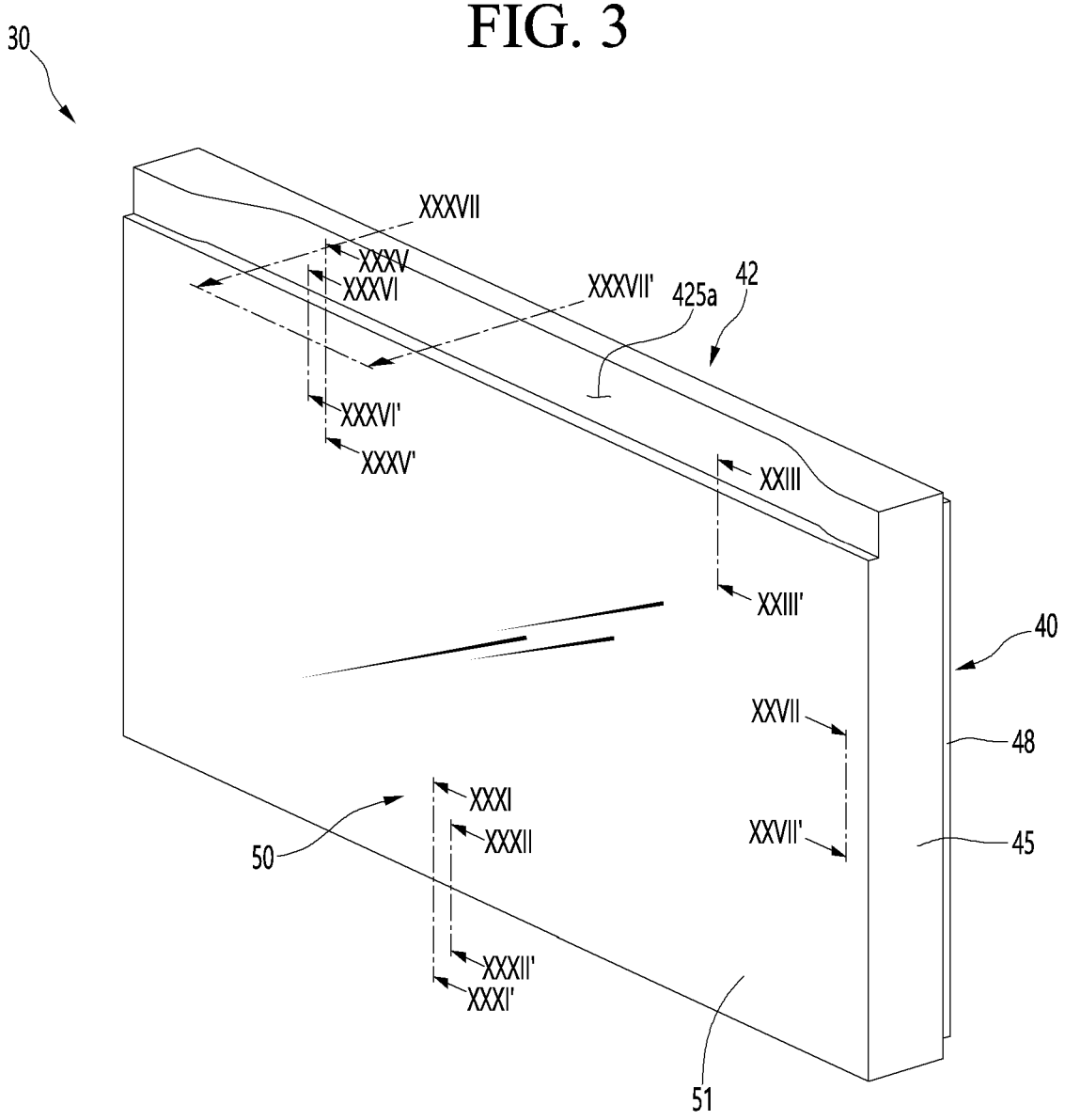
FIG. 3 is a front perspective view of the refrigerator.
Figure 4:
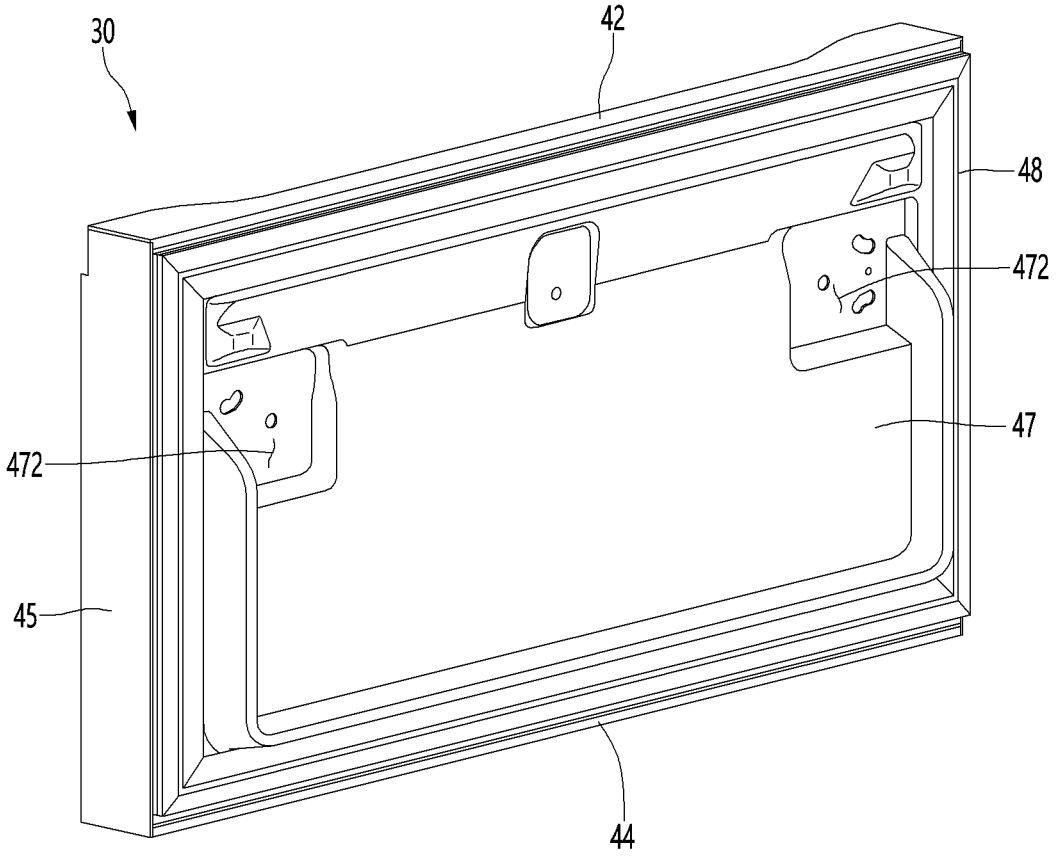
FIG. 4 is a rear perspective view of a door.
Figure 5:
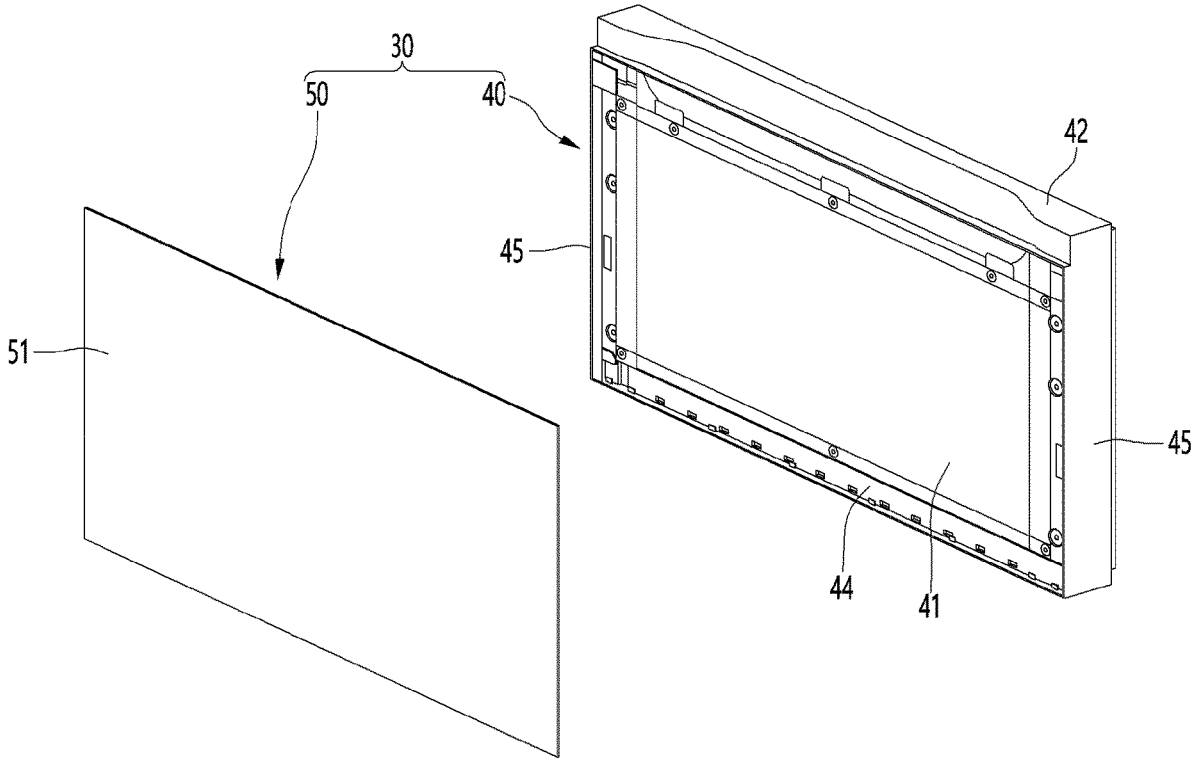
FIG. 5 is an exploded perspective view of the door.
Figure 6:
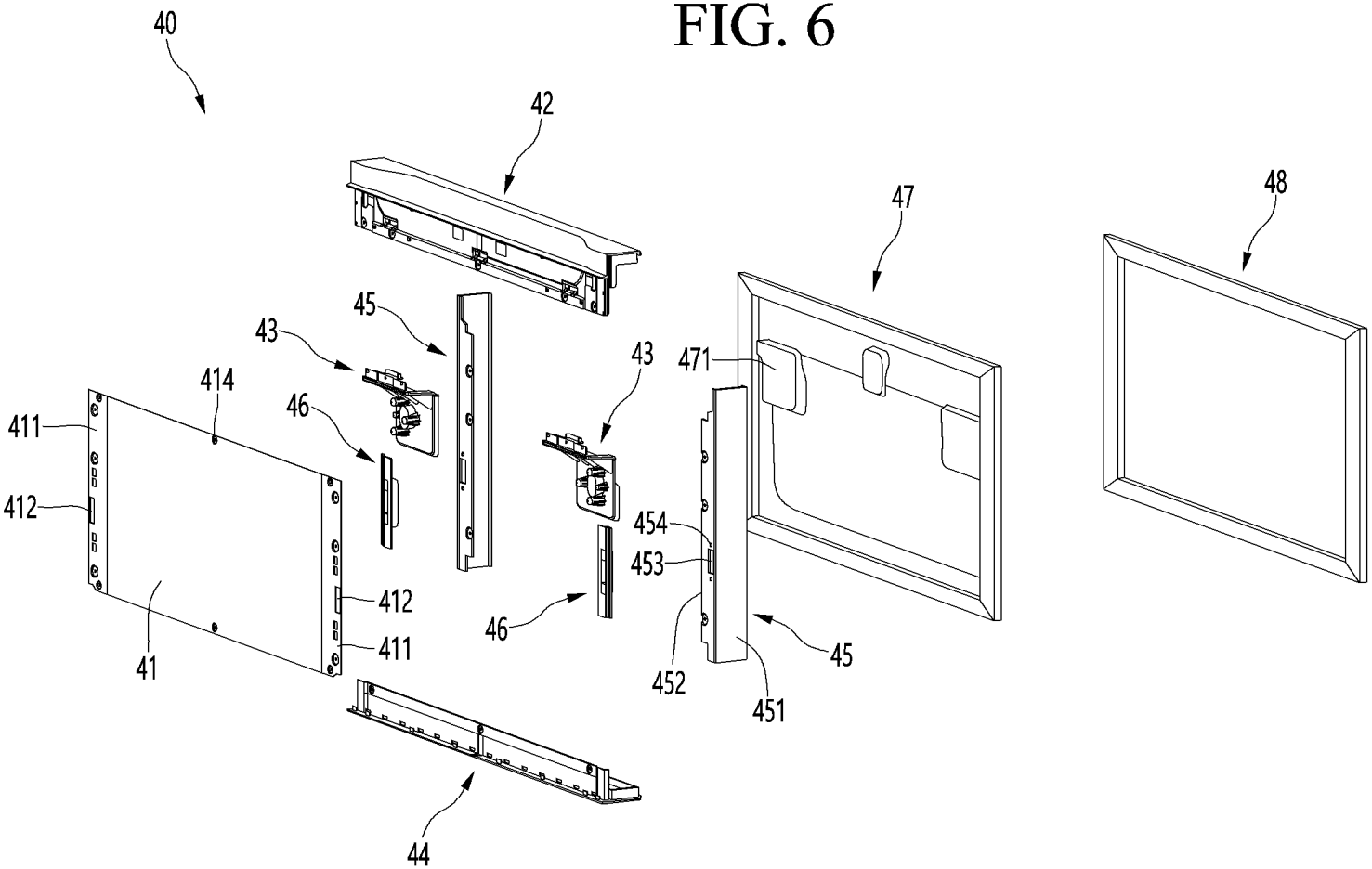
FIG. 6 is an exploded perspective view of a door body that is one component of the door.

FIG. 3 is a front perspective view of the refrigerator. Also, FIG. 4 is a rear perspective view of the door. Also, FIG. 5 is an exploded perspective view of the door. Also, FIG. 6 is an exploded perspective view of a door body that is one component of the door.

As illustrated in the drawings, the door 30 may be filled with an insulator 400 (see FIG. 17) and may include a door body 40 that substantially opens and closes the storage space and a panel assembly 50 mounted on the door body 40.

The door body 40 may have a predetermined thickness, and the insulator 400 may be filled therein to insulate the storage space. Also, the panel assembly 50 may be mounted on a front surface of the door body 40 to define outer appearances of the front surface of the door 20 and the refrigerator 1. The panel assembly 50 may be mounted to be easily detachable from the door body 40, and the panel assembly 50 may be easily detachable even when the door 30 is mounted on the cabinet 10.

Thus, the panel assembly 50 may be mounted in consideration of the outer appearance of the furniture or wall O, and the panel assembly 50 may be designed to be desired by the user and be mounted or replaced, as necessary.

Referring to the structure of the door body 40, the door body 40 may include a front plate 41, a side frame 45, an upper cap decor 42, a lower cap decor 44, a door liner 47, and a gasket 48 as a whole. Also, the insulator 400 may be filled inside the door body 40. Also, the door body 40 may further include a door bracket 43. Also, the door body 40 may further include an accommodation member 46.

In detail, the front plate 41 may define a front surface of the door body 40 and be provided in a plate shape. The front plate 41 may be made of a steel material and define a surface facing a rear surface of the panel assembly 50.

A plurality of plate openings 412 may be defined in the vertical direction along both side ends of the front plate 41. Each of the plate openings 412 may be defined at a corresponding position so that a panel fixing member 55 (see FIG. 20, 21) to be described below is capable of being inserted. Also, a protrusion hole 413 (see FIG. 19) in which a mounting protrusion 464 of the accommodation member 46 to be described below is disposed may be defined above and below each of the plate openings 412.

Also, a plurality of screw holes 414 may be defined along a circumference of the front plate 41. Screws coupled to the upper cap decor 42, the lower cap decor 44, and both the side frames 45 may be coupled to the screw hole 414.

The upper cap decor 42 and the lower cap decor 44 may be respectively disposed at upper and lower ends of the front plate 41 to define top and bottom surfaces of the door body 40. The upper cap decor 42 may be provided with a handle groove 425 through which a user puts a hand to pull the door. The handle groove 425 may have various shapes that are held by the user and thus be referred to as a handle without being limited to a recessed shape.

Also, the side frames 45 may be coupled to both left and right side ends of the front plate 41, respectively, and upper and lower ends of each of the side frames 45 may be connected to the upper cap decor 42 and the lower cap decor 44, respectively.

The side frame 45 may connect the upper cap decor 42 to the lower cap decor 44 and simultaneously may connect the front plate 41 to the door liner 47. Also, the side frame 45 may define both side surfaces of the door body 40.

The side frame 45 may extend lengthily i.e. longitudinally in the vertical direction and may be formed through extrusion of a metal material. For example, the side frame 45 may be made of an aluminum material. The accommodation member 46 coupled to the panel fixing member 55 may be mounted on the side frame 45, and the side frame 45 may firmly support the portion, on which the panel assembly is mounted, to maintain a stably mounted state of the panel assembly 50 and prevent the door body 40 from being deformed.

Referring to the detailed structure of the side frame 45, the side frame 45 may include a frame side surface 451 and a frame front surface 452.

In detail, the frame side surface 451 may define a surface exposed to a side of the door body 40 and be provided in a flat shape. An upper end of the frame side surface 451 may be in contact with the upper cap decor 42, and a lower end of the frame side surface 451 may be in contact with the lower cap decor 44.

Also, the frame front surface 452 may extend inward from a front end of the frame side surface 451. The frame front surface 452 may support both left and right side ends of the front plate 41. The frame front surface 452 may extend from an upper end to a lower end of the side frame 45 and be disposed perpendicular to the frame side surface 451.

The frame front surface 452 may have a width so that at least the accommodation member 46 is mounted and may support both left and right side ends of the front plate 41. In detail, the accommodation member 46 may be mounted on an area on which the front plate 41 and the frame front surface 452 overlap each other.

A frame opening 453 may be defined in the front surface 452 of the frame. The frame opening 453 may be defined at a position corresponding to the accommodation member 46. Also, the accommodation member 46 may be mounted at a rear side of the frame front surface 452. Also, a mounting hole 454 into which the mounting protrusion 464 of the accommodation member 46 is inserted may be defined above and below the plate opening 412. The mounting protrusion 464 may be inserted into the mounting hole 454 so that the accommodation member 46 is fixedly mounted on the side frame 45.

The accommodation member 46 may be disposed at a position corresponding to each of both side ends of the front plate 41 and may be provided in plurality in the vertical direction. Also, the accommodation member 46 may be disposed to face the front plate 41 in a state of being mounted on the side frame 45, and the plate opening 412 and the frame opening 453 may communicate with the opened front surface of the accommodation member 46 so that the panel fixing member 55 is inserted therein.

The door liner 47 may be coupled to rear surfaces of the upper cap decor 42, the lower cap decor 44, and the side frame 45. The door liner 47 may be provided in a plate shape to define the rear surface of the door body 40. The door liner 47 may be made of a plastic material and may be vacuum-molded to define a shape of the rear surface of the door body 40.

A frame mounting portion 472 on which a frame directly or indirectly connected to a basket mounted on the door 30 or a rail assembly for pulled-in/out of the door 30 is mounted may be disposed on each of both sides of the rear surface of the door liner 47. A frame of the general drawer door may be used as a structure of the frame, and a detailed description thereof will be omitted.

A gasket groove may be defined around the rear surface of the door liner 47, and the gasket 48 may be disposed along the gasket groove. The gasket 48 may be in contact with a circumference of the cabinet 10 while the door 20 is closed to seal the storage space.

Hereinafter, main components constituting the door body 40 will be described in more detail with reference to the drawings.

Figure 7:
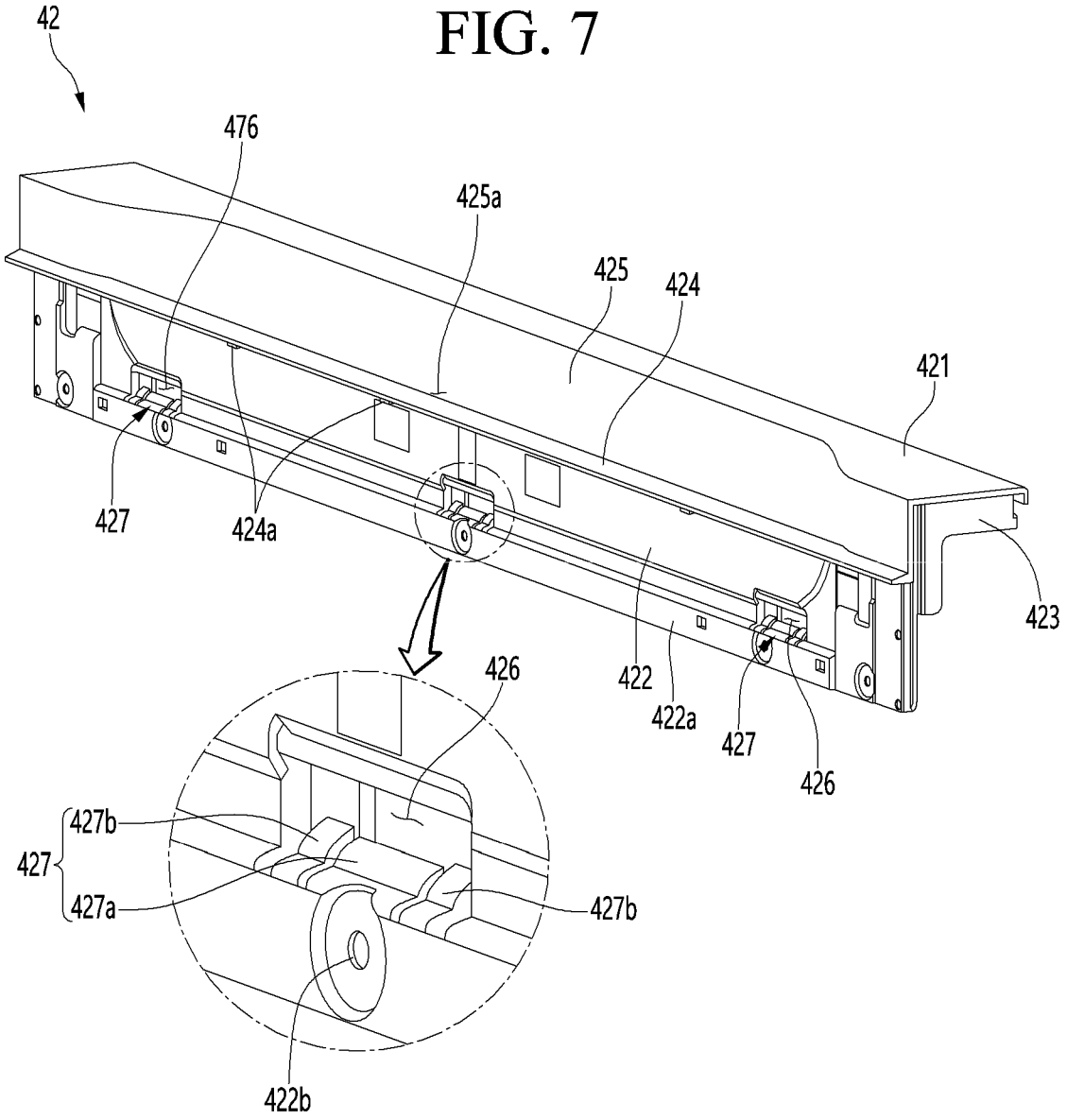
FIG. 7 is a front perspective view of an upper cap decor.
Figure 8:
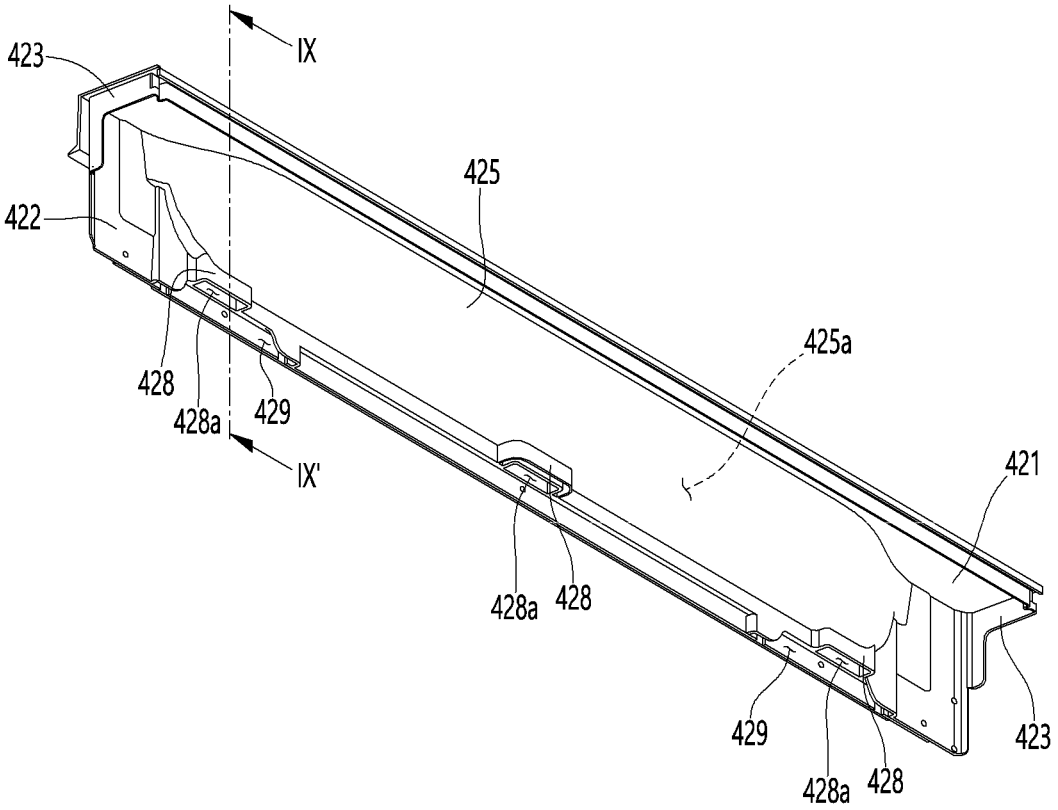
FIG. 8 is a rear perspective view of the upper cap decor.
Figure 9:
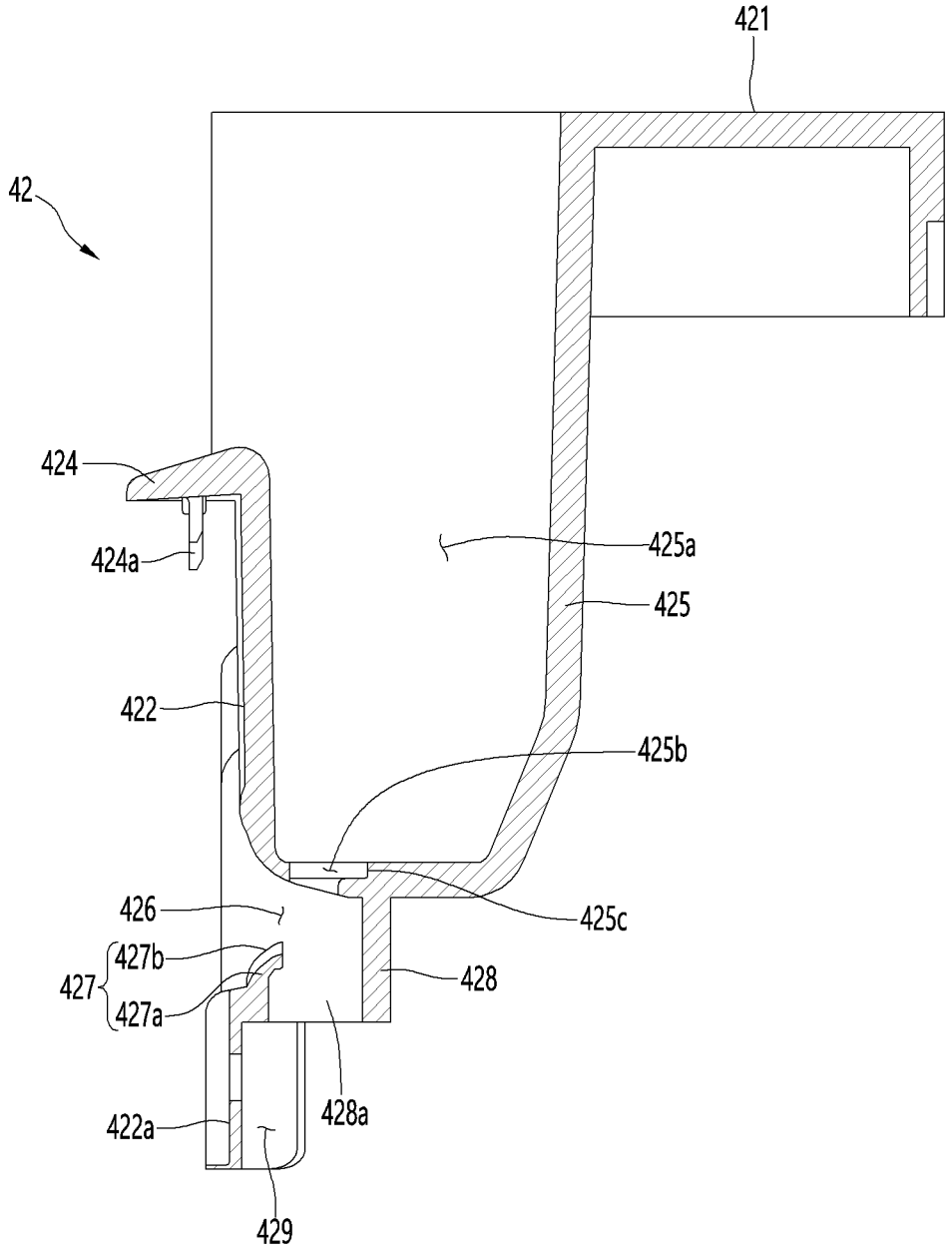
FIG. 9 is a cross-sectional view taken along line IX-IV' of FIG. 8.
Figure 10:
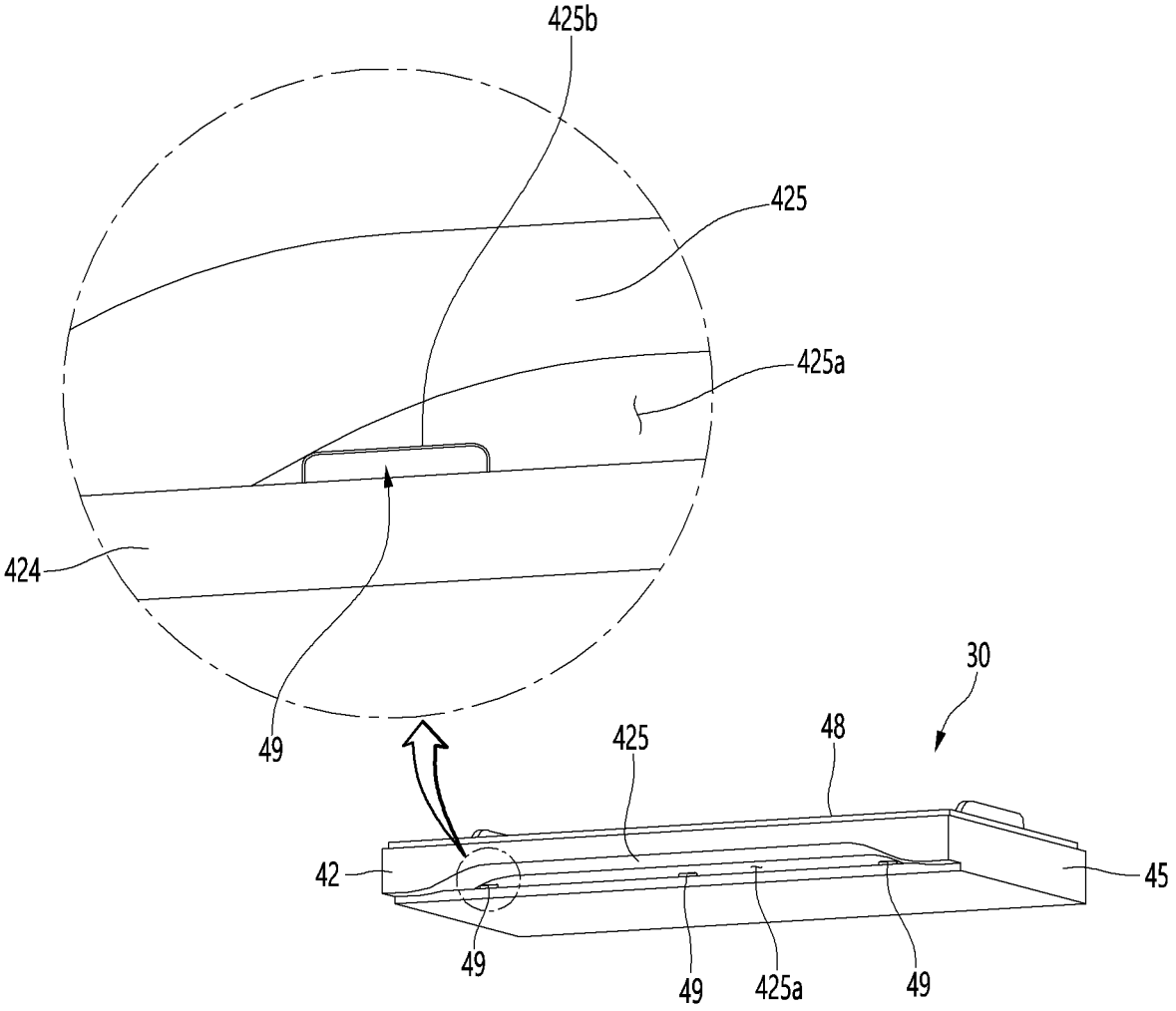
FIG. 10 is a perspective view illustrating a state in which a restriction member is mounted according to an embodiment.
Figure 11:
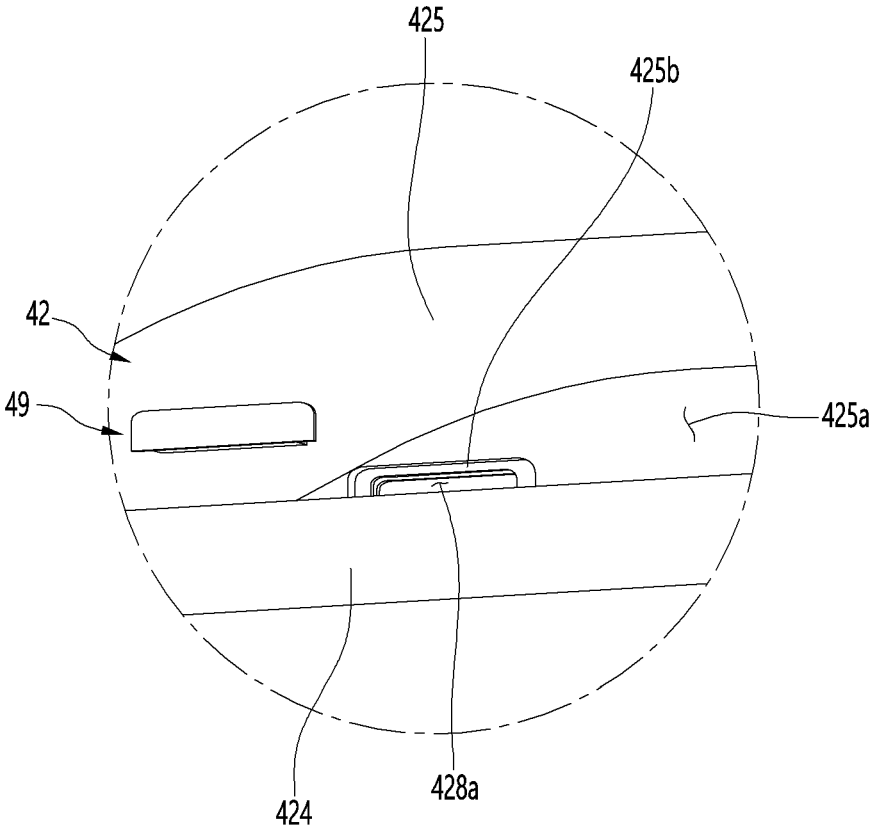
FIG. 11 is a partial perspective view illustrating a state in which the restriction member is separated.

FIG. 7 is a front perspective view of the upper cap decor. Also, FIG. 8 is a rear perspective view of the upper cap decor. Also, FIG. 9 is a cross-sectional view taken along line IX-IV' of FIG. 8. Also, FIG. 10 is a perspective view illustrating a state in which the restriction member is mounted according to an embodiment. Also, FIG. 11 is a partial perspective view illustrating a state in which the restriction member is separated.

As illustrated in the drawings, the upper cap decor 42 may define an upper portion of the door 30 and also may define a top surface of the door 30, which is exposed to the outside in an assembled state. Also, the upper cap decor 42 may be coupled to the front plate 41, the door liner 47, and the upper end of the side frame 45.

In detail, the upper cap decor 42 may be made of a plastic material and may include a top surface 421, a front surface 422, and both side surfaces 423.

The top surface 421 may define the top surface of the door 30, and the front surface 422 and both the side surfaces 423 may be disposed along a circumference of the top surface 421. The front plate 41 may be coupled to the front surface 422, and the side frames 45 may be coupled to the left and right side surfaces 423, respectively. Also, the door liner 47 may be coupled to a rear end of the top surface 421, and an upper support end 424 protruding forward may be disposed on the front surface 422 of the upper cap decor 42.

The upper support end 424 may extend from a left end to a right end of the upper cap decor 42 and may support the upper end of the panel assembly 50 when the panel assembly 50 is mounted.

Also, a plurality of upper restriction ribs 424*a* protruding downward may be disposed on a bottom surface of the upper support end 424. The upper restriction ribs 424*a* may be inserted into the upper end of the panel assembly 50 to restrict the upper end of the panel assembly 50 and may be provided in plurality at a regular interval along the upper support end 424.

The front surface 422 may include an upper portion exposed to the outside and a lower portion covered by the panel assembly 50, based on the upper support end 424. The upper support end 424 may be provided with the handle groove 425 for allowing the user to hold the door 30 to be pulled in and out.

The handle groove 425 may be defined over the front surface 422 and the top surface 421 of the upper cap decor 42 and also may be defined over most of an area expect for both ends of the upper cap decor 42 along a horizontal direction of the upper cap decor 42.

Also, the handle groove 425 may be recessed downward from the top surface of the upper cap decor 42 and also may be recessed up to a position adjacent to the lower end of the upper cap decor 42 of the front surface 422 via the upper support end 424. Also, the handle groove 425 may be recessed backward from the front surface 422 of the upper cap decor 42 and also may be recessed up to a position adjacent to the rear end of the top surface 421 of the upper cap decor 42.

The handle groove 425 may provide a recessed space 425 so that the user is capable of holding the handle groove 425 in a state in which the hand is inserted at any position on the top surface of the door 30. Also, the lower portion of the handle groove 425 may be disposed at a substantially lower position than the upper end of the panel assembly 50, and when the hand is inserted into the handle groove 425 to be pulled, force may also be essentially provided to the upper end of the panel assembly 50. Simply put, at least a part of the panel assembly 50, for example a part of the panel 51 of the panel assembly 50 such as an upper end or lower end of the panel 51 of the panel assembly 50, may overlap with at least a part of the handle groove 425 i.e. the recess or groove of the handle, in a forward-rearward direction.

Thus, the panel assembly 50 has to have a firmly fixed structure with the upper cap decor 42 at the upper end thereof. For this, a coupling structure of the upper restriction rib 424*a* and the panel bracket 42 and/or a coupling structure of the fixing bracket 54 and the restriction member 49 may be applied. The coupling structure of the panel assembly 50 will be described in more detail below.

Also, an upper plate coupling portion 422*a* supporting the front plate 41 at the rear side may be disposed on a lower portion of the front surface of the upper cap decor 42. Also, a screw hole 422*b* into which a screw coupled to the front plate 41 may be defined in the upper plate coupling portion 422*a*.

Also, a bracket mounting portion 429 on which the door bracket 43 is mounted may be disposed on the lower end of the upper cap decor 42. The bracket mounting portion 429 may be disposed on each of both left and right sides of the front surface of the upper cap decor 42 and may protrude backward. Also, the bracket mounting portion 429 may have a shape that is opened downward.

Here, the bracket mounting portion 429 may be disposed at a position corresponding to the door bracket 43, and when the door bracket 43 is mounted, the upper end of the door bracket 43 may be inserted through the opened bottom surface of the bracket mounting portion 429. Also, the bracket mounting portion 429 may extend to the bottom surface of the handle groove 425.

Also, a protrusion insertion hole 426 may be defined in the front surface of the upper cap decor 42. The protrusion insertion hole 426 may be a portion into which the insertion protrusion 542 of the fixing bracket 54 to be described below is inserted and may be defined to pass through the front surface of the upper cap decor 42.

A plurality of protrusion insertion holes 426 may be defined at regular intervals and also may be defined along the lower end of the handle groove 425. For example, the protrusion insertion hole 426 may be defined at an intermediate point in the horizontal direction of the door, and a pair of protrusion insertion holes 426 may be defined at both side ends of the handle groove 425, which are spaced the same distance from each other at both the left and right sides, based on the intermediate point. Also, a protrusion restriction portion 427 that is hooked to be restricted by the insertion protrusion 542 and the restriction member 49 may be disposed inside the protrusion insertion hole 426.

The protrusion restriction portions 427*a* and 427*b* may be disposed to protrude upward and backward from the lower end of the protrusion insertion hole 426. Also, the protrusion restriction portions 427*a* and 427*b* may include a first restriction portion 427*a* disposed at a center of the lower end of the protrusion insertion hole 426 and a second restriction portion 427*b* disposed at each of both left and right sides of the first restriction portion 427*a*.

In detail, the first restriction portion 427*a* may be hooked to be restricted by the restriction member 49 inserted downward by passing through the handle groove 425. The first restriction portion 427*a* may be provided in a shape of an insertion protrusion having elasticity and may be inclined or rounded backward and upward.

Also, the second restriction portion 427*b* may be disposed to be spaced apart from both sides of the first restriction portion 427*a* and be hooked to be restricted by the insertion protrusion 542 inserted into the protrusion insertion hole 426 independently of the first restriction portion 427*a*. The second restriction portion 427*b* may be provided in a shape of an insertion protrusion having elasticity and may be inclined or rounded backward and upward. Here, the second restriction portion 427*b* may protrude higher than the first restriction portion 427*a*, and thus, the insertion protrusion 542 inserted into the protrusion insertion hole 426 may be hooked to be restricted by the pair of second restriction portions 427*b* and may not be in contact with the first restriction portion 427*a* between the second restriction portions 427*b*.

An upper insertion hole 428*a* into which the restriction member 49 is inserted may be defined in the upper cap decor 42 corresponding to the protrusion insertion hole 426. The upper insertion hole 428*a* may be opened downward through an inner bottom surface of the handle groove 425 and may be opened downward from the upper cap decor 42.

Also, an insertion hole guide 428 protruding backward may be disposed on the front surface 422 of the upper cap decor 42, which corresponds to the upper insertion hole 428*a* and the protrusion insertion hole 426. In detail, the insertion hole guide 428 may be defined to be recessed backward at a position corresponding to the upper insertion hole 428*a* and provided in a shape that protrudes backward when the upper cap decor 42 is viewed from a rear side (see FIG. 8). Also, a horizontal length of the insertion hole guide 428 may be equal to or somewhat larger than that of the protrusion insertion hole 426. Thus, the insertion protrusion 542 inserted through the protrusion insertion hole 426 may be disposed in an inner region of the insertion hole guide 428.

Also, the insertion hole guide 428 may extend downward along a circumference of the restriction member insertion hole 425*b* defined in the bottom surface of the handle groove 425. Thus, the protrusion insertion opening 426 and the restriction member insertion opening 425*b* may communicate with each other by a space defined by the insertion opening guide 428.

The restriction member insertion hole 425*b* into which the restriction member 49 is mounted may be defined in the inner bottom surface of the handle groove 425. The restriction member insertion hole 425*b* may be defined at a position corresponding to the restriction member insertion hole 425*b* and may be defined to pass through the bottom surface of the handle groove 425 so as to communicate with the restriction member insertion hole 425*b*.

The restriction member insertion hole 425*b* may be disposed to be biased forward from a center of the handle groove 425. Thus, in a state in which the restriction member 49 is inserted and mounted, the restriction member 49 may not be exposed outside the door 30. Particularly, the restriction member 49 may be disposed substantially forward from the inside of the handle groove 425 so that the restriction member 49 is not exposed in a general situation. Also, since the restriction member 49 is disposed as far forward as possible, the restriction member 49 may provide a structure that is capable of being coupled to the fixing bracket 54 outside in the region in which the insulator 400 is disposed inside the door 30.

The restriction member insertion hole 425*b* may be larger than the upper insertion hole 428*a* and may be recessed in a stepped shape from the bottom surface of the handle groove 425. Thus, when the restriction member 49 is inserted into the handle groove 425, a cap 491 of the restriction member 49 may be seated in the restriction member insertion hole 425*b*. In a state in which the restriction member 49 is mounted in the restriction member insertion hole 425*b*, the restriction member 49 may extend downward by passing through the restriction member insertion hole 425*b*. Also, the cap 491 may be mounted in the restriction member insertion hole 425*b*, and an outer surface of the cap 491 may be disposed on the same plane as the bottom surface of the handle groove 425.

The restriction member insertion hole 425*b* may be defined at an inner center and both ends of the handle groove 425, respectively, and the restriction member 49 may be inserted and mounted through the handle groove 425. Due to the mounting of the restriction member 49, the region of the handle groove 425 may be firmly fixed to the panel assembly 50 and may be configured to so that three or more restriction members 49 are mounted along a horizontal length of the handle groove 425.

The opened bottom surface of the insertion hole guide 428 may be shielded by the door bracket 43 or a separate member, and thus, when a foaming solution for molding the insulator 400 is filled inside the door 30, the insulator 400 may be prevented from being introduced.

The door bracket 43 will be described in more detail with reference to the drawings as follows.

Figure 12:
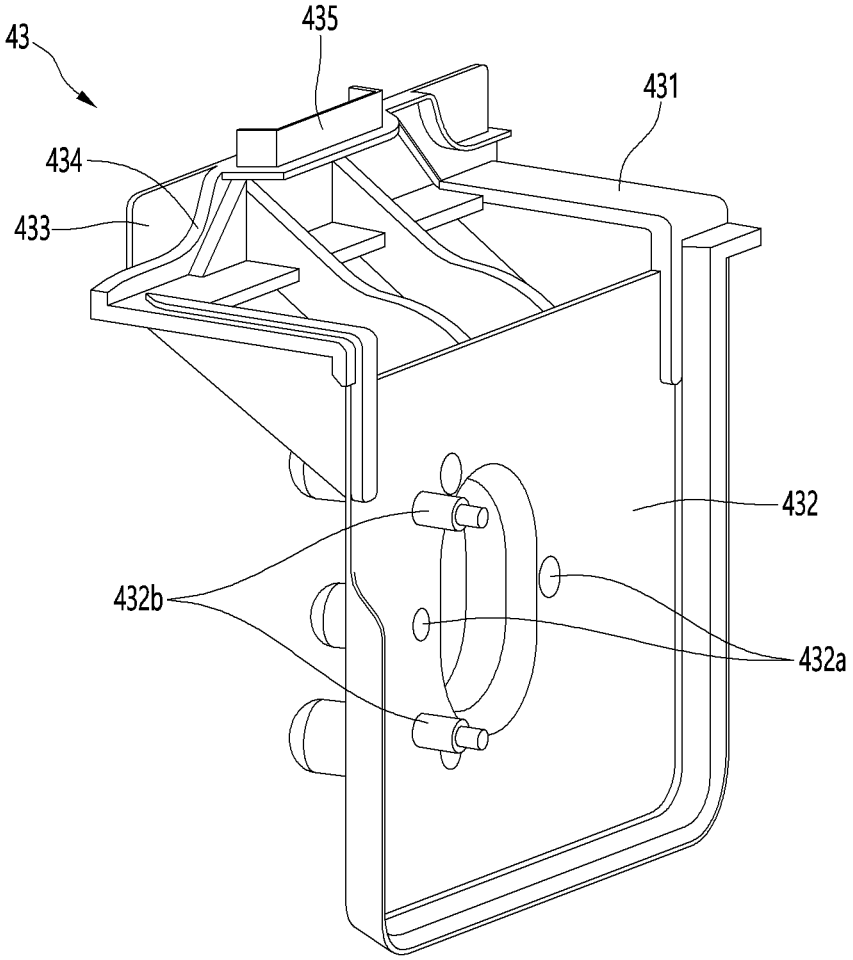
FIG. 12 is a perspective view of a door bracket that is one component of the door body.

FIG. 12 is a perspective view of the door bracket that is one component of the door body.

As illustrated in the drawings, the door bracket 43 may be provided inside the door, and a structure for mounting a door frame mounted on the door 30 may be provided. Furthermore, the door bracket 43 may support the inside of the door 30 in the mounted state, and particularly, the handle groove 425 may be supported at a lower side.

In detail, the door bracket 43 may include a horizontal portion 431 and a vertical portion 432. The horizontal portion 431 may be disposed parallel to the top surface 421 of the upper cap decor 42 to extend forward from an upper end of the vertical portion 432.

Also, a bracket rib 435 protruding upward may be disposed on an extending end of the horizontal portion 431. The bracket rib 435 may extend upward from a center of the horizontal portion 431 and be disposed at a position corresponding to the insertion hole guide 428. Therefore, when the door bracket 43 is mounted inside the door 30, the bracket rib 435 may be inserted through the opened bottom surface of the insertion hole guide 428 to shield the opened bottom surface of the insertion hole guide 428.

A guide rib 433 may be disposed on each of both left and right sides, based on the bracket rib 435. The guide rib 433 may extend upward from a position corresponding to the bracket mounting portion 429. The guide rib 433 may be inserted through the opened bottom surface of the bracket mounting portion 429 and be fixed inside the bracket mounting portion 429.

Also, a bracket support portion 434 that is in close contact with the bottom surface of the upper cap decor 42, i.e., the bottom surface of the recessed space 425*a* of the handle may be disposed along the extending front end of the horizontal portion 431. The bracket support portion 434 may be provided in a shape corresponding to the lower end of the bracket mounting portion 429 and the lower end of the insertion hole guide 428. Thus, when the door bracket 43 is mounted, the bracket support portion 434 may be in close contact with the lower end of the bracket mounting portion 429 and the lower end of the insertion hole guide 428.

The vertical portion 432 may be disposed parallel to the rear surface of the door body 40. The vertical portion 432 may extend downward from a rear end of the horizontal portion 431 and may be in close contact with the frame mounting portion 472 disposed on the door liner 47. A rear surface of the horizontal portion 431 may be provided in a shape corresponding to the frame mounting portion 472, and a screw hole 432*a* to which a screw passing through the frame mounting portion 472 is coupled may be defined. Also, a vertical portion protrusion 432*b* protruding backward and inserted into the frame mounting portion 472 may be disposed on the vertical portion 432. The vertical portion protrusion 432*b* may be inserted into the frame mounting portion 472 so that the door bracket 43 is maintained at an accurate position inside the door 30.

Hereinafter, the lower cap decor 44 defining the bottom surface of the door 30 will be described in detail with reference to the drawings.

Figure 13:
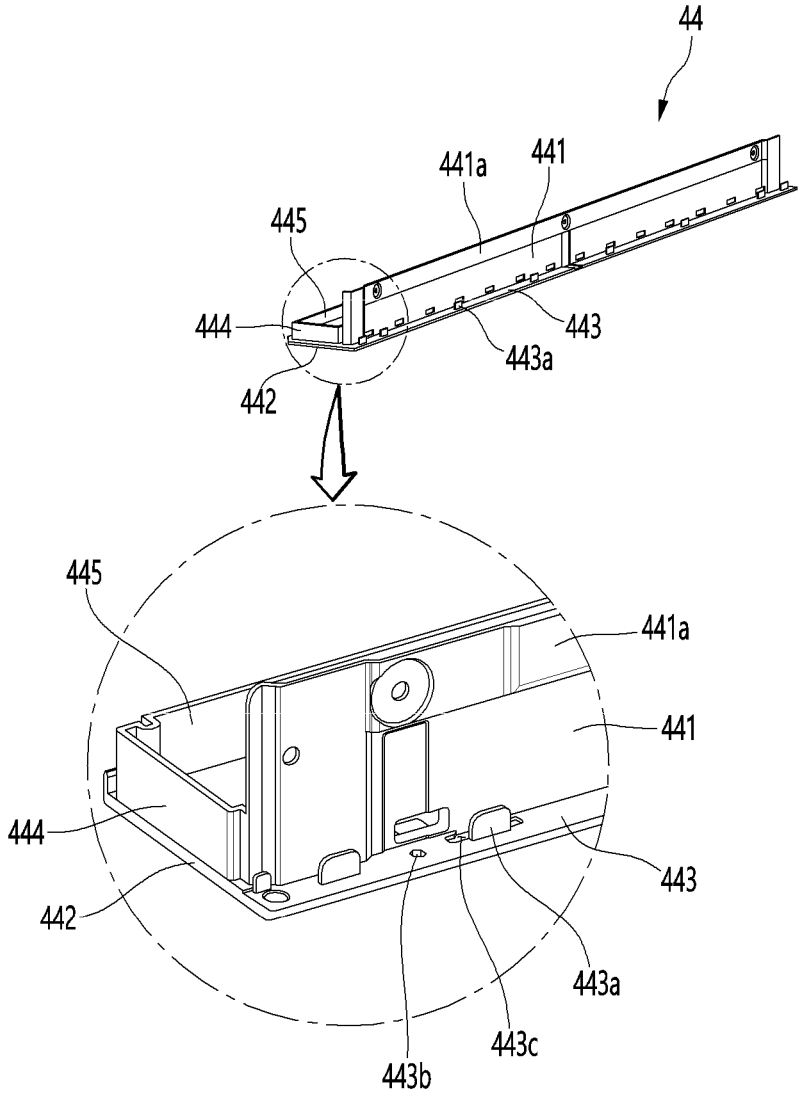
FIG. 13 is a perspective view of a lower cap decor that is one component of the door body.
Figure 14:
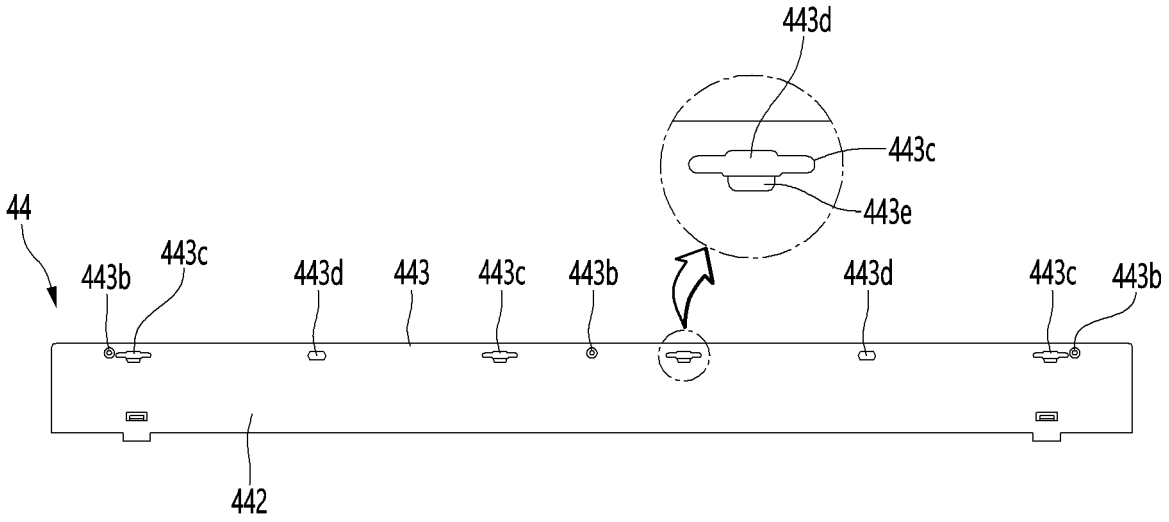
FIG. 14 is a bottom view of the lower cap decor.

FIG. 13 is a perspective view of the lower cap decor that is one component of the door body. Also, FIG. 14 is a bottom view of the lower cap decor.

The lower cap decor 44 may be made of a plastic material may define a lower portion of the door body 40 and also define a bottom surface of the door body 40. The lower cap decor 44 may include a front surface 441, a bottom surface 442, both left and right side surfaces 444, and a rear surface 445 as a whole. Also, the top surface of the lower cap decor 44 may be opened, and the heat insulator 400 may be filled in the opened inner side.

The front surface 441 may support the lower end of the front plate 41 at the rear side. Also, both the side surfaces 444 may support the lower end of the side frame 45 at the inside. Also, the rear surface 445 may support the lower end of the door liner 47 from the front.

A lower plate coupling portion 441*a* supporting the front plate 41 at the rear side may be disposed on the front surface 441 of the lower cap decor 44. The lower plate coupling portion 441*a* may extend from a left end to a right end of the front surface, and a plurality of screws passing through the front plate 41 may be coupled.

A lower support end 443 extending forward may be disposed on a lower end of the front surface 441 of the lower cap decor 44. The lower support end 443 may protrude forward from the lower end of the front surface 441 of the lower cap decor 44 and may support the lower end of the panel assembly 50.

A lower rib 443*a* protruding upward may be disposed on a lower end of the lower support end 443. The lower rib 443*a* may be inserted into the panel bracket 53 to restrict the lower end of the panel assembly 50.

A plurality of lower ribs 443*a* may be disposed at a regular interval along the lower support end 443. Also, the lower ribs 443*a* may be spaced apart from the front surface of the lower cap decor 44. An opening 443*d* may be defined in the lower support end 443 between the lower rib 443*a* and the front surface 442. When the lower cap decor 44 is injection-molded, the lower rib 443*a* may be molded by the opening 443*d*.

Also, a plurality of lower insertion holes 443*c* may be defined in the lower support end 443. The restriction member 49 may be inserted into the plurality of lower insertion holes 443*c*, which are defined along the bottom surface of the lower cap decor 44, that is, along the lower support end 443.

The lower insertion hole 443*c* may be defined together with the opening 443*d*. The number of lower insertion holes 443*c* may be less than that of openings 443*d*, and thus, only a portion of the entire opening 443*d* may be defined together with the lower insertion hole 443*c*. Also, the restriction member 49 inserted into the lower insertion hole 443*c* may be in contact with the lower restriction rib 443*a*. The restriction member 49 may be supported by the lower restriction rib 443*a* to restrict the lower end of the panel assembly 50.

The lower insertion hole 443*c* may have a size greater than that of the opening 443*d* and may be shielded by the cap 491 of the restriction member 49. Also, although not shown in detail, an inner surface of the lower insertion hole 443*c* may be provided to be stepped so that the cap 491 is seated. In the state in which the restriction member 49 is inserted into the lower insertion hole 443*c*, the cap 491 may define the same plane as the bottom surface of the lower cap decor 44.

Also, a groove 43*e* that is further recessed outward may be further defined in an outer surface of the lower insertion hole 443*c*. The groove 433*e* may be configured to allow the restriction member 49 to be easily removed when the restriction member 49 is mounted in the lower insertion hole 443*c*, and a side end of the cap 491 may be exposed through the groove 443*e*.

Also, a plurality of lower coupling holes 443*b* may be defined in the lower support end 443. The lower coupling hole 443*b* may be defined so that a screw 535*b* coupled by passing through the lower support end 443 at the lower side passes therethrough. The screw 535*b* may be coupled to the panel bracket 52 through the lower coupling hole 443*b*, and a lower end of the panel assembly 50, which is seated on the lower support end 443, may be securely fixed.

Hereinafter, the accommodation member 46 and the panel fixing member 55, which are configured to mount the panel assembly 50, will be described in more detail with reference to the drawings.

Figure 15:
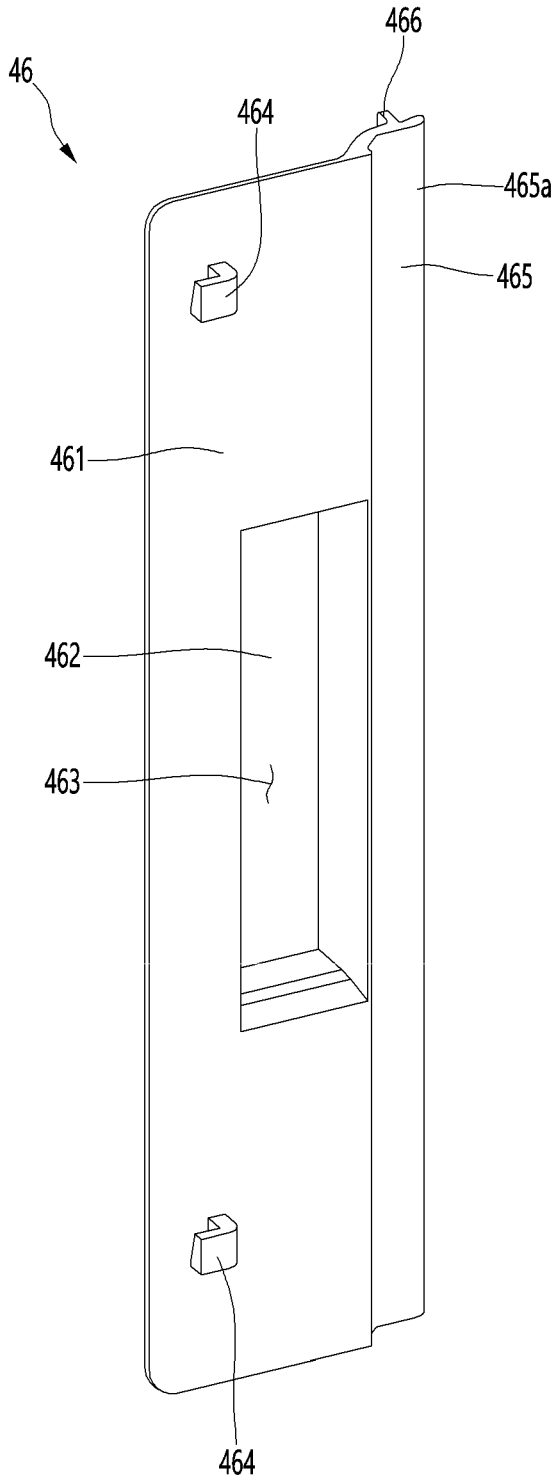
FIG. 15 is a front perspective view of an accommodation member that is one component of the door body.
Figure 16:
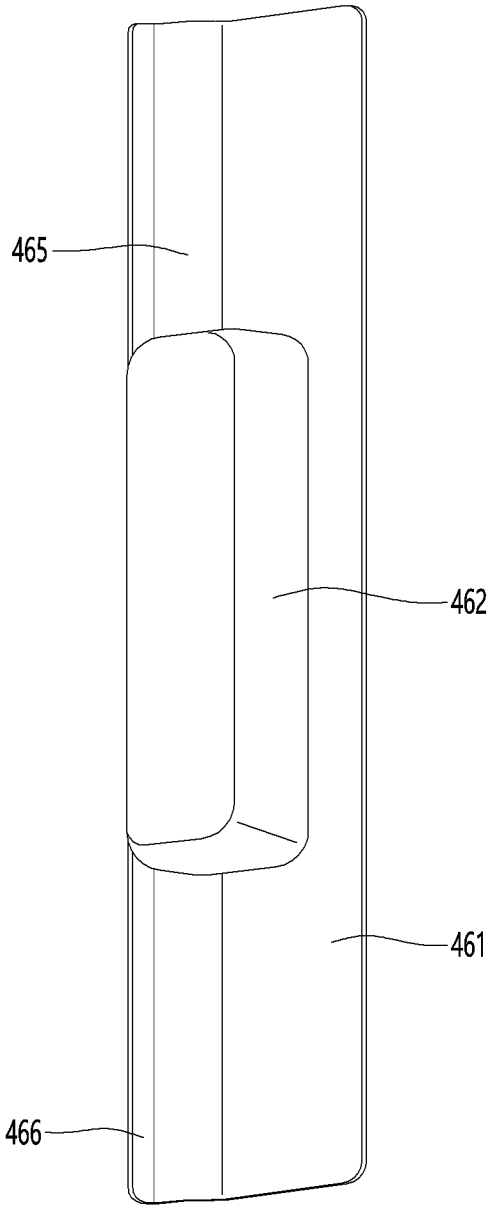
FIG. 16 is a rear perspective view of the accommodation member.

FIG. 15 is a front perspective view of the accommodation member that is one component of the door body. Also, FIG. 16 is a rear perspective view of the accommodation member.

As illustrated in the drawings, the accommodation member 46 may include an accommodation member mounting surface 461 and an accommodation portion 462 recessed from the accommodation member mounting surface 461. Also, the accommodation member 46 may provide a space 463 in which the panel fixing member 55 is inserted and hooked to be restricted.

The accommodation portion 462 may define a protrusion accommodation space 463 that is opened forward. Also, mounting protrusions 464 may be disposed above and below the accommodation portion 462, respectively. Each of the mounting protrusions 464 may be disposed at a position corresponding to the mounting hole 454 so as to pass through the mounting hole 454. Also, a protruding end of the mounting protrusion 464 may be bent laterally so as to be hooked to be restricted in the state of passing through the mounting hole 454.

An accommodation member fixing portion 465 extending laterally may be disposed on one end of the accommodation member mounting surface 461. The accommodation member fixing portion 465 may be provided to be stepped or rounded backward from one end of the accommodation member mounting surface 461, and the accommodation member 46 may be in close contact with the side frame 45.

Also, an extending end 465*a* of the accommodation member fixing portion 465 may be inserted into the insertion groove 457*a* between the side rib 457 and the side groove 455. That is, one end 465*a* of the accommodation member 46 may be inserted into and fixed to the insertion groove 457*a* of the side frame 45. Also, a fixing end 466 extending backward may be further disposed on the accommodation member fixing portion 465. The fixing end 466 may be in contact with an end of the side rib 457 in the state in which the accommodation member fixing portion 465 is inserted into the insertion groove 457*a*. Thus, the side rib 457 may support the fixing end 466 and fix the accommodation member 46 so as not to move or be separated in the state of being mounted on the side frame 45.

Hereinafter, a coupling relationship between the accommodation member 46, the side frame 45, and the front plate 41 will be described in more detail with reference to the drawings.

Figure 17:
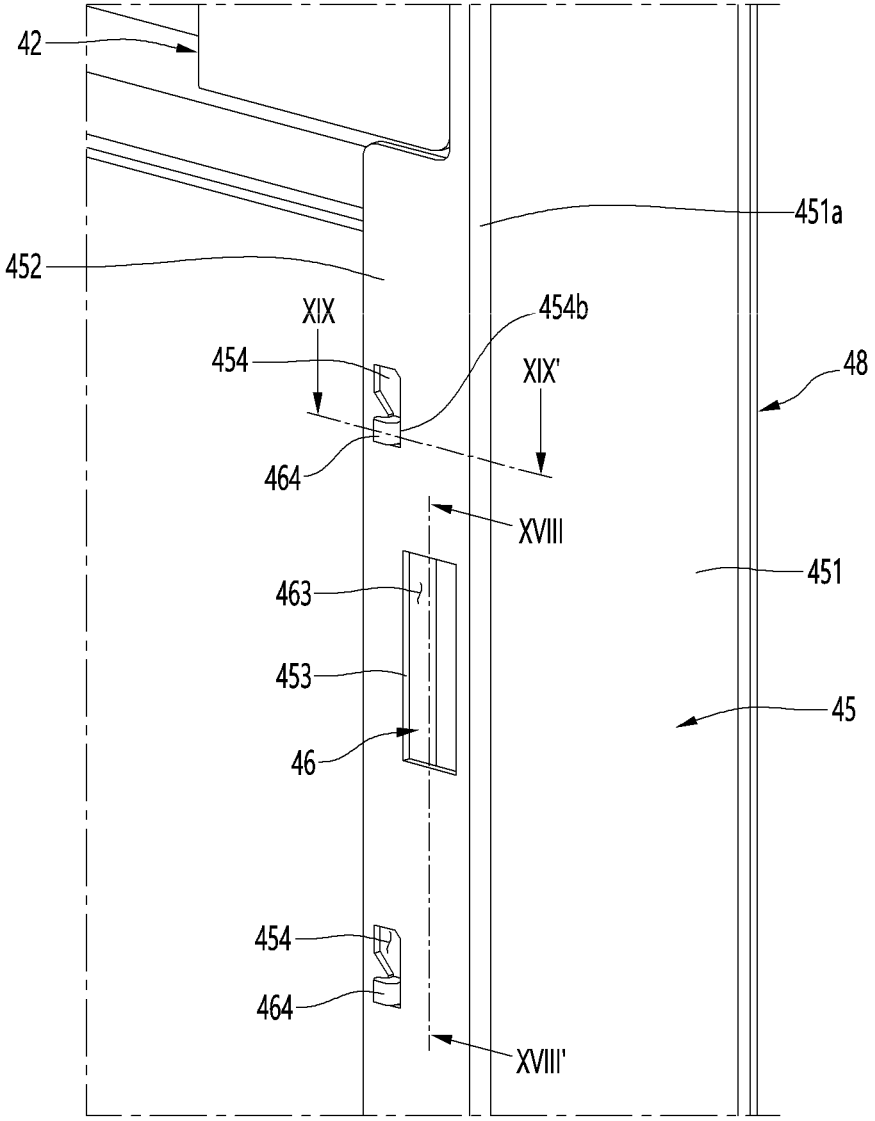
FIG. 17 is a partial perspective view illustrating a state in which the accommodation member is mounted on a side frame.
Figure 18:
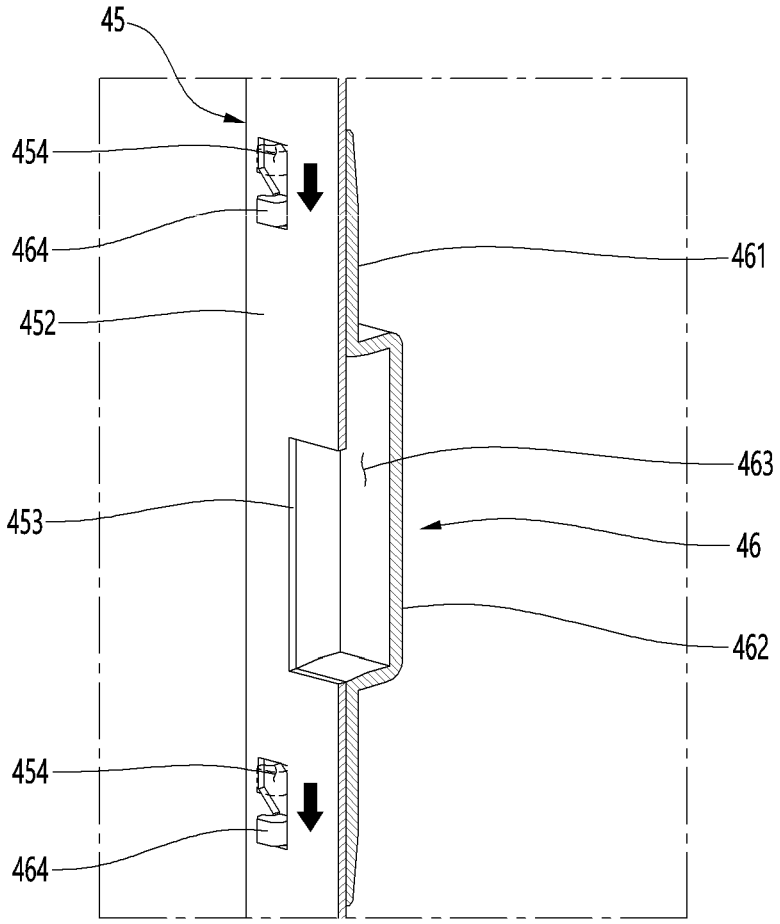
FIG. 18 is a cutaway perspective view taken along line XVIII-XVIII' of FIG. 17.
Figure 19:
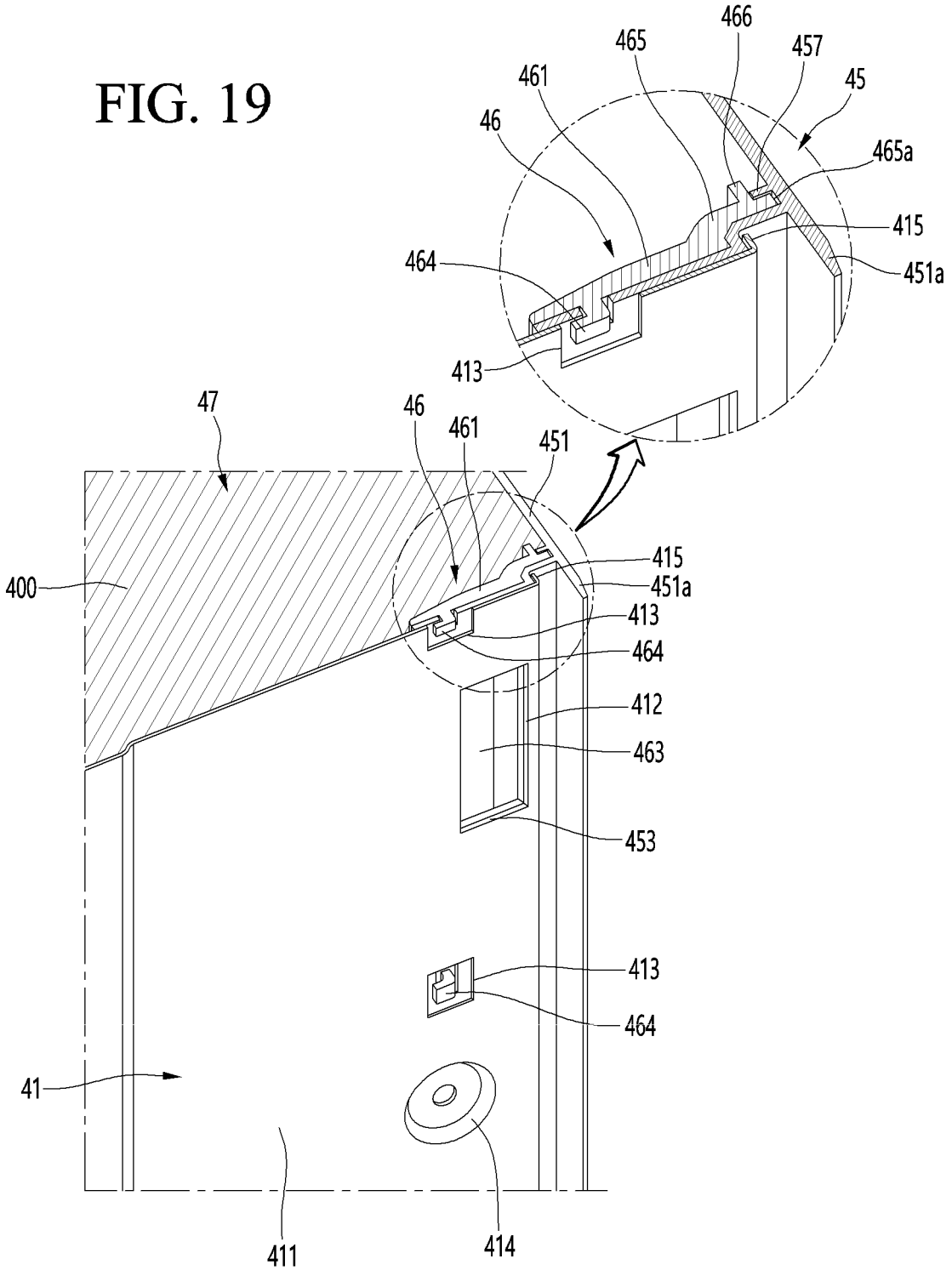
FIG. 19 is a cutaway perspective view illustrating a state, in which a front plate is mounted, taken along line XIX-XVIX' in FIG. 17.

FIG. 17 is a partial perspective view illustrating a state in which the accommodation member is mounted on the side frame. Also, FIG. 18 is a cutaway perspective view taken along line XVIII-XVIII' of FIG. 17. Also, FIG. 19 is a cutaway perspective view illustrating a state, in which the front plate is mounted, taken along line XIX-XVIX' in FIG. 17.

As illustrated in the drawings, the accommodation member 46 may be coupled inside the side frame 45, that is, at the rear side of the front frame 452. To mount the accommodation member 46, first, the accommodation member fixing portion 465 may be inserted into the insertion groove 457*a*, so that one end of the accommodation member 46 is fixed to a rear side of the frame front surface 452.

In this state, a pair of mounting protrusions 464 disposed vertically may inserted into the mounting holes 454, respectively. Here, each of the mounting protrusions 464 may be restricted by allowing the accommodation member 46 to move downward in the state of being inserted into the mounting hole 454.

Also, when the mounting protrusion 464 may be mounted at a fixed position so that the mounting protrusion 464 is hooked to be restricted inside the mounting hole 454, and the opened front surface of the accommodation portion 462 may communicate with the frame opening 453. Here, the opened front surface of the accommodation portion 462 may have a size greater than that of the frame opening 453, and thus, the frame opening 453 may be disposed in an inner region of the opened front surface of the accommodation portion 462.

The front plate 41 may be supported by the frame front surface 452 of the side frame 45 at both side surfaces. Also, a screw passing through the screw hole 414 of the front plate 41 may be coupled to be firmly fixed to the side frame 45.

The front plate 41 may define the outer appearance of the front surface of the door body 40 in the mounted state. Thus, the front plate 41 may shield the front surface 452 of the frame.

The accommodation member 46 may be mounted on the side frame 45, and in a state in which the front plate 41, the door liner 47, the upper cap decor 42, and the lower cap decor 44 are coupled to each other, a foaming solution may be filled in the door body to mold the insulator 400.

When the assembly of the door body 40 is completed, the panel assembly 50 may be mounted on the front surface of the door body 40.

Figure 20:
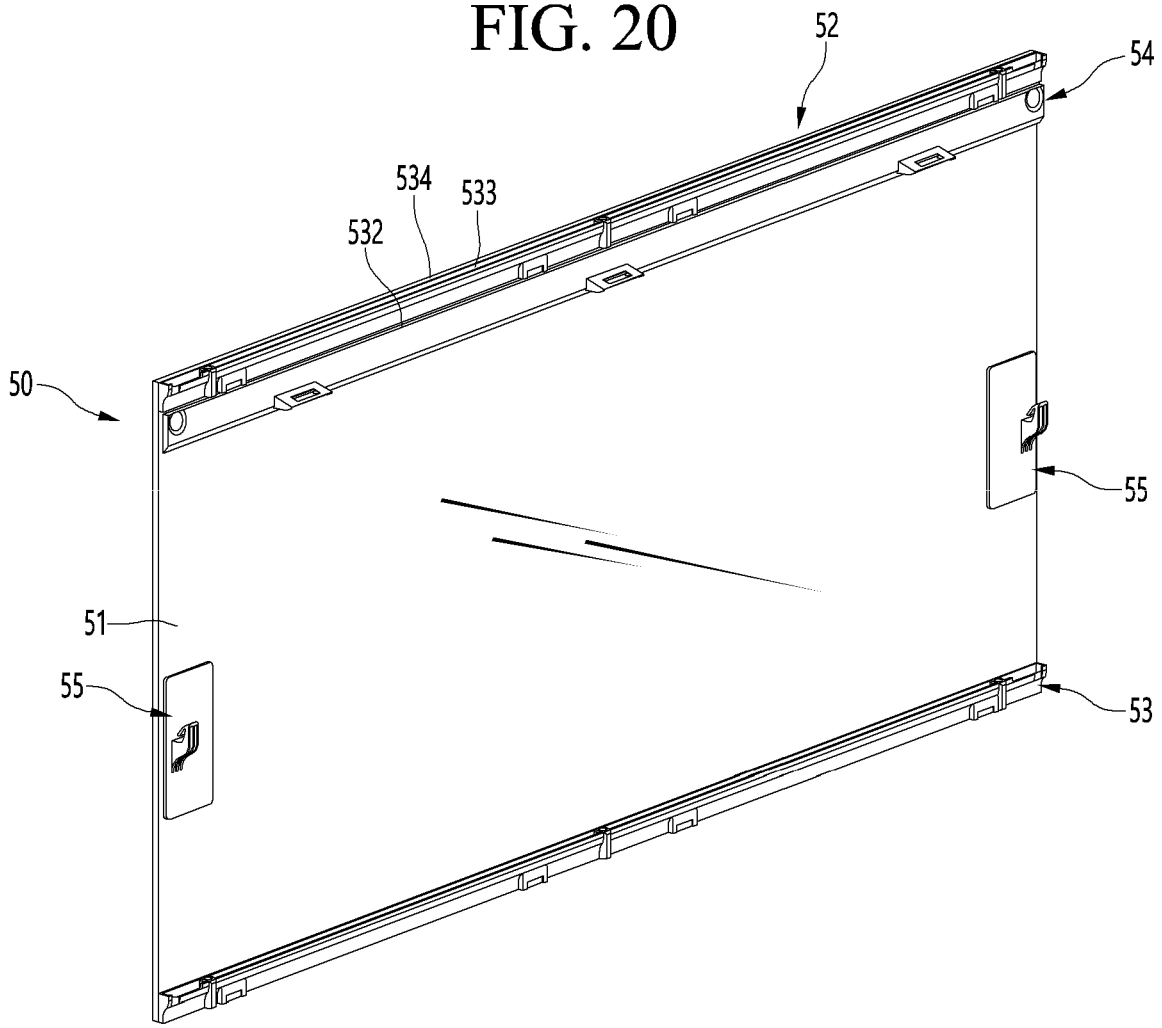
FIG. 20 is a rear perspective view of a panel assembly according to an embodiment.
Figure 21:
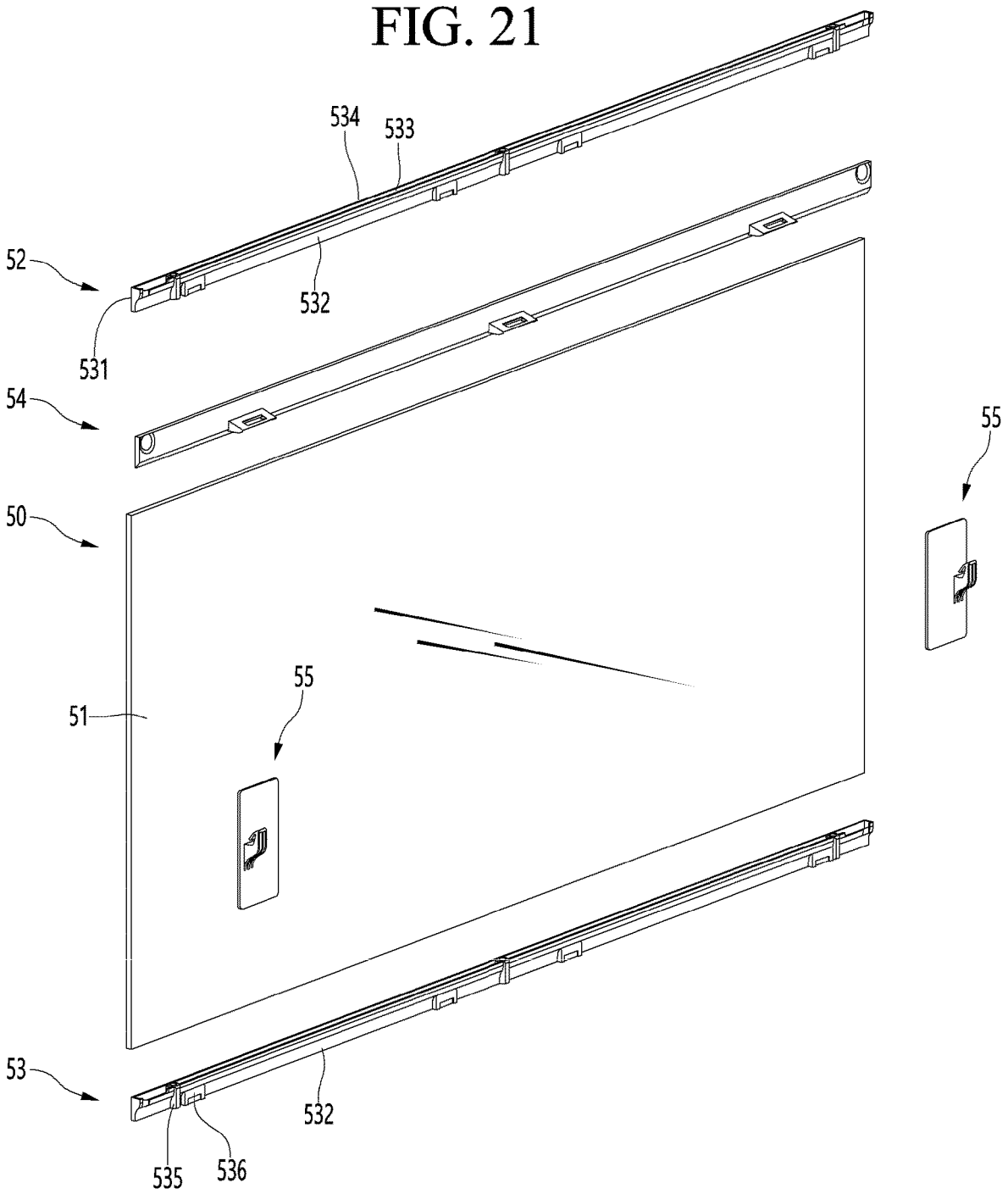
FIG. 21 is an exploded perspective view of the panel assembly.

FIG. 20 is a rear perspective view of the panel assembly according to an embodiment. Also, FIG. 21 is an exploded perspective view of the panel assembly.

As illustrated in the drawings, the panel assembly 50 may include a panel 51 defining an outer appearance, panel brackets 52 and 53 provided on an upper end and/or a lower end of a rear surface of the panel 51 to mount the panel assembly 50, and a fixing bracket 54 provided on an upper portion of the rear surface of the panel 51 to further fix the panel assembly 50. Also, the panel assembly 50 may include a panel fixing member 55 provided at both left and right sides of the rear surface of the panel 51 to fix and mount both ends of the panel assembly 50 on the body.

In detail, the panel 51 may be made of a rectangular plate-shaped material having a predetermined thickness and may be made of a material that is capable of being harmonized with the furniture or wall O or the home appliance disposed therearound. For example, the panel 51 may be made of a glass material. For example, the panel 51 may be made of a tempered glass material, and the outer appearance of the door 30 may be defined by printing or attaching a film so as to have a color or pattern.

The panel 51 may have a size so that, in the state in which the panel 51 is mounted on the door body 40, upper end lower ends of the panel 51 are supported by an upper support end 424 and a lower support end 443, respectively, and both side ends of the panel 51 are supported by side support ends 451*a*, respectively.

In addition, panel brackets 52 and 53 having the same structure and shape may be provided on the upper and lower ends of the rear surface of the panel 51. The panel brackets 52 and 53 may be configured so that the upper and lower ends of the panel assembly 50 are fixedly mounted to the door body 40.

The panel brackets 53 and 54 may extend along the upper and lower ends of the panel 51, and each of the panel brackets 53 and 54 may have a length corresponding to a horizontal width of the panel 51. Also, the panel brackets 52 and 53 may be fixed to the upper cap decor 42 and/or the lower cap decor 44 when the panel assembly 50 is mounted. The panel brackets 52 and 53 may include an upper panel bracket 52 provided on an upper end of the panel 51 and a lower panel bracket 53 provided on a lower end of the panel 51.

The panel brackets 52 and 53 may be mounted on the upper and/or lower ends of the panel 51 by rotating in direction according to the mounting method of the panel assembly 50. For example, in a mounting structure in which the upper end of the panel assembly 50 is first fixed to the upper cap decor 42, the panel bracket 52 may be provided on the upper end of the panel 51, and also, the panel bracket 52 may be disposed so that the insertion portion 534 of the panel bracket 52 faces an upper side. For another example, in the mounting structure in which the lower end of the panel assembly 50 is first fixed to the lower cap decor 44, the panel assembly 50 may be provided on the lower end of the panel bracket 53 and then rotate to be mounted in a state in which the panel bracket 53 rotates in an opposite direction so that the bracket insertion hole 534 of the panel bracket 53 faces a lower side. That is, the panel brackets 52 having the same structure may rotate in a desired direction to the upper and/or lower ends of the panel 51 and then be mounted to be used.

Also, the fixing bracket 54 may be configured to more firmly fix the panel assembly 50 to the door body 40 and may be disposed along the lower end of the panel bracket 52 disposed on the upper end of the panel 51. The fixing bracket 54 may also extend from left end to the right ends of the panel 51 and may have a predetermined width. Also, the insertion protrusion 542 of the fixing bracket 54 may be inserted by passing through the front surface of the upper cap decor 42 so that the panel assembly 50 is more firmly fixed to the door body 40.

Also, a plurality of panel fixing members 55 may be continuously disposed in the vertical direction along the left and right side ends of the rear surface of the panel 51. For example, three panel fixing members 55 may be provided on each of the left and right side surfaces of the panel 51 and may be provided on a central portion of the panel in the vertical direction and vertical portions spaced apart from the central portion, respectively, and also, left and right ends of the panel assembly 50 may be fixed to the door body 40. Of course, the number of panel fixing members 55 may be adjustable according to the total length of the panel assembly 50.

Hereinafter, the panel bracket 53 of the panel assembly 50 will be described in more detail with reference to the drawings. Hereinafter, description will be made based on a structure in which the upper end of the panel assembly is fixed first, and then the lower end of the panel assembly is in close contact with the door body and then fixed by the restriction member.

Figure 22:
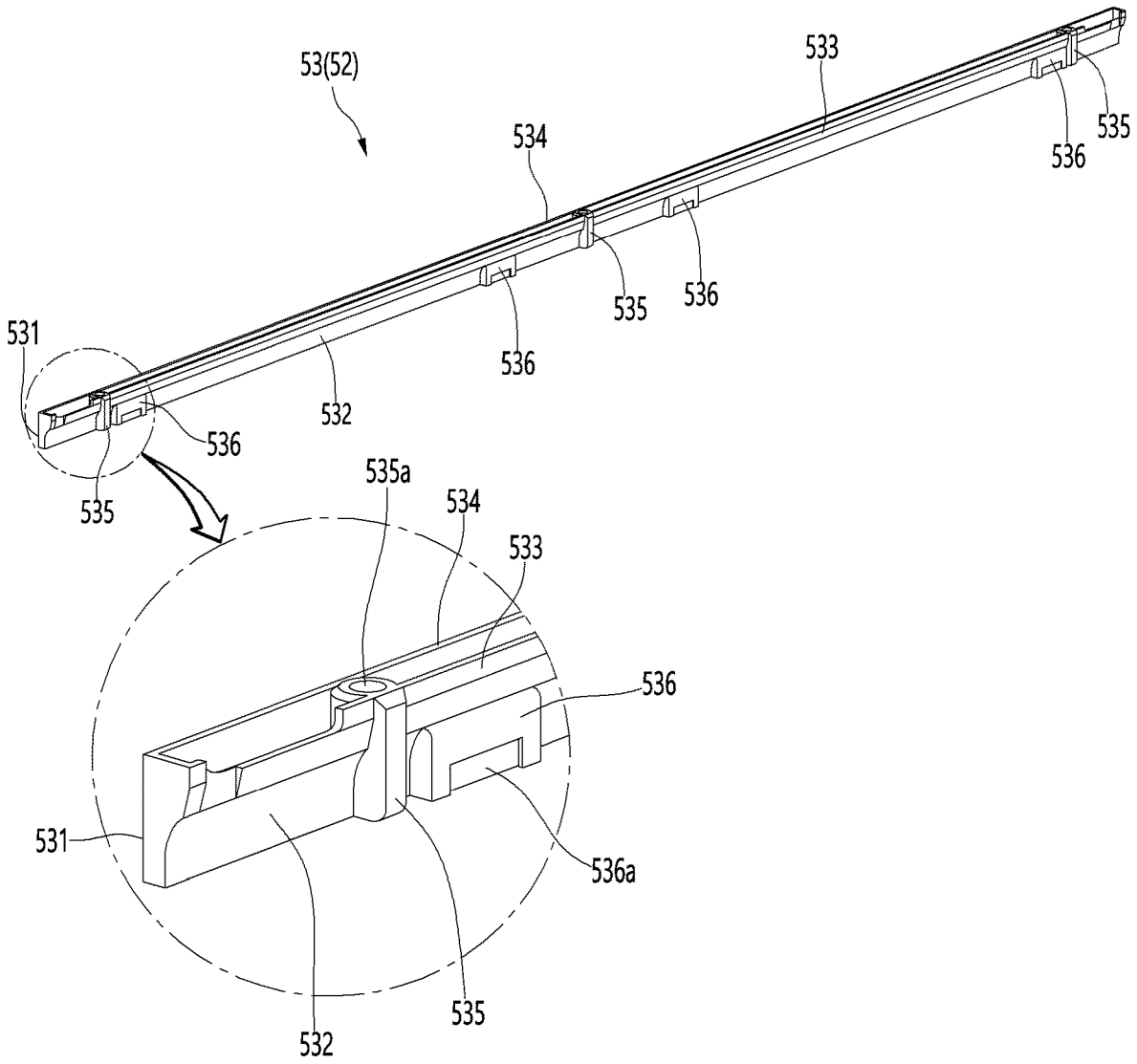
FIG. 22 is a perspective view of a panel bracket that is one component of the panel assembly.
Figure 23:
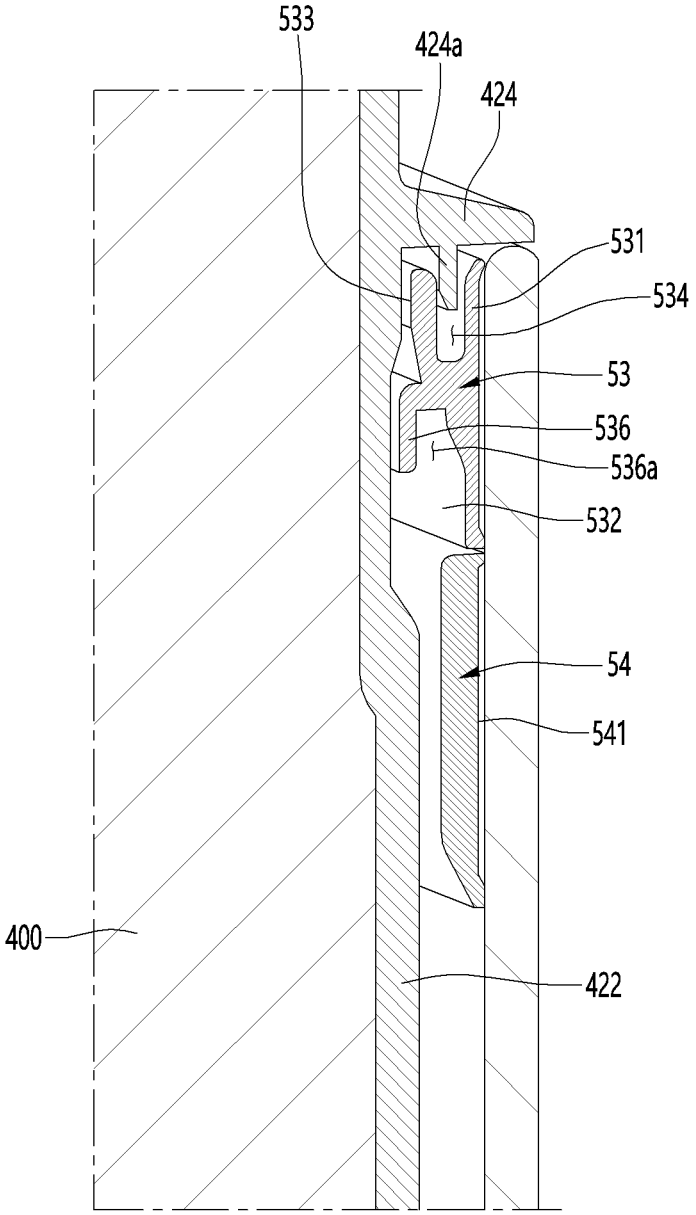
FIG. 23 is a cutaway perspective view taken along line XXIII-XXIII' of FIG. 3.

FIG. 22 is a perspective view of the panel bracket that is one component of the panel assembly. Also, FIG. 23 is a cutaway perspective view taken along line XXIII-XXIII' of FIG. 3.

As illustrated in the drawings, the panel bracket 53 may be injection-molded by using a plastic material and may be provided on the lower end of the panel 51. Also, the panel bracket 53 may extend to a length corresponding to the horizontal width of the panel 51.

The panel bracket 53 may be provided with a panel bracket adhesion portion 531 mounted on the rear surface of the panel 51. The panel bracket adhesion portion 531 may be provided in a flat shape and may be attached to the rear surface of the panel 51 by an adhesive. The panel bracket 53 may be disposed at a position at which a lower end thereof corresponds to the upper end of the panel 51 in a state in which the panel bracket adhesion portion 531 is attached to the rear surface of the panel 51.

Also, a bracket protrusion 533 protruding backward from the panel bracket adhesion portion 531 may be disposed at a rear side of the panel bracket adhesion portion 531. The bracket protrusion 533 may extend from one side of the panel bracket adhesion portion 531 to a position corresponding to the upper end of the panel bracket adhesion portion 531.

An insertion portion 534 having an opened top surface may be disposed on a top surface of the bracket protrusion 533. That is, the insertion portion 534 may be provided in a shape that is recessed downward from the top surface of the panel bracket 52 so that the upper restriction rib 424*a* of the upper cap decor 42 is inserted. The insertion portion 534 may be disposed over the entire bottom surface of the panel bracket 52.

When the upper end of the panel assembly 50 is mounted at a fixed position of the door body 40, the upper restriction rib 424*a* may be inserted into the insertion portion 534, and the upper end of the panel assembly 50 may be fixed first. The state in which the upper restriction rib 424*a* is inserted into the insertion portion 534 may be referred to as a temporarily fixed state or a temporary fixed state before the lower end of the panel assembly is completely fixed.

A bracket coupling boss 535 may be disposed on the panel bracket adhesion portion 531. The bracket coupling boss 535 may protrude from a rear surface of the panel bracket adhesion portion 531 to extend from each of the upper and lower ends of the panel bracket 52.

Also, a screw hole 535*a* may be defined in a top surface of the bracket coupling boss 535. The bracket coupling boss 535 may extend to an upper end of the panel bracket 53 through the bracket protrusion 533. Thus, the screw hole 535*a* defined in the top surface of the bracket coupling boss 535 may be disposed at a position corresponding to the position of the opened top surface of the insertion portion 534.

The screw hole 535*a* may be defined at a position corresponding to the screw hole 443*b* defined in the lower cap decor 44. Therefore, when the panel bracket 53 is mounted on the lower end of the panel 51, the bracket coupling boss 535 may be disposed at a position corresponding to the screw hole 443*b* of the lower cap decor 44 and may be provided as many as the corresponding number. For example, three bracket coupling bosses 535 may be provided on a center and both left and right sides of the panel bracket 53, respectively.

When the panel assembly 50 is mounted on the door body 40 so that the restriction rib 445*a* is inserted into the insertion portion 534, the screw hole 443*b* of the lower cap decor 44 and the screw hole 535*a* of the panel bracket 53 may be aligned with each other. In this state, when the screw 535*b* is coupled to pass through the screw hole 443*b* of the lower cap decor 44, the screw 535*b* may be coupled to the screw hole 535*a* of the panel bracket 53 so that the lower end of the panel assembly 50 is firmly fixed to the panel bracket 53.

A bracket recess 532 may be defined under the rear surface of the panel bracket 53. The bracket recess 532 may be provided to be inclined or rounded and may be defined so that a thickness of the panel bracket 53 gradually decreases as it goes upward. The lower recess may extend from the upper end of the bracket protrusion 533 to the upper end of the lower bracket 53.

Here, the bracket recess 532 may have a thickness so that, when the bracket insertion portion 534 of the panel bracket 52 faces an upper side, and the bracket recess portion 532 faces a lower side, the lower restriction rib 443*a* protruding from the lower support end 443 is not hooked to be restricted by the lower restriction rib 443*a*. That is, in the state in which the panel assembly 50 is mounted on the door body 40, the bracket recess 532 may be defined in front of the lower restriction rib 443*a*.

Also, a restriction member accommodation portion 536 in which the restriction member 49 is accommodated may be provided at one side of the bracket recess 532. The restriction member accommodation portion 536 may protrude from the bracket recess 532 to extend to a lower end of the panel bracket 53. Also, the restriction member accommodation portion 536 may be opened downward, and when the restriction member 49 is mounted on the lower cap decor 44, a portion of the restriction member 49 may be accommodated to restrict movement of the panel assembly 50 and maintain the state in which the lower end of the panel assembly 50 is mounted.

A plurality of restriction member accommodating portions 536 may be disposed along the panel bracket 53. For example, two lower restriction members 49 may be disposed at both sides with respect to a center of the panel bracket 53.

Also, a rib groove 536*a* may be defined in a lower end of the rear surface of the lower restriction member 49. When the panel assembly 50 is mounted, the rib groove 536*a* may have a corresponding size so that the lower restriction rib 443*a* passes while the lower end of the panel assembly move backward from the front side.

Therefore, when the panel assembly 50 is mounted, the lower end of the panel assembly 50 may move backward to restrict the lower end of the panel assembly 50 so that the lower restriction rib 443*a* is disposed inside the restriction member accommodation portion 536, and then, the restriction member 49 may be mounted to restrict the lower end of the panel assembly 50. The fixing structure of the lower end of the panel assembly 50 using the restriction member 49 will be described in more detail below.

The fixing bracket 54 may be further provided on the lower end of the panel bracket 52 provided on the upper end of the panel 51, and the panel assembly 50 may be further fixed to the upper cap decor 42 by the fixing bracket 54.

Hereinafter, the structure of the fixing bracket 54 will be described in more detail with reference to the drawings.

Figure 24:
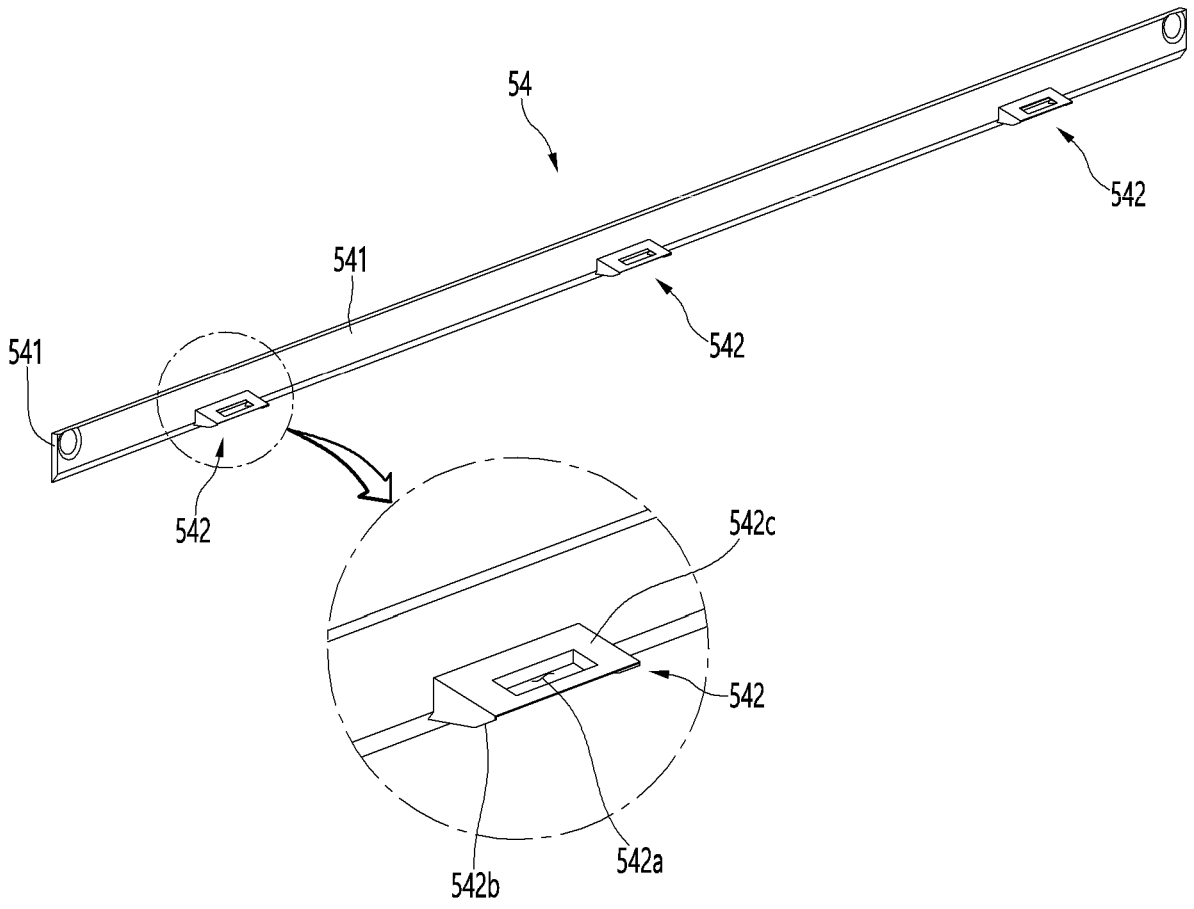
FIG. 24 is a perspective view of a fixing bracket that is one component of the panel assembly.

FIG. 24 is a perspective view of the fixing bracket that is one component of the panel assembly.

As illustrated in the drawing, the fixing bracket 54 may be provided in a plate shape and may include a bracket body 541 attached to the rear surface of the panel 51 and an insertion protrusion 542 protruding backward from the bracket body 541.

The bracket body 541 may be provided to correspond to the horizontal length of the panel 51 and may have a vertical width in which the insertion protrusion 542 is disposed. In addition, the bracket body 541 may have a thickness thinner than that of the panel bracket 52. The bracket body 541 may be attached to the rear surface of the panel 51 by the adhesive and may have a separate coupling structure, as necessary.

The insertion protrusion 542 may protrude backward from the rear surface of the panel 51 and may be inserted by passing through the front surface of the upper cap decor 42. Also, the insertion protrusion 542 may be inserted into the protrusion insertion opening 426 of the upper cap decor 42 so as to be hooked to be restricted by the pair of second restriction portions 427*b*.

In detail, the insertion protrusion 542 may be provided in plurality along the bracket body 541 and may protrude backward from a position corresponding to the protrusion insertion hole 426. Particularly, the insertion protrusion 542 may be connected to a portion corresponding to the handle groove 425 of the upper cap decor 42, and thus, additional restriction force may be applied to the upper end of the panel assembly 50, which corresponds to the handle groove 425 to which a lot of force is applied when the door 30 is pulled in or out.

The insertion protrusion 542 may have a top surface 542*c* having a flat shape perpendicular to the rear surface of the bracket body 541 and may extend to be inserted into the protrusion insertion hole 426. Also, a through-hole 542*a* through which a portion of the restriction member 49 passes in the vertical direction may be defined in the top surface of the insertion protrusion 542. The through-hole 542*a* may have a size into which the restriction member 49 is inserted.

Both the side surfaces of the insertion protrusion 542 may be provided to gradually decrease in thickness as each of the side surfaces protrudes backward from the front side. Thus, when the insertion protrusion 542 is inserted into the protrusion insertion hole 426, the insertion protrusion 542 may be guided by both the side surfaces of the inclined insertion protrusion 542.

A hook 542*b* may be further disposed on each of both the side surfaces of the insertion protrusion 542. The hook 542*b* may protrude downward and may be hooked to be restricted by the second restriction portion 427*b* inside the protrusion insertion hole 426.

That is, when the panel assembly 50 is mounted, the insertion protrusion 542 may be inserted into the protrusion insertion hole 426 of the upper cap decor 42. Also, when the panel assembly 50 is completely inserted, the hook 542*b* is restricted by the second restriction member 427*b* so that the fixing bracket 54 has the additional restricting force with the upper cap decor 42.

Of course, when the restriction force at the top of the panel 51 is secured only by the panel bracket 52 provided on the top of the panel 51, the fixing bracket 54 may be omitted.

The panel fixing members 55 are provided on both sides of the panel assembly 50 to provide an additional coupling structure between the panel assembly 50 and the door body 40. Hereinafter, the panel fixing member 55 will be described in more detail with reference to the drawings.

Figure 25:
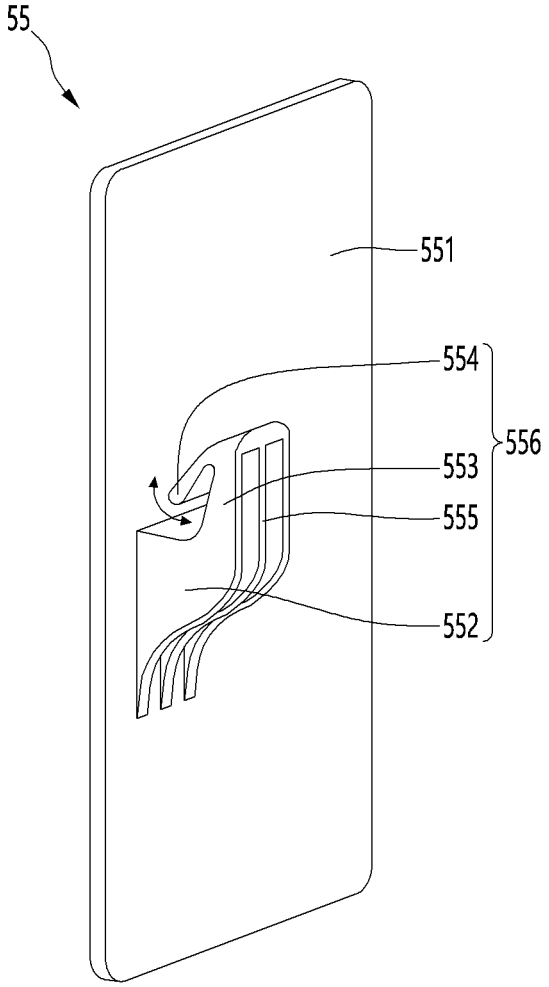
FIG. 25 is a rear perspective view of a panel fixing member that is one component of the panel assembly.
Figure 26:
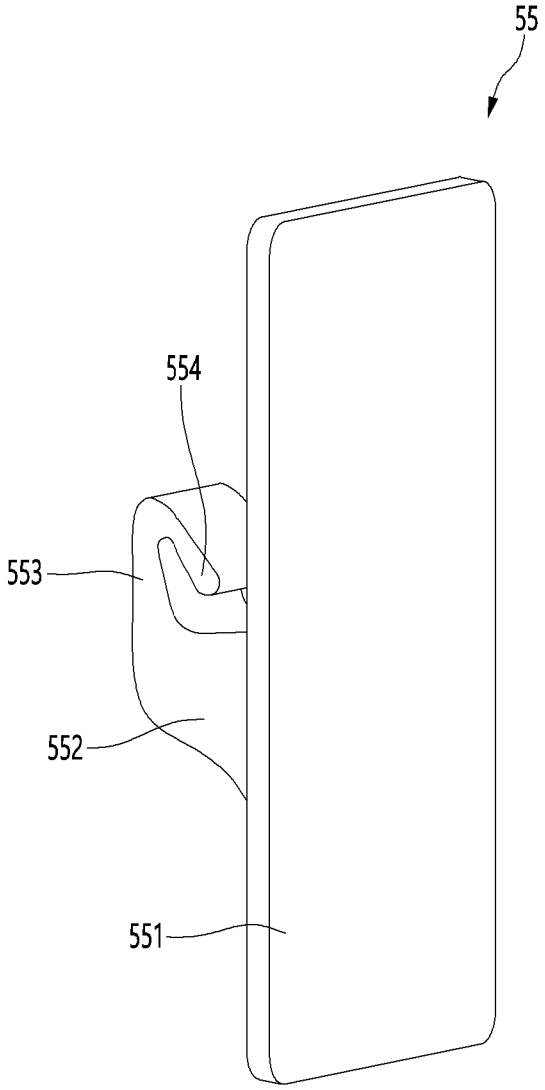
FIG. 26 is a front perspective view of the panel fixing member.
Figure 27:
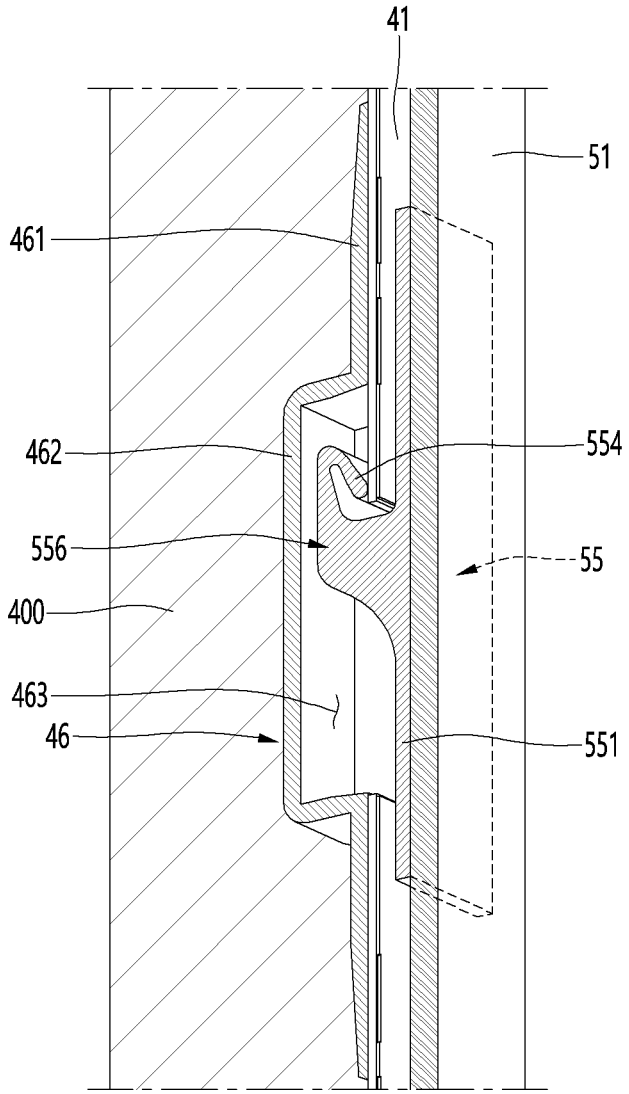
FIG. 27 is a cutaway perspective view taken along line XXVII-XXVII' of FIG. 3.

FIG. 25 is a rear perspective view of the panel fixing member that is one component of the panel assembly. FIG. 26 is a front perspective view of the panel fixing member. FIG. 27 is a cutaway perspective view taken along line XXVII-XXVII' of FIG. 3.

As illustrated in the drawings, the panel fixing member 55 may be made of a plastic material and may include a fixing member adhesion portion 551 mounted on the rear surface of the panel 51 and a hook 556 having an insertion protrusion shape that protruding from the fixing member adhesion portion 551.

In detail, the fixing member adhesion portion 551 may be provided in a rectangular plate shape and may have a predetermined size to be mounted on the rear surface of the panel 51. An adhesive may be disposed on a front surface of the fixing member adhesion portion 551 to adhere to both side ends of the panel 51. Also, the fixing member adhesion portion 551 may be mounted at a position facing the accommodation member 46.

The hook 556 may protrude from a rear surface of the fixing member adhesion portion 551. The hook 556 may be provided in a shape such as an insertion protrusion and may protrude from a center of a vertical length of the fixing member adhesion portion 551. Also, the hook 556 may protrude from one end of the left and right sides of the fixing member adhesion portion 551, which is adjacent to an outer end of the door panel 51.

The hook 556 may be provided in a shape such as a ring that is hooked while moving upward from the lower side. In detail, the hook 556 may include a rear extension portion 552 extending backward from the fixing member adhesion portion 551 and an upper extension portion 553 extending upward from a rear end of the rear extension portion 552. Thus, the upper extension portion 553 may be spaced apart from a rear surface of the fixing member adhesion portion 551, and the side frame 45 may be hooked to be restricted between the fixing member adhesion portion 551 and the upper extension portion 553.

In this case, an elastic portion 554 extending downward and forward may be further disposed on an upper end of the upper extension portion 553. The elastic portion 554 may be disposed to provide predetermined tension in a state in which the panel fixing member 55 is hooked to be restricted by the side frame 45.

Also, when the panel assembly 50 is coupled to the door body 40 in the state in which the panel fixing member 55 is mounted, the panel assembly 50 may be pressed toward the front of the body 40 by elastic force of the elastic portion 554, and thus, the panel assembly 50 may be easily maintained in a state of being mounted on the door body 40.

Also, a plurality of reinforcing ribs 555 disposed along an extending direction of the hook 556 may be further disposed on a bottom surface of the upper extension portion 552 and a rear surface of the upper extension portion 553.

Due to the shape of the panel fixing member 55 as described above, the panel assembly 50 may be mounted on the door body 40 in a manner in which the panel assembly 50 moves upward from the lower side. Here, the panel assembly 50 may be mounted while moving in a direction that is close somewhat to the rear side from the front side, i.e., the door body 40 so that the upper restriction rib 424*a* is inserted and mounted in the insertion groove 534 of the panel bracket 52.

When the panel assembly 50 is mounted, the panel fixing member 55 may be inserted into the accommodation member 46. When the panel fixing member 55 is inserted into the accommodation member 46, the elastic portion 554 may press the frame front surface 452. That is, the front surface of the frame 452 may be maintained in the contact state with the elastic portion 554, and the panel assembly 50 may be maintained in the state pressed toward the front surface of the door body 40 by the elastic force applied from the elastic portion 554.

Hereinafter, a structure for restricting the lower end of the panel assembly 50 will be described in more detail with reference to the drawings.

Figure 28:
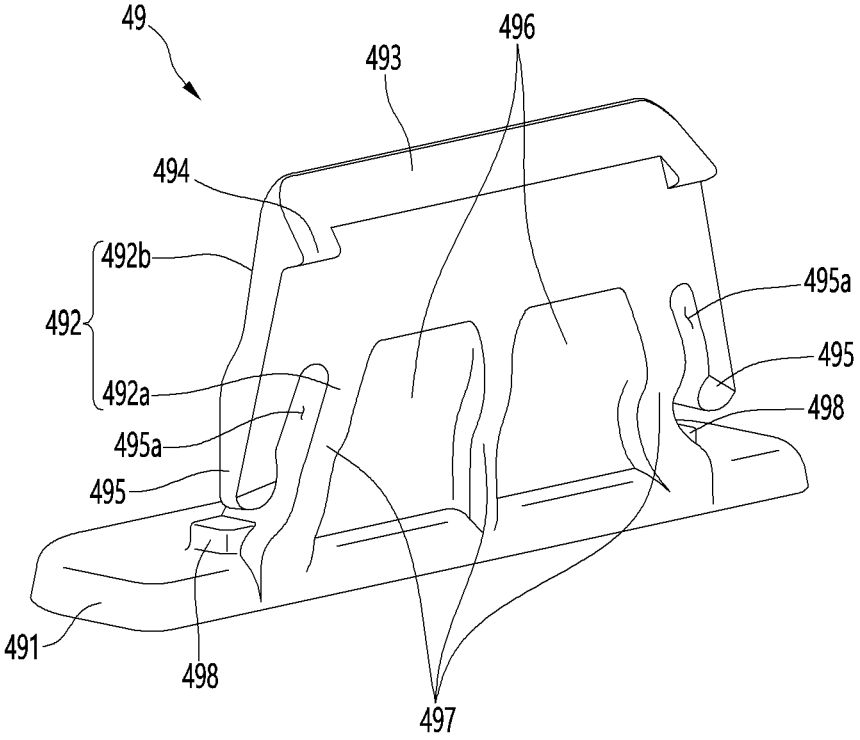
FIG. 28 is a perspective view of the restriction member.

FIG. 28 is a perspective view of the restriction member. As illustrated in the drawing, the restriction member may be configured to fixedly mount the restriction member 49 and may be mounted on the upper cap decor 42 or the lower cap decor 44. Also, the restriction member 49 may have a structure that is capable of being hooked to be restricted by the panel bracket 53 or the fixing bracket 54 in the mounted state.

The restriction member 49 may be injection-molded using a plastic material and may include a cap 491 and a body portion 492 as a whole. The cap 491 may define a surface exposed to the outside when the restriction member 49 is mounted and may be configured to cover the insertion holes 425*b* and 443*c* into which the restriction member 49 is inserted. Also, the body portion 492 may extend in a direction crossing from one end of the cap 491, and the panel bracket 53 and the fixing bracket 54 may be restricted by the body portion 492.

In detail, the cap 491 may have a shape corresponding to the restriction member insertion hole 425*b* and may have a thickness at which an outer surface of the cap 491 does not protrude to the outside in the mounted state. Also, the body portion 492 may extend along one end of the cap 491. Since the body portion 492 has a structure extending along one end of the cap 491, the restriction member 49 may be inserted with a directionality to be prevented from being misassembled.

The body portion 492 may have a width less than that of an end of the cap 491, and a first body portion 492*a* and a second body portion 492*b* may be disposed in an extension direction. An extending length of the body portion 492 may be a length at which the extending end of the body portion 492 is hooked to be restricted by a relative configuration of the panel bracket 53 or the fixing bracket 54 in the state in which the restriction member 49 is inserted.

The first body portion 492*a* may have a thickness less than that of the second body portion 492*b*, and an outer surface may have an inclined or rounded shape to facilitate the insertion of the restriction member 49. Also, the substantial restriction may be performed with the panel bracket 53 or the fixing bracket 54 at an end of the second body portion 492*b*, and an inclined surface 493 may be defined on an end of the second body portion 492*b*. When the restriction member 49 is inserted and mounted by the inclined surface 493, the body portion 492 may be guided to be inserted into an accurate position.

For example, the first body portion 492*a* may be configured to pass through the through-hole 542*a* of the fixing bracket 54, and the second body portion 492*b* may pass through the through-hole 542*a* and the protrusion insertion hole so as to be hooked to be restricted by the first restriction portion 427*a* of the protrusion insertion hole 426.

Also, a cap protrusion 498 protruding outward may be disposed at a corner at which each of both left and right side ends of the first body 492*a* and the bottom surface of the cap 491 are in contact with each other. The cap protrusion 498 may be inserted into a groove defined inside the restriction member insertion hole 425*b* in which the cap 491 is seated so that the restriction member 49 is stably mounted at a more accurate position.

The first body portion 492*a* may be provided so that a width of the first body portion 492*a* gradually decreases in the horizontal direction (left and right direction in FIG. 28) as it extends in the protruding direction (upward direction in FIG. 28). The first body portion 492*a* as well as the body portion 492 may be provided as a whole so that a width of the first body portion 492*a* in the horizontal direction gradually decreases as being extend upward, and thus, the restriction member 49 may be easily inserted and mounted.

The first body portion 492*a* may have an extension groove defined in an outer surface (right side in FIG. 28. The body portion groove 496 may be defined in each of both left and right sides with respect to a center of the first body portion 492*a* and may be disposed over an entire area of the first body portion 492*a* except for both left and right side ends. Also, a portion between each of both sides of the outer surface of the first body portion 492*a* and the body portion groove 496 may relatively protrude to provide a contact surface 497 when the restriction member 49 is mounted.

Due to the formation of the body portion groove 496 through this structure, the contact area of the first body portion 492*a* may be minimized when the restriction member 49 is mounted. Thus, friction on the contact surface 497 when the restriction member 49 is mounted may be minimized to facilitate the insertion of the restriction member 49.

The first body portion 492*a* may be inclined or rounded so that an upper portion thereof is disposed more outward than a lower portion thereof. Also, the second body portion 492*b* may extend in a direction crossing the cap 491 from an upper end of the first body portion 492*a*.

Also, a restriction protrusion 494 protruding outward may be disposed on the extending end of the second body portion 492*b*. The restriction protrusion 494 may protrude from the inclined surface 493 to protrude outward from the inclined end so that the restriction member 49 is hooked to be restricted. A pair of restriction protrusions 498 may protrude from both left and right ends to perform the hooked restriction with the relative object.

A restriction member support portion 495 extending downward may be disposed on each of both left and right side ends of the second body portion 492*b*. The restriction member support portion 495 may be configured to be maintained in the state in which the restriction member 49 is inserted and mounted and may extend downward from each of both left and right side ends of the second extension portion 492*b*.

The restriction member support portion 495 may extend downward to the side of the first extension portion 492*a* to extend to a position adjacent to a bottom surface of the cap 491. Also, when the restriction member 49 is mounted, an end of the restriction member support portion 495 may be supported in contact with an inner surface of the upper cap decor 42 or the lower cap decor 44.

The restriction member support portion 495 may define a space 495*a* that is spaced apart from a side end of the first body portion 492*a* and may be provided to face the outside as it extends downward from the upper side. Therefore, when the restriction member 49 is mounted, the restriction member support portion 495 may be elastically deformed to guide the restriction member 49 to be easily inserted. Also, in a state in which the restriction member is completely inserted into the upper cap deco 42 or the lower cap deco 44, the restriction member support portion 495 may be restored to its original position by the elasticity, and in the state of being restored to its original position, the restriction member support portion 495 may be in a state of supporting an inner surface of the upper cap decor 42 or the lower cap decor 44 to prevent the restriction member 49 from being easily separated.

In this embodiment, the lower end of the panel assembly 50 may have a structure that is fixed by a combination of the restriction member 49 and the panel bracket 53.

Hereinafter, a structure in which the restriction member 49 having the above structure is inserted into the lower cap decor 44 will be described in more detail with reference to the drawings.

Figure 29:
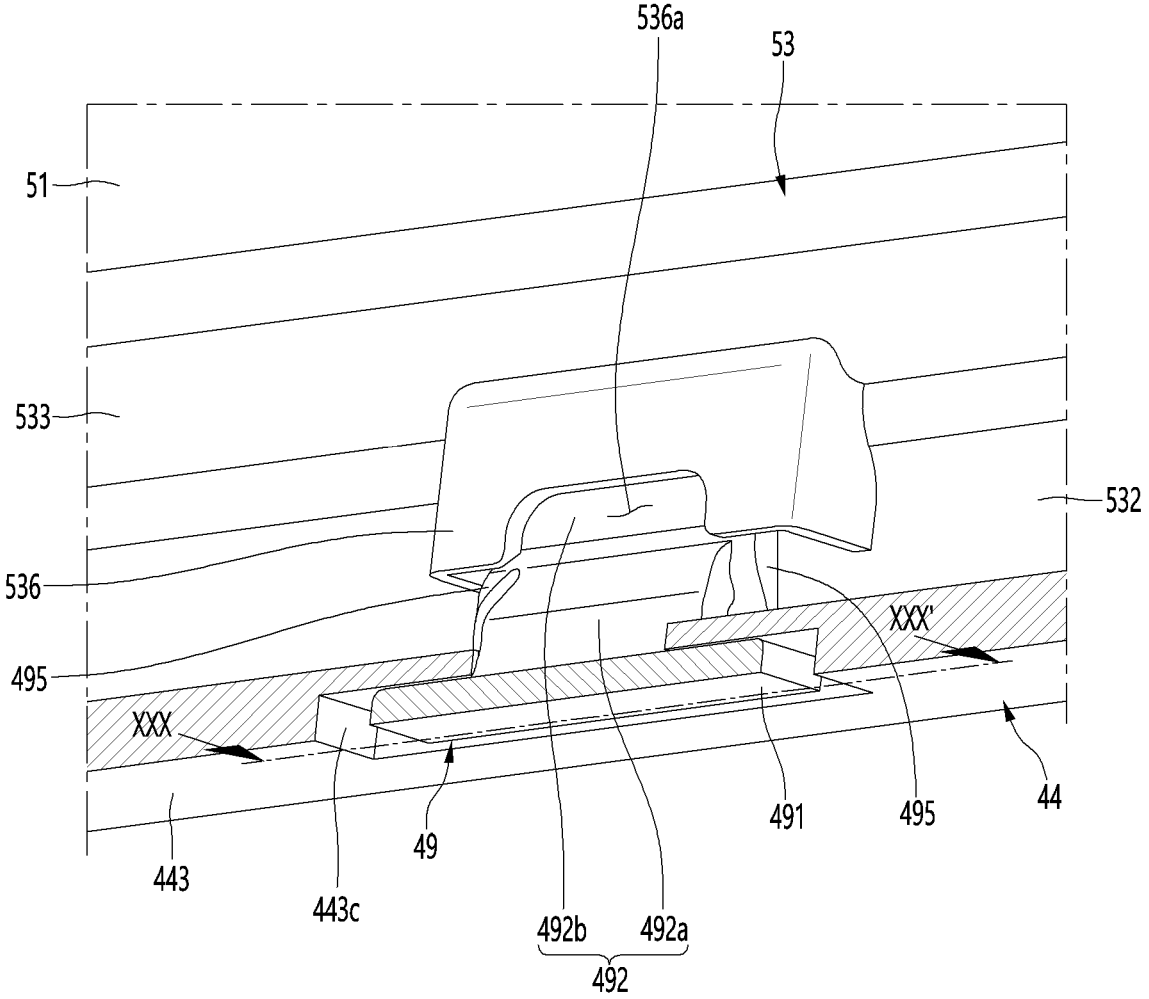
FIG. 29 is a partial cutaway perspective view illustrating a state in which the lower cap decor, the panel bracket, and the restriction member are coupled to each other.
Figure 30:
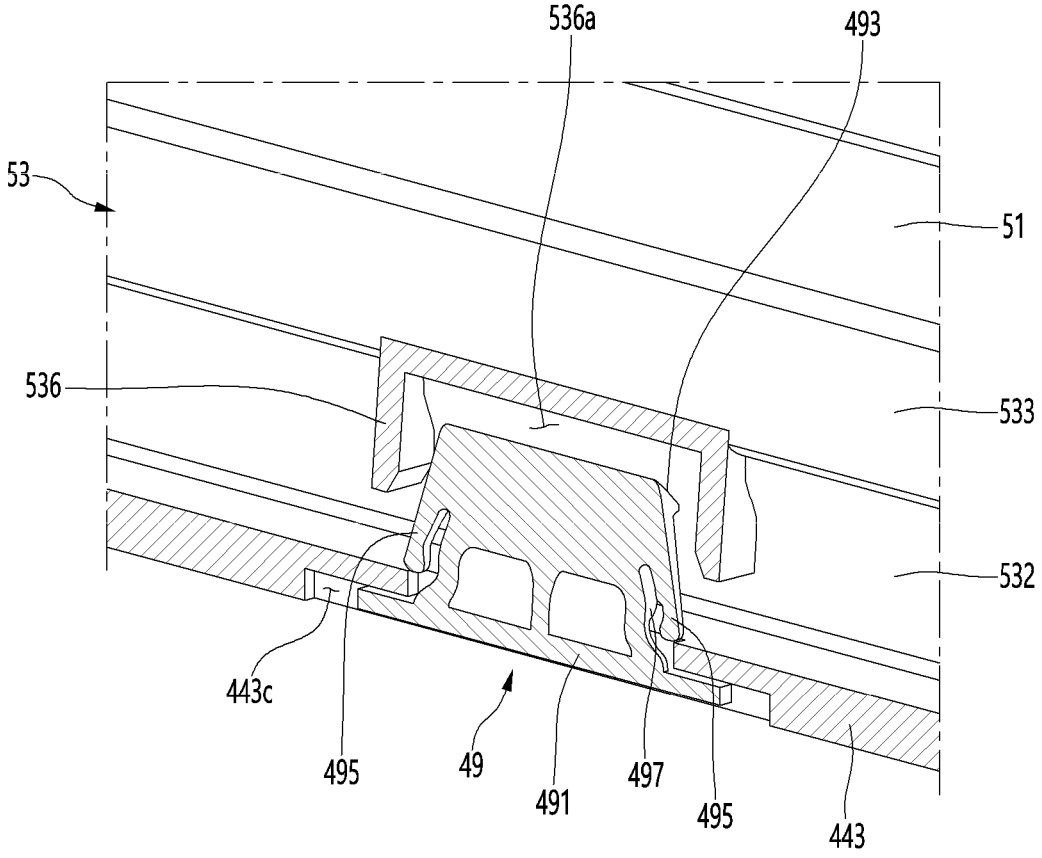
FIG. 30 is a cutaway perspective view taken along line XXX-XXX' of FIG. 29.
Figure 31:
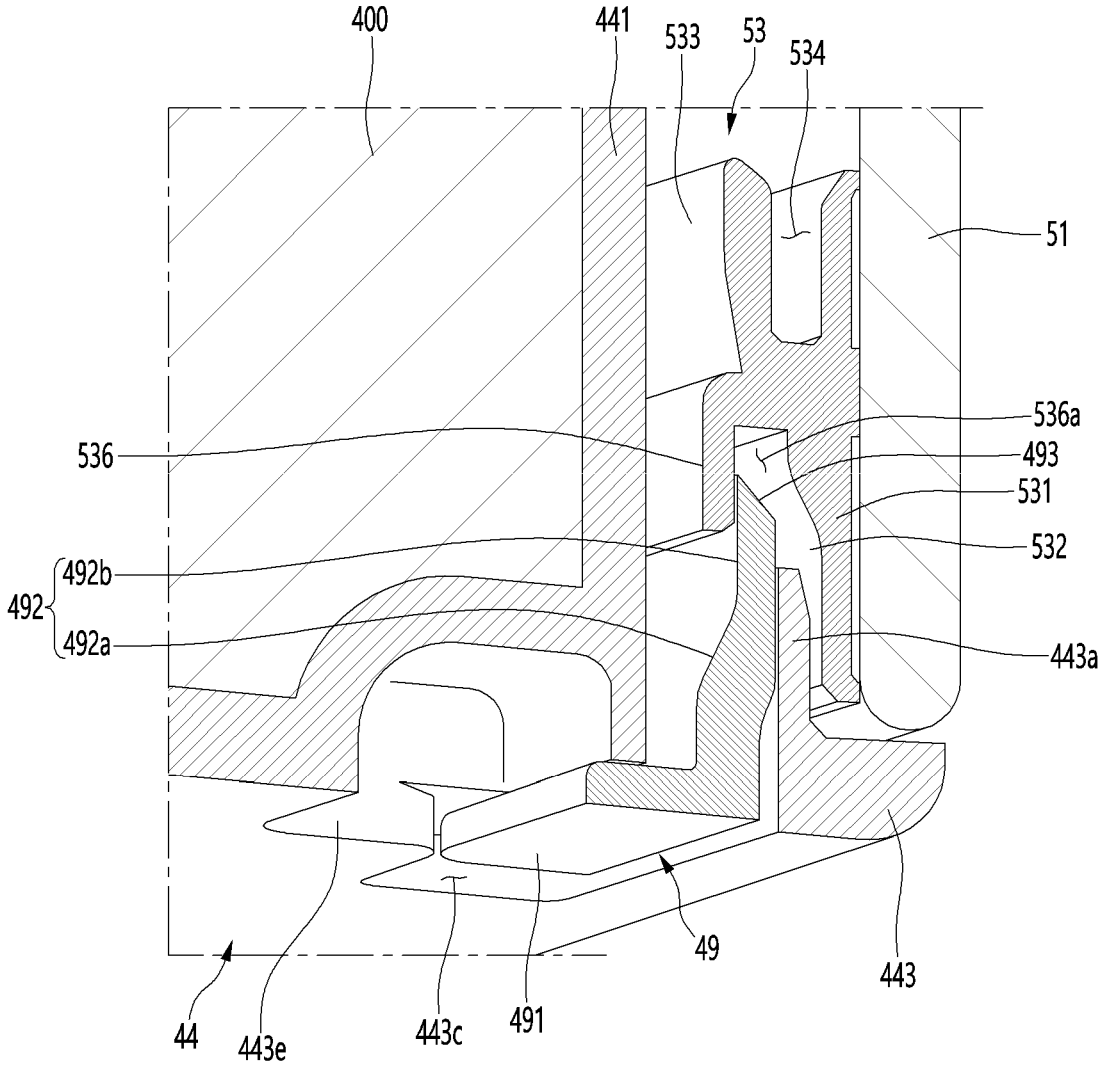
FIG. 31 is a cutaway perspective view taken along line XXXI-XXXI' of FIG. 3.

FIG. 29 is a partial cutaway perspective view illustrating a state in which the lower cap decor, the panel bracket, and the restriction member are coupled to each other. Also, FIG. 30 is a cutaway perspective view taken along line XXX-XXX' of FIG. 29. Also, FIG. 31 is a cutaway perspective view taken along line XXXI-XXXI' of FIG. 3.

As illustrated in the drawings, to mount the panel assembly 50, the panel assembly 50 may be fixed to the upper cap decor 42 while allowing the panel assembly 50 to move upward from the lower side. That is, the upper end of the panel assembly 50 may be fixed by the combination of the upper restriction rib 424*a* and the panel bracket 52. In this process, the panel fixing members 55 at both left and right sides of the panel assembly 50 may be inserted into the accommodation member 46 to be hooked to be restricted by the side frame 45.

Also, in a state in which the upper end of the panel assembly 50 is fixed, the lower end of the panel assembly 50 may move backward to be seated on the lower support end 443 of the lower cap decor 44. Here, the lower end of the panel assembly 50 may move toward the front surface of the door body 40, and in this process, the lower restriction rib 443*a* of the lower support end 443 may be inserted into the restriction member accommodation portion 536 by passing through the rib groove 536*a* of the panel bracket 53 mounted on the lower end of the panel 51. Thus, the panel assembly 50 may be disposed on the front surface of the door body 40 without interference with the lower restriction rib 443*a*.

In the state in which the panel assembly 50 is mounted, the lower end of the panel assembly 50 may be supported by the lower support end 443, and the lower restriction rib 443*a* may be disposed in the restriction member accommodation portion 536.

In this state, the restriction member 49 may be inserted into the lower insertion hole 443*c* defined in the bottom surface of the lower cap decor 44. In the restriction member 49, the body portion 492 may be inserted into the lower insertion hole 443*c*, and the lower insertion hole 443*c* may be shielded by the cap 491.

When the body portion 492 is completely inserted into the lower insertion hole 443*c*, the cap 491 may be seated inside the lower insertion hole 443*c*. Also, the restriction member support portion 495 may be elastically deformed while being pressed while the body portion 492 is inserted. When the body portion 492 is completely inserted through the lower insertion hole 443*c*, the force applied from the side to the restriction member support portion 495 disappears, and thus the restriction member support portion 495 may be elastically restored to protrude to both sides. Also, the lower end of the restriction member support portion 495 may be supported by an inner surface of the lower cap decor 44 to prevent the restriction member 49 from being separated from the inner surface of the lower insertion hole 443*c*.

The body portion 492 may be inserted into the lower cap decor 44 through the lower insertion hole 443*c* and may be inserted into the restriction member accommodation portion 536. Here, the lower restriction rib 443*a* may be already inserted into the restriction member accommodation portion 536, and thus, the lower restriction rib 443*a* and a portion of the body portion 492 of the restriction member 49 may be in a state of being inserted into the restriction member accommodation portion 536.

In detail, when the restriction member 49 is inserted, the body portion 492 may be slightly bent, and an outer surface of the body portion 492, that is, the contact surface 497 may move upward in the state of being in contact with the lower restriction protrusion 494. The body portion 492 may have an inclined or rounded shape so that the upper portion of the body portion 492, that is, the second body portion 492*b* is in close contact with the lower restriction rib 443*a*, and a lower end of the first body portion is spaced apart from the lower restriction rib 443*a*.

Also, the second body portion 492*b* may have an upper end that is inserted into the restriction member accommodation portion 536 in the state of being in close contact with the lower restriction rib 443*a*. Here, an upper end of the body portion 492 may be inserted between the lower restriction rib 443*a* and the restriction member accommodation portion 536 by the inclined surface 493 of the second body portion 492*b*.

In a state in which the restriction member 49 is completely inserted and mounted on the lower cap decor 44, an upper end of the second body portion 492*b* may be press-fit into the restriction member accommodation portion 536 and may be fixed inside the restriction member accommodation portion 536 together with the lower restriction rib 443*a*. Thus, a lower end of the panel assembly 50 may be supported by the lower cap decor 44, and simultaneously, the movement in the front and rear direction may also be restricted.

After the restriction member 49 is inserted, a coupling member 535*b* such as a screw may be coupled to the lower cap decor 44 to completely fix the lower end of the panel assembly 50.

Hereinafter, the coupling structure of the coupling member 535*b* will be described with reference to the drawings.

Figure 32:
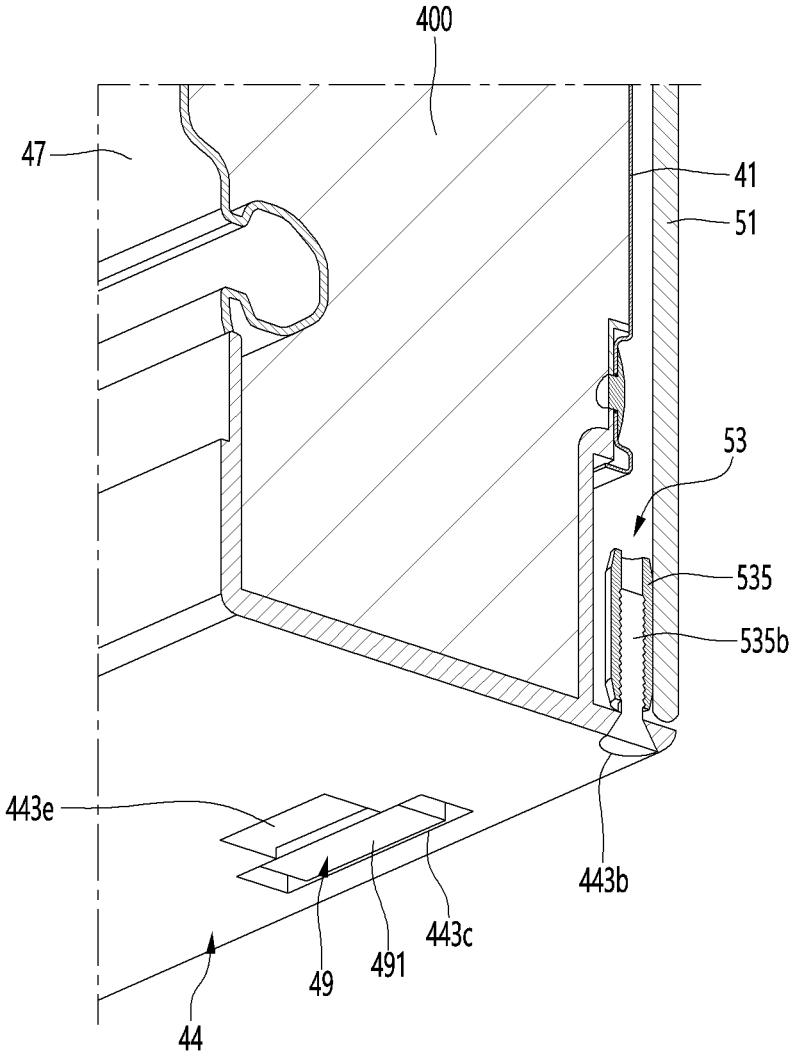
FIG. 32 is a cutaway perspective view taken along line XXXII-XXXII' of FIG. 3.

FIG. 32 is a cutaway perspective view taken along line XXXII-XXXII' of FIG. 3.

As illustrated in the drawing, when the restriction member 49 is inserted into a lower insertion hole 443*c* of the lower cap decor 44, the lower end of the panel assembly 50 may be in a state of being fixed to the lower cap decor 44.

Also, when the lower end of the panel assembly 50 is fixed, the screw hole 443*b* of the lower cap decor 44 and the screw hole 535*a* of the panel bracket 53 may be aligned with each other.

In this state, when the coupling member 535*b* is coupled to pass through the screw hole 443*b* of the lower cap decor 44, the coupling member 535*b* may be coupled to the screw hole 535*a* defined in the bracket coupling boss 535 of the panel bracket 53 so that the lower end of the panel assembly 50 is firmly fixed to the lower cap decor 44.

Since the coupling member 535*b* is coupled to the lower cap decor 44, the lower end of the panel assembly 50 may be more firmly fixed by the coupling member 535*b* while being fixed by the restriction member 49.

Particularly, since the upper end of the panel assembly 50 is restricted by the upper restriction rib 424*a* and the panel bracket 52, when the lower end of the panel assembly 50 is completely fixed, the upper end of the panel assembly 50 may also be maintained in the restricted state.

Also, even when the panel assembly 50 includes the panel 51 made of a heavy tempered glass material, the lower end of the panel assembly 50 may be maintained in a state of being completely fixed to the lower cap decor 44.

In addition, since each of the restriction member 49 and the coupling member 535*b* have a structure that restricts vertical movement of the panel assembly 50, even when the door 30 is repeatedly opened and closed, the panel assembly 50 may be completely prevented from moving or being separated due to the movement.

The coupling member 535*b* may have a structure that is coupled in a different manner.

Figure 33:
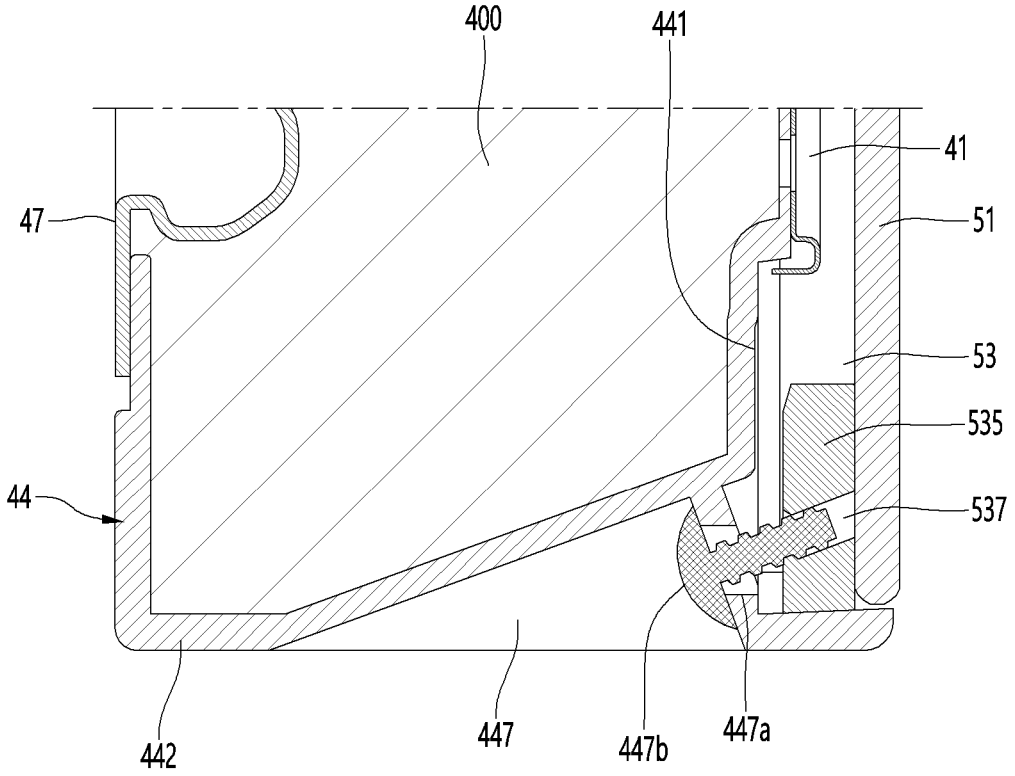
FIG. 33 is a view illustrating another example in which a coupling member is coupled to a lower end of the panel assembly.

FIG. 33 is a view illustrating another example in which the coupling member is coupled to the lower end of the panel assembly.

The panel assembly may have an upper end that is in a state of being fixed to the upper cap decor 42 in the same manner as the above-described structure and a lower end that is in a state of being fixed to the lower cap decor 44 by coupling the restriction member 49 to the panel bracket 53.

As illustrated in the drawing, a recessed coupling member mounting groove 447 may be defined in a bottom surface of the lower cap decor 44. The coupling member mounting groove 447 may be further recessed forward from the rear side, and a top surface of the coupling member mounting groove 447 may be inclined. Also, a screw hole 447*a* may be defined forward in the inclined front surface of the front end of the coupling member mounting groove 447.

Also, a bracket coupling boss 535 to which the coupling member 447*b* is mounted may be disposed on the panel bracket 53 disposed on the lower end of the panel 51. The bracket coupling boss 535 may be disposed at a position corresponding to the coupling member mounting groove 447 to protrude toward the coupling member mounting groove 447.

A screw hole 537 to which the coupling member 447*b* is coupled may be defined in a rear surface of the bracket coupling boss 535. The screw hole 537 may be defined at a position facing the screw hole 447*a* defined in the coupling member mounting groove 447 and may have an inclination corresponding to the coupling member mounting groove 447.

Therefore, when the lower end of the panel assembly 50 is mounted on the lower cap decor 44, the screw hole 447*a* of the coupling member mounting groove 447 and the screw hole 537 of the panel bracket 53 may be aligned to positions facing each other.

In this state, the worker may perform the coupling operation of the coupling member 447*b* inside the coupling member mounting groove 447. Here, the door 30 may be in a state of being laid down. For example, when the panel assembly 50 is laid down so as to be in contact with the bottom surface, the coupling member mounting groove 447 may be exposed to the outside, and the worker may easily perform the coupling operation of the coupling member 447*b*.

The coupling member 447*b* may pass through the screw hole 447*a* of the lower cap decor 44 and be coupled to the screw hole 537 of the panel bracket 53. The coupling member 447*b* may be coupled in the inclined state to prevent the coupling member 447*b* from being exposed to the outside.

In addition to the above-described embodiments, various other embodiments may be possible in addition to the foregoing embodiment. In another embodiment, a panel assembly may have a structure in which the panel assembly is fixed by a fixing bracket disposed above of a panel, a panel bracket disposed at a lower side, and a magnet. Another embodiment is different only in arrangement of components of the panel assembly, but other components may be the same. Thus, to prevent duplicated description, the same configurations are denoted by the same reference numerals, and detailed descriptions thereof may be omitted, and if necessary, those illustrated in the drawings may also be omitted.

Figure 34:
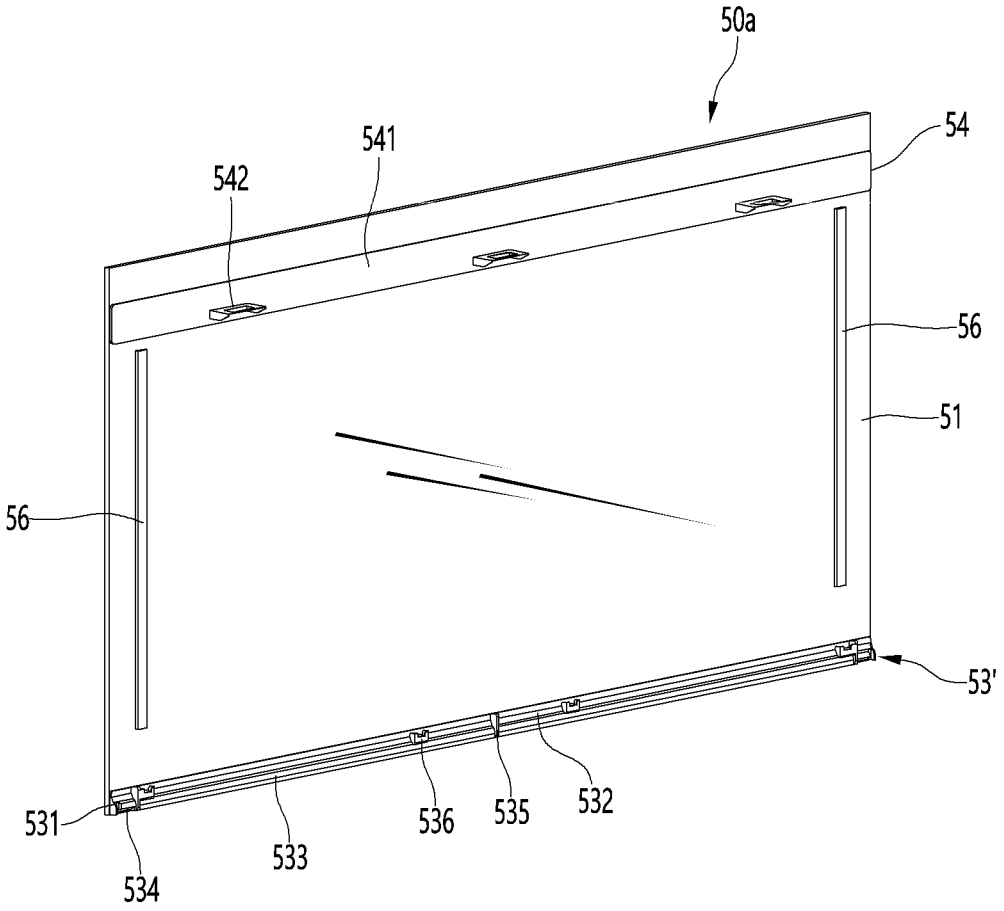
FIG. 34 is a rear perspective view of a panel assembly according to another embodiment.

FIG. 34 is a rear perspective view of a panel assembly according to another embodiment.

As illustrated in the drawing, a panel assembly 50*a* according to another embodiment may include a panel 51 defining an outer appearance of a front surface of a door 30*a*, a fixing bracket 54 disposed on an upper portion of the panel 51, and a panel bracket 53' disposed on a lower end of the panel 51. Also, the panel assembly 50*a* may further include a magnet 56 disposed at each of both left and right ends of the panel 51.

In detail, the panel 51 may be provided in a plate shape, for example, may be made of a tempered glass material. Also, the panel 51 may be provided in a square shape to shield a front surface of the door body 40 as in the above-described embodiment to form the outer appearance of the front surface of the door 30*a*.

Also, the fixing bracket 54 may be provided on the upper portion of the panel 51. The fixing bracket 54 may be disposed on a rear surface of the panel 51 and may be disposed at a position that is spaced a predetermined distance from an upper end. Of course, the fixing bracket 54 may be disposed along the upper end of the panel 51 according to a width of the fixing bracket 54.

A plurality of insertion protrusions 542 may protrude backward from the fixing bracket 54. Also, each of the insertion protrusions 542 may protrude to a corresponding length at a corresponding position so as to be inserted into a protrusion insertion hole 426 defined in a front surface of an upper cap decor 42 when the panel assembly 50*a* is mounted. An insertion protrusion 542 may be defined at a position corresponding to a lower end of a handle groove 425.

Also, a panel bracket 53' may be provided on a rear surface of the panel 57. The panel bracket 53' may be disposed along a lower end of the panel 57, and the bracket insertion portion 534 may be disposed downward. That is, the panel bracket 53' may be mounted so that a restriction member accommodating portion 536 is disposed above, and a bracket protrusion portion 533 is disposed below. Thus, the bracket insertion portion 534 may be opened downward and be disposed along the lower end of the panel 57. The panel bracket 53' may be the same as that in which the panel bracket 53 of the above-described embodiment rotates by an angle of about 180°.

Also, the magnet 56 may be disposed on each of both left and right side ends of the panel assembly 50*a*. The magnet 56 may be configured to allow the panel assembly 50*a* to be attached to a front surface of the door body 40 made of a metal material and may extend in the vertical direction along a side end of the panel 57. Thus, when the panel assembly 50*a* is mounted on the door body 40, the panel 57 to which the magnet is attached may be maintained in an attached state to the front plate 41 of the door body 40. Of course, if necessary, the door fixing member 55 according to the above-described embodiment may be provided instead of the magnet 56.

To mount the panel assembly 50*a*, a lower end of the panel assembly 50*a* may be first fixed to a lower cap decor 44, and then, an upper end of the panel assembly 50*a* may be in close contact with a front surface of the door body 40, and the restriction member 49 may be inserted to fix an upper end of the panel assembly 50*a*. The lower and upper ends of the panel assembly 50*a* may be fixed to the upper cap decor 42 and the lower cap decor 44, respectively, to complete the mounting of the panel assembly 50*a*.

Hereinafter, a state in which the upper end of the panel assembly 50*a* is fixed will be described in detail with reference to the drawings.

Figure 35:
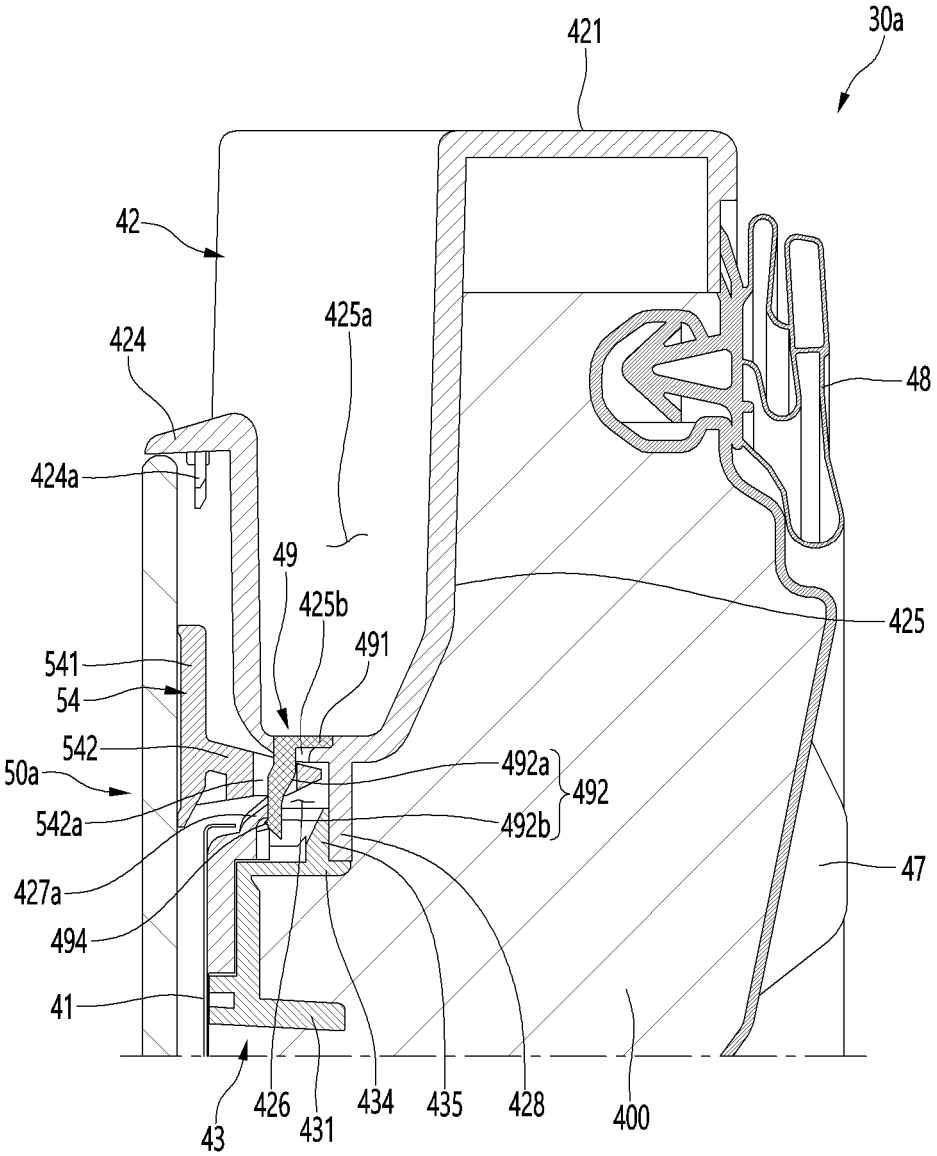
FIG. 35 is a cross-sectional view taken along line XXXV-XXXV' of FIG. 3.
Figure 36:
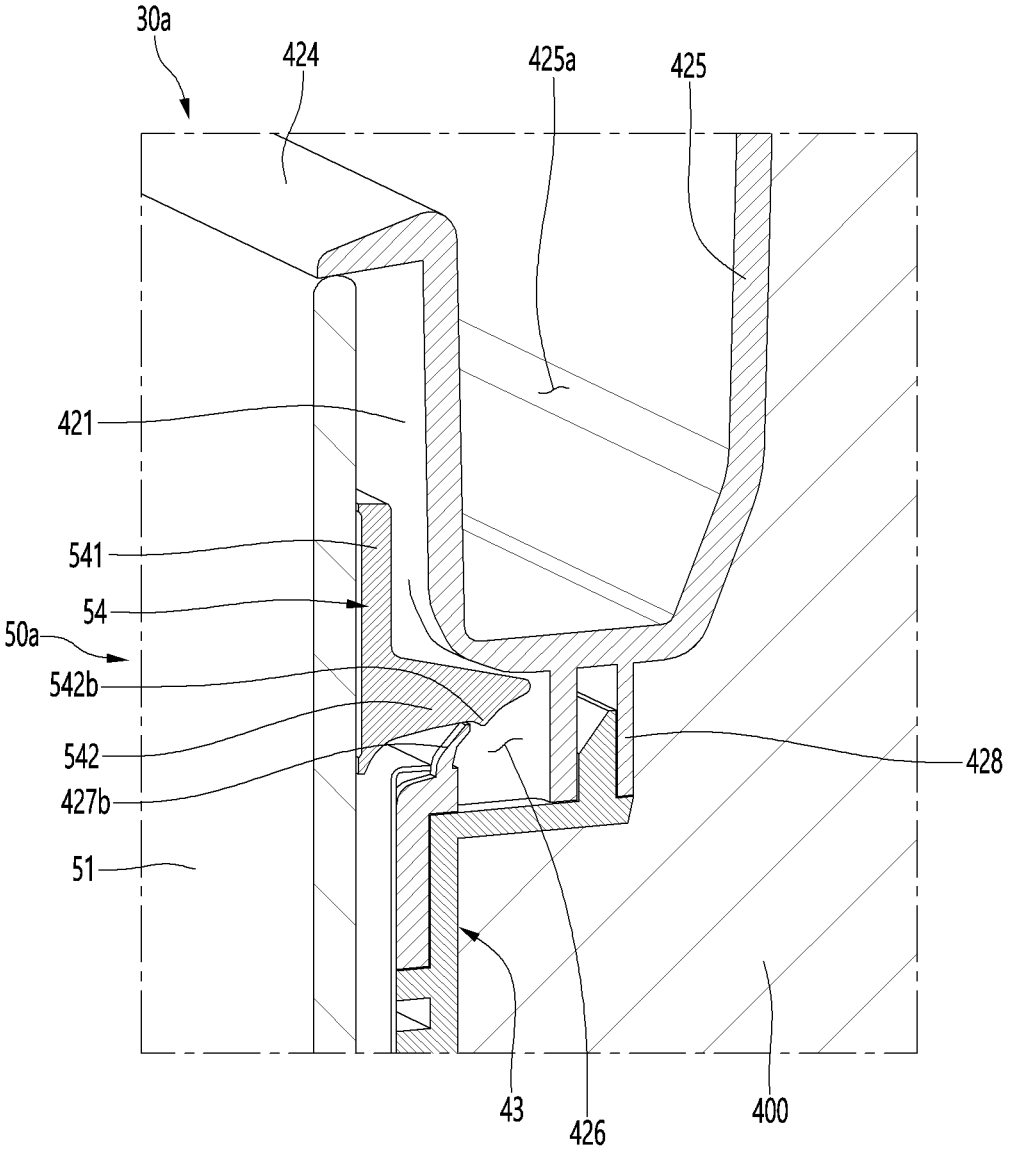
FIG. 36 is a cutaway perspective view taken along line XXXVI-XXXVI' of FIG. 3.
Figure 37:
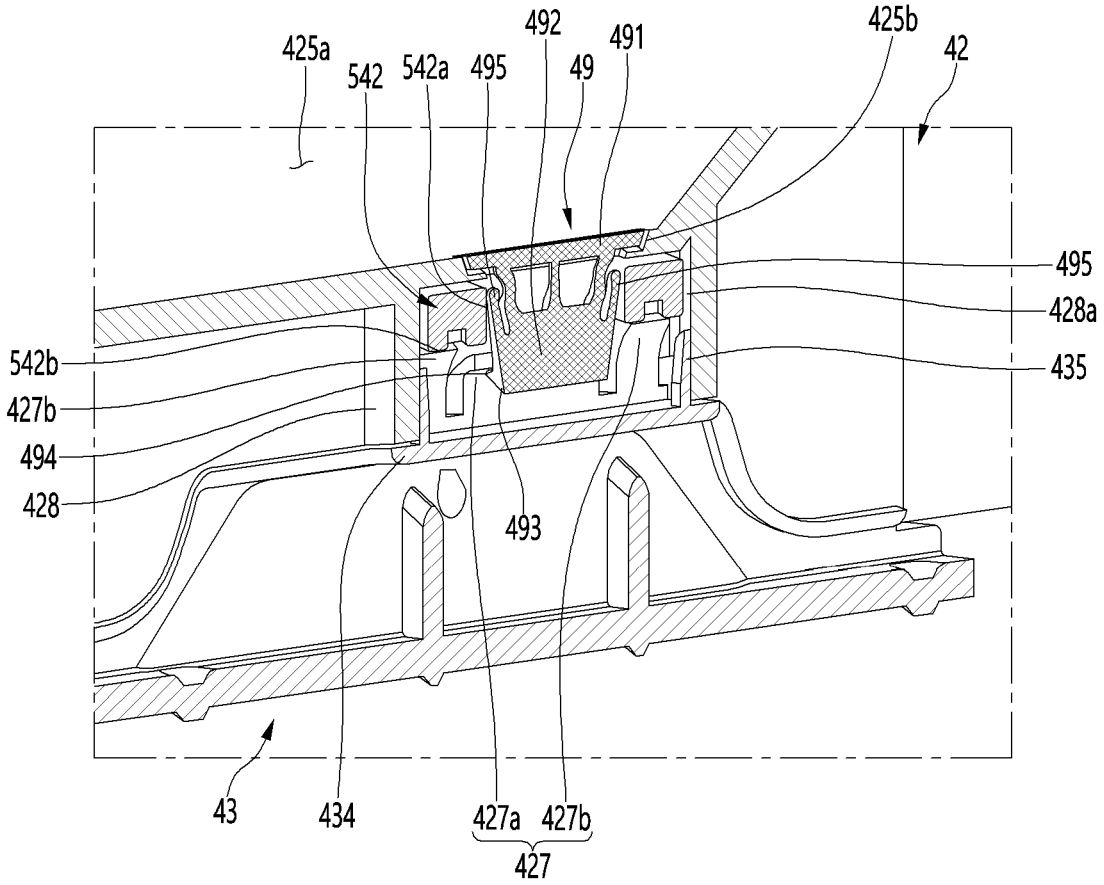
FIG. 37 is a cutaway perspective view taken along line XXXVII-XXXVII' of FIG. 3.

FIG. 35 is a cross-sectional view taken along line XXXV-XXXV' of FIG. 3. Also, FIG. 36 is a cutaway perspective view taken along line XXXVI-XXXVI' of FIG. 3. Also, FIG. 37 is a cutaway perspective view taken along line XXXVII-XXXVII' of FIG. 3.

As illustrated in the drawing, when the panel assembly 50*a* is mounted on the door body 40, the fixing bracket 54 mounted on a rear surface of the panel 57 may be coupled to the upper cap decor 42. In detail, an insertion protrusion 542 of the fixing bracket 54 may be inserted into an opened front surface of a protrusion insertion hole 426.

When the insertion protrusion 542 is completely inserted into the protrusion insertion hole 426, a hook 542*b* may be hooked to be restricted by a second restriction portion 427*b* disposed in the protrusion insertion hole 426 as illustrated in FIG. 36. Thus, the insertion protrusion 542 may be in a state of being restricted to the inside of the protrusion insertion hole 426. Here, the insertion protrusion 542 of the fixing bracket 54 may be supported at a lower side by the second restriction portion 427*b*, and thus, the panel assembly 50*a* together with the lower support end 443 may be supported at the lower side by distributing a load. That is, the panel assembly 50*a* may restrict vertical movement by the fixing bracket 54 and also be prevented from drooping downward.

In the state in which the insertion protrusion 542 is inserted into the protrusion insertion hole 426, a through-hole 542*a* may be aligned to face the restriction member insertion hole 425*b* defined in a bottom surface of a handle groove 425.

In this state, a user may insert and mount the restriction member 49 into the restriction member insertion hole 425*b* defined in a bottom surface of the inside of the handle groove 425. During the insertion process of the restriction member 49, an end of the body portion 492 may be easily inserted into the through-hole 542*a* by an inclined surface.

When the restriction member 49 is inserted into the restriction member insertion hole 425*b*, a cap 491 may shield the restriction member insertion hole 425*b*, and the body portion 492 may extend downward by passing through the aligned through-hole 542*a* and thus be hooked to be restricted by the first restriction portion 427*a*.

In detail, when the restriction member 49 is completely inserted into the restriction member insertion hole 425*b*, the body portion 492 may be inserted through the through-hole 542*a*. In this case, the restriction member support portion 495 may be inserted into an inner surface of the through-hole 542*a* in the pressed state, and the body portion 492 may be fixed to the insertion protrusion 542 in a press-fitted state.

Also, when the body portion 492 is inserted through the through-hole 542*a*, the restriction protrusion 494 disposed on an end of the second body portion 492*b* may be hooked to be restricted by the first restriction portion 427*a* to prevent the restriction member 49 from being separated upward.

As described above, due to the mounting of the restriction member 49, the restriction member 49 may be in a restricted state with the insertion protrusion 542 and the first restriction portion 427*a*, and eventually, the insertion protrusion 542 may be prevented from being separated from the protrusion insertion hole 426. That is, even if force is repeatedly applied in the opening direction of the door 30*a* when the user holds the handle groove 425 to open the door, the panel assembly 50*a* and the upper cap decor 42 may be maintained in the firmly fixed state by the restriction member 49. Particularly, a region corresponding to the handle groove 425 and an upper end of the panel assembly 50*a* may be firmly fixed to each other by a plurality of restriction members 49 mounted along the handle groove 425.

Hereinafter, a state in which the lower end of the panel assembly 50*a* is fixed will be described in detail with reference to the drawings.

Figure 38:
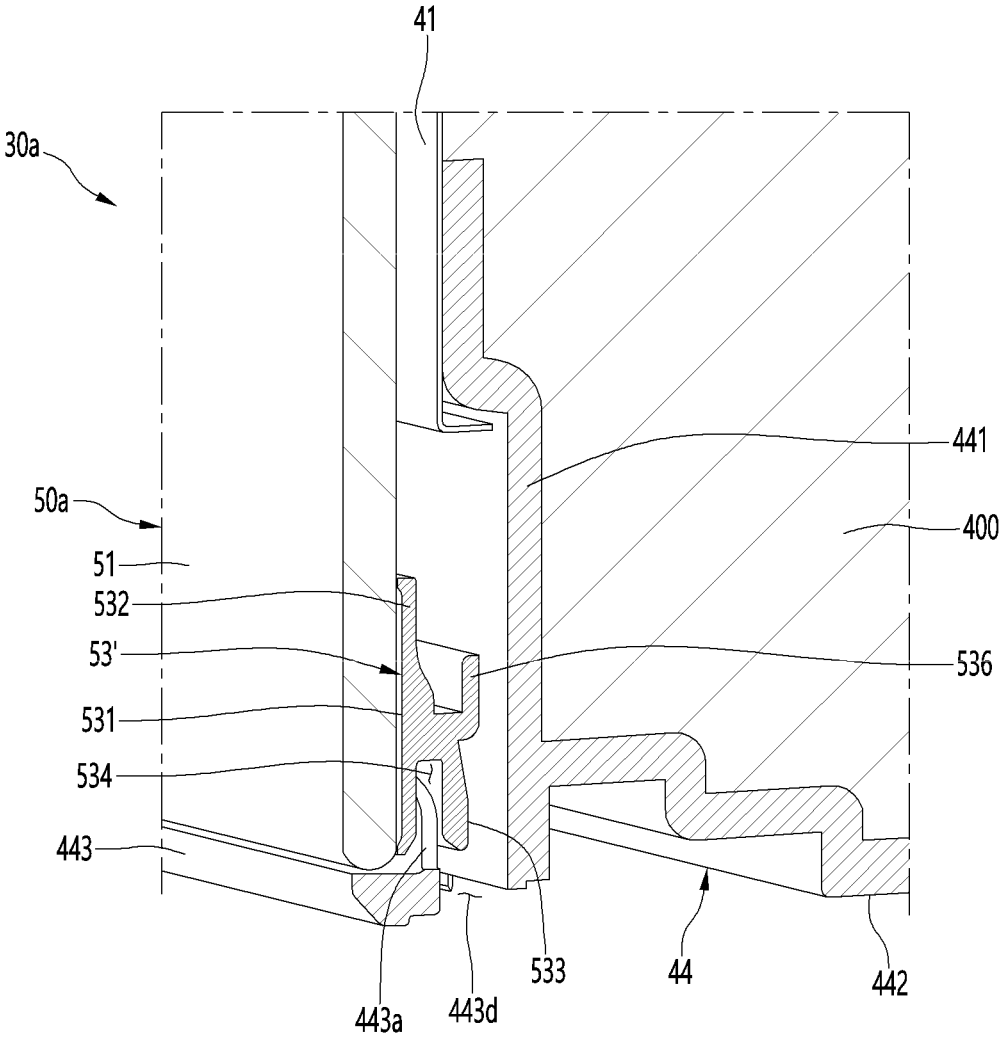
FIG. 38 is a cutaway perspective view illustrating a coupling relationship between the lower cap decor and the panel bracket of the panel assembly.
Figure 39:
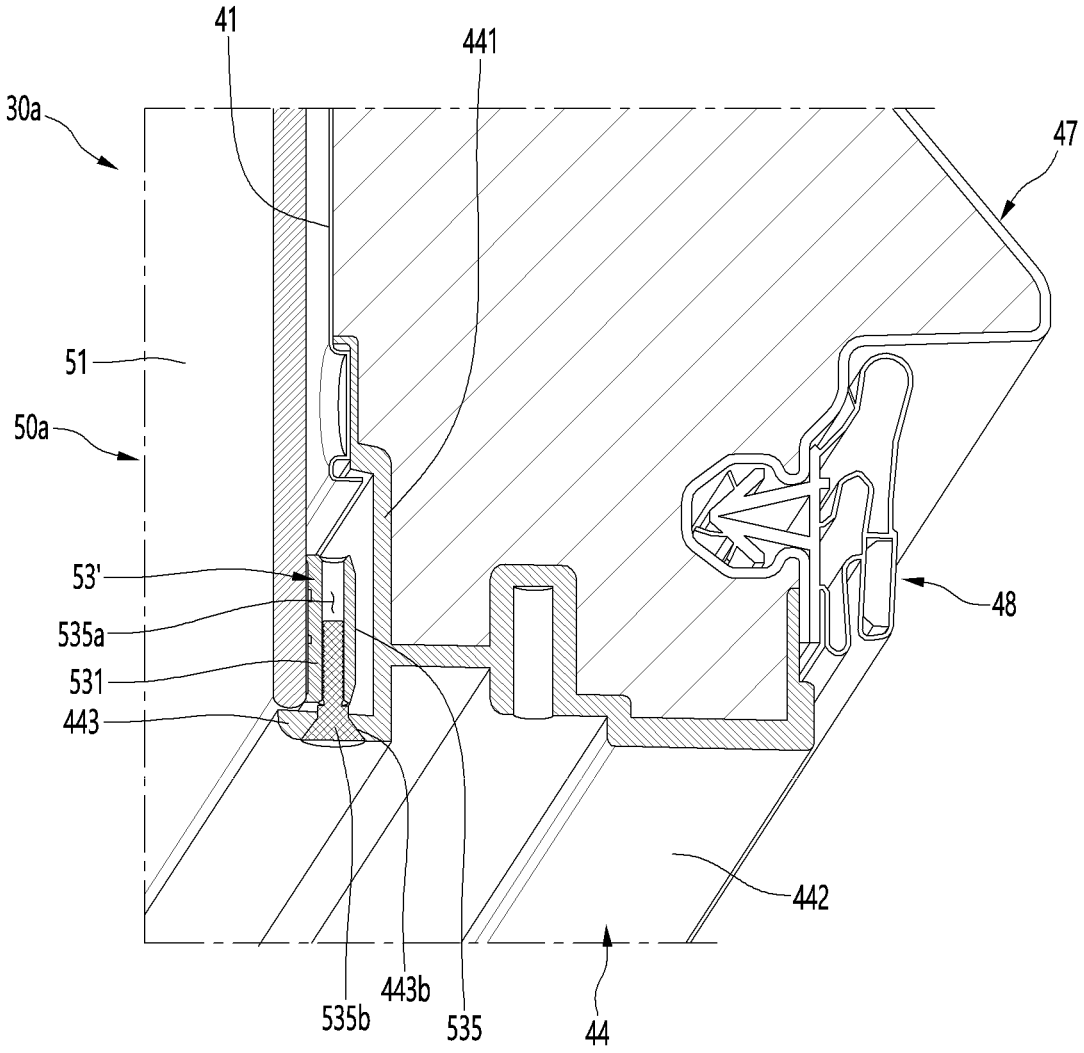
FIG. 39 is a cutaway perspective view illustrating a coupling relationship between the lower cap decor, the panel bracket, and the coupling member of the panel assembly.

FIG. 38 is a cutaway perspective view illustrating a coupling relationship between the lower cap decor and the panel bracket of the panel assembly. Also, FIG. 39 is a cutaway perspective view illustrating a coupling relationship between the lower cap decor, the panel bracket, and the coupling member of the panel assembly.

As illustrated in the drawings, when the panel assembly 50*a* is mounted, the panel assembly 50*a* may first move downward from an upper side so that a lower restriction rib 443*a* protruding from a lower support end 443 is inserted into a bracket insertion portion 534 of the panel bracket 53'.

That is, the panel assembly 50*a* may be fixed by first inserting and fixing a lower end of the panel assembly 50*a* and then attaching an upper end of the panel assembly 50*a* to a rear surface of the door body 40 so as to be fixed.

When the panel assembly 50*a* is mounted, the lower restriction rib 443*a* may be inserted into the bracket insertion portion 534, and the lower end of the panel assembly 50*a* may be maintained in the fixed state by its own weight. In this state, an upper end of the panel assembly 50*a* may be fixed by the restriction member 49.

In a state in which upper and lower ends of the panel assembly 50*a* are fixed, the coupling member 535*b* may be further coupled to the lower end of the panel assembly 50*a*. When the lower end of the panel assembly 50*a* is fixed, the screw hole 443*b* of the lower cap decor 44 and the screw hole 535*a* of the panel bracket 53 may be aligned with each other.

In this state, when the coupling member 535*b* is coupled to pass through the screw hole 443*b* of the lower cap decor 44, the coupling member 535*b* may be coupled to the screw hole 535*a* defined in the bracket coupling boss 535 of the panel bracket 53 so that the lower end of the panel assembly 50*a* is firmly fixed to the lower cap decor 44.

Since the coupling member 535*b* is coupled to the lower cap decor 44, the lower end of the panel assembly 50*a* may be more firmly fixed by the coupling member 535*b* while being fixed by the restriction member 49.

In addition to the above-described embodiments, various other embodiments may be possible in addition to the foregoing embodiment. In another embodiment, a panel assembly may be provided with panel brackets at upper and lower ends of a panel, a fixing bracket may be provided on the panel, and a restriction member may be mounted and fixed at both upper and lower ends of the panel assembly. Further another embodiment is different only in arrangement of components of the panel assembly, but other components may be the same. Thus, to prevent duplicated description, the same configurations are denoted by the same reference numerals, and detailed descriptions thereof may be omitted, and if necessary, those illustrated in the drawings may also be omitted.

Figure 40:
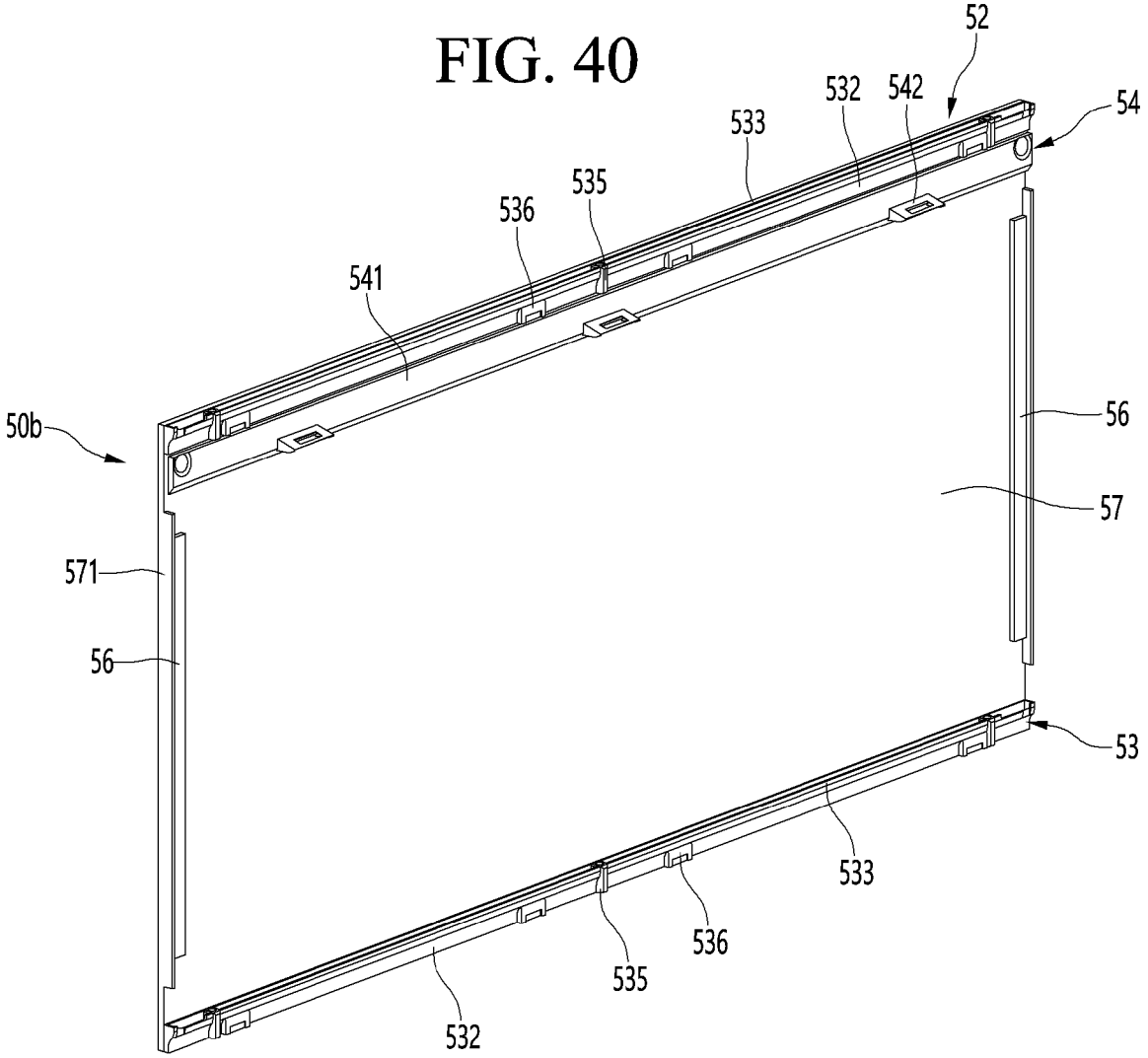
FIG. 40 is a rear perspective view of a panel assembly according to further another embodiment.

FIG. 40 is a rear perspective view of a panel assembly according to further another embodiment.

As illustrated in the drawing, a panel assembly 50*b* according to further another embodiment may include a panel 57 defining an outer appearance of a front surface of a door 30*b*, panel brackets 52 and 53 disposed on upper and lower ends of the panel 57, and a fixing bracket 54 disposed on an upper portion of the panel 57. Also, the panel assembly 50*b* may further include a magnet 56 disposed at each of both left and right ends of the panel 57.

In detail, the panel 57 may be provided in a plate shape using a metal material, for example, may be made of a stainless material. Also, the panel 57 may be provided in a square shape to shield a front surface of the door body 40 to form the outer appearance of the front surface of the door 30*b*. Also, a bent portion 571 may be disposed along a circumference of the panel 57. The bent portion 571 may be supported by an upper cap decor 42, a lower cap decor 44, and a side frame 45.

Also, panel brackets 52 and 53 may be mounted on upper and lower ends of a rear surface of the panel 57, respectively. The panel brackets 52 and 53 may be exactly the same as the structure of the panel brackets 52 and 53 illustrated in FIG. 20 described above.

The panel brackets 52 and 53 provided at the upper and lower ends of the panel 57 may have the same structure and be disposed in the same direction. That is, the panel bracket 52 provided on the upper end of the panel 57 may be disposed so that an opened surface of a bracket insertion portion 534 faces an upper side. Also, the panel bracket 53 provided at the lower end of the panel may be disposed so that an opening of a restriction member accommodating portion 536 faces a lower side.

The fixing bracket 54 may be provided on the panel 57. The fixing bracket 54 may be disposed on the rear surface of the panel 57 and be disposed to be in contact with the lower end of the panel bracket 52. Also, it may be the same as the above-described embodiment.

A plurality of insertion protrusions 542 may protrude backward from the fixing bracket 54. Also, each of the insertion protrusions 542 may protrude to a corresponding length at a corresponding position so as to be inserted into a protrusion insertion hole 426 defined in a front surface of an upper cap decor 42 when the panel assembly 50*b* is mounted. An insertion protrusion 542 may be defined at a position corresponding to a lower end of a handle groove 425.

Also, the magnet 56 may be disposed on each of both left and right side ends of the panel assembly 50*b*. The magnet 56 may be configured to allow the panel assembly 50*b* to be attached to a front surface of the door body 40 made of a metal material and may extend in the vertical direction along a side end of the panel 57. Thus, when the panel assembly 50*b* is mounted on the door body 40, the panel 57 to which the magnet is attached may be maintained in an attached state to the front plate 41 of the door body 40. Of course, if necessary, the door fixing member 55 according to the above-described embodiment may be provided instead of the magnet 56.

To mount the panel assembly 50*b*, an upper end of the panel assembly 50*b* may be first fixed to an upper cap decor 42, and then, a lower end of the panel assembly 50*b* may be in close contact with a front surface of the door body 40, and the restriction member 49 may be inserted to fix a lower end of the panel assembly 50*b*. Also, the panel assembly 50*b* may be fixedly mounted more firmly by inserting and mounting the restriction member 49 into each of the upper cap decor 42 and the lower cap decor 44.

Hereinafter, a state in which the upper end of the panel assembly 50*b* is fixed will be described in detail with reference to the drawings.

Figure 41:
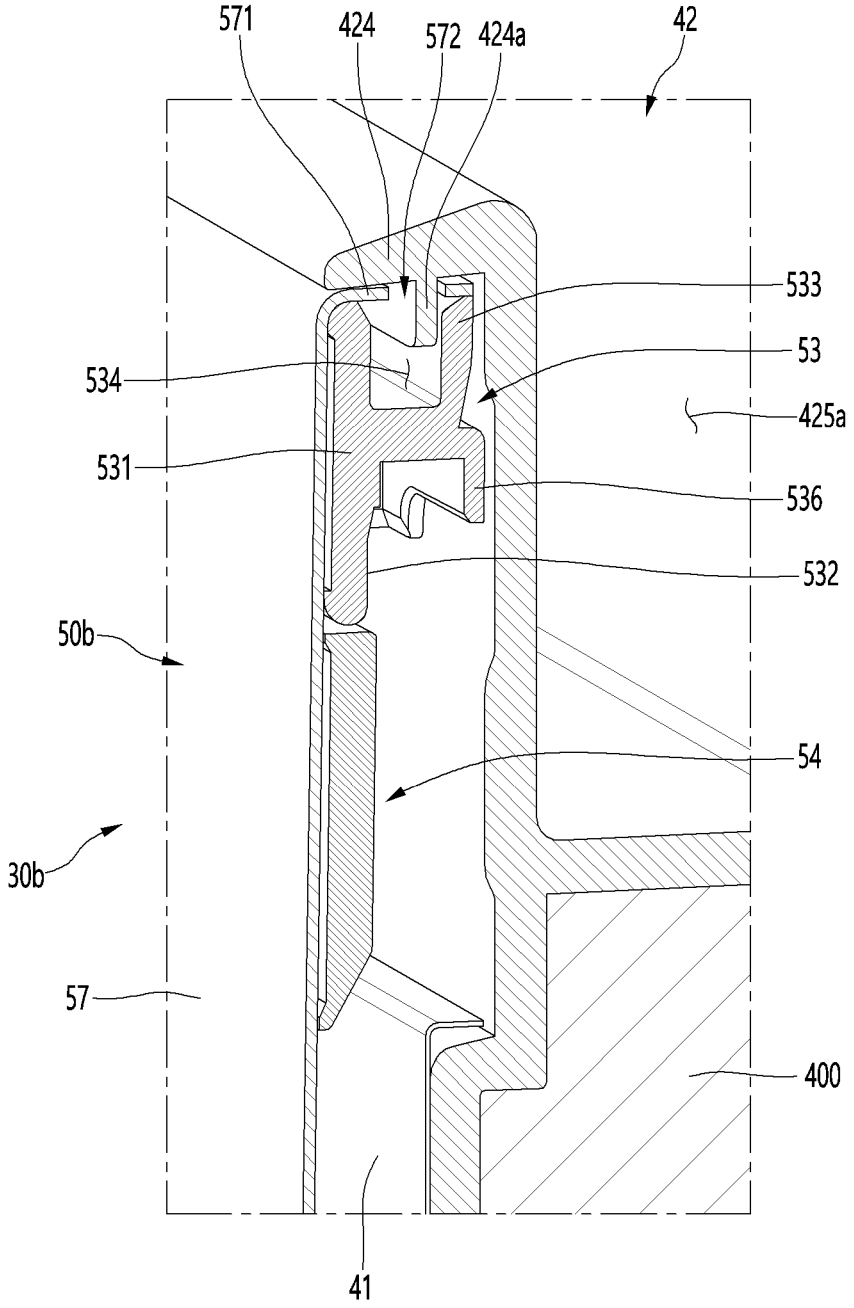
FIG. 41 is a cutaway perspective view illustrating a coupling relationship between an upper cap decor and a panel bracket of the panel assembly.
Figure 42:
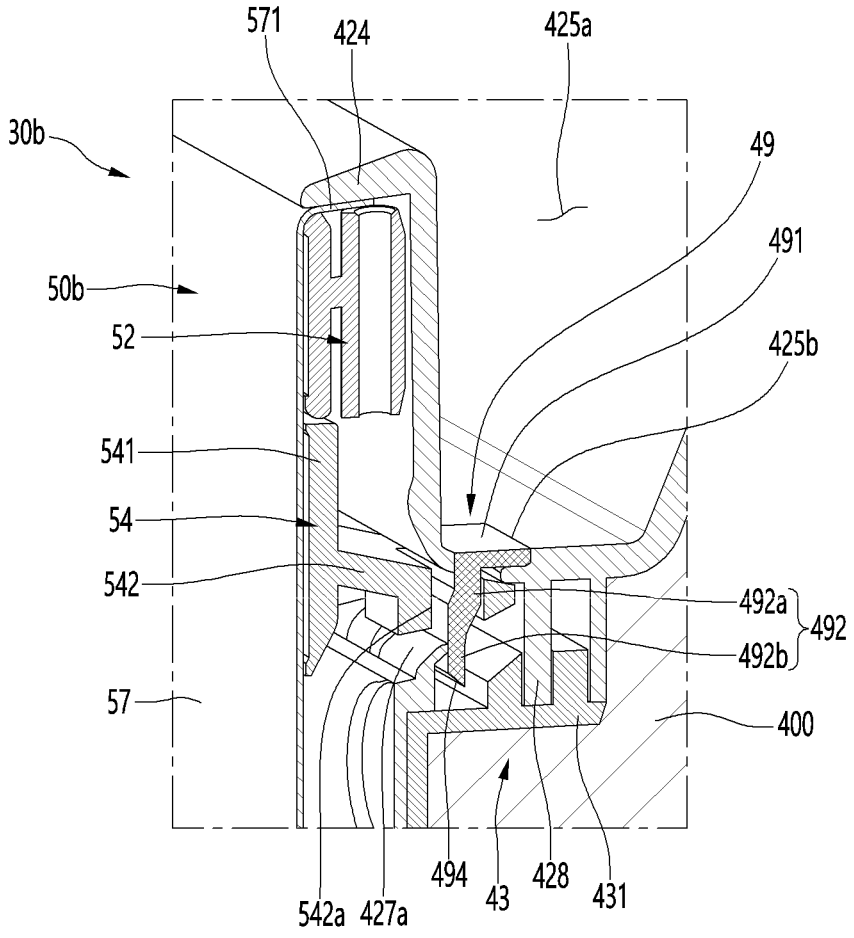
FIG. 42 is a cutaway perspective view illustrating a coupling relationship between the upper cap decor, a fixing bracket, and a restriction member of the panel assembly.

FIG. 41 is a cutaway perspective view illustrating a coupling relationship between the upper cap decor and the panel bracket of the panel assembly. Also, FIG. 42 is a cutaway perspective view illustrating a coupling relationship between the upper cap decor, the fixing bracket, and the restriction member of the panel assembly.

As illustrated in the drawings, to mount the panel assembly 50*b*, the panel assembly 50*b* may move upward from a lower side, and an upper end of the panel 57, that is, a bent portion 571 at the upper end of the panel 57 may move upward so as to be in contact with an upper support end 424 of the upper cap decor 42. Here, the panel assembly 50*b* may be aligned so that an upper restriction rib 424*a* of an upper support end 424 passes through a panel opening 572 defined in the bent portion 571 at the upper end of the panel 57.

When the panel assembly 50*b* is mounted, the upper restriction rib 424*a* may be inserted into a bracket insertion portion 534 of the panel bracket 52 after passing through the panel opening 572. Thus, an upper end of the panel assembly 50*b* may be hooked to be restricted and fixed by the upper cap decor.

Also, when the panel assembly 50*b* is mounted on the door body 40, the fixing bracket 54 mounted on a rear surface of the panel 57 may be coupled to the upper cap decor 42. In detail, an insertion protrusion 542 of the fixing bracket 54 may be inserted into an opened front surface of a protrusion insertion hole 426.

When the insertion protrusion 542 is completely inserted into the protrusion insertion hole 426, a hook 542*b* may be hooked to be restricted by a second restriction portion 427*b* disposed in the protrusion insertion hole 426 as illustrated in FIG. 42. Thus, the insertion protrusion 542 may be in a state of being restricted to the inside of the protrusion insertion hole 426. Here, the insertion protrusion 542 of the fixing bracket 54 may be supported at a lower side by the second restriction portion 427*b*, and thus, the panel assembly 50*b* together with the lower support end 443 may be supported at the lower side by distributing a load. That is, the panel assembly 50*b* may restrict vertical movement by the fixing bracket 54 and also be prevented from drooping downward.

In the state in which the insertion protrusion 542 is inserted into the protrusion insertion hole 426, a through-hole 542*a* may be aligned to face the restriction member insertion hole 425*b* defined in a bottom surface of a handle groove 425.

In this state, a user may insert and mount the restriction member 49 into the restriction member insertion hole 425*b* defined in a bottom surface of the inside of the handle groove 425. During the insertion process of the restriction member 49, an end of the body portion 492 may be easily inserted into the through-hole 542*a* by an inclined surface.

When the restriction member 49 is inserted into the restriction member insertion hole 425*b*, a cap 491 may shield the restriction member insertion hole 425*b*, and the body portion 492 may extend downward by passing through the aligned through-hole 542*a* and thus be hooked to be restricted by the first restriction portion 427*a*.

In detail, when the restriction member 49 is completely inserted into the restriction member insertion hole 425*b*, the body portion 492 may be inserted through the through-hole 542*a*. In this case, the restriction member support portion 495 may be inserted into an inner surface of the through-hole 542*a* in the pressed state, and the body portion 492 may be fixed to the insertion protrusion 542 in a press-fitted state.

Also, when the body portion 492 is inserted through the through-hole 542*a*, the restriction protrusion 494 disposed on an end of the second body portion 492*b* may be hooked to be restricted by the first restriction portion 427*a* to prevent the restriction member 49 from being separated upward.

As described above, due to the mounting of the restriction member 49, the restriction member 49 may be in a restricted state with the insertion protrusion 542 and the first restriction portion 427*a*, and eventually, the insertion protrusion 542 may be prevented from being separated from the protrusion insertion hole 426. That is, even if force is repeatedly applied in the opening direction of the door 30*b* when the user holds the handle groove 425 to open the door, the panel assembly 50*b* and the upper cap decor 42 may be maintained in the firmly fixed state by the restriction member 49. Particularly, a region corresponding to the handle groove 425 and an upper end of the panel assembly 50*b* may be firmly fixed to each other by a plurality of restriction members 49 mounted along the handle groove 425.

Hereinafter, a state in which the lower end of the panel assembly 50*b* is fixed will be described in detail with reference to the drawings.

Figure 43:
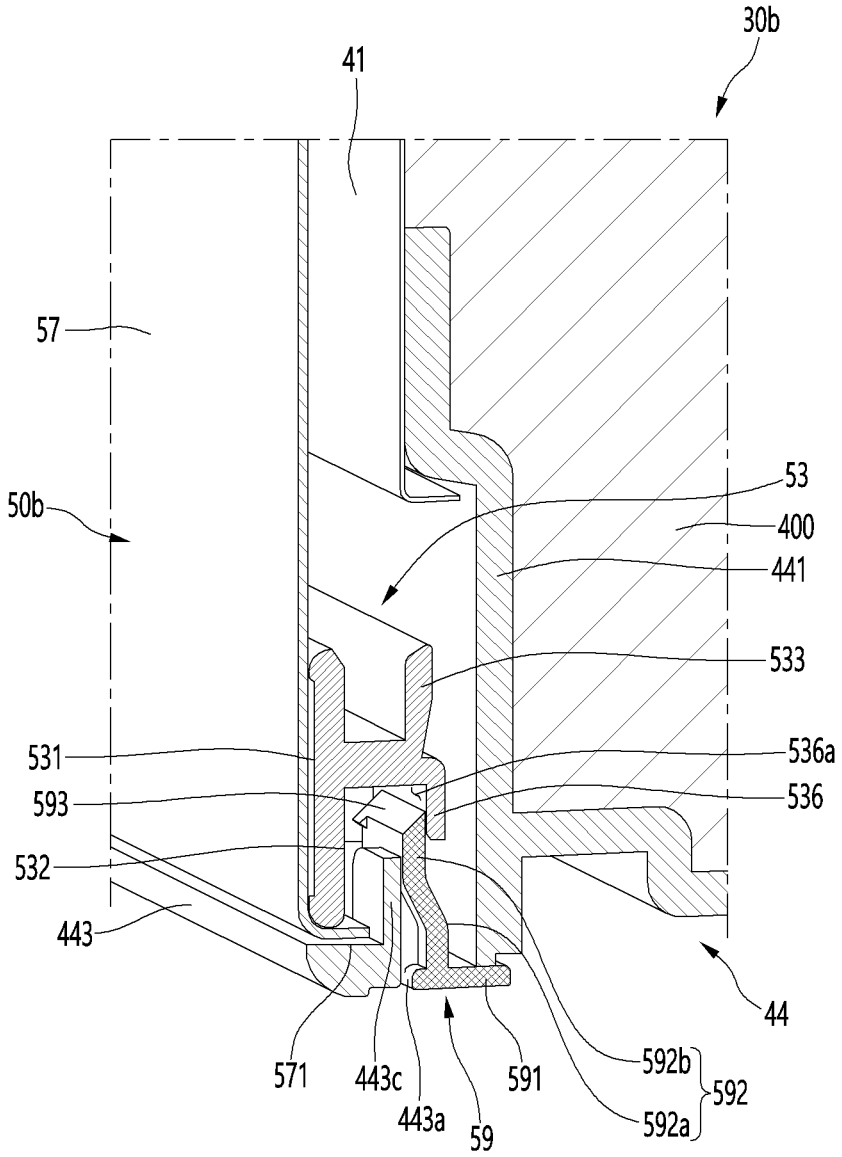
FIG. 43 is a cutaway perspective view illustrating a coupling relationship between a lower cap decor, the panel bracket, and the restriction member of the panel assembly.
Figure 44:
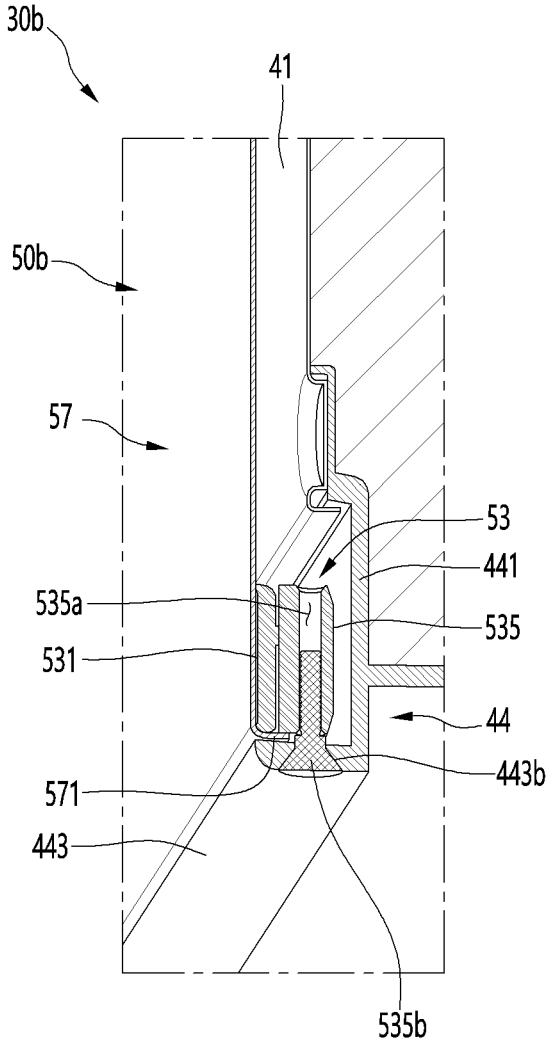
FIG. 44 is a cutaway perspective view illustrating a coupling relationship between the lower cap decor, the panel bracket, and the coupling member of the panel assembly.

FIG. 43 is a cutaway perspective view illustrating a coupling relationship between the lower cap decor, the panel bracket, and the restriction member of the panel assembly. Also, FIG. 44 is a cutaway perspective view illustrating a coupling relationship between the lower cap decor, the panel bracket, and the coupling member of the panel assembly.

As illustrated in the drawings, in a state in which the upper end of the panel assembly 50*b* is fixed, the lower end of the panel assembly 50*b* may move backward to be seated on the lower support end 443 of the lower cap decor 44. Here, the lower end of the panel assembly 50*b* may move toward the front surface of the door body 40, and in this process, the lower restriction rib 443*a* of the lower support end 443 may be inserted into the restriction member accommodation portion 536 by passing through the rib groove 536*a* of the panel bracket 53 mounted on the lower end of the panel 57. Thus, the panel assembly 50*b* may be disposed on the front surface of the door body 40 without interference with the lower restriction rib 443*a*.

In the state in which the panel assembly 50*b* is mounted, the lower end of the panel assembly 50*b* may be supported by the lower support end 443, and the lower restriction rib 443*a* may be disposed in the restriction member accommodation portion 536.

In this state, the restriction member 49 may be inserted into the lower insertion hole 443*c* defined in the bottom surface of the lower cap decor 44. In the restriction member 49, the body portion 492 may be inserted into the lower insertion hole 443*c*, and the lower insertion hole 443*c* may be shielded by the cap 491.

The body portion 492 may be inserted into the lower cap decor 44 through the lower insertion hole 443*c* and may be inserted into the restriction member accommodation portion 536. Here, the lower restriction rib 443*a* may be already inserted into the restriction member accommodation portion 536, and thus, the lower restriction rib 443*a* and a portion of the body portion 492 of the restriction member 49 may be in a state of being inserted into the restriction member accommodation portion 536.

In detail, when the restriction member 49 is inserted, the body portion 492 may be slightly bent, and an outer surface of the body portion 492, that is, the contact surface 497 may move upward in the state of being in contact with the lower restriction protrusion 494. The body portion 492 may have an inclined or rounded shape so that the upper portion of the body portion 492, that is, the second body portion 492*b* is in close contact with the lower restriction rib 443*a*, and a lower end of the first body portion is spaced apart from the lower restriction rib 443*a*.

Also, the second body portion 492*b* may have an upper end that is inserted into the restriction member accommodation portion 536 in the state of being in close contact with the lower restriction rib 443*a*. Here, an upper end of the body portion 492 may be inserted between the lower restriction rib 443*a* and the restriction member accommodation portion 536 by the inclined surface 493 of the second body portion 492*b*.

In a state in which the restriction member 49 is completely inserted and mounted on the lower cap decor 44, an upper end of the second body portion 492*b* may be press-fit into the restriction member accommodation portion 536 and may be fixed inside the restriction member accommodation portion 536 together with the lower restriction rib 443*a*. Thus, a lower end of the panel assembly 50*b* may be supported by the lower cap decor 44, and simultaneously, the movement in the front and rear direction may also be restricted.

In a state in which upper and lower ends of the panel assembly 50*b* are fixed, the coupling member 535*b* may be further coupled to the lower end of the panel assembly 50*b*. When the lower end of the panel assembly 50*b* is fixed, the screw hole 443*b* of the lower cap decor 44 and the screw hole 535*a* of the panel bracket 53 may be aligned with each other.

In this state, when the coupling member 535*b* is coupled to pass through the screw hole 443*b* of the lower cap decor 44, the coupling member 535*b* may be coupled to the screw hole 535*a* defined in the bracket coupling boss 535 of the panel bracket 53 so that the lower end of the panel assembly 50*b* is firmly fixed to the lower cap decor 44.

Since the coupling member 535*b* is coupled to the lower cap decor 44, the lower end of the panel assembly 50*b* may be more firmly fixed by the coupling member 535*b* while being fixed by the restriction member 49.

In addition to the above-described embodiments, various other embodiments may be possible in addition to the foregoing embodiment. In further another embodiment, a panel assembly may have a structure in which the panel assembly is fixed by a fixing bracket disposed above of a panel, a panel bracket disposed at a lower side, and a magnet. Further another embodiment is different only in arrangement of components of the panel assembly, but other components may be the same. Thus, to prevent duplicated description, the same configurations are denoted by the same reference numerals, and detailed descriptions thereof may be omitted, and if necessary, those illustrated in the drawings may also be omitted.

Figure 45:
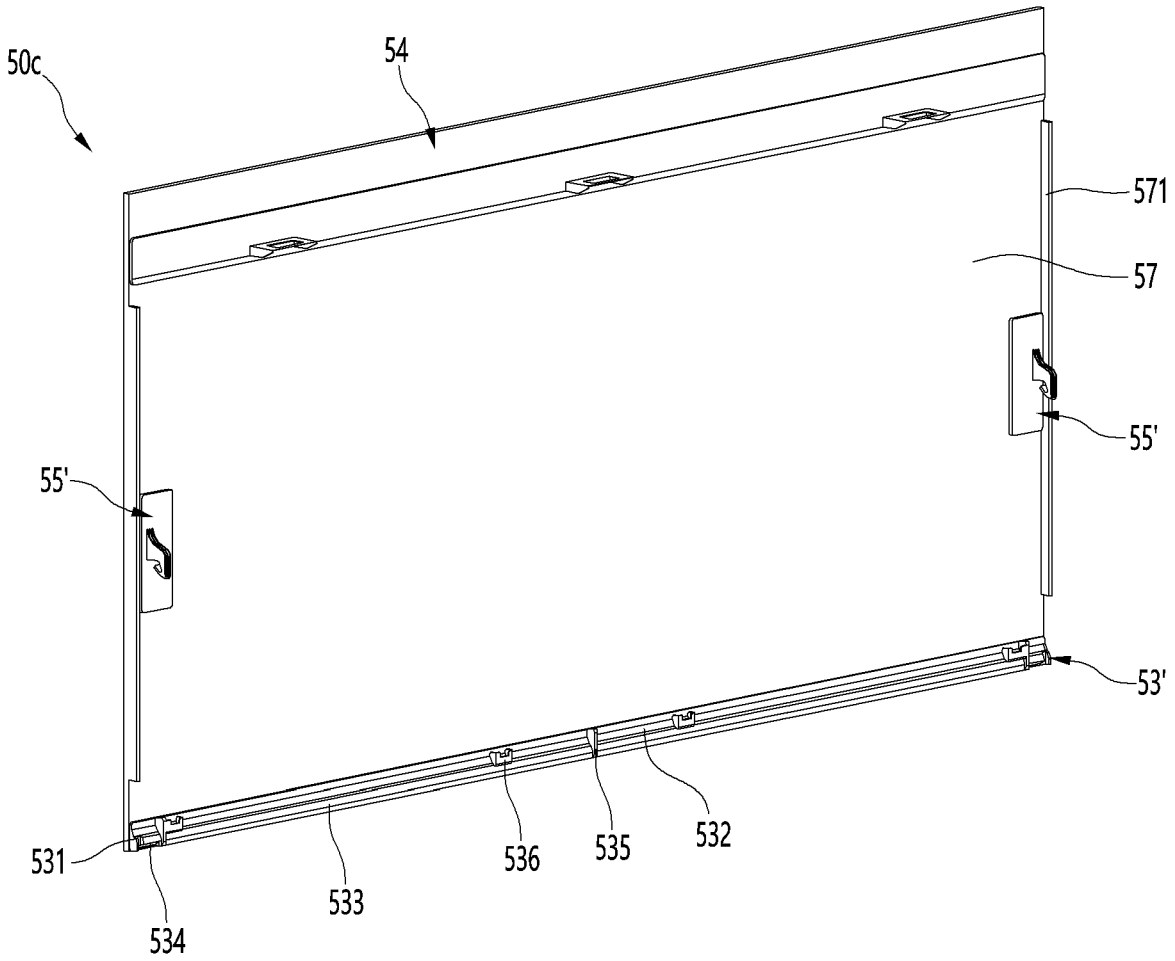
FIG. 45 is a rear perspective view of a panel assembly according to further another embodiment.

FIG. 45 is a rear perspective view of a panel assembly according to further another embodiment.

As illustrated in the drawing, a panel assembly 50*c* according to another embodiment may include a panel 57 defining an outer appearance of a front surface of a door 30*c*, a fixing bracket 54 disposed on an upper portion of the panel 57, and a panel bracket 53' disposed on a lower end of the panel 57. Also, the panel assembly 50*c* may further include a panel fixing member 55' disposed at each of both left and right ends of the panel 57.

In detail, the panel 57 may be provided in a plate shape using a metal material, for example, may be made of a stainless material. Also, the panel 57 may be provided in a square shape to shield a front surface of the door body 40 to form the outer appearance of the 30*b*. Also, a bent portion 571 may be disposed along a circumference of the panel 57. The bent portion 571 may be supported by an upper cap decor 42, a lower cap decor 44, and a side frame 45.

Also, the fixing bracket 54 may be provided on the upper portion of the panel 57. The fixing bracket 54 may be disposed on a rear surface of the panel 57 and may be disposed at a position that is spaced a predetermined distance from an upper end. Of course, the fixing bracket 54 may be disposed along the upper end of the panel 57 according to a width of the fixing bracket 54.

A plurality of insertion protrusions 542 may protrude backward from the fixing bracket 54. Also, each of the insertion protrusions 542 may protrude to a corresponding length at a corresponding position so as to be inserted into a protrusion insertion hole 426 defined in a front surface of an upper cap decor 42 when the panel assembly 50*c* is mounted. An insertion protrusion 542 may be defined at a position corresponding to a lower end of a handle groove 425.

Also, a panel bracket 53' may be provided on a rear surface of the panel 57. The panel bracket 53' may be disposed along a lower end of the panel 57, and the bracket insertion portion 534 may be disposed downward. That is, the panel bracket 53' may be mounted so that a restriction member accommodating portion 536 is disposed above, and a bracket protrusion portion 533 is disposed below. Thus, the bracket insertion portion 534 may be opened downward and be disposed along the lower end of the panel 57. The panel bracket 53' may be the same as that in which the panel bracket 53 of the above-described embodiment rotates by an angle of about 180°.

Also, the panel fixing member 55' may be provided at each of both left and right side ends of the panel assembly 50*c*. The panel fixing member 55' may be attached to the rear surface of the panel 57 and have a structure that is hooked to be restricted by a front surface of the door body 40 when the panel assembly 50*c* is mounted. The panel fixing member 55' may have substantially the same structure as the fixing member 55 of the above-described embodiment described with reference to FIGS. 20 and 25, and only after the configuration corresponding to the hook 556 may be provided in an insertion protrusion shape that is bent downward after protruding backward. Thus, when the panel assembly 50*c* is mounted on the door body 40, the panel assembly 50*c* may move downward so that the lower end of the panel assembly 50*c* is fixed to the lower cap decor 44. Here, the panel fixing member 55' may be configured to be hooked to be restricted. Of course, if necessary, a magnet 56 according to the above-described embodiment may be provided instead of the panel fixing member 55'.

To mount the panel assembly 50*c*, a lower end of the panel assembly 50*c* may be first fixed to a lower cap decor 44, and then, an upper end of the panel assembly 50*c* may be in close contact with a front surface of the door body 40, and the restriction member 49 may be inserted to fix an upper end of the panel assembly 50*c*. The lower and upper ends of the panel assembly 50*c* may be fixed to the upper cap decor 42 and the lower cap decor 44, respectively, to complete the mounting of the panel assembly 50*c*.

Hereinafter, a state in which the upper end of the panel assembly 50*c* is fixed will be described in detail with reference to the drawings.

Figure 46:
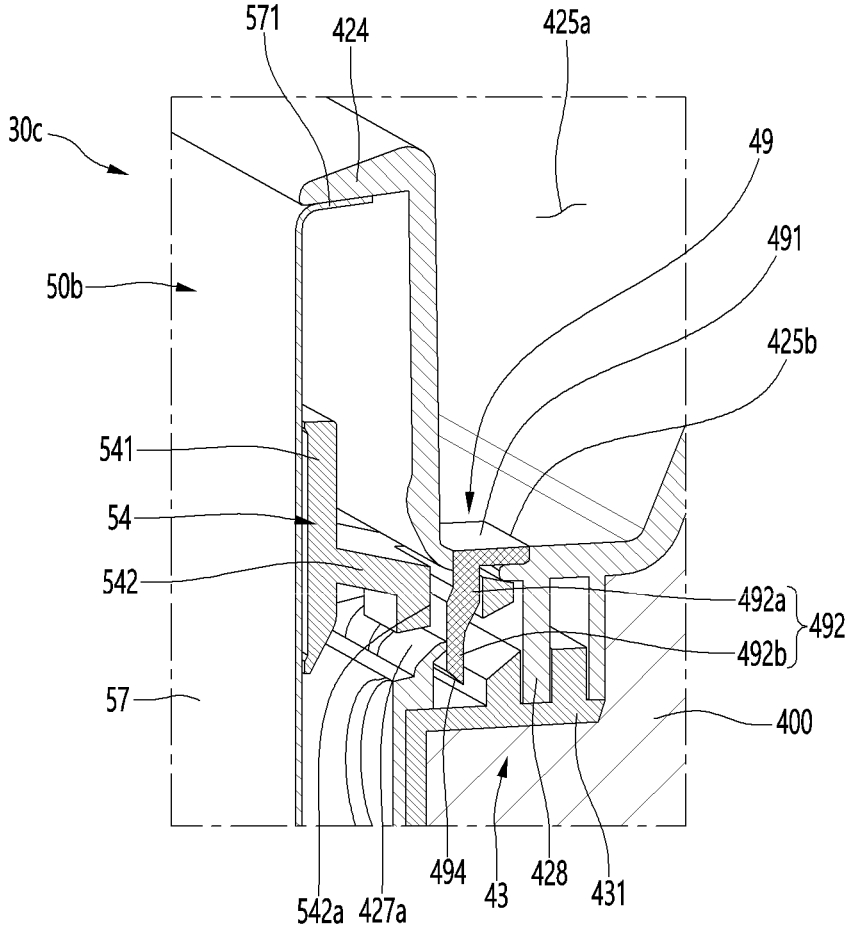
FIG. 46 is a cutaway perspective view illustrating a coupling relationship between an upper cap decor, a fixing bracket, and a restriction member of the panel assembly.

FIG. 46 is a cutaway perspective view illustrating a coupling relationship between the upper cap decor, the fixing bracket, and the restriction member of the panel assembly.

As illustrated in the drawing, when the panel assembly 50*c* is mounted on the door body 40, the fixing bracket 54 mounted on a rear surface of the panel 57 may be coupled to the upper cap decor 42. In detail, an insertion protrusion 542 of the fixing bracket 54 may be inserted into an opened front surface of a protrusion insertion hole 426.

When the insertion protrusion 542 is completely inserted into the protrusion insertion hole 426, a hook 542*b* may be hooked to be restricted by a second restriction portion 427*b* disposed in the protrusion insertion hole 426 as illustrated in FIG. 36. Thus, the insertion protrusion 542 may be in a state of being restricted to the inside of the protrusion insertion hole 426. Here, the insertion protrusion 542 of the fixing bracket 54 may be supported at a lower side by the second restriction portion 427*b*, and thus, the panel assembly 50*c* together with the lower support end 443 may be supported at the lower side by distributing a load. That is, the panel assembly 50*c* may restrict vertical movement by the fixing bracket 54 and also be prevented from drooping downward.

In the state in which the insertion protrusion 542 is inserted into the protrusion insertion hole 426, a through-hole 542*a* may be aligned to face the restriction member insertion hole 425*b* defined in a bottom surface of a handle groove 425.

In this state, a user may insert and mount the restriction member 49 into the restriction member insertion hole 425*b* defined in a bottom surface of the inside of the handle groove 425. During the insertion process of the restriction member 49, an end of the body portion 492 may be easily inserted into the through-hole 542*a* by an inclined surface.

When the restriction member 49 is inserted into the restriction member insertion hole 425*b*, a cap 491 may shield the restriction member insertion hole 425*b*, and the body portion 492 may extend downward by passing through the aligned through-hole 542*a* and thus be hooked to be restricted by the first restriction portion 427*a*.

In detail, when the restriction member 49 is completely inserted into the restriction member insertion hole 425*b*, the body portion 492 may be inserted through the through-hole 542*a*. In this case, the restriction member support portion 495 may be inserted into an inner surface of the through-hole 542*a* in the pressed state, and the body portion 492 may be fixed to the insertion protrusion 542 in a press-fitted state.

Also, when the body portion 492 is inserted through the through-hole 542*a*, the restriction protrusion 494 disposed on an end of the second body portion 492*b* may be hooked to be restricted by the first restriction portion 427*a* to prevent the restriction member 49 from being separated upward.

As described above, due to the mounting of the restriction member 49, the restriction member 49 may be in a restricted state with the insertion protrusion 542 and the first restriction portion 427*a*, and eventually, the insertion protrusion 542 may be prevented from being separated from the protrusion insertion hole 426. That is, even if force is repeatedly applied in the opening direction of the door 30*c* when the user holds the handle groove 425 to open the door, the panel assembly 50*c* and the upper cap decor 42 may be maintained in the firmly fixed state by the restriction member 49. Particularly, a region corresponding to the handle groove 425 and an upper end of the panel assembly 50*c* may be firmly fixed to each other by a plurality of restriction members 49 mounted along the handle groove 425.

Hereinafter, a state in which the lower end of the panel assembly 50*c* is fixed will be described in detail with reference to the drawings.

Figure 47:
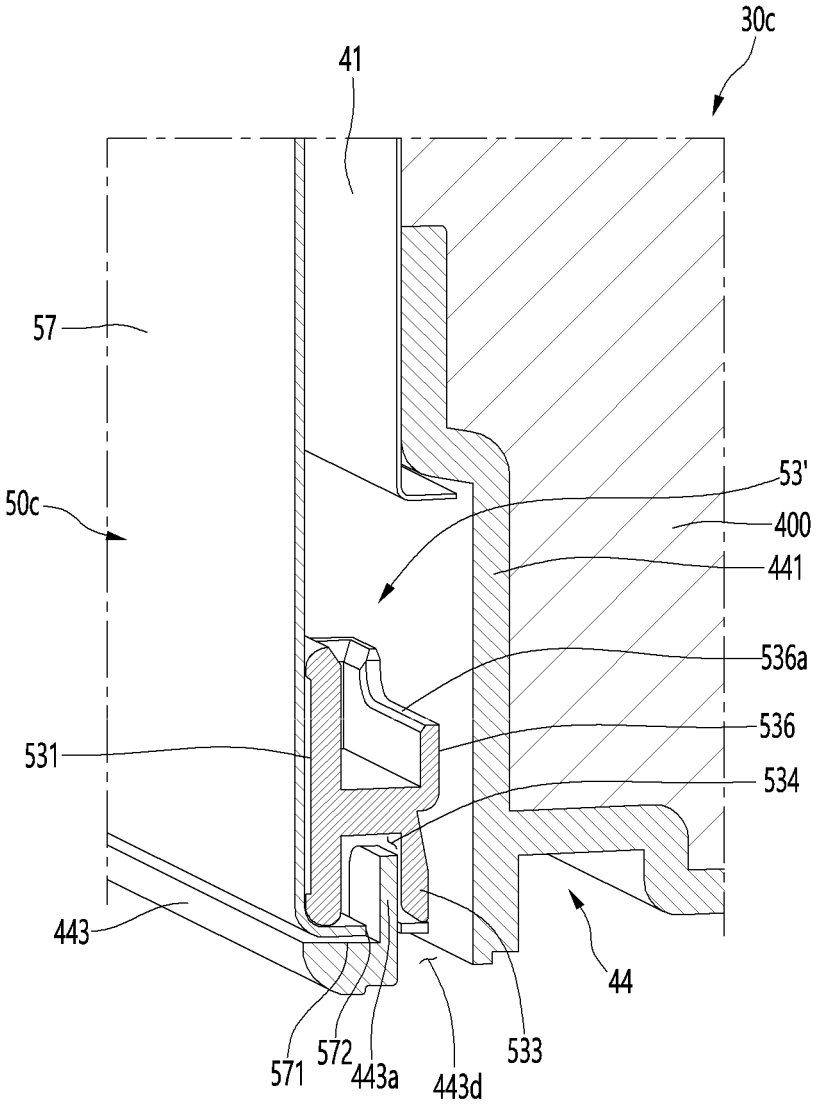
FIG. 47 is a cutaway perspective view illustrating a coupling relationship between a lower cap decor and a panel bracket of the panel assembly.
Figure 48:
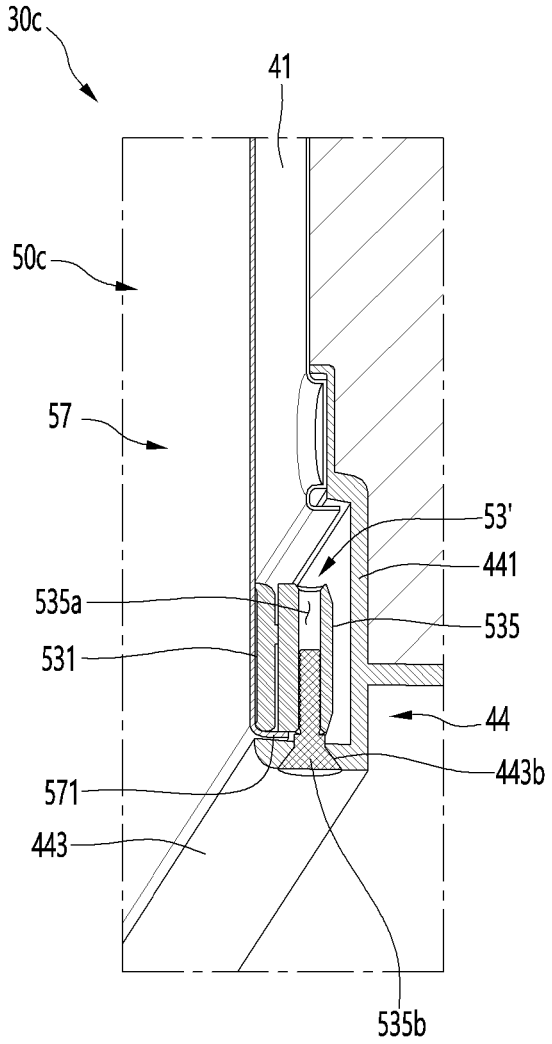
FIG. 48 is a cutaway perspective view illustrating a coupling relationship between the lower cap decor, the panel bracket, and a coupling member of the panel assembly.

FIG. 47 is a cutaway perspective view illustrating a coupling relationship between the lower cap decor and the panel bracket of the panel assembly. Also, FIG. 48 is a cutaway perspective view illustrating a coupling relationship between the lower cap decor, the panel bracket, and the coupling member of the panel assembly.

As illustrated in the drawings, when the panel assembly 50*a* is mounted, the panel assembly 50*a* may first move downward from an upper side so that a lower restriction rib 443*a* protruding from a lower support end 443 is inserted into a bracket insertion portion 534 of the panel bracket 53' after passing through a bent portion opening 572 defined in the bent portion 571 of the panel.

That is, the panel assembly 50*c* may be fixed by first inserting and fixing a lower end of the panel assembly 50*c* and then attaching an upper end of the panel assembly 50*c* to a rear surface of the door body 40 so as to be fixed.

Of course, if necessary, the panel bracket 53' may be omitted, and in this case, the lower restriction rib 443*a* may be inserted into the bent opening 572 so that the lower end of the panel assembly 50*c* is restricted.

When the panel assembly 50*c* is mounted, the lower restriction rib 443*a* may be inserted into the bracket insertion portion 534, and the lower end of the panel assembly 50*c* may be maintained in the fixed state by its own weight. In this state, an upper end of the panel assembly 50*c* may be fixed by the restriction member 49.

In a state in which upper and lower ends of the panel assembly 50*c* are fixed, the coupling member 535*b* may be further coupled to the lower end of the panel assembly 50*c*. When the lower end of the panel assembly 50*c* is fixed, the screw hole 443*b* of the lower cap decor 44 and the screw hole 535*a* of the panel bracket 53 may be aligned with each other.

In this state, when the coupling member 535*b* is coupled to pass through the screw hole 443*b* of the lower cap decor 44, the coupling member 535*b* may be coupled to the screw hole 535*a* defined in the bracket coupling boss 535 of the panel bracket 53 so that the lower end of the panel assembly 50*a* is firmly fixed to the lower cap decor 44.

Since the coupling member 535*b* is coupled to the lower cap decor 44, the lower end of the panel assembly 50*c* may be more firmly fixed by the coupling member 535*b* while being fixed by the restriction member 49.

In addition to the foregoing embodiment of the present invention, a refrigerator according to various embodiments may be exemplified.

Hereinafter, another embodiment will be described in more detail with reference to the drawings. Also, among configurations according to other embodiment described below, the same components as those of the above-described embodiment will be indicated by the same reference numerals, and detailed descriptions thereof will be omitted.

Figure 49:
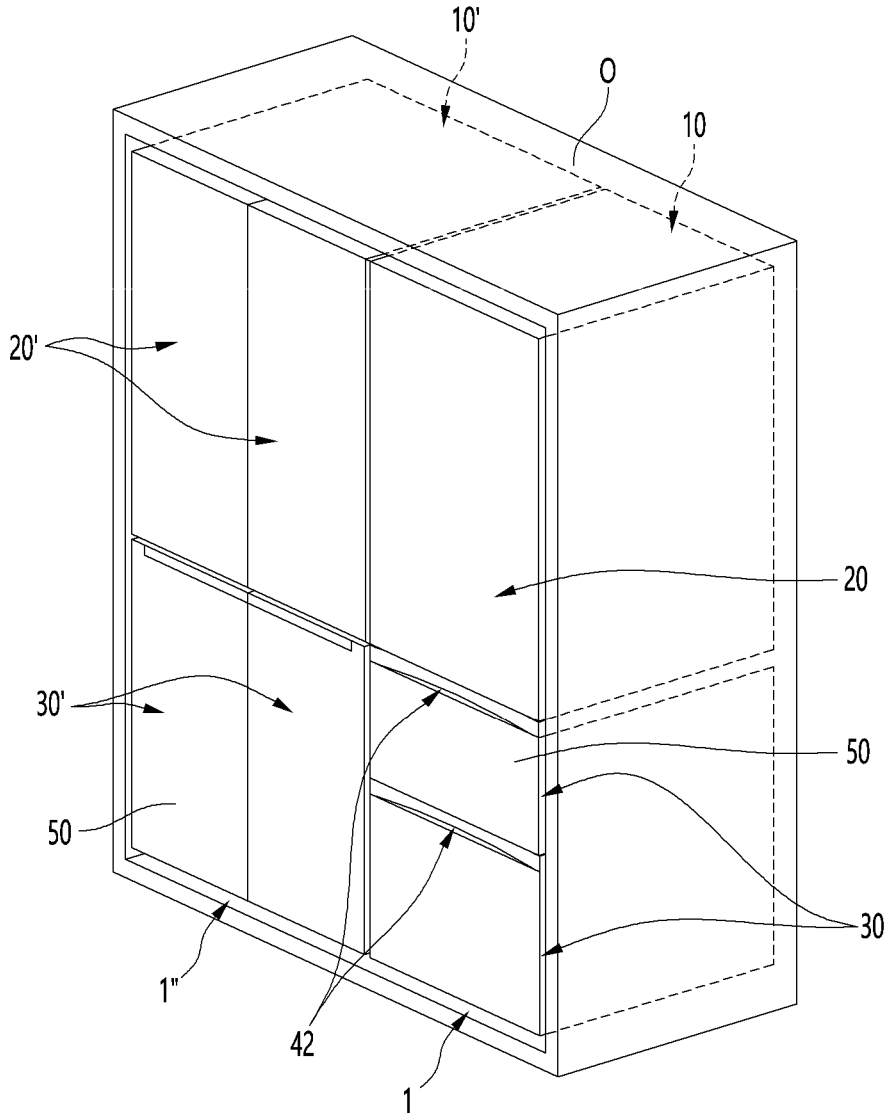
FIG. 49 is a perspective view illustrating a state in which refrigerators are disposed according to another embodiment.
Figure 50:
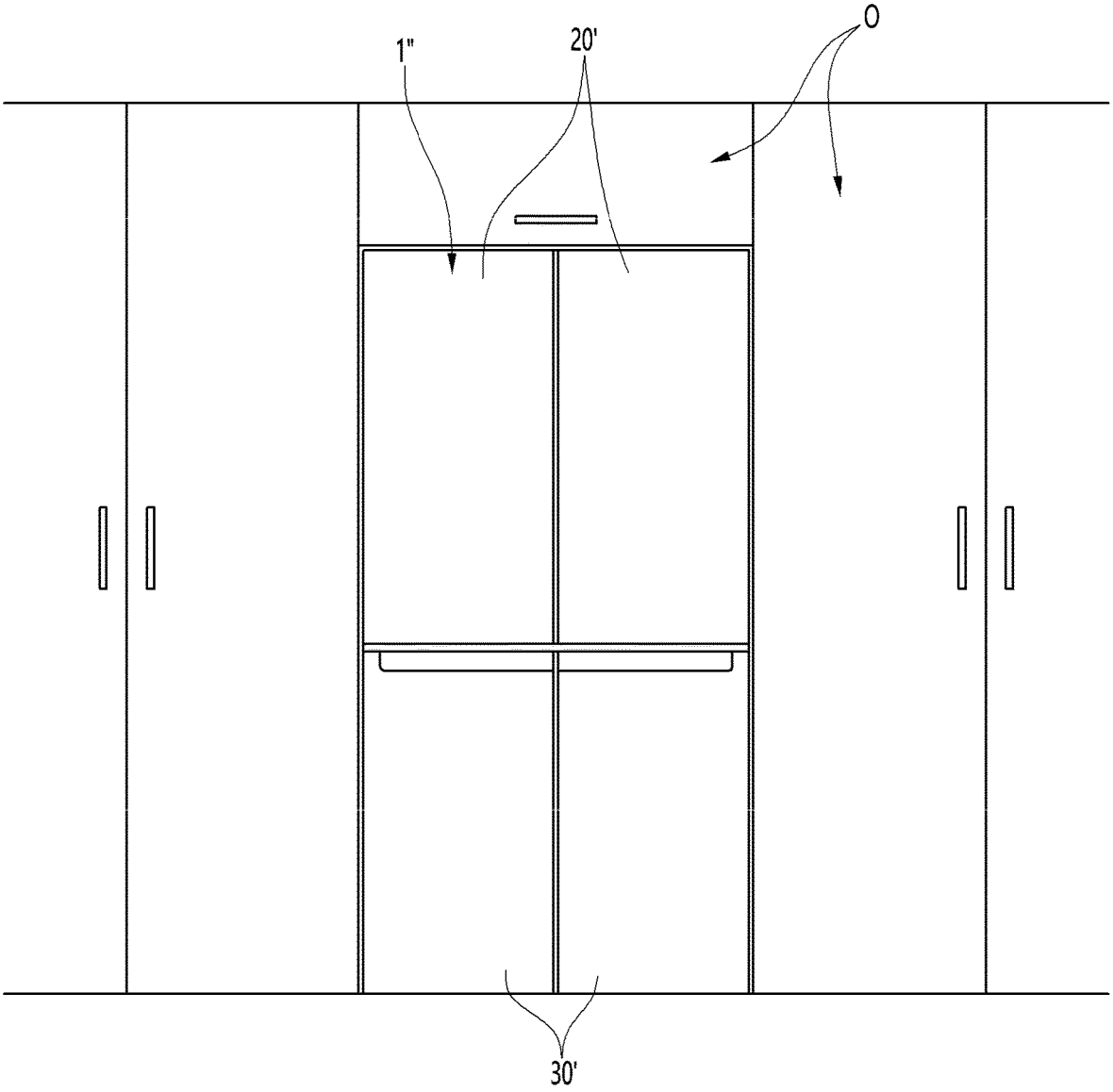
FIG. 50 is a front view illustrating a state in which a built-in refrigerator is mounted.

FIG. 49 is a perspective view illustrating a state in which refrigerators are disposed according to another embodiment. Also, FIG. 50 is a front view illustrating a state in which a built-in refrigerator is mounted.

Referring to the drawings, a refrigerator 1" according to an embodiment includes a cabinet 10 defining a storage space having an opened front surface and a door opening or closing the storage space. Here, an outer appearance of the refrigerator 1 may be defined by a cabinet 10 and doors 20 and 30.

Also, the refrigerator 1 may be mounted so as to harmonize with furniture or wall O of an indoor space. As illustrated in FIG. 1, each of the refrigerators 1 and 1" may be installed in the indoor space such as a kitchen and may be disposed adjacent to the furniture or the wall O to harmonize with each other. That is, a space corresponding to a size of each of the refrigerators 1 and 1" may be provided in the furniture or the wall O, and the refrigerator 1 may be accommodated or disposed in a built-in type.

Also, as illustrated in FIG. 49, the other refrigerator 1" may be continuously disposed in parallel at a side of the refrigerator 1. That is, a space in which a plurality of refrigerators 1 and 1" may be disposed may be provided by the furniture or the wall O.

The plurality of refrigerators 1 and 1" may have the same structure, and as necessary, the refrigerators 1 and 1' having various structures may be disposed in combination. For example, as illustrated in FIG. 49, in the refrigerator 1 disposed on a right side, doors 20 and 30 may be disposed vertically. That is, the right refrigerator 1 may be configured so that the door 20 that is opened and closed in a rotating manner is provided at an upper side, and the door 30 that is opened and closed in a sliding manner is provided at a lower side. Here, an upper decor 142 having a handle may be provided at an upper end of the door 30, and a user may open the door 30 by holding and pulling the handle.

Also, the refrigerator 1" disposed side by side at a left side may be configured so that an upper storage space is opened and closed by a pair of doors 20', and a lower storage space is opened and closed by a pair of doors 30'. Also, the doors 20' and 30' may be configured to be opened and closed in the rotating manner, and the doors 20' and 30' may be referred to as French-type doors. Here, an upper decor 142 having a handle may be provided at an upper end of the door 30' that is opened and closed in a rotation manner, and a user may open the door 30' by holding and pulling the handle.

A panel assembly 50 may be mounted on all of the doors 20, 30, 20', and 30' of the refrigerators 1 and 1". The panel assembly 50 may define front surfaces of the doors 20, 30, 20', and 30' and thus may define an outer appearance of each of the refrigerators 1 and 1" when viewed from a front side.

The doors 20, 30, 20', and 30' of the refrigerators 1 and 1" may have only different sizes, and panel assemblies 50 having the same structure may be mounted. Thus, even if the plurality of refrigerators 1 and 1" are disposed, the same outer appearance, an outer appearance such as a color and texture may be provided. Of course, the panel assemblies 50 may have different colors or different textures, as necessary.

Also, since each of the panel assemblies 50 has a detachable structure, the panel assembly 50 having an appropriate outer appearance may be selected according to an environment in which the refrigerators 1 and 1" and thus mounted.

When the refrigerator 1" is mounted on the furniture or wall O, the outer appearance of the refrigerator 1" may be provided to have the same material or materials having the same texture as the furniture or wall O, and thus, the outer appearance of the refrigerator and the adjacent furniture or wall O may have a sense of unity. Of course, even if the outer appearance of the refrigerator 1" and the furniture or wall O do not have a sense of unity, the refrigerator 1" may be made of a material that is capable of harmonized with the furniture or wall O.

Also, the refrigerator 1 may be disposed adjacent to the adjacent refrigerator 1" and the furniture or wall O and also may be disposed close to the adjacent refrigerator 1 and the furniture or wall O in a range that does not interfere when the doors 20 and 30 are opened and closed.

A structure and mounting structure of the panel assembly 50 according to an embodiment may be the same in both the left refrigerator 1" and the right refrigerator 1. Therefore, hereinafter, a structure of the left refrigerator 1" of the refrigerators 1 and 1" of FIG. 49 will be described in more detail.

Also, for convenience of explanation and understanding, the panel assembly 50 and a mounting structure of the panel assembly 50 will be described with reference to the door 30' provided on a lower portion of the left refrigerator 1". That is, it should be noted in advance that the structure according to an embodiment is equally applicable to the lower doors of the refrigerator on the right side.

Figure 51:
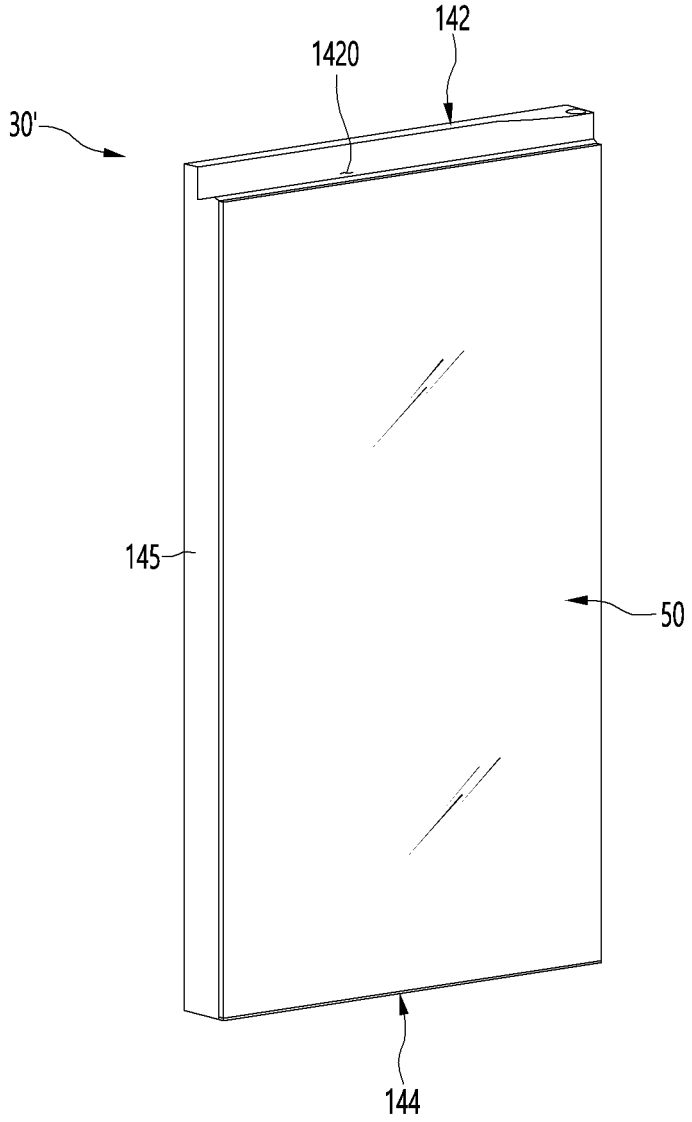
FIG. 51 is a perspective view illustrating a door of the refrigerator.
Figure 52:
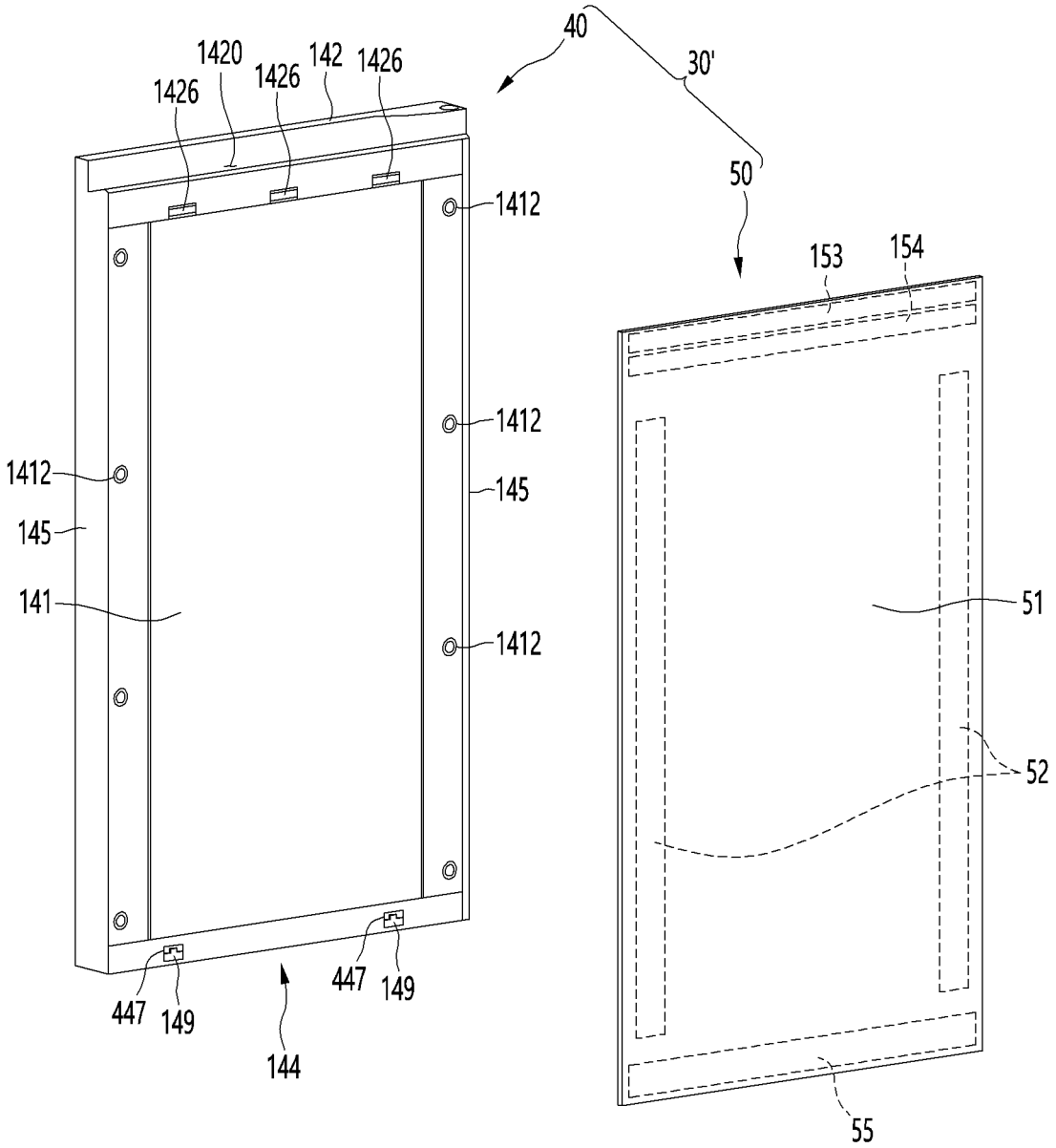
FIG. 52 is an exploded front perspective view of the door.
Figure 53:
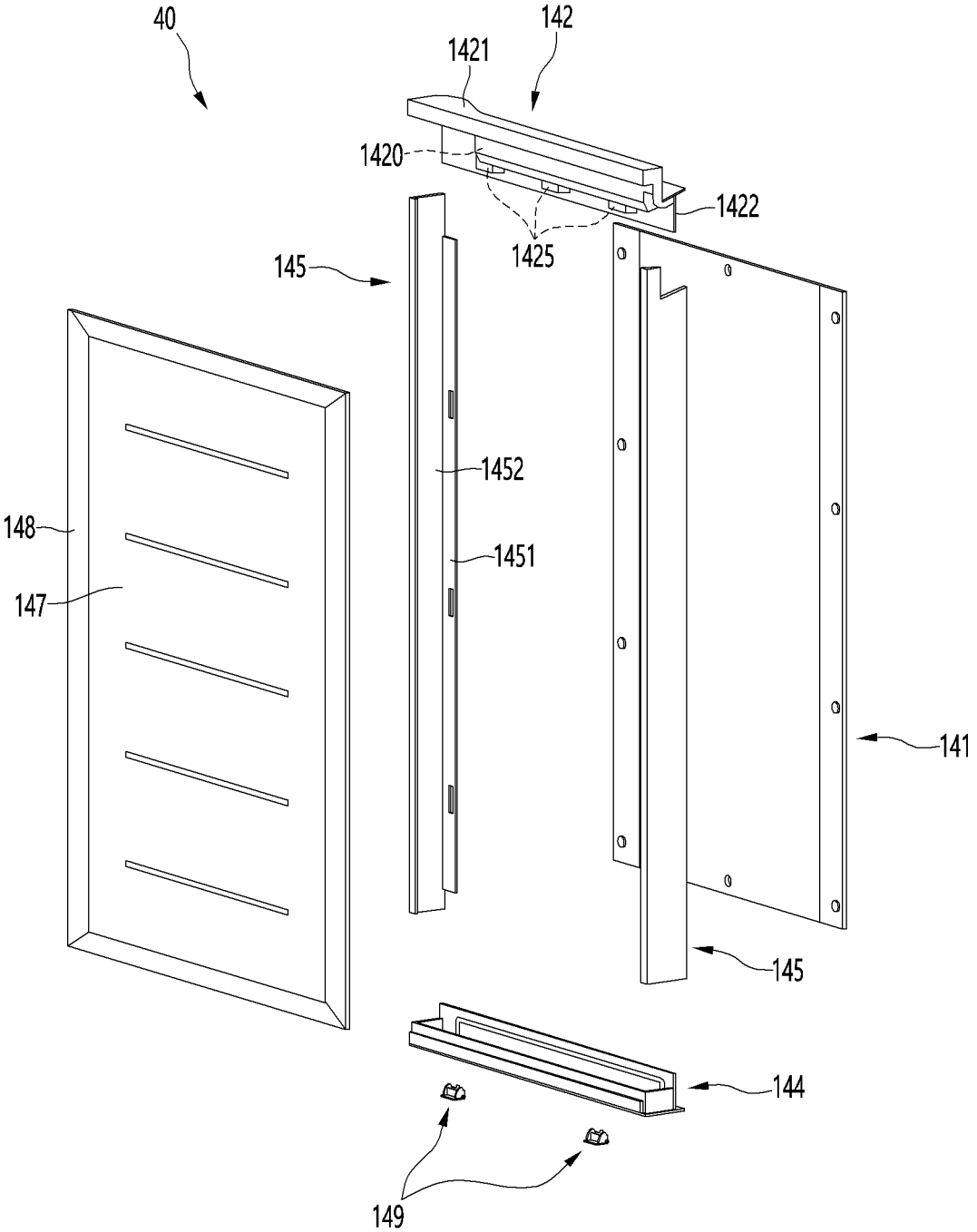
FIG. 53 is an exploded perspective view illustrating a state in which a door body that is one component of the door is disassembled.

FIG. 51 is a perspective view illustrating a door of the refrigerator. Also, FIG. 52 is an exploded front perspective view of the door. Also, FIG. 53 is an exploded perspective view illustrating a state in which a door body that is one component of the door is disassembled. As illustrated in the drawings, the door 30 may be filled with an insulator 143 (see FIG. 65) and may include a door body 40 that substantially opens and closes the storage space and a panel assembly 50 mounted on the door body 40.

The door body 40 may have a predetermined thickness, and the insulator 143 may be filled therein to insulate the storage space. Also, the panel assembly 50 may be mounted on a front surface of the door body 40 to define outer appearances of the front surfaces of the door 20 and the refrigerator 1. The panel assembly 50 may be mounted to be easily detachable from the door body 40, and the panel assembly 50 may be easily detachable even when the door 30 is mounted on the cabinet 10.

Thus, the panel assembly 50 may be mounted in consideration of the outer appearance of the furniture or wall O, and the panel assembly 50 may be designed to be desired by the user and be mounted or replaced, as necessary.

Referring to the structure of the door body 40, the door body 40 may include a front plate 141, a side frame 1145, an upper cap decor 142, a lower cap decor 144, a door liner 147, and a gasket 148 as a whole. Also, the insulator 143 may be filled inside the door body 40.

In detail, the front plate 141 may define a front surface of the door body 40 and be provided in a plate shape. The front plate 141 may be made of a steel material and define a surface facing a rear surface of the panel assembly 50.

A plurality of screw holes 1412 may be defined along a circumference of the front plate 141. Screws coupled to the upper cap decor 142, the lower cap decor 144, and both the side frames 1145 may be coupled to the screw hole 1412.

The upper cap decor 142 and the lower cap decor 144 may be respectively disposed at upper and lower ends of the front plate 141 to define top and bottom surfaces of the door body 40. The upper cap decor 142 may be provided with a handle groove 1420 through which a user puts a hand to pull the door. The handle groove 1420 may have various shapes that are held by the user and thus be referred to as a handle without being limited to a recessed shape.

Also, the side frames 1145 may be coupled to both left and right side ends of the front plate 141, respectively, and upper and lower ends of each of the side frames 1145 may be connected to the upper cap decor 142 and the lower cap decor 144, respectively.

The side frame 1145 may connect the upper cap decor 142 to the lower cap decor 144 and simultaneously may connect the front plate 141 to the door liner 147. Also, the side frame 1145 may define both side surfaces of the door body 40.

Referring to the detailed structure of the side frame 1145, the side frame 1145 may include a frame side surface 1451 and a frame front surface 1452. The frame side surface 1451 may define a surface exposed to a side of the door body 40 and be provided in a flat shape. An upper end of the frame side surface 1451 may be in contact with the upper cap decor 142, and a lower end of the frame side surface 1451 may be in contact with the lower cap decor 144.

Also, the frame front surface 1452 may extend inward from a front end of the frame side surface 1451. The frame front surface 1452 may support both left and right side ends of the front plate 141. The frame front surface 1452 may extend from an upper end to a lower end of the side frame 1145 and be disposed perpendicular to the frame side surface 1451.

The door liner 147 may be coupled to rear surfaces of the upper cap decor 142, the lower cap decor 144, and the side frame 1145. The door liner 147 may be provided in a plate shape to define the rear surface of the door body 40. The door liner 147 may be made of a plastic material and may be vacuum-molded to define a shape of the rear surface of the door body 40.

Also, the gasket 148 may be disposed along the circumference of the rear surface of the door liner 147. The gasket 148 may be in contact with a circumference of the cabinet 10 while the door 20 is closed to seal the storage space.

Hereinafter, structures of the upper cap decor 142 and the lower cap decor 144 constituting the door body 40 will be described in more detail with reference to the drawings.

Figure 54:
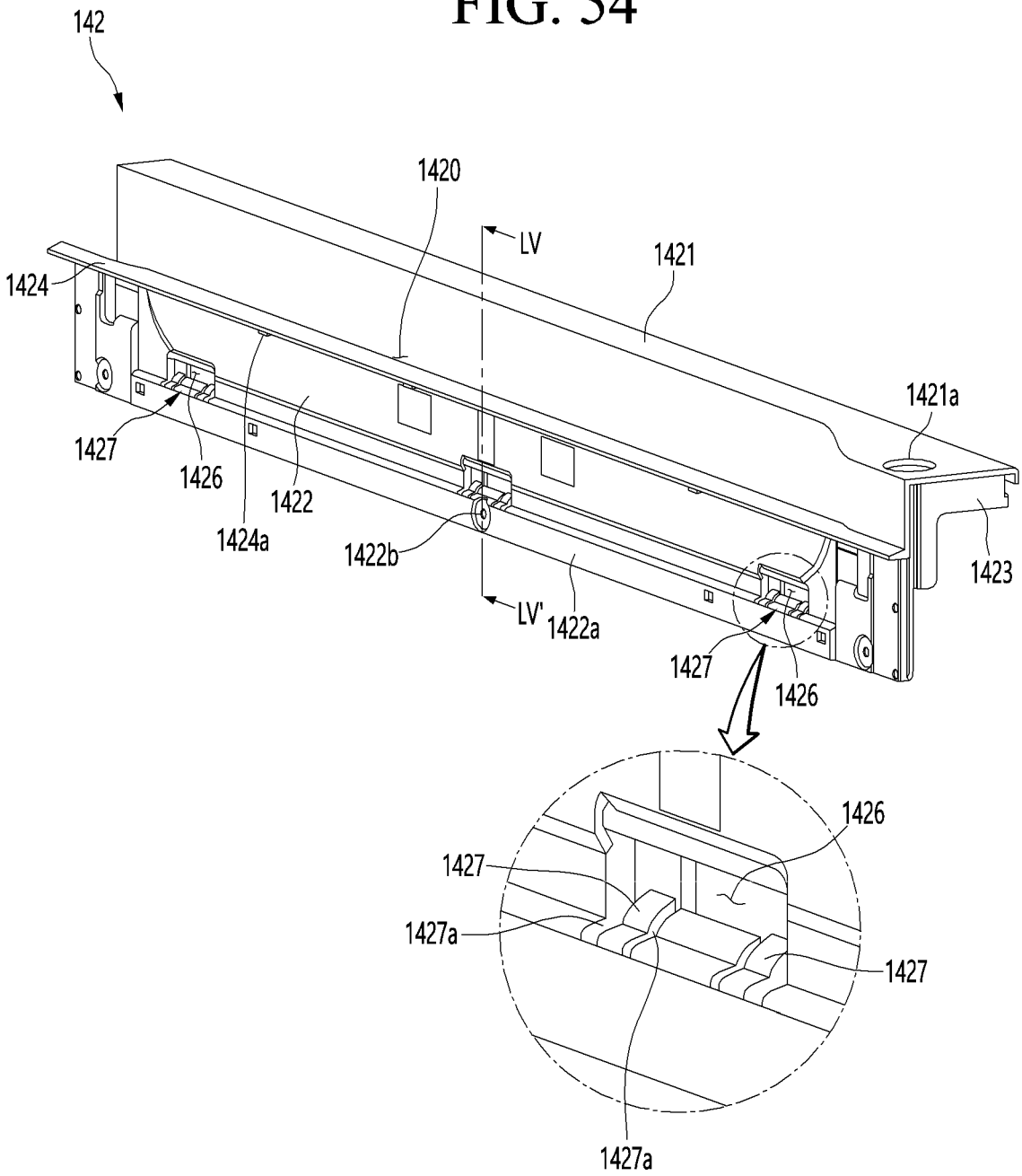
FIG. 54 is a perspective view of an upper cap decor that is one component of the door.
Figure 55:
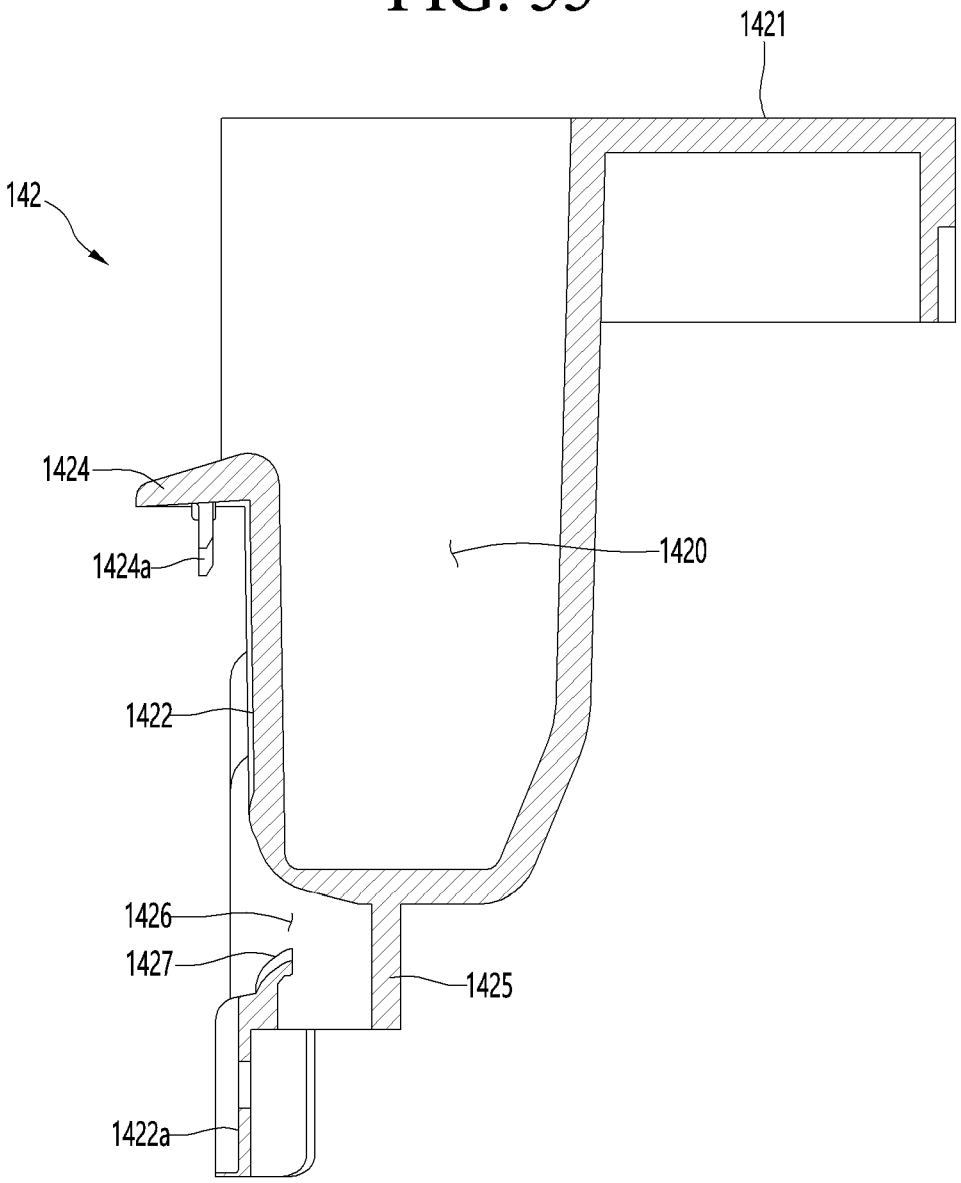
FIG. 55 is a cross-sectional view taken along line LV-LV' of FIG. 54.

FIG. 54 is a perspective view of an upper cap decor that is one component of the door. Also, FIG. 55 is a cross-sectional view taken along line LV-LV' of FIG. 54.

As illustrated in the drawings, the upper cap decor 142 may define an upper portion of the door 30 and also may define a top surface of the door 30, which is exposed to the outside in an assembled state. Also, the upper cap decor 142 may be coupled to the front plate 141, the door liner 147, and the upper end of the side frame 1145.

In detail, the upper cap decor 142 may be made of a plastic material and may include a top surface 1421, a front surface 1422, and both side surfaces 1423.

The top surface 1421 may define the top surface of the door 30, and the front surface 1422 and both the side surfaces 1423 may be disposed along a circumference of the top surface 1421. The front plate 141 may be coupled to the front surface 1422, and the side frames 1145 may be coupled to the left and right side surfaces 1423, respectively. Also, the door liner 147 may be coupled to a rear end of the top surface 1421, and an upper support end 1424 protruding forward may be disposed on the front surface 1422 of the upper cap decor 142.

The upper support end 1424 may extend from a left end to a right end of the upper cap decor 142 and may support the upper end of the panel assembly 50 when the panel assembly 50 is mounted.

Also, a plurality of upper ribs 1424*a* protruding downward may be disposed on a bottom surface of the upper support end 1424. The upper rib 1424*a* may be configured to restrict an upper end of the panel assembly 50 and may be inserted into the rib insertion groove 1533 of the fixing bracket 153 to be described in detail below. A plurality of upper ribs 1424*a* may be disposed at a regular interval along the upper support end 1424.

The front surface 1422 of the upper cap decor 142 may include an upper portion exposed to the outside and a lower portion covered by the panel assembly 50, based on the upper support end 1424. The upper support end 1424 may be provided with the handle groove 1420 for allowing the user to hold the door 30 to be pulled in and out.

The handle groove 1420 may be defined to be recessed between the front surface 1422 and the top surface 1421 of the upper cap decor 142 and also may be defined over most of an area expect for both ends of the upper cap decor 142 along a horizontal direction of the upper cap decor 142.

Also, the handle groove 1420 may be recessed downward from the top surface 1421 of the upper cap decor 142 to extend to an upper end of the insertion hole 1426 to be described below. In detail, a bottom surface of the handle groove 1420 may be disposed above the insertion hole 1426.

Also, the upper support end 1424 corresponding to a front end of the handle groove 1420 may be disposed lower than a top surface 1421, and thus a portion of the handle groove 1420 may be exposed when viewed from the front side.

The handle groove 1420 may provide a recessed space 1425 so that the user is capable of holding the handle groove 1420 in a state in which the hand is inserted at any position on the top surface of the door 30. Also, the lower portion of the handle groove 1420 may be disposed at a substantially lower position than the upper end of the panel assembly 50, and when the hand is inserted into the handle groove 1420 to be pulled, force may also be essentially provided to the upper end of the panel assembly 50.

Therefore, the panel assembly 50 has to have a firmly fixed structure with the upper cap decor 142 at the upper end. As a result, the coupling structure may be provided between the upper bracket 154, the fixing bracket 153, and a front surface of the upper cap decor 142. The coupling structure of the panel assembly 50 will be described in more detail below.

Also, an upper plate coupling portion 1422*a* supporting the front plate 141 at the rear side may be disposed on a lower portion of the front surface of the upper cap decor 142. Also, a screw hole 1422*b* into which a screw coupled to the front plate 141 may be defined in the upper plate coupling portion 1422*a*.

Also, an insertion hole 1426 may be defined in the front surface of the upper cap decor 142. The insertion hole 1426 may be a portion into which the insertion protrusion 1542 of the upper bracket 154 to be described below is inserted and may be defined to pass through the front surface 1422 of the upper cap decor 142.

A plurality of insertion holes 1426 may be defined at the same height at regular intervals and also may be defined along the lower end of the handle groove 1420. For example, the protrusion insertion hole 1426 may be defined at an intermediate point in the horizontal direction of the door, and a pair of protrusion insertion holes 426 may be defined at both side ends of the handle groove 1420, which are spaced the same distance from each other at both the left and right sides, based on the intermediate point to firmly fix the entire upper end of the pan assembly 50.

A protrusion insertion portion 1425 defining a space into which the insertion protrusion 1542 is inserted may be disposed at the rear side of the insertion hole 1426. A front surface of the protrusion insertion portion 1425 may be defined by the insertion hole 1426, and a space in which the insertion protrusion 1542 is accommodated may be defined.

Also, a bottom surface of the protrusion insertion portion 1425 may be opened so that the insertion hole 1426 and the support portion 1427 defined in the insertion hole 1426 are easily molded. That is, the upper cap decor 142 may be injection-molded using a plastic material, and the bottom surface of the protrusion insertion portion 1425 may be opened to locate a mold for molding the insertion hole 1426 and the support portion 1427.

Also, the opened bottom surface of the protrusion insertion portion 1425 may be shielded by an insertion portion cover 1429. The protrusion insertion portion 1425 may be shielded by the insertion portion cover 1429 to prevent an insulator 143 filled in the door 30 from being introduced into the inside of the protrusion insertion portion 1425.

A support portion 1427 may be disposed in the insertion hole 1426 to support the panel assembly by being in contact with the insertion protrusion 1542.

The support portion 1427 may be provided to protrude upward and backward from a lower end of the insertion hole 1426. Also, the support portion 1427 may be disposed at each of both left and right sides of the lower end of the insertion hole 1426 and may be elastically deformed according to the mounting of the insertion protrusion 1542.

The support portion 1427 may extend upward from a lower end of the insertion hole 1426 and may be inclined or rounded backward, that is, the inner side of the protrusion insertion portion 1425 as it extends upward. Also, the support portion 1427 may have a thickness that gradually decreases as it protrudes upward. Also, a cutoff portion 1427*a* may be provided on each of both left and right sides of the support portion 1427 so that the support portion 1427 is elastically deformed easily according to the contact with the insertion protrusion 1542. Thus, the support portion 1427 may elastically support the bottom surface of the insertion protrusion 1542 while the insertion protrusion 1542 is inserted into the insertion hole 1426.

Figure 56:
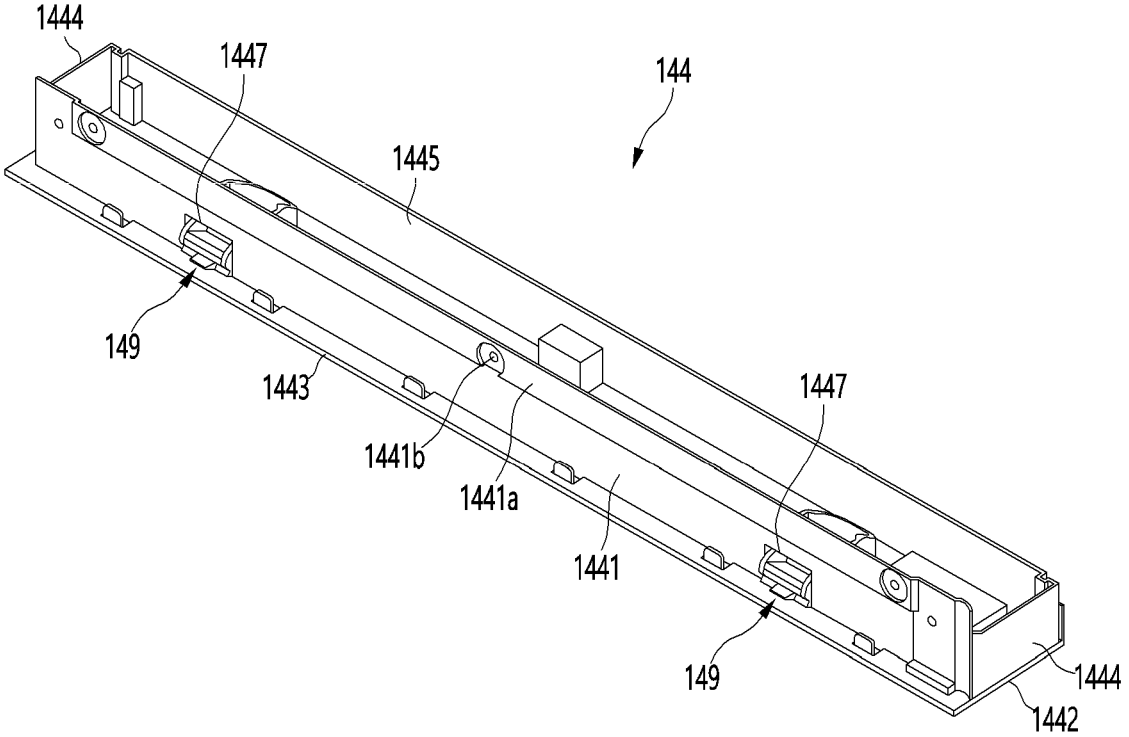
FIG. 56 is a perspective view of a lower cap decor that is one component of the door.
Figure 57:
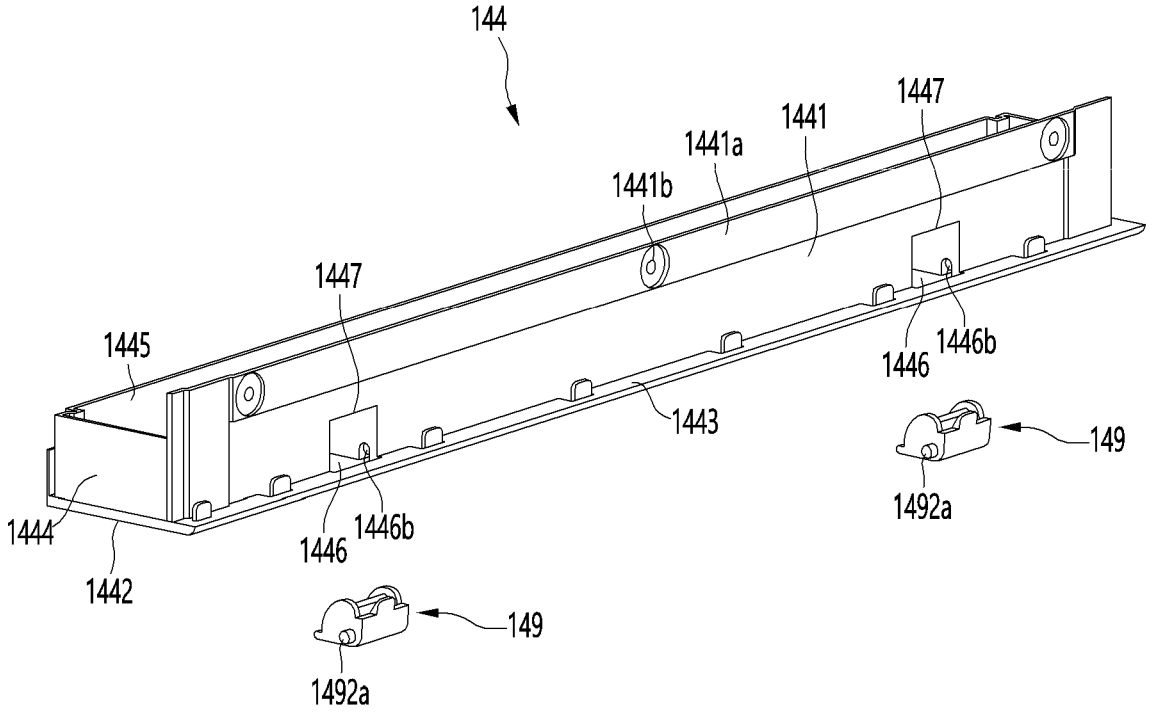
FIG. 57 is an exploded top perspective view illustrating a coupling structure of the lower cap decor and a locking member.
Figure 58:
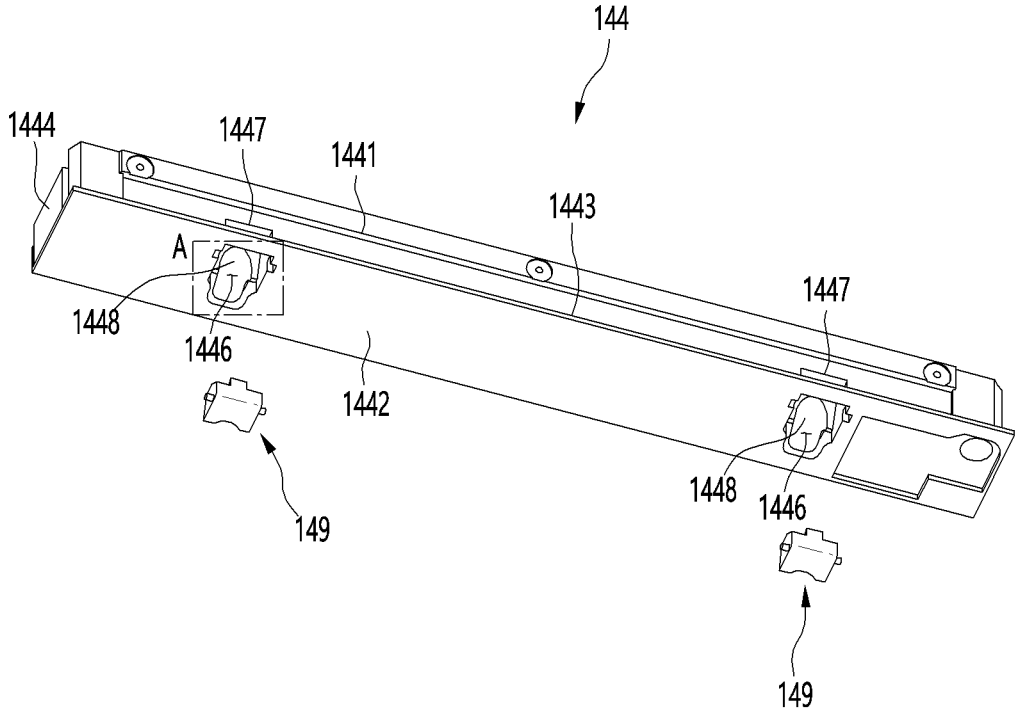
FIG. 58 is an exploded bottom perspective view illustrating a coupling structure of the lower cap decor and the locking member.
Figure 59:
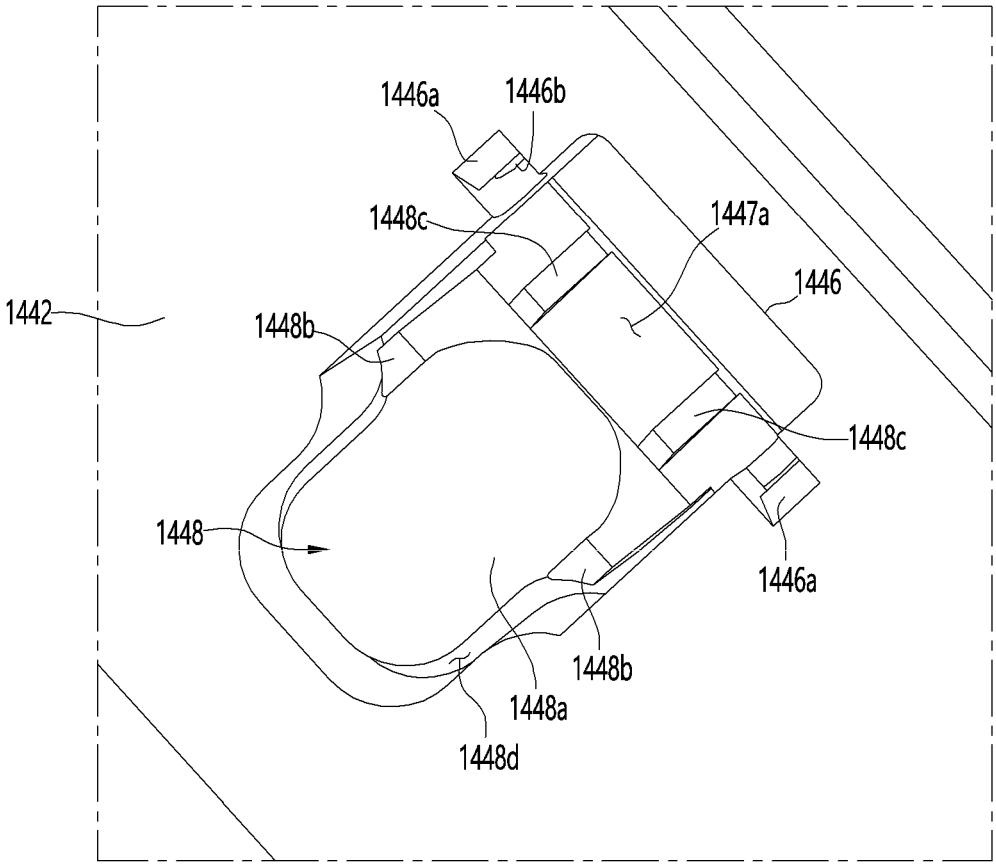
FIG. 59 is an enlarged view illustrating a portion A of FIG. 18.

FIG. 56 is a perspective view of the lower cap decor that is one component of the door. Also, FIG. 57 is an exploded top perspective view illustrating a coupling structure of the lower cap decor and a locking member. Also, FIG. 58 is an exploded bottom perspective view illustrating a coupling structure of the lower cap decor and the locking member. Also, FIG. 59 is an enlarged view illustrating a portion A of FIG. 18.

As illustrated in the drawings, the lower cap decor 144 may be made of a plastic material may define a lower portion of the door body 40 and also define a bottom surface of the door body 40. The lower cap decor 144 may include a front surface 1441, a bottom surface 1442, both left and right side surfaces 1444, and a rear surface 1445 as a whole. Also, the top surface of the lower cap decor 144 may be opened, and the heat insulator 143 may be filled in the opened inner side.

The front surface 1441 may support the lower end of the front plate 141 at the rear side. Also, both the side surfaces 1444 may support the lower end of the side frame 1145 at the inside. Also, the rear surface 1445 may support the lower end of the door liner 147 from the front.

A lower plate coupling portion 1441*a* supporting the front plate 141 at the rear side may be disposed on the front surface 1441 of the lower cap decor 144. The lower plate coupling portion 1441*a* may extend from a left end to a right end of the front surface, and a screw hole 1441*b* to which a plurality of screws passing through the front plate 141 is coupled may be further provided.

A lower support end 1443 extending forward may be disposed on a lower end of the front surface 1441 of the lower cap decor 144. The lower support end 1443 may protrude forward from the lower end of the front surface 1441 of the lower cap decor 144 and may support the lower end of the panel assembly 50.

Also, a front opening 1447 may be defined in a lower end of a front surface of the lower cap decor 144 that is in contact with the lower support end 1443. The front opening 1447 may be opened so that a portion of a locking member 149 to be described in detail below is exposed. Also, to mount the panel assembly 50, a restriction protrusion 1552 to be described below may be inserted through the front opening 1447.

For this, a shaft coupling portion 1446*b* may be disposed inside the front opening 1447, and the rotation shaft of the locking member 149 may be mounted on the shaft coupling portion 1446*b* so that the locking member 149 is mounted rotatably. A pair of front openings 1447 may be defined in both left and right sides of the lower cap decor 144, respectively.

The lower cap decor 144 may have a bottom opening 1446 defined at a position corresponding to the front opening 1447 among the bottom surfaces of the lower cap decor 144. The bottom opening 1446 may be opened downward for manipulation of the locking member 149. Also, the front opening 1447 and the bottom opening 1446 may be connected to each other to define a portion of an accommodation space 1447*a* inside the lower cap decor 144. That is, the accommodation space 1447*a* in which the locking member 149 is mounted may be defined in the lower cap decor 144. Thus, a front surface of the accommodation space 1447*a* may be opened to define the front opening 1447, and a bottom surface of the accommodation space 1447*a* is opened to define the bottom opening 1446.

The accommodation space 1447*a* may have a size in which the locking member 149 is rotatably mounted. Also, the locking member 149 may be exposed through the front opening 1447 to be restricted by the restriction protrusion 1552 when the panel assembly 50 is mounted and may be exposed through the bottom opening 1446 so that a user manipulates the locking member 140 to separate the panel assembly 50.

A shaft coupling portion 1446*b* may be recessed at each of both left and right sides of the opening 1446, and the rotation shaft 1492*a* protruding from each of both side surfaces of the locking member 149 may be inserted into the shaft coupling portion 1446*b*. Also, a hook 1446*a* may protrude from the shaft coupling portion 1446*b* and have an inclination to facilitate the insertion of the rotation shaft 1492*a* and restrict the rotation shaft 1492*a* so that the rotation shaft 1492*a* is not easily separated after being inserted into the inner side of the shaft coupling portion 1446*b*.

Also, the bottom opening 1446 may have a size greater than that of the locking member 149 to facilitate the user's manipulation and may be further opened backward so that the user's finger is inserted in the state in which the locking member 149 is mounted.

Also, a manipulation guide 1448 for guiding the finger when the user manipulates the locking member 149 by putting the finger through the bottom opening 1446 may be disposed in the accommodation space 1447*a*. The manipulation guide 1448 may extend backward from the upper side of the accommodation space 1447*a* and may extend toward a rear end of the bottom opening 1446.

Also, an open stopper 1448*c* protruding downward may be disposed at both left and right sides of an upper end of the manipulation guide 1448. The open stopper 1448*c* may allow the locking member 149 to be maintained in a fully rotating state such as a state before mounting or detaching the panel assembly 50 and may be in contact with a manipulation portion 1491 of the locking member 149.

An upper end of the manipulation guide 1448 may be fixed, and a cutoff portion 1448*d* may be disposed on an extending circumference except for the upper end. Thus, the manipulation guide 1448 may be elastically deformed while rotating based on the fixed upper end according to the user's manipulation.

In detail, the manipulation guide 1448 may include a guide surface 1448*a* that provides a rounded curved surface, and the guide surface 1448*a* may be disposed above the locking member 149 to guide the insertion position of the user's finger.

Also, a restriction stopper 1448*b* protruding downward may be disposed on each of both left and right sides of the manipulation guide 1448. The restriction stopper 1448*b* may restrict the locking member 149 from arbitrarily rotating in a state in which the panel assembly 50 is mounted and may extend to be in contact with the manipulation portion 1491.

Hereinafter, a structure of the locking member 149 will be described in more detail with reference to the drawings.

Figure 60:
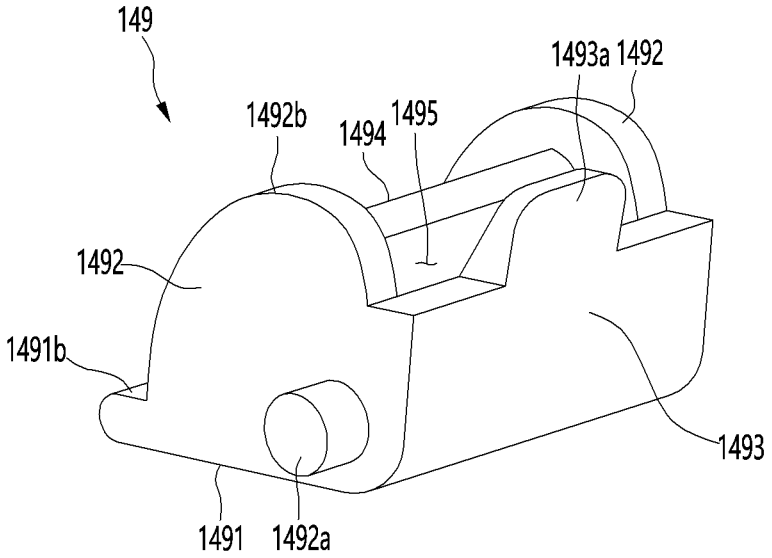
FIG. 60 is a perspective view of the locking member when viewed from one side.
Figure 61:
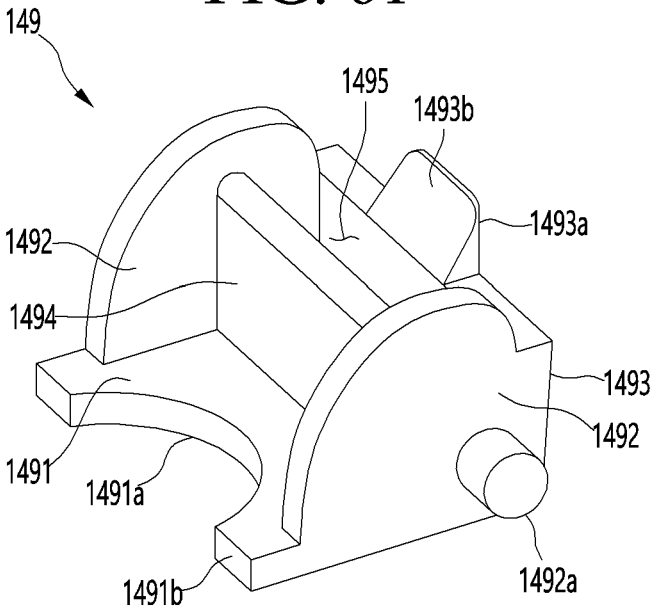
FIG. 61 is a perspective view of the locking member when viewed from the other side.

FIG. 60 is a perspective view of the locking member when viewed from one side. Also, FIG. 61 is a perspective view of the locking member when viewed from the other side.

As illustrated in the drawings, the locking member 149 may include a manipulation portion 1491 manipulated by a user, a rotation shaft 1492*a* serving as a rotation center of the locking member 149, and restriction portions 493 and 494 extending from the manipulation portion 1491 to be hooked to be restricted by the restriction protrusion 1552.

In detail, the manipulation portion 1491 may define a bottom surface of the locking member 149 and be exposed to the bottom opening 1446 in a state in which the locking member 149 is mounted and manipulated by the user. Also, a recess 1491*a* may be defined in an extending end of the manipulation portion 1491 so that the user easily pulls the manipulation portion 1491 by inserting a finger. Also, both side ends 1491*b* of the extending end of the manipulation portion 1491, that is, both left and right side ends 1491*b* of the recess 1491*a* may be in contact with the open stopper 1448*c* or the restriction stopper 1449*b* according to the rotation state of the locking member 149.

Also, a side surface portion 1492 extending upward may be disposed at each of both side ends of the manipulation portion 1491. A circumference 1492*b* of the side surface portion 1492 may be provided to be rounded so that the side surface portion 1492 does not interfere with the manipulation guide 1448 when the locking member 149 rotates. Also, the manipulation portion 1491 may protrude more than the rear end of the side surface portion 1492. Also, the rotation shaft 1492*a* protruding laterally may be disposed at one side of the side surface portion 1492. The rotation shaft 1492*a* may allow the locking member 149 to be mounted inside the accommodation space 1447*a* and may serve as a rotation center of the locking member 149. Also, the rotation shaft 1492*a* may be disposed at a position adjacent to a front end of the manipulation portion 1491.

Each of the restriction portions 493 and 494 may extend in a direction crossing from the manipulation portion 1491 to the manipulation portion 1491. For example, the restriction portions 493 and 494 may extend perpendicular to the manipulation portion 1491 to connect both the side surface portions 1492 to each other. Also, the restriction portions 493 and 494 may be hooked to be restricted by the restriction protrusion 1552 so as to restrict the lower end of the panel assembly 50.

The restriction portions 493 and 494 may include a first restriction portion 1493 and a second restriction portion 1494. The first restriction portion 1493 and the second restriction portion 1494 may be spaced apart from each other and may define an accommodation groove 1495 into which the restriction protrusion 1552 is inserted.

The first restriction portion 1493 may be bent from a rear end of the manipulation portion 1491 to extend upward. Here, an upper end of the first restriction portion 1493 may be disposed at a position lower than that of each of an upper end of the side surface portion 1492 and an upper end of the second restriction portion 1494.

Also, a restriction portion guide 1493*a* protruding upward may be further disposed at the center of the first restriction portion 1493. The restriction portion guide 1493*a* may extend to protrude outside the front opening 1447 in a state in which the locking member 149 rotate to an open state. Thus, when the panel assembly 50 is mounted, the restriction protrusion 1552 may be guided to be inserted into the accommodation groove 1495 along the restriction portion guide 1493*a*. The restriction member guide 1493*a* may be inclined to be lowered toward the front side.

The second restriction portion 1494 may extend parallel to the first restriction portion 1493 and may extend upward from one side of the manipulation portion 1491 spaced apart from the first restriction portion 1493. Also, the second restriction portion 1494 may be also in contact with both the side surface portions 1492. Thus, the accommodation groove in which the restriction protrusion 1552 is inserted may be defined by the manipulation portion 1491, the first restriction portion 1493, the second restriction portion 1494, and the side surface portion 1492 of left and right sides.

The accommodation groove 1495 may be opened upward, and the opened top surface may be disposed at a position lowered than each of the first and second restrictions 1493 and 1494 and an upper end of the side surface portion 1492. Also, the accommodation groove 1495 may be defined at a position corresponding to the rotation shaft 1492*a*. Thus, the locking member 149 may rotate by the restriction protrusion 1552 accommodated in the accommodation groove 1495, and the restriction protrusion 1552 may rotate so that the restriction protrusion 1552 is withdrawn outside the accommodation groove 1496.

Hereinafter, the panel assembly 50 will be described in more detail with reference to the drawings.

Figure 62:
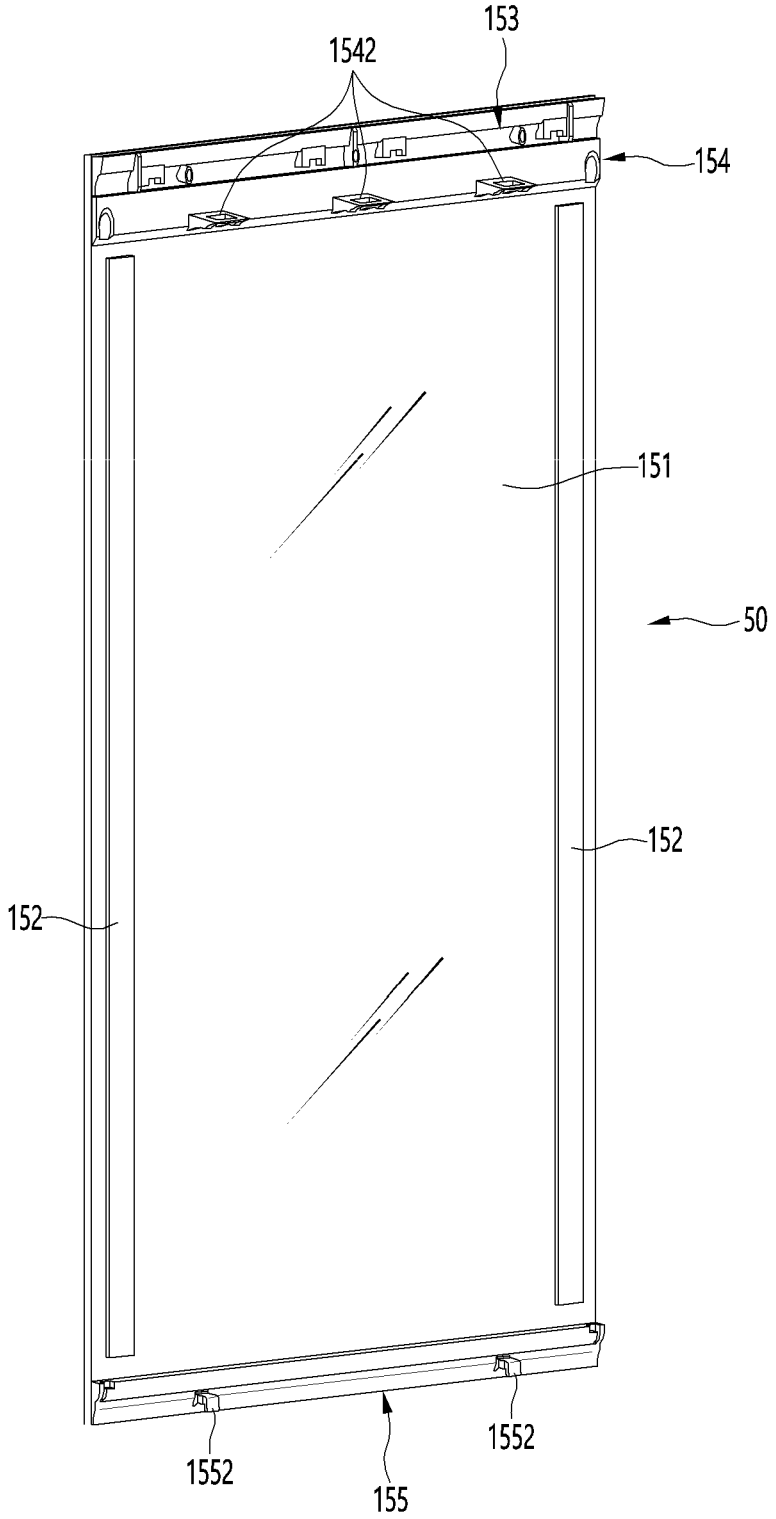
FIG. 62 is a perspective view of a panel assembly that is one component of the door.

FIG. 62 is a perspective view of the panel assembly that is one component of the door.

As illustrated in the drawing, the panel assembly 50 may include a panel 151 defining an outer appearance and upper and lower brackets 154 and 155 provided on a rear surface of the panel 151 to mount the panel assembly 50. Also, the panel assembly 50 may further include a fixing bracket 153. Also, the panel assembly 50 may further include a magnet 152 to be attached to a rear surface of the panel 151 and a front plate 141 of the door body 40.

In detail, the panel 151 may be made of a rectangular plate-shaped material having a predetermined thickness and may be made of a material that is capable of being harmonized with the furniture or wall O or the home appliance disposed therearound. For example, the panel 151 may be made of a glass material. For example, the panel 151 may be made of a tempered glass material, and the outer appearance of the door 30 may be defined by printing or attaching a film so as to have a color or pattern.

The panel 151 may have a size so that, in the state in which the panel 51 is mounted on the door body 40, upper end lower ends of the panel 51 are in contact with an upper support end 1424 and a lower support end 1443, respectively, and both side ends of the panel 51 are in contact with side frames 1145, respectively.

Also, an upper bracket 154 and a lower bracket 155 may be provided on a rear surface of the panel 151.

The upper bracket 154 may be provided on an upper portion of the panel 151 to extend from a left end to a right end of the panel 151 in a horizontal direction. The upper bracket 154 may be disposed along the upper end of the panel 151.

The upper bracket 154 may be configured to more firmly fix the panel assembly 50 to the door body 40 and may include a plurality of restriction protrusions 1552. The restriction protrusion 1552 may be provided in plurality at the same height and may be inserted into the insertion hole 1426 of the front surface of the upper cap decor 1.

Also, the restriction protrusion 1552 may be hooked to be restricted in a state of being inserted into the insertion hole 1426 and then be maintained in state of being supported by the support portion 1427. Also, when the panel assembly 50 rotate to be mounted and separated, the panel assembly 50 may be supported by the support portion 1427 to prevent the panel assembly 50 from falling due to its own weight.

A fixing bracket 153 may be further provided on an upper end of the upper bracket 154. The fixing bracket 153 may be disposed along an upper end of the panel assembly 50 and may be restricted by an upper support end 1424 when the panel assembly 50 is mounted.

The fixing bracket 153 may be separately provided and then be attached to a rear surface of the panel 151 independently of the upper bracket 154. Of course, the fixing bracket 153 may be integrated with the upper bracket 154 and then mounted on the panel 151. Here, the upper bracket 154 may be disposed along the upper end of the panel 151.

The lower bracket 155 may extend along a lower end of the panel 151 and have a length corresponding to a horizontal width of the panel 151. Also, the lower bracket 155 may be seated on the lower cap decor 144 when the panel assembly 50 is mounted.

Also, a restriction protrusion 1552 for restricting the lower end of the panel assembly 50 may be disposed on the lower bracket 155. The restriction protrusion 1552 may protrude backward and also may be inserted into the front opening 1447 when the panel assembly 50 is mounted and may be restricted by being coupled to the locking member 149.

Also, a magnet 152 may be provided at each of both left and right ends of the panel 151. The magnet 152 may be attached to the rear surface of the panel 151 by an adhesive or magnetic force. The magnet 152 may extend from an upper end to a lower end of the panel 151. Also, when the panel assembly 50 is mounted on the door body 40 in a state in which the magnet is attached to the panel 151, the magnet 152 may be attached to the front plate 141 by the magnetic force. That is, the mounting of the panel assembly 50 may be assisted by the magnet 152.

Hereinafter, structures of the upper bracket 154 and the fixing bracket 153 will be described in more detail with reference to the drawings.

Figure 63:
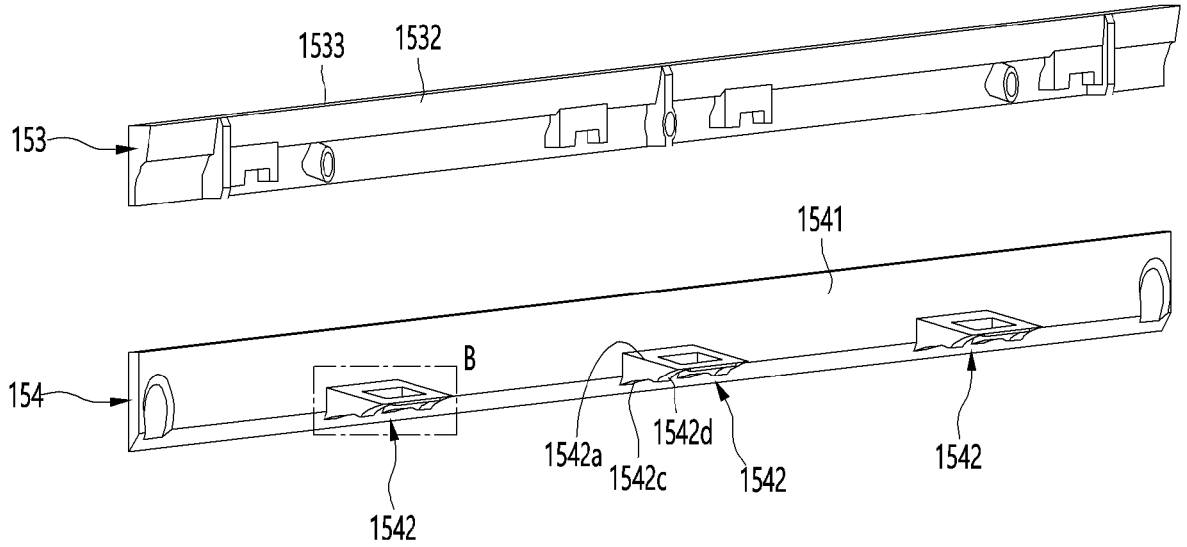
FIG. 63 is a perspective view of an upper bracket and a fixing bracket, each of which is one component of the panel assembly.
Figure 64:
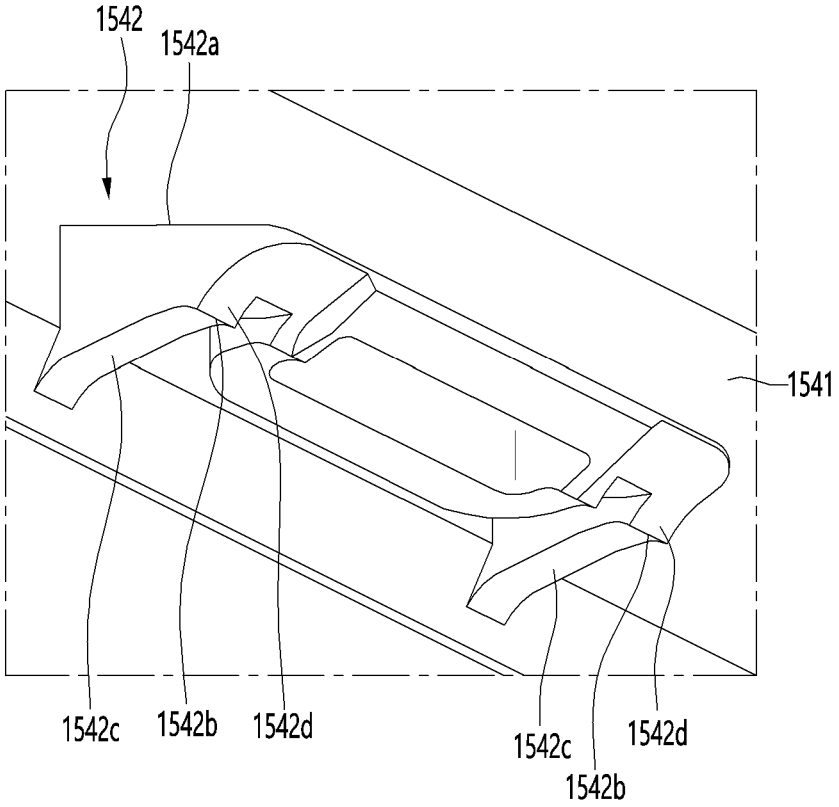
FIG. 64 is an enlarged view illustrating a portion B of FIG. 63.
Figure 65:
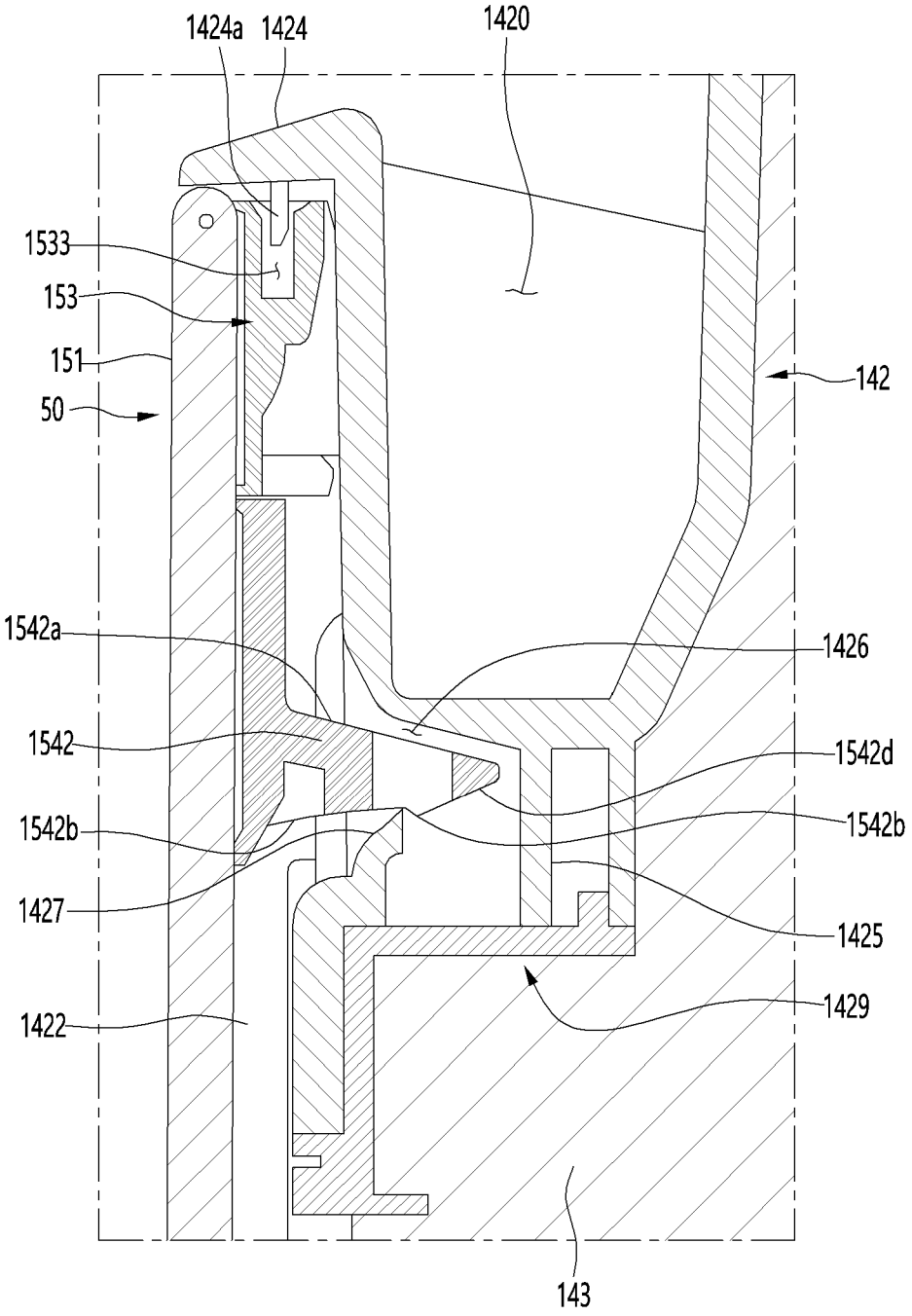
FIG. 65 is a cross-sectional view illustrating an upper end of the door in a state in which the panel assembly is mounted.

FIG. 63 is a perspective view of the upper bracket and the fixing bracket, each of which is one component of the panel assembly. Also, FIG. 64 is an enlarged view illustrating a portion B of FIG. 63. Also, FIG. 65 is a cross-sectional view illustrating an upper end of the door in a state in which the panel assembly is mounted.

As illustrated in the drawing, the fixing bracket 154 may be provided in a plate shape and may include a bracket body 1541 attached to the rear surface of the panel 151 and an insertion protrusion 1542 protruding backward from the bracket body 1541.

The bracket body 1541 may be provided to correspond to the horizontal length of the panel 151 and may have a vertical width in which the insertion protrusion 1542 is disposed. In addition, the bracket body 1541 may have a thickness thinner than that of the panel bracket 152. The bracket body 1541 may be attached to the rear surface of the panel 151 by the adhesive and may have a separate coupling structure, as necessary.

The insertion protrusion 1542 may protrude backward from the rear surface of the panel 151 and may be inserted by passing through an insertion hole 1426 of the upper cap decor 142. Also, when the insertion protrusion 1542 is inserted into the insertion hole 1426 of the upper cap decor 142, the insertion protrusion 1542 may be hooked to be restricted by the support portion 1427 and simultaneously may be supported by the support portion 1427.

In detail, the insertion protrusion 1542 may be provided in plurality along the bracket body 1541 and may protrude backward from a position corresponding to the insertion hole 1426. Particularly, the insertion protrusion 1542 may be coupled to a front surface of the upper cap decor 142, which is adjacent to the handle groove 1425 of the upper cap decor 142, and thus, additional restriction force may be applied to the upper end of the panel assembly 50, which corresponds to the handle groove 1425 to which a lot of force is applied when the door 30 is pulled in or out.

The insertion protrusion 1542 may have a thickness that gradually decreases as each of the side surfaces protrudes backward from the front side. Thus, when the panel assembly 50 rotate to allow the insertion protrusion 1542 to be accessible through the insertion hole 1426, smooth access may be achieved.

That is, a top surface 1542*a* of the insertion protrusion 1542 may be lowered toward a front side. Also, bottom surfaces 542*c* and 542*d* of the insertion protrusion 1542 may increase in height toward the front side.

A hook 1542*b* that is hooked to be restricted by the support portion 1427 may protrude from the bottom surfaces 542*c* and 542*d* of the insertion protrusion 1542. Also, the bottom surfaces 542*c* and 542*d* of the insertion protrusion 1542 may include a first bottom surface portion 1542*c* and a second bottom surface portion 1542*d* based on the hook 1542*b*. Also, when the insertion protrusion 1542 is inserted, an upper end of the support portion 1427 may be in contact with the bottom surfaces 542*c* and 542*d* of the insertion protrusion 1542.

Each of the first bottom surface portion 1542*c* and the second bottom surface portion 1542*d* may have an inclination that increases toward the front side. Also, the first bottom surface portion 1542*c* may have an inclination less than that of the second bottom surface portion 1542*d*. Thus, a front end of the first bottom surface portion 1542*c* and a rear end of the second bottom surface portion 1542*d* may naturally define a stepped portion, and a hook 1542*b* may be provided.

Thus, referring to the process in which the insertion protrusion 1542 is inserted into the insertion hole 1426, the insertion protrusion 1542 may be inserted in state in which the upper end of the support portion 1427 is in contact with the second bottom surface 1542*d*, and thus, the upper end of the support portion 1427 may be pushed downward to be elastically deformed. Also, the upper end of the support portion 1427 may be restored by the elasticity at the moment when the hook 1542*b* passes through the support portion 1427 and then may be hooked to be restricted by a front end of the first bottom surface portion 1542*c*, i.e., the hook 1542*b*. Here, a clicking sound may be heard while the support portion 1427 is elastically deformed and restored, and thus, the user may recognize that the upper end of the panel assembly 50 is hooked to be restricted through the sound. Also, since the panel assembly 50 that is relatively heavy does not fall arbitrarily in the state in which the insertion protrusion 1542 is restricted once, the user may more easily detach the panel 151.

The fixing bracket 153 may be further provided at an upper end of the upper bracket 154. The fixing bracket 153 may be in contact with the upper end of the upper bracket 154 and may have the same horizontal length as the upper bracket 154. Also, the fixing bracket 153 may be disposed along the upper end of the panel assembly 50.

A rib insertion groove 1533 may be defined in the top surface of the fixing bracket 153. The rib insertion groove 1533 may be formed from the left end to the right end of the fixing bracket 153, and the upper rib 1424*a* of the upper support end 1424 is inserted when the panel assembly 50 is mounted.

When the panel assembly 50 is mounted, the upper end of the panel assembly 50 may move first to the upper support end 1424. Here, the upper rib 1424*a* may be inserted into the rib insertion groove 1533. Also, the rear surface portion 1532 of the fixing bracket 153 may be in contact with the front surface 1422 of the upper cap decor 142 when the panel assembly 50 is mounted. Therefore, even if the user holds the handle groove 1420 strongly, the rear surface portion 1532 may be in contact with the front surface 1422 of the upper cap decor 142 so as to be prevented from being deformed or moving, and the upper rib 1424*a* and the rib insertion groove 1533 may be coupled to further reinforce the fixing structure at a position adjacent to the handle groove 1420.

Hereinafter, the lower bracket will be described in more detail with reference to the drawings.

Figure 66:
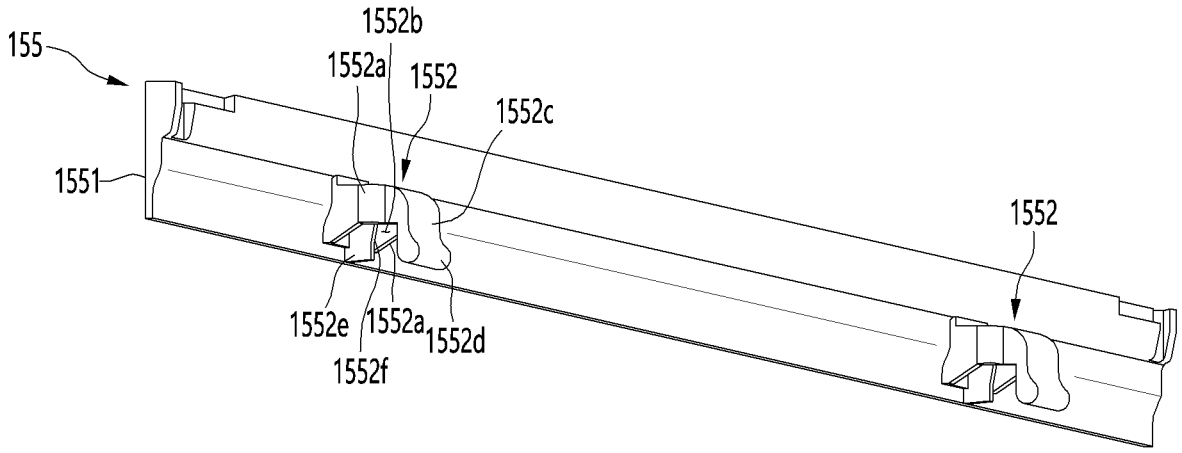
FIG. 66 is a perspective view of a lower bracket that is one component of the panel assembly.
Figure 67:
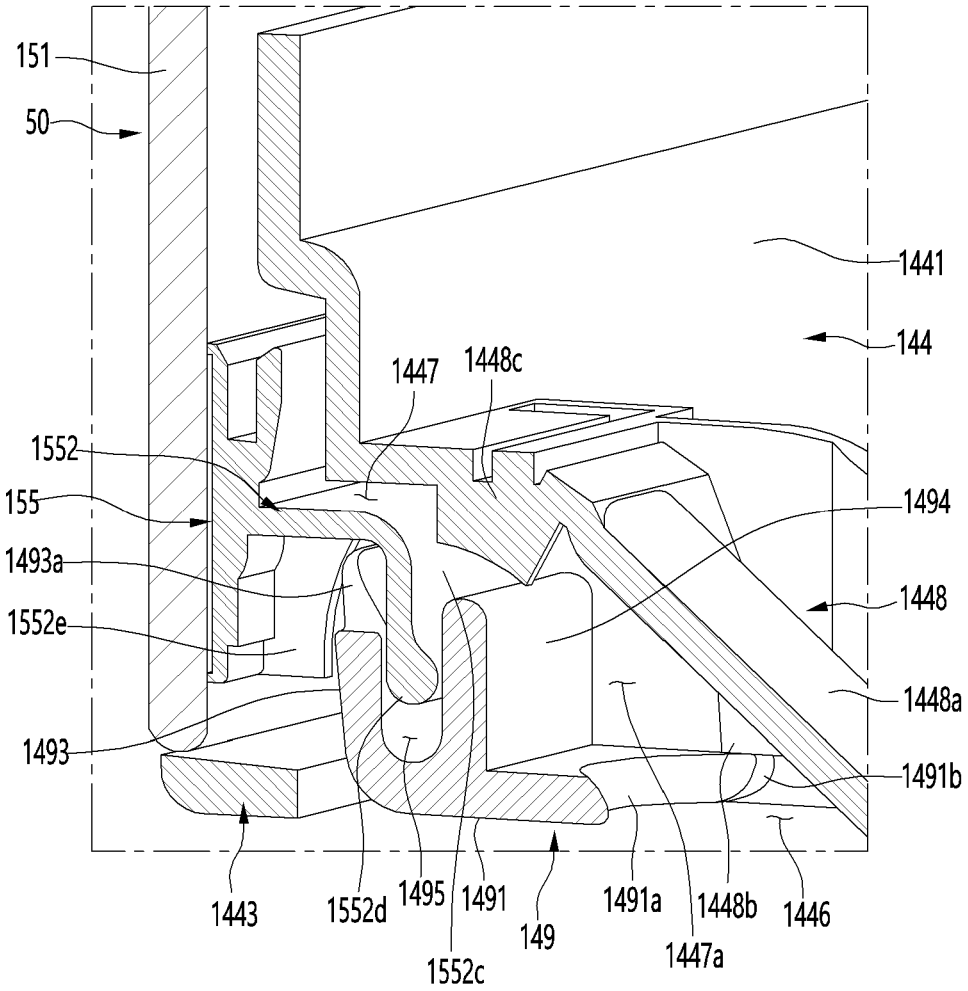
FIG. 67 is a cross-sectional view illustrating a lower end of the door in a state in which the panel assembly is mounted.

FIG. 66 is a perspective view of the lower bracket that is one component of the panel assembly. Also, FIG. 67 is a cross-sectional view illustrating the lower end of the door in a state in which the panel assembly is mounted.

As illustrated in the drawings, the lower bracket 155 may be injection-molded by using a plastic material and may be provided on the lower end of the panel 151. Also, the lower bracket 155 may extend to a length corresponding to the horizontal width of the panel 151.

The lower bracket 155 may be hooked to be restricted by the lower cap decor 144. The lower bracket 155 may be in close contact with the front surface of the lower cap decor 144 in a state in which the upper end of the panel assembly 50 is first restricted and then be restricted by the locking member 149.

In detail, the lower bracket 155 may be provided with a lower adhesive portion 1551 mounted on the rear surface of the panel 151. The lower adhesive portion 1551 may be provided in a flat shape and may be attached to the rear surface of the panel 151 by an adhesive. The lower bracket 155 may be disposed at a position corresponding to the lower end of the panel 151 in a state in which the lower adhesive portion 1551 is attached to the rear surface of the panel 151.

Also, a restriction protrusion 1552 protruding backward from the lower adhesion portion 1551 may be disposed backward from the lower adhesion portion 1551. The restriction protrusion 1552 may protrude backward perpendicular to the lower adhesive portion 1551 and may be disposed at a position corresponding to the front opening 1447 of the lower cap decor 144. Thus, when the panel assembly 50 is mounted, the restriction protrusion 1552 may be inserted into the front opening 1447.

Referring to the structure of the restriction protrusion 1552 in detail, the restriction protrusion 1552 may include a protrusion 1552*c* which protrude from the lower adhesion portion 1551 to extend backward by a predetermined length and then is bent downward.

The restriction protrusion 1552 may protrude to a height capable of being coupled to the locking member 149 through the front opening 1447 of the protrusion 1552*c*. Also, the protrusion 1552*c* may be bent to extend to a length that is capable of being inserted into the accommodation groove 1495.

An end of the protrusion 1552*c* may be accessible into the accommodation groove 1495, and in this process, the locking member 149 may rotate. To realize a smooth operation of the locking member 149 and a smooth access of the protrusion 1552*c*, a round portion 1552*d* having a predetermined curvature may be disposed on the end of the protrusion 1552*c* that is in contact with an inner surface of the accommodation groove 1495. A diameter of the round portion 1552*d* may be greater than a thickness of the protrusion portion 1552*c* and slightly less than a width of the accommodation groove 1495. Thus, the round portion 1552*d* may facilitate the rotation of the locking member 149 while allowing the smooth access to the inside of the accommodation groove 1495.

Also, a side surface portion 1552*a* may be disposed on each of both left and right sides of the protrusion portion 1552*c*. The side surface portion 1552*a* may extend downward to a predetermined length of the protrusion 1552*c* and may be disposed slightly higher than the lower end of the protrusion 1552*c*. A space may be defined inside the protrusion portion 1552*c* by the side surface portion 1552*a*. When the protrusion 1552*c* is accommodated in the accommodation groove 1495, the first restriction portion 1493 of the locking member 149 may be inserted into the space 1552*b* of the protrusion 1552*c*. Also, as the locking member 149 rotates, the first restriction portion 1493 may be accessible through the space 1552*b*.

Also, a reinforcing rib 1552*e* protruding into the space 1552*b* may be disposed on a bottom surface of the protrusion 1552*c*. The reinforcing rib 1552*e* may be provided in a rib shape connecting the bottom surface of the protrusion 1552*c* to the rear surface of the lower adhesion portion 1551, and the protrusion 1552*c* may be prevented from being deformed or damaged while the protrusion 1552*c* is coupled to or separated from the locking member 149 even if a high load is applied to the protrusion portion 1552*c*.

Also, an end of the reinforcing rib 1552*e* may have an evacuation portion 1552*f* defined to be rounded, and an end of the first restriction portion 1493 rotating in the space 1552*b* may be disposed so as not to interfere with the reinforcing rib 1552*e*. That is, the evacuation portion 1552*f* may be disposed along the outside more than a rotation radius of the first restriction portion 1493.

Hereinafter, a process in which the panel assembly 50 is mounted on the door 30 of the refrigerator 1 having the above structure will be described in more detail with reference to the drawings.

Figure 68:
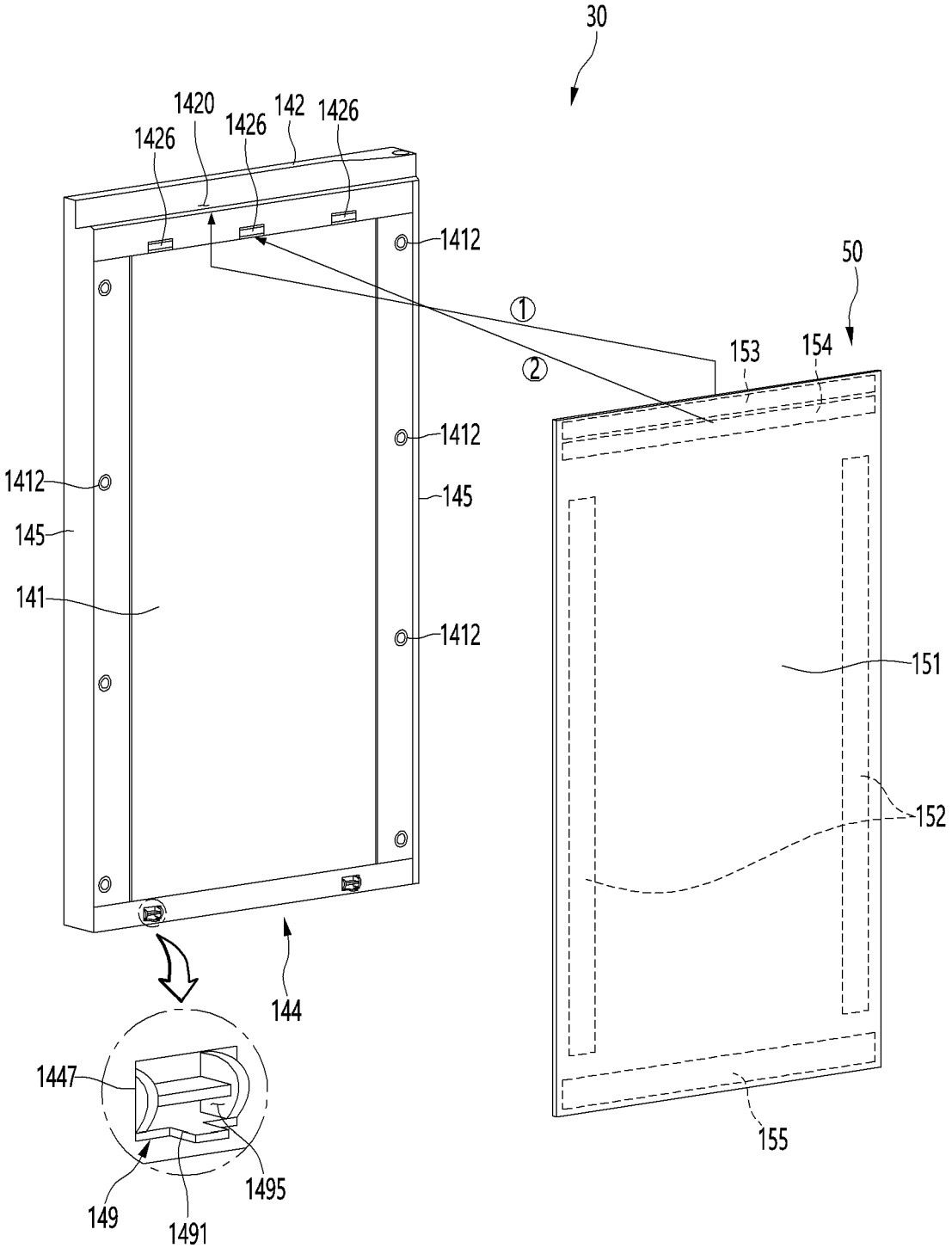
FIG. 68 is a view illustrating a state before the panel assembly is mounted on a door body.
Figure 69:
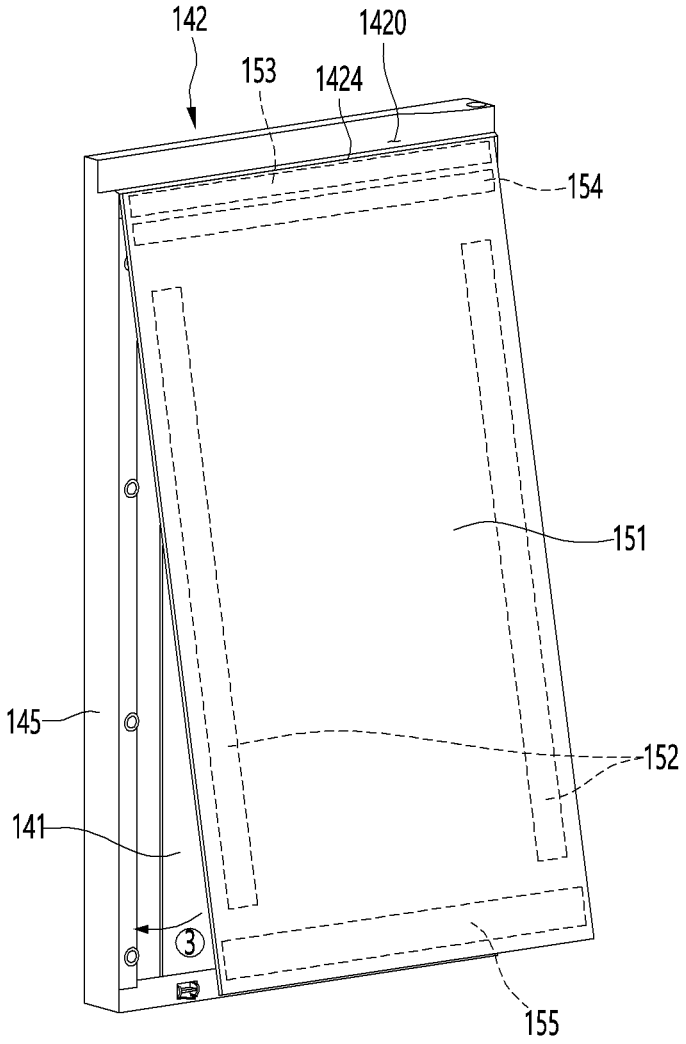
FIG. 69 is a view illustrating a process of restricting an upper end of the panel assembly.
Figure 70:
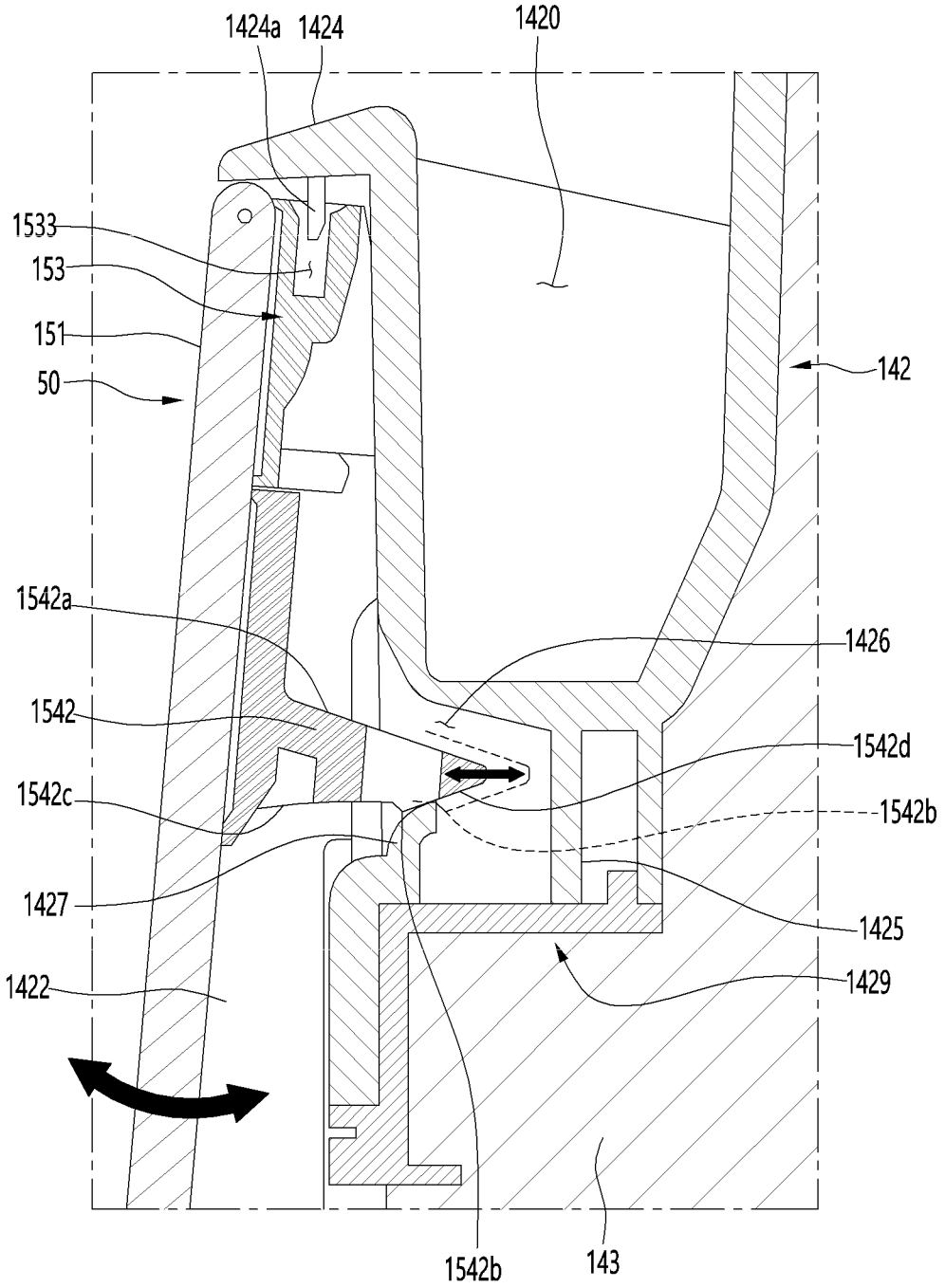
FIG. 70 is a cross-sectional view illustrating a coupling structure of the upper end of the door in the state of FIG. 69.
Figure 71:
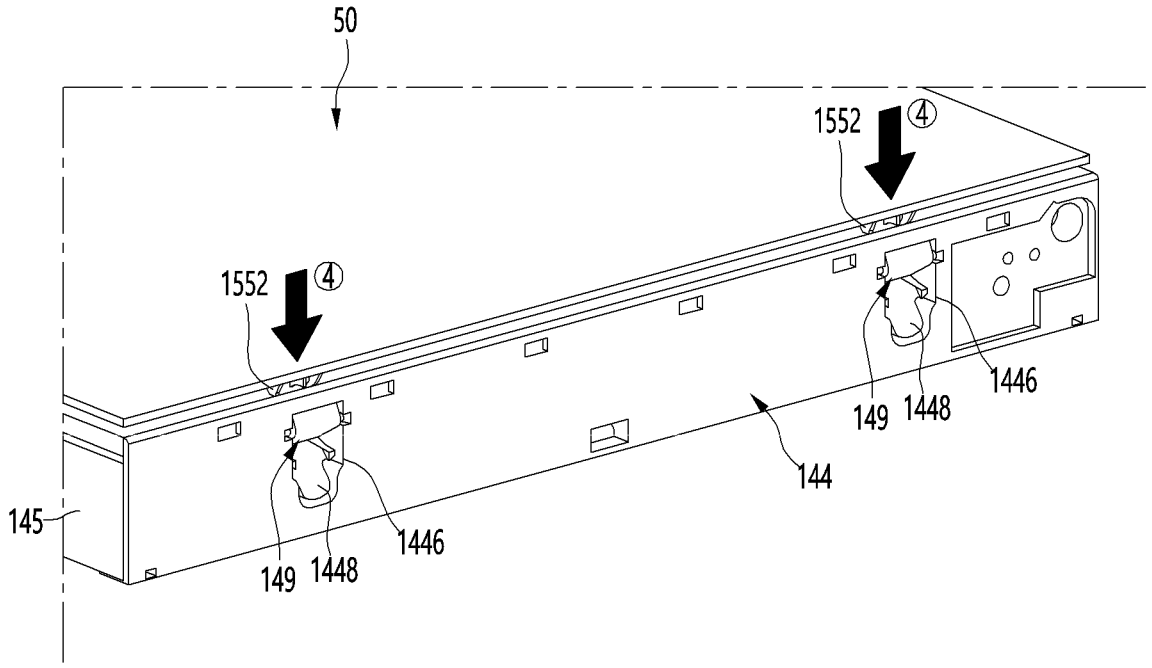
FIG. 71 is a view illustrating a process of restricting a lower end of the panel assembly.
Figure 72:
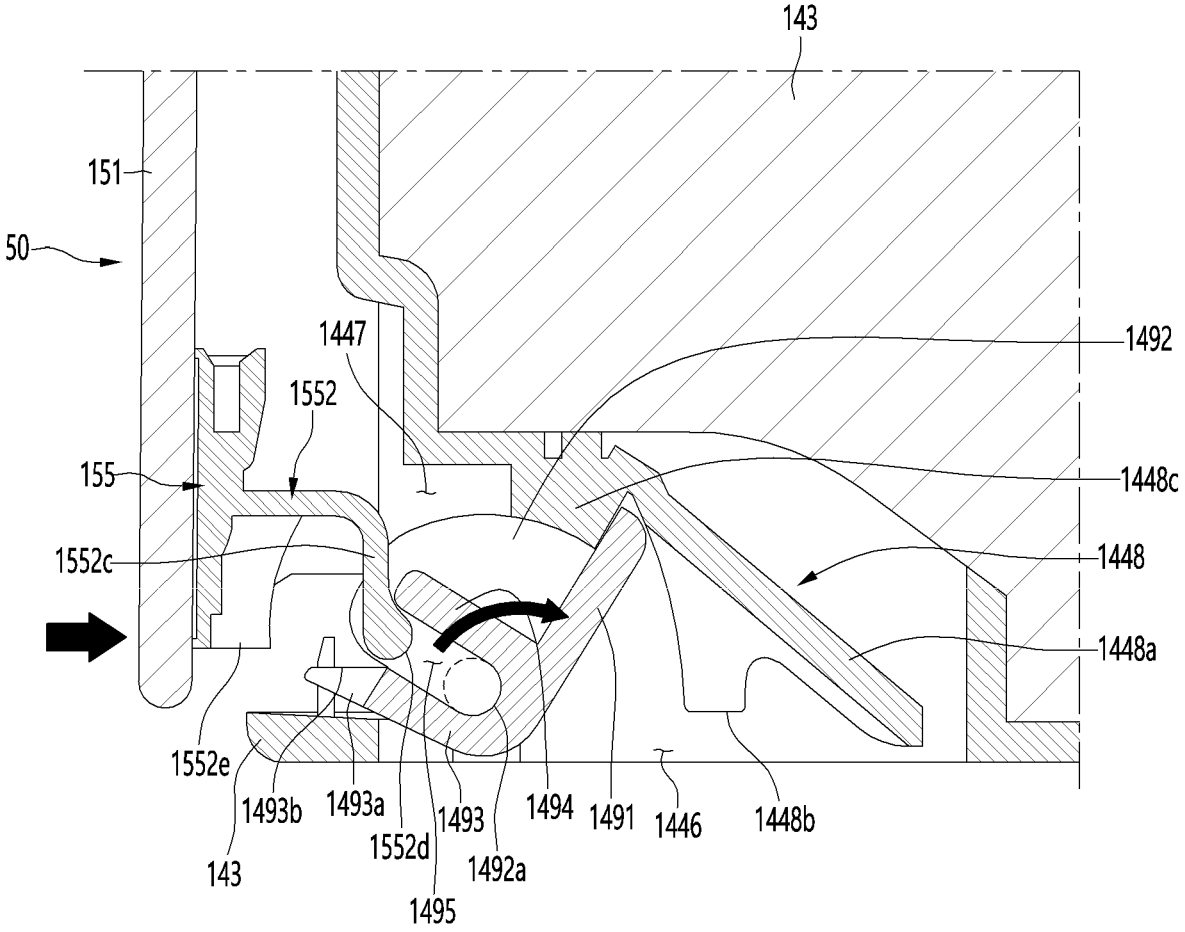
FIG. 72 is a cross-sectional view illustrating a coupling structure of the lower end of the door in the state of FIG. 71.
Figure 73:
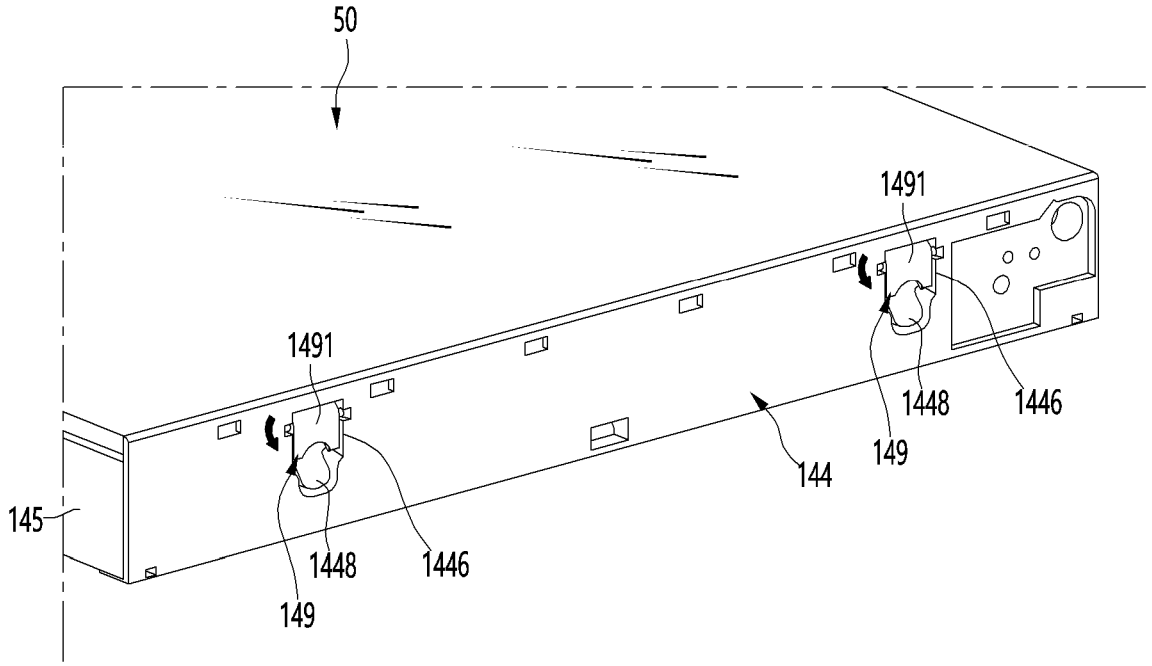
FIG. 73 is a view illustrating a state of a bottom surface of the door in a state in which the panel assembly is completely mounted.
Figure 74:
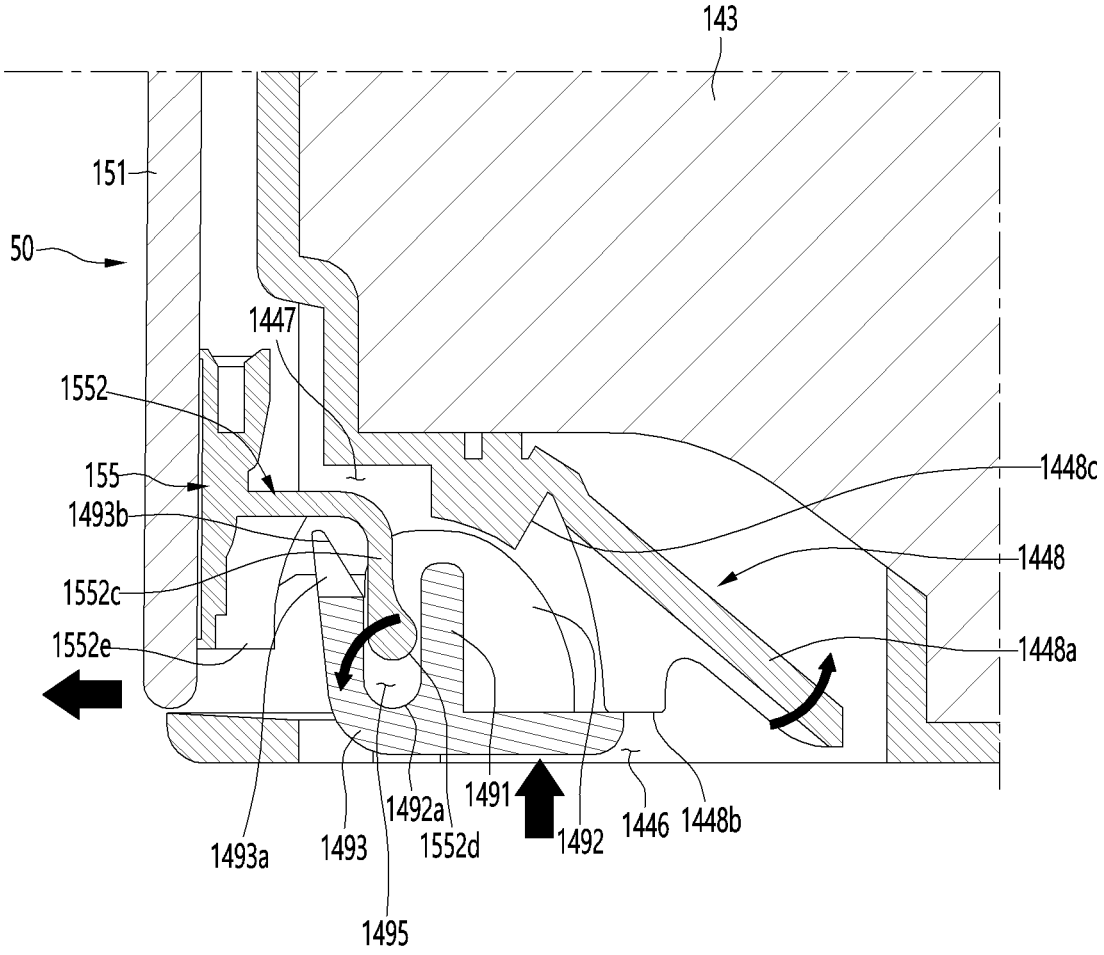
FIG. 74 is a cross-sectional view illustrating an operation state of a locking member for separating the panel assembly.

FIG. 68 is a view illustrating a state before the panel assembly is mounted on the door body. Also, FIG. 69 is a view illustrating a process of restricting an upper end of the panel assembly. Also, FIG. 70 is a cross-sectional view illustrating a coupling structure of the upper end of the door in the state of FIG. 69. Also, FIG. 71 is a view illustrating a process of restricting a lower end of the panel assembly. Also, FIG. 72 is a cross-sectional view illustrating a coupling structure of the lower end of the door in the state of FIG. 71. Also, FIG. 73 is a view illustrating a state of a bottom surface of the door in a state in which the panel assembly is completely mounted. Also, FIG. 74 is a cross-sectional view illustrating an operation state of the locking member for separating the panel assembly.

As illustrated in FIG. 68, the door 30 may be assembled by mounting the panel assembly 50 on the door body 40. For this, the panel assembly 50 may be completed by mounting the upper bracket 153, the lower bracket 155, and the panel fixing member 155 on the panel 151. Also, after assembling the front panel 151 and the side frame 1145, and the upper cap decor 142, the lower cap decor 144, and the accommodation member 46, an insulator 149 may be molded to complete the door body 40.

Also, the panel assembly 50 may be disposed to be mounted on the front surface of the door body 40 in the assembled state. Here, a rear surface of the panel assembly 50 may be directed to a front surface of the door body 40, and an upper end of the panel assembly 50 may be disposed to be in contact with the upper support end 1424.

In detail, the panel assembly 50 may move backward from the front side to approach the front surface of the door body 40 and simultaneously move upward from the lower side so that the fixing bracket 153 is coupled to the upper support end 1424, and thus, the upper bracket may be coupled to the upper cap decor 142.

Also, in a state in which the panel assembly 50 is not mounted, the locking member 149 may be maintained in an opened state so that the accommodation groove 1495 is exposed through the front opening 1447.

As illustrated in FIGS. 69 and 70, to mount the panel assembly 50, the panel assembly 50 may be tilted so that the upper end of the panel assembly 50 is supported by the upper support end 1424, and simultaneously, the upper portion of the panel assembly 50 is coupled to the upper cap decor 142. Also, the lower end of the panel assembly 50 may be in a state that is away from the door body 40, that is, the lower cap decor 144.

In detail, the panel assembly 50 may move upward so that the upper rib 1424*a* is inserted into the rib insertion groove 1533 of the fixing bracket 153. Here, the upper end of the panel 151 or the upper end of the fixing bracket 153 may be in contact with the upper support portion 1427.

Also, when the upper end of the panel assembly 50 moves to the upper support portion 1427, the insertion protrusion 1542 of the upper bracket 154 may be aligned in front of the insertion hole 1426. As described above, when the panel assembly 50 rotates toward the front surface of the door body 40, the insertion protrusion 1542 may be inserted into the insertion hole 1426. For example, when the user rotates the panel assembly 50 in a counterclockwise direction by using the upper end of the panel assembly 50 as an axis, the insertion protrusion 1542 may be inserted into the insertion hole 1426.

Here, as illustrated in FIG. 70, the second bottom surface portion 1542*d* of the insertion protrusion 1542 may start to be in contact with the support portion 1427, and as the rotation of the panel assembly 50 proceeds, the support portion 1427 may be elastically deformed to pass through the second bottom surface 1542*d* and then be hooked to be restricted by the hook 1542*b*. Also, a click sound may be generated while the support portion 1427 is elastically restored at the moment the end of the support portion passes through the second hook. Here, the sound and vibration may be transferred to the user, and thus, the user may confirm that the upper end of the panel assembly is fixed.

In a state in which the hook 1542*b* of the insertion protrusion 1542 is hooked to be restricted by the upper end of the support portion 1427, the upper end of the panel assembly 50 may not fall downward, and the mounted state may be maintained. Therefore, even in a state in which mounting up to the bottom of the panel assembly 50 is not completed, the panel assembly 50 may be prevented from falling due to its own weight, and an operation for restricting the lower end of the panel assembly 50 may be more easily performed.

The coupling of the upper rib 1424*a* and the rib insertion groove 1533 and the insertion of the insertion protrusion 1542 into the insertion hole 1426 may also be performed by a single operation of moving the panel assembly 50 upward and forward.

Also, even when the upper end of the panel assembly 50 is fixed, the lower end of the panel assembly 50 may not be restricted yet. When the lower end of the panel assembly 50 is not restricted, the lower end of the panel assembly 50 may be slightly spaced apart from the front surface of the lower cap decor 144.

Also, as illustrated in FIGS. 71 and 72, the locking member 149 may be maintained in an opened state, and the accommodation groove 1495 may be exposed through the front opening 1447 so that the restriction protrusion 1552 is maintained in a standby state for insertion of the restriction protrusion 1552.

In detail, the locking member 149 may be maintained in a rotating state up to a position at which the manipulation portion 1491 is in contact with the open stopper 1448*c*. In this state, the first restriction portion 1493 and the second restriction portion 1494 may be maintained in a state of being disposed to face the front opening 1447. Also, the front end of the first restriction portion 1493, that is, the restriction guide 1493*a* may be exposed to the outside of the front opening 1447 and be disposed at a position adjacent to the lower support end 1443. Thus, the accommodation groove 1495 may also be exposed through the front opening 1447.

In such a state, when the lower end of the panel assembly 50 is pushed so as to be disposed on the lower support end 1443, the restriction protrusion 1552 may be coupled to the locking member 149 so as to be restricted.

In detail, when the panel assembly 50 continuously rotate in the counterclockwise direction by using the top end of the panel assembly 50, which is already temporarily fixed, as an axis, the restriction protrusion 1552 may move toward the front opening 1447.

Also, as illustrated in FIG. 72, a lower end of the protrusion 1552*c* of the restriction protrusion 1552, that is, the round portion 1552*d* may be inserted into the accommodation groove 1495 along the restricting guide 1493*a*. Also, the front end of the protrusion 1552*c* may be in contact with the front end of the second restriction portion 1494.

In such a state, when the lower end of the panel assembly 50 further rotate, the front end of the protrusion portion 1552*c* may push the second restriction portion 1494 backward, and thus, the locking member 149 may rotate in a clockwise direction by using the rotation shaft 1492*a* as an axis.

As the locking member 149 rotates, the lower end of the protrusion portion 1552*c*, that is, the round portion 1552*d* may be gradually inserted into the accommodation groove 1495. In addition, the first restriction portion 1493 may be inserted into the space 1552*b* inside the restriction protrusion 1552 to pull the protrusion 1552*c* backward, that is, toward the door body 40.

That is, as the lower end of the panel assembly 50 rotates in the counterclockwise direction, the locking member 149 may rotate in the clockwise direction, the restriction protrusion 1552 may be inserted into the front opening 1447, and the protrusion 1552*c* may be gradually inserted into the accommodation groove 1495.

When the panel assembly 50 rotates to face the front surface of the door body 40 while the upper end of the panel assembly 50 is restricted, the magnet 152 disposed on each of both left and right sides of the panel 151 may be attached to the front plate 141 by magnetic force. That is, in a state in which the upper end of the panel assembly 50 is restricted, the panel assembly 50 may naturally move to the front surface of the door body 40 by its own weight and the magnetic force of the magnet 152 and then be aligned at a correct position.

That is, the magnet 152 may assist the rotational mounting of the panel assembly 50 so that the panel assembly 50 is mounted more easily, and in the state in which the panel assembly is mounted, the panel assembly 50 may be further firmly maintained in a state of being coupled to the door 30 by the magnetic force.

Also, as illustrated in FIGS. 73 and 74, when the rotation of the panel assembly 50 is completed, the lower end of the panel 151 may be supported by the lower support portion 1427. Also, the restriction protrusion 1552 may be completely inserted into the front opening 1447 by the rotation of the lower end of the panel assembly 50, and the protrusion 1552*c* may be inserted up to the lowermost side of the accommodation groove 1495 so that the restriction protrusion 1552 is in a state of being restricted by the locking member 149 at the lower cap decor 144.

When the panel assembly 50 completely rotate, the locking member 149 may be in the restricted state. When the locking member 149 reaches the restricted state, the restriction stopper 1448*b* of the manipulation guide 1448 may press and fix the top surface of the manipulation portion 1491. That is, the locking member 149 may allow the manipulation portion 1491 to be disposed on the bottom opening 1446 to maintain the locking member 149 in the restricted state. In such a state, the lock member 149 may be restricted in the counterclockwise direction thereof, and thus, the lower end of the panel assembly 50 may be maintained in the restricted state.

Through this operation, the panel assembly 50 may be mounted on the front surface of the door body 40, and a firmly mounted state may be maintained.

As described above, the panel assembly 50 may be simply manipulated and mounted by the user without using an additional tool or separate member for coupling. Of course, to separate the panel assembly 50, the panel assembly 50 may be simply separated without the use of the separate tool or member for coupling by performing in the reverse order of the above-described process, and the user may replace the panel assembly 50 to a desired panel assembly 50.

Particularly, when the panel assembly 50 is mounted, the restriction protrusion and the locking member 149 may be coupled to be completely mounted by simply pushing the lower end of the panel assembly 50 toward the front of the lower cap decor 144 after fixing the upper end of the panel assembly 50. Also, to separate the panel assembly 50, the manipulation portion 1491 may be simply manipulated to rotate, and thus, the lower end of the panel assembly 50 may rotate to move forward so that the panel assembly 50 is in a detachable state.

Referring to FIG. 74, which illustrates a process of disassembling the panel assembly 50, to separate the panel assembly 50, the user may rotate the manipulation guide 1448 by inserting the finger into the bottom opening 1446 of the lower cap decor 144.

When the contact between the restriction stopper 1448*b* and the manipulation portion 1491 is released by the rotation of the manipulation guide 1448, the locking member 149 may be in a rotatable state, and the user may push the manipulation portion 1491 by using the finger so that the locking member 149 rotates in the counterclockwise direction by using the rotation shaft 1492*a* as an axis.

When the locking member 149 rotates in the counterclockwise direction, the second restriction portion 1494 may push the protrusion 1552*c* forward and rotate the lower end of the panel assembly 50 to move forward. As a result, the protrusion 1552*c*, that is, the round portion 1552*d* may be gradually withdrawn from the accommodation groove 1495.

Here, since the insertion protrusion 1542 is maintained in the hooked and restricted by the support portion 1427, even if the lower end of the panel assembly 50 rotates to release the restriction of the lower end of the panel assembly 50, the panel assembly 50 may not fall by its own weight and may be maintained in the mounted state.

Also, when the lower end of the panel assembly 50 further rotates while the restriction protrusion 1552 is completely separated from the locking member 149, the restriction of the support portion 1427 with the hook 1542*b* may be released, and thus, the support portion 1427 may move to the second restriction portion 1494. In this process, the support portion 1427 may be elastically deformed and then be restored its original position. Here, when the support portion 1427 is elastically deformed and then restored, the click sound and vibration may be transmitted to the user. Therefore, the user may confirm that the upper end of the panel assembly 50 is also released and thus hold the panel assembly 50 so as not to fall and may allow the panel assembly 50 to move downward and backward so that the panel assembly 50 is completely separated from the door 30.

In addition to the foregoing embodiment, a refrigerator according to various embodiments may be exemplified. Another embodiment is characterized in that a panel constituting a panel assembly is made of a metal material. Further another embodiment are all the same as the above-described embodiment except for a structure of the panel, and thus, the same components will be denoted by the same reference numerals, and detailed descriptions thereof will be omitted.

Figure 75:
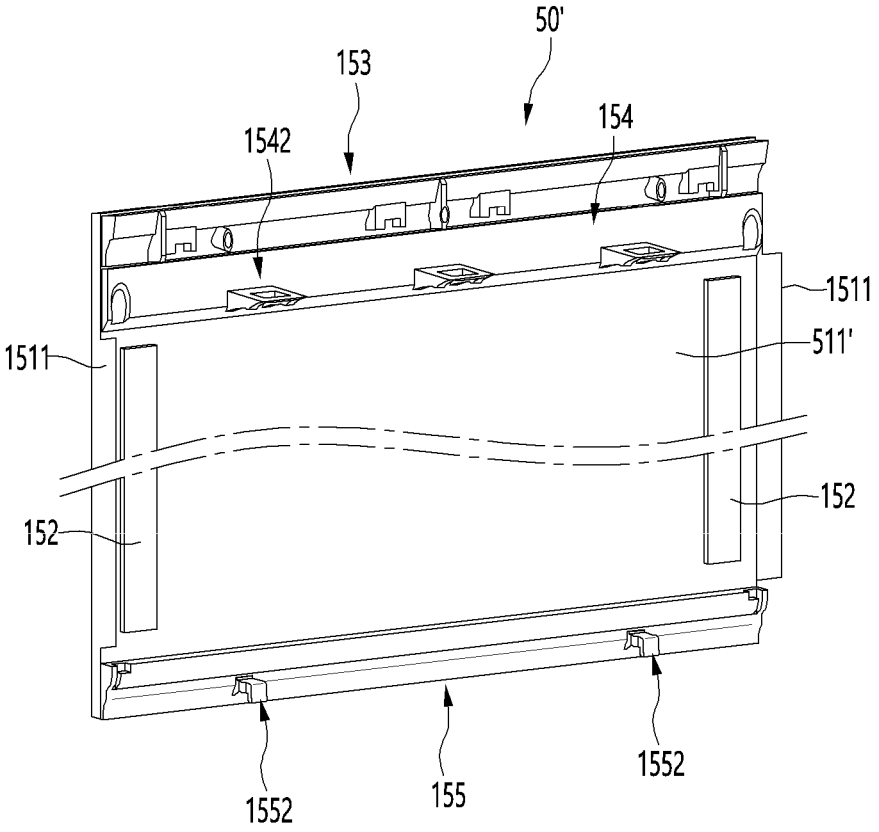
FIG. 75 is a rear perspective view of a panel assembly according to another embodiment.

FIG. 75 is a rear perspective view of a panel assembly according to another embodiment.

As illustrated in the drawing, a refrigerator door 30 according to another embodiment may include a door body 40 and a panel assembly 50' mounted on a front surface of the door body 40.

The panel assembly 50' may have a size corresponding to that of a front surface of the door body 40 and be configured to define an outer appearance of an entire front surface of the door 30 in a state of being mounted on the door body 40.

The panel assembly 50' may include a plate-shaped panel 151 defining an outer appearance and upper and lower brackets 153 and 155 for fixing upper and lower ends of the panel 151. Also, the panel assembly 50 may further include a magnet 152 so that a rear surface of the panel 151' and a front surface of the door body 40 are attached to each other.

In detail, the panel 151' may be made of a rectangular plate-shaped material having a predetermined thickness and may be made of a material that is capable of being harmonized with the furniture or wall O or the home appliance disposed therearound.

For example, the panel 151' may be made of a plate-shaped metal material such as stainless steel. Also, printing, coating treatment, or film attachment may be performed on the front surface of the panel 151' to have a color or pattern, thereby defining the outer appearance of the door 30.

The panel 151' may be maintained in a stable support state when mounted on the door body 40, and a bent portion 1511 may be disposed along a circumference so that a cross-section of the panel 151' is not exposed to the outside. Thus, the outer appearance of the circumferential surface of the panel 151' may be defined by the bent portion 1511. Also, the fixing bracket 153, the upper bracket 154, the lower bracket 155, and the magnet 152 mounted on a rear surface of the panel 151' may be shielded by the bent portion 1511, and thus, the panel 151' may be prevented from being exposed to the outside.

A magnets 152 may be provided at each of both left and right ends of the panel 151'. The magnet 152 may be attached to the rear surface of the panel 151' by an adhesive or magnetic force. The magnet 152 may extend from an upper end to a lower end of the panel 151'. Also, when the panel assembly 50 is mounted on the door body 40 in a state in which the magnet is attached to the panel 151', the magnet 152 may be attached to the front panel 151' by the magnetic force. That is, the mounting of the panel assembly 50 may be assisted by the magnet 152.

The fixing bracket 153 and the upper bracket 154 may extend along an upper end of the panel 151' and have a length corresponding to a horizontal width of the panel 151'. Also, when the panel assembly 50' is mounted, the fixing bracket 153 may be coupled to an upper rib 1424*a* of an upper support end 1424, and an insertion protrusion 1542 of the upper bracket 154 may be inserted into an insertion hole 1426. Thus, the upper end of the panel assembly 50' may be fixed to an upper cap decor 142 by the fixing bracket 153 and the upper bracket 154.

Also, the lower bracket 155 may be provided on a lower end of the panel 151' and may have a horizontal length that is equal to a horizontal length of the panel 151'. Also, the restriction protrusion 1552 of the lower bracket 155 may be inserted into a front opening 1447 of the lower cap decor 144 to be coupled to a locking member 149. Thus, a lower end of the panel assembly 50' may be fixed to the lower cap decor 144 by the locking member 149.

In addition to the foregoing embodiment, a refrigerator according to various embodiments may be exemplified. In further another embodiment, a panel of a panel assembly may be made of a FENIX material. In further another embodiment, other configurations except for the panel are all the same as those of the above-described embodiment, and the same components are denoted by the same reference numerals, and detailed descriptions thereof will be omitted.

Figure 76:
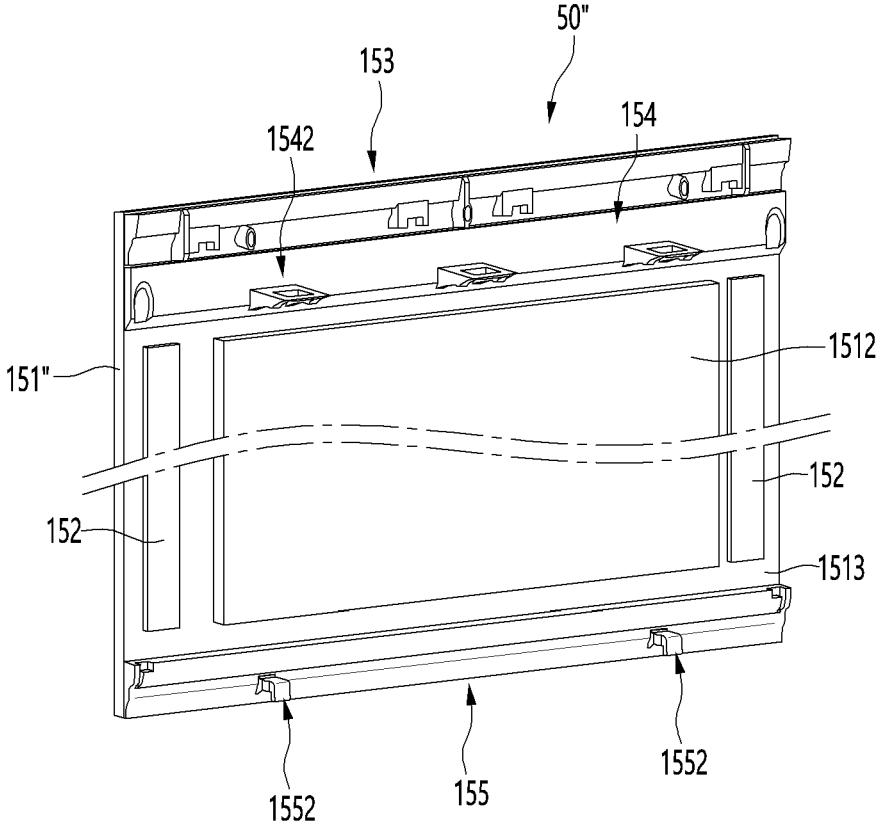
FIG. 76 is a rear perspective view of a panel assembly according to further another embodiment.

FIG. 76 is a rear perspective view of a panel assembly according to further another embodiment.

As illustrated in the drawing, a refrigerator door 30 according to further another embodiment may include a door body 40 and a panel assembly 50" mounted on a front surface of the door body 40.

The panel assembly 50" may be mounted on a front surface of the door body 40 to define an outer appearance of a front surface of the door 30. The panel assembly 50" may include a panel 151", an upper bracket 153, and a lower bracket 155. Also, the panel assembly 50" may further include a magnet 152 attached to the front plate 141.

In detail, the panel 151 may be made of a rectangular plate-shaped material having a predetermined thickness and may be made of a material that is capable of being harmonized with the furniture or wall O or the home appliance disposed therearound.

For example, the panel 151" may be made of a FENIX material having a predetermined thickness. Also, a pattern may be disposed on a front surface of the panel 151" to realize surface texture or may be surface-treated such as coating to define the outer appearance of the door 30. Of course, the panel 151" may be made of ceramic, tile, composite material, stone, or the like having a similar thickness, not the FENIX material.

The panel 151" made of the FENIX material may have a thickness greater than or equal to a set thickness in consideration of workability and strength for use in the door 30. Thus, the thickness of the panel 151" may be thicker than that of each of the panels 51 and 51' made of a glass or metal material described above.

In this state, when a fixing bracket 153, an upper bracket 154, a lower bracket 155, and a magnet 152 are disposed on a rear surface of the panel 151", the thickness of the panel assembly 50" may be excessively thick to deteriorate the outer appearance of the door 30 or prevent a normal assembly structure from being applied. As a result, a recessed panel seating portion 1512 may be defined in a circumference of a rear surface of the panel 151".

In detail, in the rear surface of the panel 151", a central portion 1513 of the rear surface of the panel 151" may protrude backward, and the panel seating portion 1512 recessed along the circumference of the central portion 1513 may be provided. The panel 151" may be provided in a plate shape having the same thickness as the central portion 1513, and a recessed panel seating portion 1512 may be provided by processing the panel seating portion 1512.

The panel seating portion 1512 may have a predetermined width so that the fixing bracket 153, the upper bracket 154, the lower bracket 155, and the magnet 152 are mounted. Also, when the panel assembly 50 is mounted, the fixing bracket 153, the upper bracket 154, and the lower bracket 155 may be coupled to the upper cap decor 142 and the lower cap decor 144 as in the above-described embodiment, and the magnet may have a thickness to be attached to the front plate 141.

That is, the panel mounting portion 1512 may be provided to be stepped from the central portion 1513 and have a thickness less than that of the central portion 1513 so that the fixing bracket 153, the upper bracket 154, the lower bracket 155, and the magnet 152 are disposed.

If necessary, the panel seating portion 1512 may not be stepped, but only an area on which the fixing bracket 153, the upper bracket 153, the lower bracket 155, and the magnet 152 are mounted may be recessed in a corresponding shape.

Also, a magnet 152 may be provided at each of both left and right ends of the panel 151". The magnet 152 may be attached to the rear surface of the panel 151" by an adhesive or magnetic force. The magnet 152 may extend from an upper end to a lower end of the panel 151". Also, when the panel assembly 50 is mounted on the door body 40 in a state in which the magnet is attached to the panel 151" the magnet 152 may be attached to the front panel 151" by the magnetic force. That is, the mounting of the panel assembly 50" may be assisted by the magnet 152.

A magnets 152 may be provided at each of both left and right ends of the panel 151'. The magnet 152 may be attached to the rear surface of the panel 151' by an adhesive or magnetic force. The magnet 152 may extend from an upper end to a lower end of the panel 151'. Also, when the panel assembly 50 is mounted on the door body 40 in a state in which the magnet is attached to the panel 151', the magnet 152 may be attached to the front panel 151' by the magnetic force. That is, the mounting of the panel assembly 50 may be assisted by the magnet 152.

The fixing bracket 153 and the upper bracket 154 may extend along an upper end of the panel 151" and have a length corresponding to a horizontal width of the panel 151". Also, when the panel assembly 50" is mounted, the fixing bracket 153 may be coupled to an upper rib 1424*a* of an upper support end 1424, and an insertion protrusion 1542 of the upper bracket 154 may be inserted into an insertion hole 1426. Thus, the upper end of the panel assembly 50" may be fixed to an upper cap decor 142 by the fixing bracket 153 and the upper bracket 154.

Also, the lower bracket 155 may be provided on a lower end of the panel 151" and may have a horizontal length that is equal to a horizontal length of the panel 151". Also, the restriction protrusion 1552 of the lower bracket 155 may be inserted into a front opening 1447 of the lower cap decor 144 to be coupled to a locking member 149. Thus, a lower end of the panel assembly 50' may be fixed to the lower cap decor 144 by the locking member 149.

In addition to the foregoing embodiment, a refrigerator according to various embodiments may be exemplified. Further another embodiment is characterized in that a locking member is inserted into a lower cap decor to restrain a lower end of a panel assembly. In further another embodiment, other configurations except for a lower bracket, a lower cap decor, and a locking member are all the same as those of the above-described embodiment, and the same components use the same reference numerals, and detailed descriptions thereof will be omitted. Also, the same configuration will be described using the same reference numerals, not shown separately.

Figure 77:
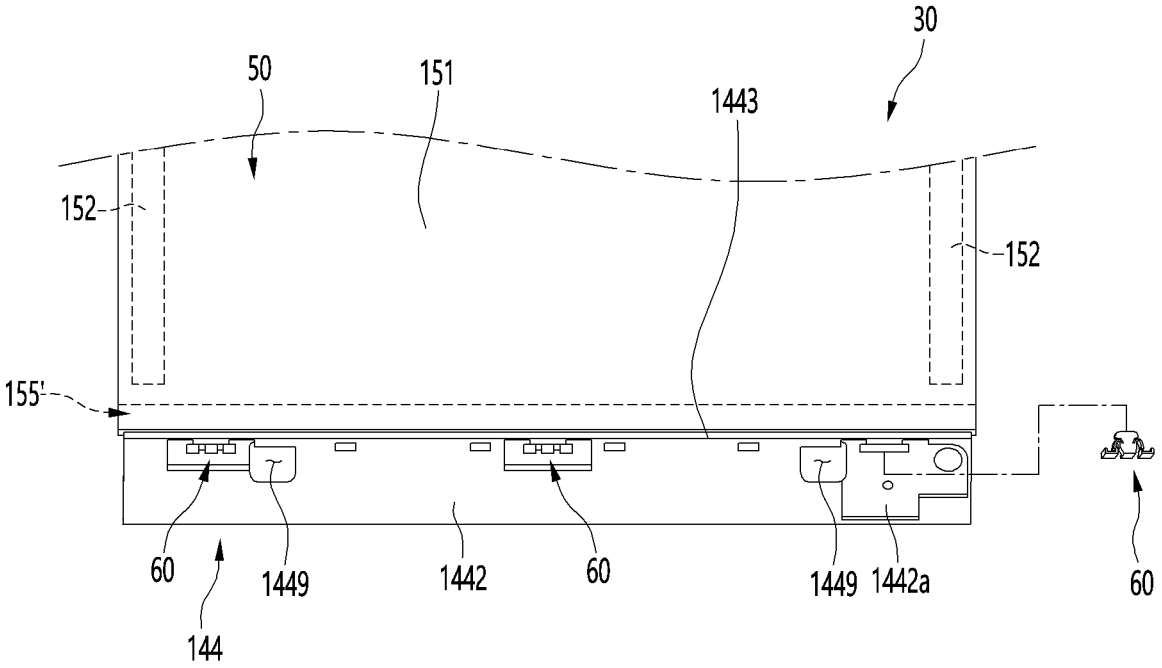
FIG. 77 is a partial bottom perspective view of a refrigerator door according to further another embodiment.
Figure 78:
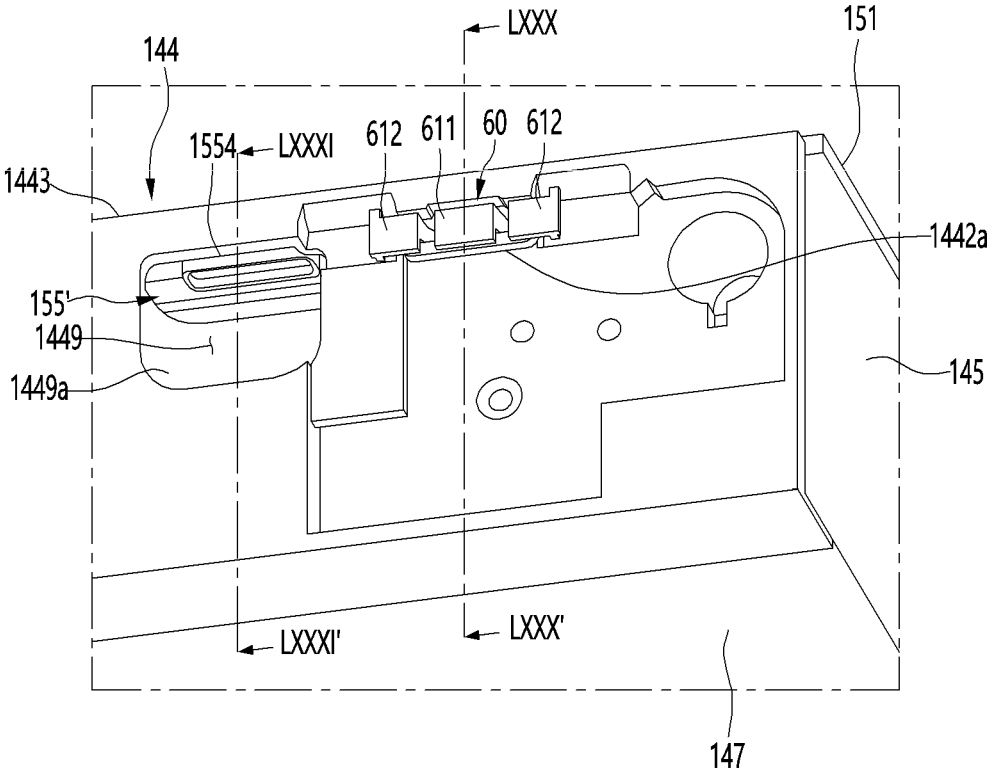
FIG. 78 is a partial bottom perspective view illustrating a bottom surface of a lower cap decor on which a locking member is mounted according to further another embodiment.

FIG. 77 is a partial bottom perspective view of a refrigerator door according to further another embodiment. Also, FIG. 78 is a partial bottom perspective view illustrating a bottom surface of a lower cap decor on which a locking member is mounted according to further another embodiment.

As illustrated in the drawings, a refrigerator door 30 according to an embodiment may include a door body 40 and a panel assembly 50. The door body 40 may include a front plate 141, a door liner 147, an upper cap decor 142, a lower cap decor 144, and a side frame 1145. Also, other configurations except for a structure of the lower cap decor 144 may have the same structure as in the above-described embodiment.

The lower cap decor 144 may also have the same overall outer appearance structure as in the above-described embodiment. The lower cap decor 144 may include a front surface 1441, a bottom surface 1442, both left and right side surfaces 1444, and a rear surface 1445, and a top surface may be opened so that an insulator 143 is filled therein.

Also, a lower support end 1443 protruding further forward than the front surface 1441 may be disposed on the bottom surface 1442 of the lower cap decor 144. Also, a lower rib 1443*a* protruding upward may be further disposed on the lower support end 1443.

A bottom opening 1449 may be defined in a bottom surface of the lower cap decor 144. The bottom opening 1449 may be defined to communicate with a front surface of the lower cap decor 144 and may have a size into which a user's finger is insertable.

Also, a guide surface 1449*a* may be disposed to be rounded inside the bottom opening 1449 to press a lower end of the panel assembly 50, that is in a state in which the user's finger is mounted, from a rear side. The guide surface 1449*a* may extend from a rear end of the bottom opening 1449 to a front surface of the lower cap decor 144 and may have a predetermined curvature.

The bottom opening 1449 may be defined at a position corresponding to the pressing portion 1554 on the rear surface of the panel assembly 50. Therefore, when the panel assembly 50 is mounted, the pressing portion 1554 may be disposed at a position corresponding to the position of the bottom opening 1449, and when the panel assembly 50 is to be removed, the pressing portion 1554 may be pressed by the user's finger.

Also, a plurality of bottom openings 1449 may be defined along the lower cap decor 144. For example, the bottom openings 1449 may be defined one by one at both left and right side surfaces of the lower cap decor 144.

An insertion hole 1442*a* may be further defined at a position corresponding to the lower support end 1443 of the bottom surface of the lower cap decor 144. The insertion hole 1442*a* may be a hole into which the restriction member 60 for restricting the lower portion of the panel assembly 50 is inserted, and a plurality of the insertion openings 1442*a* may be defined along the lower cap decor 144. For example, one insertion hole 1442*a* may be defined at a center of the lower cap decor 144 in a horizontal direction and may be defined at each of left and right ends.

The insertion hole 1442*a* may be defined at a position corresponding to the lower support end 1443 and may be disposed at a lower end of the front surface of the lower cap decor 144. Thus, when the restriction member 60 is inserted, the restriction member 60 may restrict a lower end of the panel assembly 50 above the lower support end 1443.

Also, the panel assembly 50 may have the same structure as the above-described embodiment in the panel 151, the fixing bracket 153, and the upper bracket 154, except for the lower bracket 155'. Also, the lower bracket 155' may be provided with the pressing portion 1554 and a restriction member restriction portion 1535 hooked to be restricted by the restriction member 60.

Hereinafter, the structure of the restriction member 60 will be described in more detail with reference to the drawings.

Figure 79:
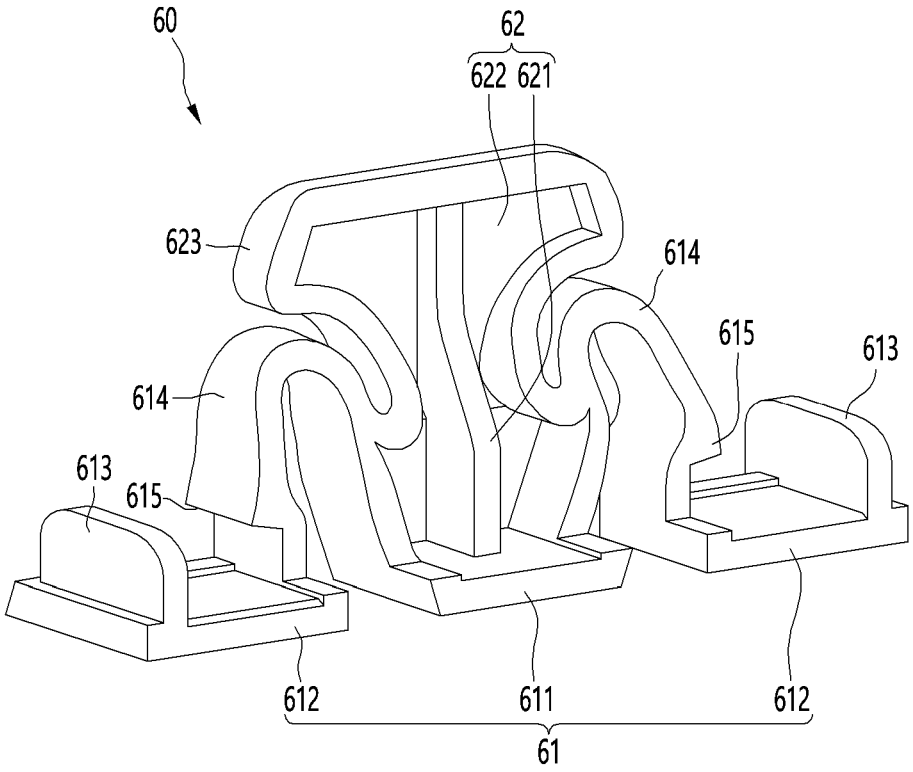
FIG. 79 is a perspective view of a restriction member.

FIG. 79 is a perspective view of the restriction member.

As illustrated in the drawing, the restriction member 60 may be provided to a size that is capable of being inserted into the insertion hole 1442*a*, have elasticity, be pressed into the inside of the insertion hole 1442*a* to be fixed. For example, at least a portion of the restriction member 60 may be injection-molded by using a plastic material that is elastically deformable.

In detail, the restriction member 60 may include a restriction member cap 61 that is exposed to the outside of an insertion hole 1442*a* and a restriction member body 62 extending from the restriction member cap 61 and inserted into an insertion hole 1442*a* as a whole.

The restriction member cap 61 may be provided in a shape capable of shielding the insertion hole 1442*a*, and when the restriction member 60 is mounted on the insertion hole 1442*a*, the restriction member 60 may be exposed to a bottom surface of the lower cap decor 144.

The restriction member cap 61 may include a center cap 611 disposed at a center and a pair of side caps 612 disposed at both left and right sides of the center cap 611 as a whole. Also, the center cap 611 and the side cap 612 may be spaced apart from each other.

The restriction member body 62 may extend to the center cap 611, and the restriction member body 62 may be inserted into the insertion hole 1442*a*. Also, a connection portion 614 connected to the side cap 612 may be disposed on each of both side surfaces of the restriction member body 62. The connection portion 614 may be bent downward and then upward again to be connected to one end of the side cap 612. Thus, the connection portion 614 may have a structure capable of elastically deformable and may be deformed when the restriction member 60 is mounted on the insertion hole 1442*a*.

Also, a protrusion 615 protruding outward may be disposed on the connection portion 614, and the protrusion 615 may be hooked to be restricted by an outer end of the insertion hole 1442*a* in a state in which the restriction member 60 is inserted into the insertion hole. That is, when the restriction member 60 is inserted into the insertion hole 1442*a*, the connection portion 614 may be compressed and elastically deformed to facilitate the insertion of the restriction member body 62, and when the insertion of the restriction member 60 is completed, the connection portion 614 may be elastically restored, and the protrusion 615 may be hooked to be restricted by both ends of the insertion hole 1442*a* so as to prevent the restriction member 60 from being separated arbitrarily.

Also, a cap protrusion 613 extending downward may be disposed on a bottom surface of the side cap 612. The cap protrusion 613 may protrude from a position that is slightly spaced from the outer end of the side cap 612, and when the restriction member 60 is mounted, an end of the cap protrusion 613 may be in contact with the bottom surface 1442 of the lower cap decor 144 to support the lower cap decor 144. Therefore, the side cap 612 may be somewhat spaced apart from the bottom surface 1422 of the lower cap decor 144 by the cap protrusion 613. Thus, when the restriction member 60 is separated, the side cap 612 may be held to be pulled easily.

The restriction member body 62 may include an upper body 621 extending from the center cap 611 and a lower body 622 extending further from the upper body 621. An outer surface of the upper body 621 may be inclined or rounded to facilitate the insertion and mounting of the restriction member 60. Also, the lower body 622 may extend in a state that is slightly bent forward from a lower end of the upper body 621, and the extending end of the lower body 622 may be inserted into the restriction member 1553 of the lower bracket 155'.

Hereinafter, a state in which the panel assembly 50 is mounted will be described with reference to the drawings.

Figure 80:
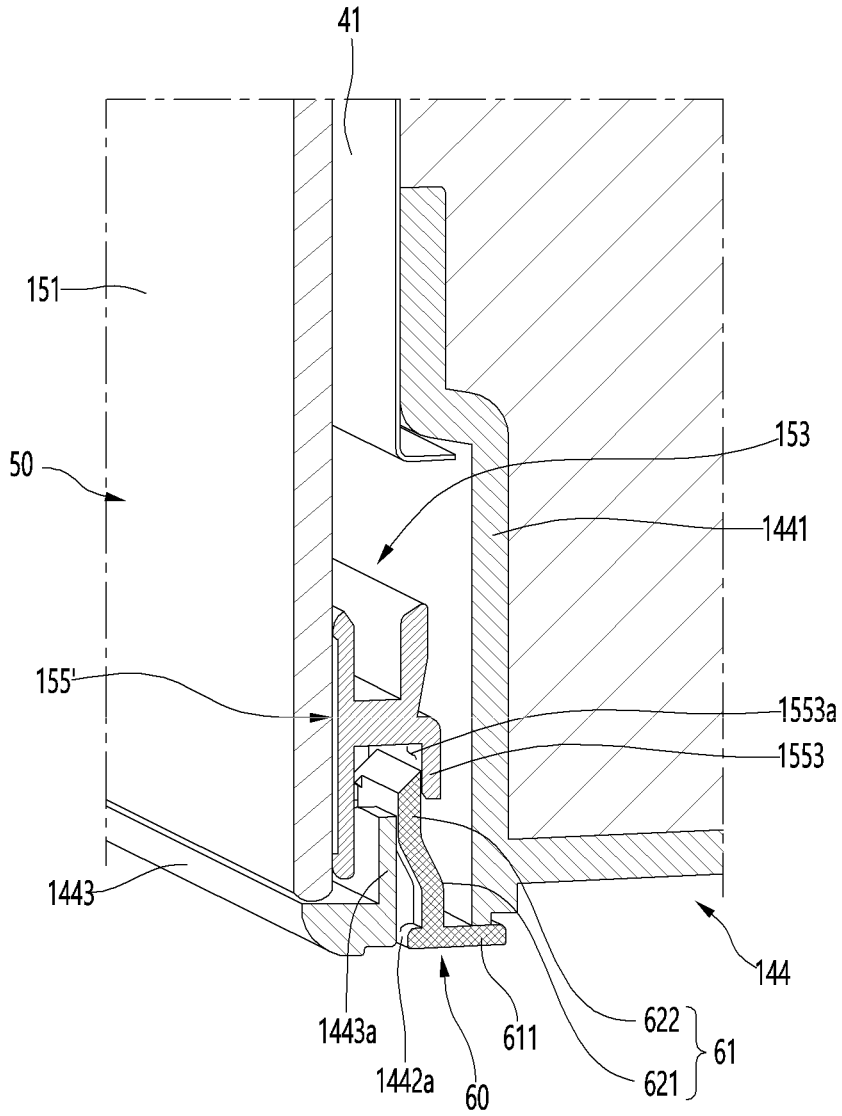
FIG. 80 is a cutaway perspective view taken along line LXXX-LXXX' of FIG. 78.

FIG. 80 is a cutaway perspective view taken along line LXXX-LXXX' of FIG. 78.

As illustrated in the drawing, to mount the panel assembly 50, an upper portion of the panel assembly 50 may be first fixed as in the above-described embodiment. In this state, the panel assembly 50 may be in close contact with the door body 40.

In this case, the lower end of the panel assembly 50 may be supported by the lower support end 1443, and the lower end of the panel assembly 50 may be supported by the lower rib 1443*a*. In such a state, an opened bottom surface of the restriction member restriction portion 1553 protruding backward from the lower bracket 155' may be aligned with the insertion hole 1442*a*.

The restriction member restriction portion 1535 may be disposed to protrude backward from a rear surface of the lower bracket 155' and may have an opened bottom surface to define a space 153*a* in which an end of the restriction member is accommodated. Therefore, when the restriction member 60 is inserted into the insertion hole 1442*a*, the restriction member cap 61 may shield the insertion hole 1442*a*, and the restriction member body 62 may be inserted into the insertion hole 1442*a* and then be hooked to be restricted by the restriction member restriction portion 1553.

In detail, the restriction member body 62, that is, the lower body 622, may extend upward while in contact with the lower rib 1443*a* and be inserted into the opened bottom surface of the restriction member restriction portion 1535 and thus be hooked to be restricted by the restriction member restriction portion 1553.

Thus, the lower end of the panel assembly 50 may be restricted by the restriction member 60, and separation of the panel assembly 50 may be prevented.

In the following, a manipulation state for separating the panel assembly 50 will be described with reference to the drawings.

Figure 81:
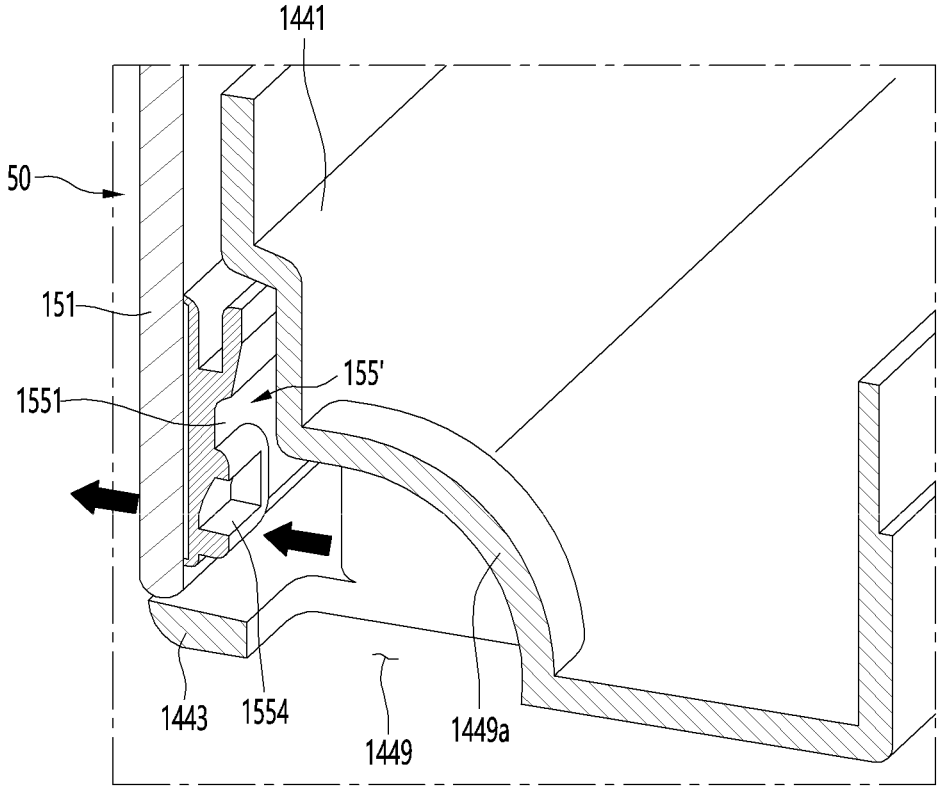
FIG. 81 is a cutaway perspective view taken along line LXXXI-LXXXI' of FIG. 78.

FIG. 81 is a cutaway perspective view taken along line LXXXI-LXXXI' of FIG. 78.

As illustrated in the drawing, when the panel assembly 50 is mounted, the lower end of the panel assembly 50 may be seated on the lower support end 1443.

In this state, to separate the panel assembly 50 from the door 30, the restriction member 60 may be first separated from the insertion hole 1442*a*. When the restriction member 60 is all removed from the lower cap decor 144, the restriction of the lower end of the panel assembly 50 may be released.

In this state, the upper end of the panel assembly 50 may be still in a fixed state, and the lower end of the panel assembly 50 may be supported by the lower support end 1443. As a result, it is difficult to directly manipulate the panel assembly 50.

In this state, when the user inserts a finger through the bottom opening 1449, the pressing portion 1554 of the lower bracket 155' may be pressed. The pressing portion 1554 may protrude backward from the lower bracket 155' and may have a structure of which a center is recessed, and a circumference protrudes backward so as to be easily pressed with the user's finger.

When the user pushes the pressing portion 1554 forward by pressing the pressing portion 1554 with a finger through the bottom opening 1449, the panel assembly 50 may rotate in the clockwise direction by using the upper end of the panel assembly 50 as an axis, and the lower end of the panel assembly 50 may be separated from the lower support end 1443.

In this state, the user may separate the panel assembly from the door body 40 by holding the panel assembly 50 and moving the panel assembly 50 downward and forward.

A refrigerator according to another aspect of an embodiment includes: a cabinet configured to define a storage space; and a door configured to open and close the storage space, wherein the door includes: a door liner configured to define a rear surface of the door; a front plate disposed to be spaced forward from the door liner; an upper cap decor which is coupled to the door liner and an upper end of the front plate to define a top surface of the door and in which a recessed handle is defined; a lower cap decor coupled to the door liner and a lower end of the front plate to define a bottom surface of the door; an insulator filled into a space defined by coupling the door liner, the front plate, and the cap decors; and a panel assembly disposed detachably in front of the front plate, wherein the panel assembly includes: a panel configured to define an outer appearance of the front surface of the door; an upper bracket provided along an upper portion of a rear surface of the panel facing the upper cap decor and inserted into and coupled to the upper cap decor; and a lower bracket provided along a lower portion of the rear surface of the panel facing the lower cap decor and restricted by the lower cap decor.

The upper bracket may include: an upper adhesion portion adhering to the panel; and an insertion protrusion, which is provided in plurality along the upper adhesion portion and extends to be inserted into the upper cap decor.

The handle may be recessed from a top surface of the upper cap decor, and the insertion protrusion may be disposed below a recessed bottom surface of the handle.

An insertion hole into which the insertion protrusion is inserted may be defined in the front surface of the upper cap decor, and the insertion hole may be provided in plurality along the upper cap decor at the same height.

A support portion configured to support a bottom surface of the insertion protrusion may extend upward from a lower end of the insertion hole, and the support portion may be inclined or rounded toward a rear side to extend upward and be elastically deformable.

A hook protruding to be hooked to be restricted by an upper end of the support portion may be disposed on a bottom surface of the insertion protrusion, and the hook and the support portion may be in a hooked and restricted state until the panel assembly rotates by a set angle.

The insertion protrusion may have a thickness that gradually decreases as protruding backward.

The upper cap decor may be provided with an upper support end that protrudes forward along an end of the upper cap decor to support an upper end of the panel.

The panel assembly may further include a fixing bracket which extends along an upper end of a rear surface of the panel and in which an opened rib insertion groove is defined in a top surface thereof, wherein a plurality of upper ribs inserted into the rib insertion groove may be disposed on the upper support end to protrude downward.

The front plate may be made of a steel material, and the front plate may be attached to each of both side ends of the rear surface of the panel.

The lower bracket may include: a lower adhesion portion adhering to the rear surface of the panel and extending along the rear surface of the panel; and a restriction protrusion configured to protrude backward from the lower adhesion portion and inserted into a front surface of the lower cap decor.

A front opening that is opened so that the restriction protrusion is inserted may be defined in the front surface of the lower cap decor, a bottom opening that is opened at a position corresponding to the front opening may be defined in a bottom surface of the lower cap decor, and a locking member, which is rotatably mounted in an accommodation space that communicates between the front opening and the bottom opening and is selectively coupled to the restriction protrusion, may be provided.

The locking member may include: a manipulation portion exposed to the bottom opening and manipulated by a user; a first restriction portion extending from a front end of the manipulation portion in a direction crossing an extension direction of the manipulation portion and hooked to be restricted by an end of the restriction protrusion; and a rotation shaft protruding in both lateral directions between the manipulation portion and the first restriction portion so as to be axially coupled to the cap decor.

The refrigerator may include a second restriction portion extending parallel to the first restriction portion at a portion that is spaced apart from the first restriction portion, and an accommodation groove into which an end of the restriction protrusion is inserted may be defined between the first restriction portion and the second restriction portion.

The first restriction portion may further extend than the second restriction portion, and an end of the first restriction portion may extend to protrude to the outside of the front opening in a state in which the end of the first restriction portion is not coupled to the restriction protrusion.

An open stopper that is in contact with the manipulation portion in a state of rotating so that the accommodation groove is exposed through the front opening may be disposed inside the accommodation space.

The restriction protrusion may include a protrusion that is bent downward after extending backward, and the bent end of the protrusion may be inserted into the accommodation groove.

A space into which the first restriction portion is accommodated may be defined inside the protrusion.

A manipulation guide which is opened to the bottom opening and extends forward through an upper side of the manipulation portion to guide a user's finger so as to face the manipulation portion may be disposed inside the accommodation space.

An upper end of the manipulation guide may be fixed to the cap decor, and the manipulation guide may be deformable according to user's manipulation by using the upper end of the manipulation guide as an axis, and a restriction stopper that restricts rotation of the locking member by restricting the manipulation portion so that the locking member is maintained in the state of being restricted by the insertion protrusion may be disposed on the manipulation guide.

The following effects may be expected in the refrigerator according to the proposed embodiments of the present invention.

In the refrigerator according to the embodiment, the panel assembly defining the outer appearance of the front surface of the door may be fixed by the restriction member inserted so that the end of the panel assembly passes through the cap decor from the outside.

In the panel assembly, the structure for fixing other than the restriction member may not be exposed, and the restriction member may also have the structure that is inserted into the top surface or the bottom surface of the cap decor and thus may not be exposed to the outside in the general situation to improve the outer appearance of the door.

Particularly, when the lower end of the panel assembly is supported and restricted by the lower cap decor, the restriction member may be inserted and mounted through the inside of the handle groove in the top surface of the door.

Therefore, the restriction member may be not exposed to the outside at all, and the outer appearance of the door may be simple and neat.

In addition, the upper support end and the lower support end may be disposed on the upper cap decor or lower cap decor to fix the upper and lower ends of the panel assembly. The plurality of restriction ribs may protrude along the upper support end or the lower support end, and the upper and lower ends of the panel assembly may be rigidly fixed by inserting the restriction rib.

Particularly, in the structure in which the door is withdrawn by holding the recessed handle groove and pulling the handle forward, the coupling force at the upper end of the panel assembly may be insufficient due to the handle groove. However, the panel assembly includes the fixing bracket in which the insertion protrusion passing through the front surface of the upper cap decor adjacent to the handle groove is disposed, and the fixing bracket may be more firmly fixed to the upper cap decor through coupling of the restriction member.

Therefore, the firm coupling structure may be provided by the fixing bracket in the region of the handle groove, to which the force is applied when the user manipulates the handle, and thus, the panel assembly may be maintained in the firmly mounted state.

Also, in the case of the drawer-type door that is withdrawn and inserted, the drawer-type door may be vulnerable to the load in the pull-in/out direction in which the panel is mounted, but the occurrence of the gap between the upper and lower ends of the panel assembly may be prevented through the structure in which the restriction rib is continuously disposed along the upper and lower ends of the panel assembly.

In addition, the panel assembly may have the structure supported by the upper cap decor or the lower cap deco and may have the additional support structure by the insertion protrusion of the fixing bracket. The insertion protrusion may pass through the front surface of the upper cap deco and may be hooked to be restricted by the upper cap decor.

Accordingly, the load of the panel assembly having the heavy weight may be distributed to the upper cap decor by the insertion protrusion, and the panel assembly may ensure the stable maintenance of the mounted state.

In addition, the insertion protrusion may be additionally restricted by the restriction member passing through the upper cap decor while being hooked to be restricted by the front surface of the upper cap decor. Therefore, the panel assembly may be fixed in the more firmly fixed state, and even in the structure of the door that is repeatedly opened and closed, the stably mounted state of the panel assembly may be maintained.

In addition, when the upper portion of the panel assembly is in close contact with the front surface of the door body while the lower restriction protrusion protruding from the lower cap decor is mounted to be inserted into the lower end of the panel assembly, the insertion protrusion of the fixing bracket may have the structure that is naturally hooked to be restricted by the protrusion insertion hole of the upper cap decor.

Therefore, only when the panel assembly is in close contact with the door body while moving downward from the upper side without the complex assembly operation or manipulation, the panel assembly may be primarily fixed. In addition, in the state in which the upper cap decor and the insertion protrusion are aligned with each other, the panel assembly may be easily mounted through the simple operation of inserting the restriction member. Of course, the panel assembly may be simply separated in the reverse order of the above-described process.

In addition, the door may be configured so that the panel assembly is easily detachably mounted on the front surface of the door body filled with the insulator. The panel assembly defining the outer appearance of the door may have one end, which is inserted into the restriction rib disposed on the upper cap decor or the lower cap decor, and the other end, which is fixed by the restriction member inserted from the outside.

Here, the restriction member may be configured to restrict one end of the panel assembly by being press-fitted into the cap decor, but not the configuration that requires the separate tool or operation. Therefore, the panel assembly may be mounted through the very simple operation and also may be easily mounted and detached without the separate tool. In addition, due to the ease of detachment, the panel assembly may be selectively detached so that the outer appearance is harmonized with the built-in furniture or wall or other adjacent refrigerators or home appliances.

In addition, the upper end of the panel assembly may be coupled to the cap decor, and the lower end of the panel assembly may be coupled to the lower cap decor by the locking member. Therefore, even if the door is slightly twisted due to the scattering or insulation during the assembly process of the door, the panel assembly may be maintained in the firmly fixed state by the rotation of the locking member, the panel assembly may be prevented from being deformed, and the quality of the outer appearance of the door may be maintained.

In addition, in the panel assembly, the upper end of the panel assembly may be hooked to be restricted by the insertion protrusion of the upper bracket to the upper cap decor, and the lower end of the panel assembly may be restricted and mounted on the locking member of the lower cap decor. Thus, the panel assembly may be mounted very simply and easily without using the separate tool or coupling member.

Particularly, if the lower end of the panel assembly is to be restricted, when the panel assembly may be pushed toward the door body and then be naturally restricted with the locking member so as to be completely mounted. In addition, if the panel assembly in the mounted state is to be removed, when the locking member rotates, the panel may be interlocked to rotate so as to be separated from the lower cap decor. That is, when the panel assembly is mounted and detached, the panel assembly may be mounted and detached by performing the very simple and intuitive operation without the complicated operation.

In addition, the panel assembly may be attached to the front plate by the magnet in the state in which the upper end is restricted, and the lower end of the panel assembly may be more easily restricted.

In addition, the panel assembly may have the structure in which the upper end of the panel assembly is first restricted to the door and is hooked to be restricted by the support portion due to the insertion protrusion so as to prevent the panel assembly from falling during the mounting operation of the panel assembly by its own weight. Thus, the replacement of the panel assembly may be easier.

Particularly, the insertion protrusion may have the hook restriction structure on the support portion having elasticity. Therefore, when the panel assembly is mounted, the clicking sound and the vibration may be generated while the insertion protrusion passes through the support portion so that the operator is capable of recognizing that the normally fixed mounting operation on the upper end of the panel assembly has been performed. In addition, when the panel assembly is separated, the clicking sound and the vibration may be generated while the insertion protrusion passes through the support portion so that the upper end of the panel assembly may be separated. Thus, the worker may perform the operation in the state of holding the panel assembly to prevent the panel assembly from falling. Through this, the operator may prevent the accident in which the panel assembly falls to ensure the safety of the worker and prevent the panel assembly from being damaged.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet that defines a storage space; and a door configured to open and close at least a portion of the storage space, the door comprising a door body and a panel assembly that is detachably mounted on a front surface of the door body and defines a front surface of the door, wherein the door body comprises:

a door liner that defines a rear surface of the door, a front plate disposed forward relative to the door liner, an upper cap decor connecting the door liner to an upper end of the front plate and comprising a handle that has a recessed space, a lower cap decor connecting the door liner to a lower end of the front plate, the upper cap deco and the lower cap deco defining an external surface of the door, and an insulator provided in a space defined by the door liner, the front plate, the upper cap decor, and the lower cap deco, wherein the panel assembly comprises:

a panel that defines an outer appearance of the front surface of the door, and an insertion protrusion that protrudes rearward from the panel toward the upper cap decor and configured to restrict movement of the panel assembly relative to the door body;

a protrusion insertion hole defined at a front surface of the upper cap decor and configured to receive the insertion protrusion;

a restriction member disposed inside the recessed space of the handle and passing through a bottom surface of the recessed space of the handle and the insertion protrusion; and a restriction portion disposed in the protrusion insertion hole and configured to interfere with the insertion protrusion and the restriction member, wherein the insertion protrusion extends from an outside of the recessed space of the handle in a direction crossing the recessed space of the handle.

2. The refrigerator according to claim 1, wherein the upper cap decor comprises:

a top surface that defines the recessed space of the handle and a top portion of the door; and a front surface that extends downward from the top surface and is coupled to the upper end of the front plate, the front surface defining a protrusion insertion hole that receives the insertion protrusion.

3. The refrigerator according to claim 2, wherein the panel assembly further comprises a panel bracket that is disposed at a rear surface of the panel assembly and extends along an upper end of the panel assembly, the panel bracket defining an insertion portion at an upper end thereof, and wherein the upper cap decor comprises:

an upper support end that is disposed along an upper end of the front surface of the upper cap decor, that protrudes forward to the panel assembly, and that supports the upper end of the panel assembly; and an upper restriction rib that is disposed at the upper support end, the upper restriction rib protruding downward and being inserted into the insertion portion to thereby restrict the upper end of the panel assembly from being detached from the upper cap decor.

4. The refrigerator according to claim 3, wherein the insertion protrusion is provided in plurality, and wherein the panel assembly further comprises:

a fixing bracket disposed at the rear surface of the panel assembly and disposed below the panel bracket, and the plurality of insertion protrusions disposed on the fixing bracket and arranged at a same height along the fixing bracket.

5. The refrigerator according to claim 1, wherein the insertion protrusion is in contact with a bottom surface of the recessed space of the handle.

6. The refrigerator according to claim 1, wherein a top surface of the insertion protrusion is inclined with respect to a protruding direction of the insertion protrusion away from the panel such that a thickness of the insertion protrusion decreases in the protruding direction, and wherein a bottom surface of the insertion protrusion is disposed vertically below a bottom surface of the recessed space of the handle.

7. The refrigerator according to claim 1, wherein the panel assembly further comprises a lower bracket that is disposed at a rear surface of the panel and extends along a lower end of the panel, the lower bracket being coupled to the lower cap decor.

8. The refrigerator according to claim 1, wherein the handle defines a restriction member insertion hole in the recessed space of the handle, wherein the insertion protrusion defines a through-hole that faces the restriction member insertion hole and is aligned with at least a portion of the restriction member insertion hole, and wherein the restriction member is inserted into the restriction member insertion hole and the through-hole.

9. The refrigerator according to claim 1, wherein the restriction portion comprises:

a first restriction portion configured to interfere with the restriction member; and a plurality of second restriction portions spaced apart from each other and disposed at left and right sides of the first restriction portion, the plurality of second restriction portions being configured to interfere with side surfaces of the insertion protrusion, and wherein the restriction member passes between the plurality of second restriction portions.

10. The refrigerator according to claim 1, wherein the handle defines a restriction member insertion hole at an inner surface of the recessed space of the handle, and wherein the restriction member comprises:

a cap that covers the restriction member insertion hole; and a body portion that extends from a bottom surface of the cap and passes through the inner surface of the recessed space, the body portion being configured to interfere with the insertion protrusion.

11. The refrigerator according to claim 10, wherein the body portion comprises a restriction member support portion curved toward a circumference of the restriction member insertion hole and configured to interfere with the circumference of the restriction member insertion hole to thereby restrict the restriction member from being separated from the restriction member insertion hole.

12. The refrigerator according to claim 1, wherein the panel assembly further comprises a restriction member that passes through the lower cap decor and is coupled to a lower end of the panel assembly.

13. The refrigerator according to claim 1, wherein the panel assembly further comprises:

an upper bracket that is disposed at a rear surface of the panel, that faces the upper cap decor, and that extends along an upper portion of the panel, the upper bracket comprising the insertion protrusion that is inserted into the upper cap decor; and a lower bracket that is disposed at the rear surface of the panel, that faces the lower cap decor, and that extends along a lower portion of the panel, the lower bracket being configured to couple to the lower cap decor.

14. The refrigerator according to claim 13, wherein the lower bracket comprises:

a lower adhesion portion that is attached to the rear surface of the panel and extends along the rear surface of the panel; and a restriction protrusion that protrudes rearward from the lower adhesion portion and is inserted into a front surface of the lower cap decor.

15. The refrigerator according to claim 14, wherein the lower cap decor defines:

a front opening at the front surface of the lower cap decor, the front opening receiving the restriction protrusion;

a bottom opening at a bottom surface of the lower cap decor, the bottom opening being defined at a position corresponding to the front opening; and an accommodation space that communicates with the front opening and the bottom opening, and wherein the lower cap decor comprises a locking member rotatably mounted in the accommodation space and configured to selectively couple to the restriction protrusion.

16. The refrigerator according to claim 15, wherein the locking member comprises:

a manipulation portion exposed to the bottom opening and configured to be manipulated by a user;

a first restriction portion that extends from a front end of the manipulation portion in a direction crossing an extension direction of the manipulation portion, the first restriction portion being configured to interfere with an end of the restriction protrusion; and a rotation shaft that is rotatably coupled to the lower cap decor and protrudes laterally outward relative to the manipulation portion and the first restriction portion.

17. The refrigerator according to claim 16, wherein the lower cap decor further comprises a manipulation guide that is disposed inside the accommodation space, that is connected to the bottom opening, and that extends forward through an upper side of the manipulation portion, the manipulation guide being configured to guide a finger of the user to the manipulation portion.

* * * * *